US007067979B2

(12) United States Patent
Sakamoto

(10) Patent No.: US 7,067,979 B2
(45) Date of Patent: Jun. 27, 2006

(54) GAS-DISCHARGE DISPLAY DEVICE AND ITS MANUFACTURING METHOD

(75) Inventor: Susumu Sakamoto, Nagoya (JP)

(73) Assignee: Noritake Co., Limited, Nagoya (JP)

( * ) Notice: Subject to any disclaimer, the term of this patent is extended or adjusted under 35 U.S.C. 154(b) by 296 days.

(21) Appl. No.: 10/491,408

(22) PCT Filed: Oct. 1, 2002

(86) PCT No.: PCT/JP02/10224

§ 371 (c)(1),
(2), (4) Date: Apr. 1, 2004

(87) PCT Pub. No.: WO03/032356

PCT Pub. Date: Apr. 17, 2003

(65) Prior Publication Data

US 2004/0245929 A1 Dec. 9, 2004

(30) Foreign Application Priority Data

| | | |
|---|---|---|
| Oct. 2, 2001 | (JP) | 2001-306875 |
| Oct. 2, 2001 | (JP) | 2001-306876 |
| Jan. 15, 2002 | (JP) | 2002-005762 |
| Jan. 16, 2002 | (JP) | 2002-007025 |
| May 15, 2002 | (JP) | 2002-140352 |

(51) Int. Cl.
*H01J 17/49* (2006.01)

(52) U.S. Cl. ..... 313/584; 313/582; 313/586

(58) Field of Classification Search ..... 313/491, 313/493, 582–586
See application file for complete search history.

(56) References Cited

U.S. PATENT DOCUMENTS 5,264,758 A * 11/1993 Iijima et al. ..... 313/584
5,744,909 A * 4/1998 Amano ..... 313/585

FOREIGN PATENT DOCUMENTS

| | | |
|---|---|---|
| JP | A 4-129131 | 4/1992 |
| JP | A 5-41164 | 2/1993 |
| JP | A 8-45433 | 2/1996 |
| JP | A 10-27551 | 1/1998 |
| JP | A 10-214569 | 8/1998 |
| JP | A 10-302646 | 11/1998 |
| JP | A 2000-133144 | 5/2000 |
| JP | A 2002-170493 | 6/2002 |

* cited by examiner

*Primary Examiner*—Vip Patel
(74) *Attorney, Agent, or Firm*—Oliff & Berridge, PLC

(57) ABSTRACT

When a PDP 10 is produced by superposing, and fixing, a front plate 16 and a rear plate 18 on, and to, each other, a sheet member 20 including an X wiring layer 36 and a Y wiring layer 40 is fixed to the front plate 16 or the rear plate 18, so that X electrodes 46 and Y electrodes 48 are provided in respective discharge spaces 24. Thus, the X electrodes 46 and the Y electrodes 48 can be assembled with the front and rear plates 16, 18, by just placing the sheet member 20 between the two plates 16, 18. Therefore, in the PDP 10, the front plate 16, the rear plate 18, and the discharge electrodes 46, 48 are free of distortions resulting from a heat treatment that would otherwise be carried out to form the electrodes.

40 Claims, 58 Drawing Sheets

GAS-DISCHARGE DISPLAY DEVICE AND ITS MANUFACTURING METHOD

TECHNICAL FIELD

The present invention relates to a gas-discharge display apparatus which displays a desired image by utilizing a gas-discharge light emission, and a method of producing a gas-discharge display apparatus.

BACKGROUND ART

There is known a gas-discharge display apparatus such as a plasma display panel (PDP) which includes a transparent first substrate (i.e., a front plate), a second substrate (i.e., a rear plate) that is distant from the front plate by a pre-determined distance and extends parallel to the first plate, a plurality of discharge spaces that are provided in a gas-tight space that is located between the front and rear plates and is filled with a pre-selected gas, and a plurality of pairs of first and second discharge electrodes each pair of which selectively produce a gas discharge in a corresponding one of the discharge spaces, and which utilizes the gas discharge to emit a light from a corresponding one of a plurality of light emission units (i.e., pixels or cells) in the gas-tight space and thereby displays a desired image such as a character, a symbol, or a figure. For example, the gas-discharge display apparatus displays an image by directly utilizing a light such as neon orange that is emitted with the plasma produced by the gas discharge, or utilizing a light that is emitted from a fluorescent body, provided in each light emission unit, when the fluorescent body is excited by an ultraviolet light produced by the plasma. Therefore, a gas-discharge display apparatus of a flat type can be easily increased in size and decreased in thickness and weight. In addition, the gas-discharge display apparatus enjoys a large angle of visibility and a quick response that are comparable to those of a CRT. Thus, the gas-discharge display apparatus is expected to replace the CRT.

Meanwhile, in the conventional gas-discharge display device, generally, the discharge electrodes are formed by using, e.g., a thick-film forming process in which a conductive material is applied to an inner surface of one of the front and rear plates and is subjected to a heat treatment such as firing.

More specifically described, conventional gas-discharge display devices can be grouped into two large groups, i.e., DC types and AC types, with respect to the structure of discharge electrodes. In the DC types, and an AC type having a opposing-discharge structure, discharge electrodes are arranged in two directions perpendicular to each other on the front and rear plates. Generally, the discharge electrodes are each formed of a conductive thick film. In addition, in an AC type having a three-electrode surface-discharge structure, sustaining electrodes are provided on one of the front and rear plates such that the sustaining electrodes extend parallel to each other in one direction; and writing electrodes are provided on the other plate such that the writing electrodes extend in another direction perpendicular to the above-indicated one direction. In the surface discharge structure, the sustaining electrodes that are required to have as high as possible a light transmitting property, are constituted by bus electrodes each of which includes a transparent electrode formed of, e.g., an ITO (indium tin oxide) film and a conductive thick film to compensate for the electrical conductivity of the transparent electrode. In addition, in the AC types, discharge electrodes or sustaining electrodes are covered with a dielectric thick film so as to allow the production of alternating current discharges.

Therefore, in each of the above-described electrode structures, the electrodes are formed on the inner surface of at least one of the front and rear plates (i.e., substrates), by using, e.g., the thick-film forming process in which the substrates are subjected to the heat treatment so as to fire the thick films, and accordingly the substrates may be distorted and the dielectric and conductive thick films may be cracked or deformed.

More specifically described, in the heat treatment of the thick-film forming process, the substrates may be distorted because of the variation of amounts of thermal expansion of each substrate resulting from the distribution of temperatures in the each substrate and/or the difference of respective thermal expansion coefficients of the each substrate and the dielectric and conductive thick films. If the substrates are thus distorted, then they cannot have an appropriate flatness and/or the thick-film patterns cannot have an appropriate accuracy.

DISCLOSURE OF THE INVENTION

It is therefore an object of the present invention to provide a gas-discharge display apparatus, and a method of producing a gas-discharge display apparatus, each of which is free of the problem of distortions resulting from a heat treatment to form electrodes.

The above object has been achieved by a first invention according to which there is provided a gas-discharge display apparatus comprising a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, and a plurality of pairs of first and second discharge electrodes each pair of which cooperate with each other to produce a gas discharge in a corresponding one of the discharge spaces, so that a light produced by the gas discharge is observed through the first substrate, the apparatus being characterized by comprising a sheet member including (a) a dielectric core layer comprising a dielectric thick film having a grid pattern and a pre-determined thickness, (b) a first conductive thick-film layer comprising a plurality of first conductive thick films which are provided on one of opposite surfaces of the grid pattern of the dielectric core layer and extend parallel to each other in one direction of the grid pattern and which function as the first discharge electrodes, respectively, and (c) a second conductive thick-film layer comprising a plurality of second conductive thick films which are provided on the other surface of the grid pattern of the dielectric core layer and extend parallel to each other in an other direction of the grid pattern and which function as the second discharge electrodes, respectively, the sheet member being provided between the first and second substrates, such that the sheet member extends parallel to each of the first and second substrates.

According to this invention, the first and second conductive layers that are provided on the opposite surfaces of the grid pattern of the sheet member, respectively, constitute the plurality of pairs of first and second discharge electrodes. Therefore, the discharge electrodes can be assembled with the first and second substrates, by just placing the sheet member between the two substrates. Thus, the first and second substrates are not subjected to a heat treatment to form the discharge electrodes on an inner surface or respective inner surfaces of one or both of the two substrates. Thus, in the present gas-discharge display apparatus, the first and second substrates and the discharge electrodes are free of distortions resulting from the heat treatment.

Here, preferably, the first conductive thick-film layer comprises a plurality of first opposing portions which are fixed to respective side surfaces of grid bars of the dielectric core layer, and the second conductive thick-film layer comprises a plurality of second opposing portions which are fixed to respective side surfaces of grid bars of the dielectric core layer, such that the second opposing portions oppose the first opposing portions, respectively. According to this feature, the first conductive layer comprises the first opposing portions provided on the inner wall surfaces of the grid pattern of the sheet member, and the second conductive layer comprises the second opposing portions provided on the inner wall surfaces of the grid pattern, such that the second opposing portions oppose the first opposing portions, respectively. That is, the first discharge electrodes and the second discharge electrodes are substantially constituted by the first opposing portions and the second opposing portions, respectively. Thus, the present apparatus employs the opposing discharge structure in which the discharge surfaces extend parallel to each other. Therefore, the variation of respective discharge voltages (e.g., starting voltages or sustaining voltages) of respective light emission units (pixels or cells) is reduced, and the operation margin of the present apparatus is improved. In particular, in a gas-discharge display apparatus of a type in which a fluorescent layer is provided in each discharge space, the discharge surfaces are located at an intermediate height position between the first and second substrates, and the discharge direction is parallel to the respective inner surfaces of the two substrates. In this case, since the inner surfaces of the first and second substrates are less influenced by the ions of the discharge gas, the fluorescent layers can be provided in a large area or respective large areas of one or both of those inner surfaces so as to increase the degree of brightness of the image displayed by the apparatus.

As described above, in the opposing discharge structure of the conventional gas-discharge display apparatus, the first discharge electrodes and the second discharge electrodes are provided on the respective inner surfaces of the first and second substrates, respectively. In a color display device which utilizes a light emission of a fluorescent body, a high degree of brightness and/or a high degree of efficiency are preferably obtained by applying the fluorescent material to not only the partition walls that separate RGB light emissions from each other and form the discharge spaces but also the respective surfaces of respective dielectric layers of the first and second substrates. In this case, however, the respective discharging areas of the dielectric layers must not be coated with the fluorescent material, and simultaneously those areas must be coated with respective protection films such as MgO. Therefore, the fluorescent layers can be provided in limited or small areas only, and accordingly an image cannot be displayed with a high degree of brightness. In addition, since the fluorescent layers are located in the vicinity of the discharging areas, they are severely deteriorated by the ions of the discharge gas. Moreover, it has been difficult to develop a practically usable production method in which the MgO protection films are uniformly applied to the respective surfaces of the dielectric layers located between the partition walls, and the fluorescent material is applied to the partition walls and the dielectric layers, except for the discharging areas. On the other hand, in a gas-discharge display apparatus of a type having a surface discharge structure, a fluorescent layer can be provided on a substantially entire area of the inner surface of one of the first and second substrates that is free of the discharge electrodes, such that the fluorescent layer is spatially separated from the discharging areas, and accordingly a high degree of brightness can be obtained while the deterioration of the fluorescent layer is prevented. Since, however, respective distances between respective surfaces of respective pairs of discharge electrodes provided on one plane cannot be made uniform, those electrodes which have the smaller distances can more easily discharge and enjoy the higher efficiency. Therefore, the deterioration of the dielectric layers and the protection films that cover the electrodes most quickly progresses in edge areas where the electrode patterns are concentrated, because the discharges occur at the higher probability in the edge portions. In addition, as the size of the electrode patterns increases, the average efficiency thereof decreases. That is, the conventional gas-discharge display apparatus has not been able to enjoy simultaneously a large operation margin and a high degree of brightness of image.

Also, preferably, the plurality of discharge spaces are separated from each other by a plurality of rib-like walls which extend in one direction and are arranged at a pre-determined interval of distance, so that the discharge spaces have a stripe pattern, and wherein the sheet member includes a plurality of portions which extend in one direction of the grid pattern and are located on respective top ends of the rib-like walls. According to this feature, the sheet member can be prevented from interrupting a light produced from a portion of each discharge space that is opposite to an observer with respect to the sheet member, for example, a light emitted by a fluorescent layer provided in that portion of the each discharge space. Therefore, the gas-discharge display apparatus can enjoy a still higher degree of brightness.

The above object has been also achieved by a second invention according to which there is provided a method of producing a gas-discharge display apparatus including a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, and a plurality of pairs of first and second discharge electrodes each pair of which cooperate with each other to produce a gas discharge in a corresponding one of the discharge spaces, so that a light produced by the gas discharge is observed through the first substrate, the method comprising superposing the first and second substrates on each other and gas-tightly sealing the superposed first and second substrates, the method being characterized by comprising a sheet-member fixing step of fixing, to an inner surface of one of the first and second substrates, a sheet member including (a) a dielectric core layer comprising a dielectric thick film having a grid pattern and a pre-determined thickness, (b) a first conductive thick-film layer comprising a plurality of first conductive thick films which are provided on one of opposite surfaces of the grid pattern of the dielectric core layer and extend parallel to each other in one direction of the grid pattern and which function as the first discharge electrodes, respectively, and (c) a second conductive thick-film layer comprising a plurality of second conductive thick films which are provided on the other surface of the grid pattern of the dielectric core layer and extend parallel to each other in an other direction of the grid pattern and which function as the second discharge electrodes, respectively.

According to this invention, when the gas-discharge display apparatus is produced by superposing, and fixing, the first and second substrates on, and to, each other, the sheet member in which the first and second conductive layers are provided on the opposite surfaces of the grid pattern of the dielectric core layer, respectively, is fixed to the first and second substrates, so that the first and second discharge electrodes are provided in the discharge spaces, respectively. Since the conductive thick films constituting the first and second discharge electrodes are provided on the sheet member, the first and second electrodes can be assembled with the first and second substrates, by just placing the sheet member between the first and second substrates. Therefore, the gas-discharge display apparatus can be produced such that the first and second substrates and the discharge electrodes are free of distortions resulting from a heat treatment which would be carried out in the case where the discharge electrodes are provided on the first and second substrates.

Here, preferably, the gas-discharge display apparatus producing method further comprises (d) a support-member preparing step of preparing a support member having a film formation surface which is defined by a high melting point particle layer in which particles having a melting point higher than a first pre-selected temperature are bound together by a resin, (e) a first conductive paste film forming step of forming, on the film formation surface, and in a pre-determined pattern corresponding to the first conductive thick-film layer, a plurality of first conductive paste films which are separate from each other and in each of which particles as a conductive thick films which are sintered at the first temperature are bound together by a resin, (f) a dielectric paste film forming step of forming, on respective surfaces of the first conductive paste films, and in a grid pattern corresponding to the grid pattern of the dielectric core layer, a dielectric paste film in which particles as a dielectric thick-film material which are sintered at the first temperature are bound together by a resin, (g) a second conductive paste film forming step of forming, on a surface of the dielectric paste film, and in a pre-determined pattern corresponding to the second conductive thick-film layer, a plurality of second conductive paste films which are separate from each other and in each of which particles as a conductive thick-film material which are sintered at the first temperature are bound together by a resin, and (h) a firing step of subjecting the support member to a heat treatment at the first temperature, so that the first conductive paste films, the second conductive paste films, and the dielectric paste film are sintered while the high melting point particle layer is not sintered, whereby the first conductive paste films, the second conductive paste films, and the dielectric paste film are processed into the first conductive thick-film layer, the second conductive thick-film layer, and the dielectric core layer, respectively, and thus the sheet member is produced.

According to this feature, after the respective paste films are so formed, using the respective materials of the dielectric thick film and the conductive thick films, as to have the respective pre-determined patterns on the film formation surface defined by the layer formed of the particles having the higher melting point than the respective sintering temperatures (i.e., the first temperature) of the dielectric thick film and the conductive thick films, those paste films are subjected to a heat treatment at the first temperature at which the respective materials of the dielectric thick film and the conductive thick films can be sintered. Thus, the sheet member having the conductive layers on the dielectric core layer is produced. Since, in the high melting point particle layer, the high melting point particles are not sintered at the first temperature and the resin is burned out, only the particles remain in the layer. Therefore, the thus produced thick films are not fixed to the support member, and accordingly can be easily peeled from the film formation surface. The respective paste films of the respective materials of the dielectric thick film and the conductive thick films can be formed in the respective desired patterns on the film formation surface, using respective appropriate methods corresponding to the materials used and their uses, and using respective simple equipments. In addition, the paste films can be easily dealt with, because they are temporarily fixed, by application, to the film formation surface till they are sintered in the heat treatment. Thus, the sheet member constituting the discharge electrodes can be easily produced and can be used in producing the gas-discharge display apparatus.

Since the thick films are sintered on the layer consisting of the high melting point particles only, they are not subjected to any restraints when being sintered, unlike in the conventional thick-film forming process. Therefore, the thick films are free of warpage or deformation that would result from the resistance of the film formation surface to the shrinkage of the films, and eventually free of cracks accompanied by the warpage or deformation. Thus, the distortions of the discharge electrodes can be minimized.

Also, preferably, the first conductive thick-film layer comprises a plurality of first opposing portions which are fixed to respective side surfaces of grid bars of the dielectric core layer, the second conductive thick-film layer comprises a plurality of second opposing portions which are fixed to respective side surfaces of grid bars of the dielectric core layer, such that the second opposing portions oppose the first opposing portions, respectively, and the method further comprises a third conductive paste film forming step of forming, on respective side surfaces of grid bars of the dielectric paste film, and in a pattern corresponding to the first and second opposing portions, a plurality of third conductive paste films in each of which particles a conductive thick-film material which are sintered at the first temperature are bound together by a resin. According to this feature, in the third conductive paste film forming step, the third conductive paste films constituting the first and second opposing portions are formed. Since the first and second conductive layers comprise the first and second opposing portions, respectively, the gas-discharge display apparatus including the first and second opposing portions substantially functioning as the first and second discharge electrodes can be produced by fixing the sheet member to the first or second substrate.

The above object has been achieved by a third invention according to which there is provided a gas-discharge display apparatus comprising a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, and a plurality of pairs of discharge electrodes each pair of which cooperate with each other to produce a gas discharge in a corresponding one of the discharge spaces, so that a light produced by the gas discharge is observed through the first substrate, the apparatus being characterized by comprising a sheet member including (a) a dielectric core layer comprising a dielectric thick film having a grid pattern and a pre-determined thickness, the dielectric thick film including a plurality of grid bars, a plurality of grid spaces, and a plurality of pairs of recesses which are formed in respective side surfaces of the grid bars, such that each pair of recesses oppose each other in a corresponding one of the grid spaces, (b) a plurality of pairs of electrode-constituting conductive thick films which are provided in the plurality of pairs of recesses, respectively, and which constitute the plurality of pairs of discharge electrodes, respectively, and (c) a plurality of wiring-constituting conductive thick films which are provided on at least one of opposite surfaces of the dielectric core layer and are connected to the electrode-constituting conductive thick films, the sheet member being provided between the first and second substrates, such that the sheet member extends parallel to each of the first and second substrates.

According to this invention, a plurality of pairs of electrode-constituting conductive thick films which are provided in the respective side surfaces of the grid portions of the grid pattern of the dielectric core layer, provide the pairs of discharge electrodes, respectively, and the plurality of wiring-constituting conductive thick films which are provided on the dielectric core layer provide wiring members which apply an electric voltage to the plurality of pairs of discharge electrodes. Thus, the discharge electrodes can be provided by just placing the sheet member including the dielectric core layer, etc. between the first and second substrates, and accordingly no heat treatment to form the discharge electrodes on the inner surface of the first or second substrate need not be carried out. Therefore, the present apparatus is advantageously freed of the problem that the substrate may be distorted by the heat treatment. In addition, since the plurality of pairs of recesses are provided in the respective grid spaces of the dielectric core layer, such that the two recesses of each pair oppose each other in a corresponding one of the grid spaces, and the electrode-constituting conductive thick films are embedded in the recesses, respectively, respective ends of the electrode-constituting conductive thick films are covered by respective inner wall surfaces of the recesses, so that each of those ends is advantageously prevented from producing a local discharge. In particular, regarding an AC-type PDP in which discharge electrodes are covered with a dielectric layer (or, additionally, a protection film formed of, e.g., MgO), dielectric breakdown resulting from the local discharge can be advantageously prevented.

Here, it is noted that the above-described structure in which the wiring members are provided on the sheet member having the grid pattern and the pairs of discharge electrodes each pair of which oppose each other are provided in the respective side surfaces of the grid portions of the grid pattern, may be easily employed by a three-electrode-structure AC-type PDP having an opposing-discharge structure. However, it is difficult to provide the discharge electrodes in the respective side surfaces of the grid portions of the grid pattern, such that each of the discharge electrodes has a stable shape. Therefore, there has been a problem that respective local portions, in particular, respective ends, of the discharge electrodes produce discharges because of undesirable variations of shapes of the electrodes, and accordingly the electrodes are easily deteriorated.

Here, preferably, the plurality of wiring-constituting conductive thick films are provided on one of the opposite surfaces of the dielectric core layer, such that the wiring-constituting conductive thick films extend parallel to each other along one side of the grid pattern of the dielectric core layer and are connected to the electrode-constituting conductive thick films. Since the wiring-constituting conductive thick films extend parallel to each other, the third invention can be advantageously applied to a display apparatus having a three-electrode surface-discharge structure and including pairs of sustaining electrodes each pair of which extend parallel to each other.

The above object has been achieved by a fourth invention according to which there is provided a method of producing a gas-discharge display apparatus including a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, and a plurality of pairs of discharge electrodes each pair of which cooperate with each other to produce a gas discharge in a corresponding one of the discharge spaces, so that a light produced by the gas discharge is observed through the first substrate, the method comprising superposing the first and second substrates on each other and gas-tightly sealing the superposed first and second substrates, the method being characterized by comprising (a) a sheet-member fixing step of fixing a sheet member to an inner surface of one of the first and second substrates, such that the sheet member extends parallel to each of the first and second substrates, the sheet member including a dielectric core layer comprising a dielectric thick film having a grid pattern and a pre-determined thickness, the dielectric thick film including a plurality of grid bars and a plurality of grid spaces; a plurality of pairs of electrode-constituting conductive thick films which are provided on respective side surfaces of the grid bars, such that each pair of electrode-constituting conductive thick films oppose each other in a corresponding one of the grid spaces; and a plurality of wiring-constituting conductive thick films which are provided on at least one of opposite surfaces of the dielectric core layer and are connected to the electrode-constituting conductive thick films, the sheet member (b) a support-member preparing step of preparing a support member having a film formation surface which is defined by a high melting point particle layer in which particles having a melting point higher than a first pre-selected temperature are bound together by a resin, (c) a dielectric paste film forming step of forming, on the film formation surface, and in a grid pattern corresponding to the grid pattern of the dielectric core layer, a dielectric paste film in which particles as a dielectric thick-film material which are sintered at the first temperature are bound together by a resin, (d) a wiring-constituting conductive paste film forming step of forming, on the film formation surface, and in a pattern corresponding to the wiring-constituting conductive thick films, a plurality of wiring-constituting conductive paste films in each of which particles as a conductive thick-film material which are sintered at the first temperature are bound together by a resin, (e) an electrode-constituting conductive paste film forming step of applying, to the dielectric paste film having the grid pattern, an electrode-constituting conductive paste in which a conductive thick-film material which are sintered at the first temperature and a resin are dispersed in a solvent, in an island-like pattern, and allowing the electrode-constituting conductive paste to flow down along respective side surfaces of grid bars of the dielectric paste film, thereby forming, on the respective side surfaces of the grid bars, a plurality of electrode-constituting conductive paste films having respective shapes corresponding to respective shapes of the electrode-constituting conductive thick films, such that the electrode-constituting conductive paste films are connected to the wiring-constituting conductive paste films, and (f) a firing step of subjecting the support member to a heat treatment at the first temperature, so that the dielectric paste film, the wiring-constituting conductive paste films, and the electrodes-providing conductive paste films are sintered while the high melting point particle layer is not sintered, whereby the dielectric paste film, the wiring-constituting conductive paste films, and the electrode-constituting conductive paste films are processed into the dielectric core layer, the wiring-constituting conductive thick films, and the electrode-constituting conductive thick films, respectively, and thus the sheet member is produced.

According to this invention, when the gas-discharge display apparatus is produced by superposing, and fixing, the first and second substrates on, and to, each other, the sheet member including the dielectric core layer, the electrode-constituting conductive thick films fixed to the respective side surfaces of the grid portions of the grid pattern of the dielectric core layer, and the wiring-constituting conductive thick films stacked on one of opposite major surfaces of the dielectric core layer, is fixed to the first or second substrate, so that the discharge electrodes are provided in the discharge spaces, respectively. Since the sheet member includes the conductive thick films providing the discharge electrodes, the discharge electrodes can be provided by just placing the sheet member between the first and second substrates, and accordingly no heat treatment to form the discharge electrodes on the substrate need not be carried out. Therefore, the present apparatus is advantageously freed of the problem that the first substrate may be distorted by the heat treatment. In addition, the sheet member is produced as follows: After the dielectric paste film is formed on the film formation surface that is provided by the high melting point particle layer whose melting point is higher than the sintering temperatures (the first temperature) of the dielectric thick-film material and the conductive thick-film material, the electrode-constituting conductive paste is applied in the island-like pattern to one surface of the dielectric paste film, while allowing the paste to flow down along the respective side surfaces of the grid portions of the grid pattern of the dielectric paste film, so that the electrode-constituting conductive paste films are connected to the wiring-constituting conductive paste films. Then, the thus obtained thick films are subjected to the firing treatment so as to produce the sheet member. Since, at the heat-treatment temperature, the high melting point particles are not sintered but the resin is burned out, the high melting point particle layer is processed into the layer in which only the high melting point particles are gathered. Therefore, the thus processed thick films are not fixed to the support member, and can be easily peeled from the film formation surface. In addition, before the thick films are subjected to the heat treatment, the thick films can be easily dealt with since the thick films are in a state in which the films are temporarily fixed to the support member because of the application of the pastes to the film formation surface. Since the electrode-constituting conductive thick films are fixed to the side surfaces of the grid portions of the dielectric core layer, by allowing the electrode-constituting conductive paste to flow down from the upper surface of the dielectric core layer, the pairs of discharge electrodes each of which oppose each other in a corresponding one of the grid spaces can be easily formed by just applying the electrode-constituting conductive paste to the dielectric core layer. Therefore, even if the present apparatus may employ the surface discharge structure, the apparatus is advantageously freed of the problems of local discharge and dielectric breakdown.

The above-described wiring-constituting conductive paste film forming step may be carried out, depending upon the construction of the sheet member, before, or after, the dielectric paste film forming step, or after the electrode-constituting conductive paste film forming step, such that the wiring-constituting conductive thick films are formed on either one, or both, of the upper and lower surfaces of the dielectric core layer.

Here, preferably, the plurality of wiring-constituting conductive thick films are provided on one of the opposite surfaces of the dielectric core layer, such that the wiring-constituting conductive thick films extend parallel to each other along one side of the grid pattern of the dielectric core layer and are connected to the electrode-constituting conductive thick films, and the wiring-constituting conductive paste film forming step comprises forming, on the film formation surface, the wiring-constituting conductive paste films in a stripe pattern corresponding to the wiring-constituting conductive thick films. Since the wiring-constituting conductive thick films extend parallel to each other, the fourth invention can be advantageously applied to the production of a display apparatus having a three-electrode surface-discharge structure and including pairs of sustaining electrodes each pair of which extend parallel to each other.

Also, preferably, the electrode-constituting conductive paste has a higher degree of fluidity than a degree of fluidity of a conductive paste which is used to form the wiring-constituting conductive paste films. According to this feature, the electrode-constituting conductive paste is so prepared as to have the nature of high fluidity assuring that the paste can easily flow down along the side surfaces of the grid portions of the dielectric paste film, to form electrode-constituting conductive paste films, and the wiring-constituting conductive paste is so prepared as to have the nature assuring that the paste can be easily applied to form wiring-constituting conductive paste films in a highly defined pattern. The thus obtained two sorts of thick films can meet respective demand characteristics, respectively. For example, the electrode-constituting conductive paste films can enjoy their own smooth surfaces, and accordingly enjoy improved uniformity of the respective distances between the respective pairs of discharge electrodes each pair of which oppose each other.

Also, preferably, the gas-discharge display apparatus producing method further comprises a flow stopper forming step of forming, before the electrode-constituting conductive paste film forming step, a plurality of flow stoppers on the film formation surface, so that each of the flow stoppers prevents the electrode-constituting conductive paste flowing down along a corresponding one of the respective side surfaces of the grid bars of the dielectric paste film, from spreading, on the film formation surface, toward the side surface opposing the one side surface. According to this feature, the respective lower end portions of the electrode-constituting conductive paste films that are flowing downward are prevented from approaching unnecessarily toward the respective opposite electrode-constituting conductive paste films. Therefore, those end portions are more effectively prevented from producing local discharges.

Also, preferably, each of the flow stoppers is formed of the high melting point particles that are bound together by the resin. According to this feature, after the firing step, the flow stoppers can be removed and accordingly the lower end portions of the electrode-constituting conductive paste films, hidden by the flow stoppers, can be exposed. Thus, the respective effective areas of the electrodes are not decreased by the provision of the flow stoppers. In addition, in the case where fluorescent layers are formed on the second substrate in the gas-discharge display apparatus, the flow stoppers do not interrupt the lights emitted by those fluorescent layers on the second substrate. Thus, the degree of brightness of the display apparatus is not lowered by the use of the flow stoppers in the producing method.

Also, preferably, each of the flow stoppers is formed, integrally with the dielectric paste film, of the particles of the dielectric thick-film material that are bound together by the resin. According to this feature, the respective lower end portions of each pair of opposing discharge electrodes that project toward each other are covered by the flow stoppers that are each formed of the dielectric material. Therefore, those projecting portions are advantageously prevented from producing local discharges or dielectric breakdown.

Also, preferably, in the case where the flow stoppers are each formed of the dielectric material as described above, the wiring-constituting conductive paste film forming step comprises forming, before the dielectric paste film forming step, the wiring-constituting conductive paste films including respective projecting portions which are to project, at respective positions where the electrode-constituting conductive paste films are to be formed, from the dielectric paste film to be formed, and each of the flow stoppers is so formed as to have a shape which assures that the each flow stopper covers an end portion of a corresponding one of the projecting portions of the wiring-constituting conductive paste films and allows a portion of the one projecting portion to be exposed. According to this feature, if the electrode-constituting conductive paste films are formed on the respective side surfaces of the grid portions of the dielectric core layer, by allowing the electrode-constituting conductive paste to flow down from the upper surface of the core layer, then the electrode-constituting conductive paste films are connected to the wiring-constituting conductive paste films provided below the core layer.

Also, preferably, the dielectric paste film forming step comprises forming the dielectric paste film which has, in the respective side surfaces of the grid bars thereof where the electrode-constituting conductive paste films are to be formed, a plurality of recesses each of which has a pre-determined depth as measured from an upper surface of the grid pattern of the dielectric paste film. According to this feature, the electrode-constituting conductive paste applied can easily flow into the recesses and accordingly can be advantageously prevented from spreading unnecessarily in the lateral direction on the upper surface, or the side surfaces, of the dielectric core layer. Thus, respective ends of the electrode-constituting paste films can enjoy a stable shape and can be freed of local discharge. In addition, the discharge electrodes can have desired height and width.

Also, preferably, each of the recesses extends from the upper surface of the grid pattern of the dielectric paste film to a lower surface of the grid pattern. According to this feature, the electrode-constituting conductive paste is allowed to flow down in each of the recesses, so as to form an electrode-constituting conductive thick film, i.e., a discharge electrode in the each recess.

The above object has been achieved by a fifth invention according to which there is provided an AC-type gas-discharge display apparatus comprising a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, a plurality of pairs of sustaining electrodes which are covered with a dielectric element and each pair of which cooperate with each other to produce a gas discharge in a corresponding one of the discharge spaces, so that a light produced by the gas discharge is observed through the first substrate, and a plurality of writing electrodes which cooperate with the sustaining electrodes to produce respective gas discharges and thereby select respective light emission units and which are provided on the second substrate such that the writing electrodes extend parallel to each other in one direction, the apparatus being characterized by comprising a sheet member including (a) a dielectric core layer comprising a dielectric thick film having a grid pattern and a pre-determined thickness, (b) a conductive thick-film layer comprising a plurality of conductive thick films which are provided on at least one of opposite surfaces of the dielectric core layer, such that the conductive thick films extend parallel to each other in an other direction perpendicular to the one direction, and which include respective portions that are located between respective intersection points of the grid pattern of the dielectric core layer and function as the sustaining electrodes, and (c) a dielectric cover layer comprising a dielectric thick film which covers the conductive thick-film layer, the sheet member being provided between the first and second substrates, such that the sheet member extends parallel to each of the first and second substrates.

According to this invention, the thick-film conductive layer provided on at least one of the opposite surfaces of the sheet member having the grid pattern constitutes the plurality of pairs of sustaining electrodes. Thus, the sustaining electrodes can be provided by just placing the sheet member between the first and second substrates and accordingly the first substrate is not subjected to a heat treatment to form the sustaining electrodes on the inner surface of the first substrate. In addition, since no electrodes or dielectric elements are formed on the inner surface of the first substrate through which the lights are emitted, the steps of forming the electrodes and the other elements on the first substrate need not be so complicated as to make the degree of transparency of the first substrate as high as possible. Therefore, the present three-electrode-structure AC-type gas-discharge display apparatus can be produced by a simple method and can be freed of the distortions caused by the heat treatment to form the electrodes and the other elements.

There is known, as one of various sorts of commonly used AC-type gas-discharge display apparatuses, a display apparatus having a three-electrode structure including a plurality of pairs of sustaining electrodes each pair of which oppose each other and writing electrodes which cooperate with the sustaining electrodes to produce writing discharges and thereby select light emission units. In the three-electrode-structure display apparatus, the sustaining electrodes are provided on the front plate through which lights are emitted, and the writing electrodes are provided on the rear plate. Since the front plate needs to transmit the lights as much as possible, the sustaining electrodes are constituted by transparent electrodes formed of, e.g., ITO (indium tin oxide), and bus electrodes which are formed of a metal or a conductive thick film and compensate for the electric conductivity of the transparent electrodes. To this end, the front plate is produced by forming sequentially, on a glass substrate, (a) an $SIO_2$ film to all the ITO film to contact closely the substrate, (b) the ITO film, (c) the bus electrodes, (d) a black stripe, (e) a dielectric layer, and (f) an MgO film. The ITO film may be formed by sputtering, and then may be patterned by a photo process including application of a resist, exposure to light, development of the pattern, etching, and peeling of the resist. The bus electrodes may be constituted by thin films such as Cr—Cu—Cr and, in this case, the thin films may be formed by the same process as used to form the ITO film and, in the case where the bus electrodes are constituted by conductive thick films such as silver thick film, the thick films may be formed by a thick-film forming process such as a thick-film screen printing method. The dielectric layer and the MgO film are required to have a high quality, i.e., a high degree of transparency. In short, since the conventional three-electrode structure is required to employ the transparent front plate, the processes of forming the conductive films and the dielectric films on the inner surface of the front plate are complicated.

Here, preferably, each pair of conductive thick films of the conductive thick-film layer that are adjacent each other include, as the respective portions thereof located between the respective intersection points of the grid pattern of the dielectric core layer, a plurality of pairs of opposing portions which are fixed to respective side surfaces of grid bars of the dielectric core layer, such that each pair of opposing portions oppose each other. According to this feature, the thick-film conductive layer includes the pairs of opposing portions which are provided on the inner wall surfaces of the grid pattern of the sheet member, such that each pair of opposing portions oppose each other in a corresponding one of the grid spaces of the sheet member, and those opposing portions substantially provide the respective discharge surfaces of the sustaining electrodes. Thus, the present display apparatus employs the opposing discharge structure in which each pair of discharge surfaces extend parallel to each other and accordingly enjoys a high efficiency than the efficiency of the conventional three-electrode structure in which the sustaining electrodes are provided on one plane. In addition, in the present display apparatus, the dielectric cover layer (or the dielectric cover layer and a protection film, in the case where the protection film, formed of, e.g., MgO is employed) is prevented from local deterioration caused by local strengthening of discharge, and accordingly its life expectancy is increased. In particular, in a gas-discharge display apparatus of a type in which fluorescent layers are provided in discharge spaces, the discharge surfaces are located at an intermediate position between the first and second substrates, and the discharge direction in which the electrodes produce the discharges is parallel to the respective inner surfaces of the two plates. Therefore, the inner surfaces of the front and rear plates are less influenced by discharge-gas ions and accordingly the fluorescent layers can be provided in respective wider areas of those inner surfaces, so as to increase the degree of brightness.

In the conventional surface-discharge-type gas-discharge display apparatus, each pair of sustaining electrodes, provided on one plane, cooperate with each other to produce a discharge and accordingly the size of each discharge surface and the distance between two discharge surfaces are limited by, e.g., a cell pitch. That is, the designing of the display apparatus is largely limited. In addition, a distance between respective inner end portions of respective discharge surfaces of each pair of sustaining electrodes largely differs from a distance between respective outer end portions of the discharge surfaces. Therefore, if a discharge is produced from the outer end portions of the discharge surfaces so as to emit a light from the entirety of a light emission unit (i.e., a pixel or a cell), then the efficiency of discharging of the discharge surfaces lowers; and if a discharge is produced from the inner end portions of the discharge surfaces where the discharge can be easily produced, then the display apparatus suffers the disadvantage that the dielectric cover layer is easily deteriorated by local discharge.

Also, preferably, the conductive thick films comprise first thick films provided on one of the opposite surfaces of the dielectric core layer, and second thick films provided on the other surface of the core layer such that the first thick films and the second thick films are alternate with each other in one direction of the core layer. According to this feature, each pair of conductive thick films that are adjacent each other in one direction of the dielectric core layer are provided on the opposite surfaces of the core layer, respectively. Therefore, respective portions of the conductive thick films that are fixed to the opposite surfaces of the core layer are prevented from producing surface discharges. Therefore, even in the case where a relationship between the discharge gap (i.e., the distance of two sustaining electrodes of each one pair corresponding to each one cell) and the cell pitch is such that a distance between a conductive thick film including one of those two sustaining electrodes and a conductive thick film belonging to another cell adjacent to the each one cell is smaller than the discharge gap, an erroneous discharge can be advantageously prevented from being produced between the two conductive thick films.

Also, preferably, each of the conductive thick films includes the opposing portions located on each of opposite sides of the each conductive thick film in a widthwise direction thereof. According to this feature, the pairs of opposing portions substantially functioning as the pairs of discharge electrodes are provided in all the grid spaces of the sheet member, respectively. Therefore, a first group of pairs of opposing portions which produce discharges in arrays of discharge spaces with respective odd numbers as counted from one end of the sheet member, and a second group of pairs of opposing portions which produce discharges in arrays of discharge spaces with respective even numbers as counted from the one end of the sheet member, can be alternately operated to display one frame (i.e., one image) in two fields, i.e., can employ 2:1 interlacing (i.e., jumping scanning). Thus, without needing to increase the total number of the conductive thick films, the number of the scanning lines of the present display apparatus can be doubled as compared with that of the conventional three-electrode structure, and the resolution of the present display apparatus can be accordingly increased.

The above object has been achieved by a sixth invention according to which there is provided a method of producing an AC-type gas-discharge display apparatus including a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, a plurality of pairs of sustaining electrodes which are covered with a dielectric element and each pair of which cooperate with each other to produce a gas discharge in a corresponding one of the discharge spaces, so that a light produced by the gas discharge is observed through the first substrate, and a plurality of writing electrodes which cooperate with the sustaining electrodes to produce respective gas discharges and thereby select respective light emission units and which are provided on the second substrate such that the writing electrodes extend parallel to each other in one direction, the method comprising superposing the first and second substrates on each other and gas-tightly sealing the superposed first and second substrates, the method being characterized by comprising a sheet-member fixing step of fixing a sheet member to an inner surface of one of the first and second substrates, the sheet member including (a) a dielectric core layer comprising a dielectric thick film having a grid pattern and a pre-determined thickness, (b) a conductive thick-film layer comprising a plurality of conductive thick films which are provided on at least one of opposite surfaces of the dielectric core layer, such that the conductive thick films extend parallel to each other in an other direction perpendicular to the one direction, and which includes respective portions that are located between respective intersection points of the grid pattern of the dielectric core layer and function as the sustaining electrodes, and (c) a dielectric cover layer comprising a dielectric thick film which covers the conductive thick-film layer.

According to this invention, when the gas-discharge display apparatus is produced by superposing, and fixing, the first and second substrates on, and to, each other, the sheet member in which the thick-film conductive layer is provided on at least one of the opposite surfaces of the dielectric core layer, is fixed to the first or second substrate, so that the pairs of sustaining electrodes are provided in the discharge spaces, respectively. Since the conductive thick films constituting the sustaining electrodes are provided on the sheet member, the sustaining electrodes can be assembled with the first and second substrates, by just placing the sheet member between the first and second substrates. Therefore, the gas-discharge display apparatus can be produced such that the first substrate and the sustaining electrodes are free of distortions resulting from a heat treatment which would be carried out in the case where the sustaining electrodes are provided on the first substrate. Thus, the present three-electrode-structure AC-type gas-discharge display apparatus can be produced by a simple method and can be freed of the distortions resulting from the heat treatment to form the electrodes and the other elements.

Here, preferably, the above-described gas-discharge display apparatus producing method further comprises a support-member preparing step of preparing a support member having a film formation surface which is defined by a high melting point particle layer in which particles having a melting point higher than a first pre-selected temperature are bound together by a resin, a dielectric paste film forming step of forming, on the film formation surface, and in a grid pattern corresponding to the grid pattern of the dielectric core layer, a dielectric paste film in which particles as a dielectric thick-film material which are sintered at the first temperature are bound together by a resin, a conductive paste film forming step of forming, on the film formation surface, and in a pre-determined pattern corresponding to the conductive thick-film layer, a plurality of conductive paste films which are separate from each other and in each of which particles as a conductive thick-film material which are sintered at the first temperature are bound together by a resin, and a firing step of subjecting the support member to a heat treatment at the first temperature, so that the conductive paste films and the dielectric paste film are sintered while the high melting point particle layer is not sintered, whereby the conductive paste films and the dielectric paste film are processed into the conductive thick-film layer and the dielectric core layer, respectively.

According to this feature, after the respective paste films are so formed, using the respective materials of the dielectric thick films and the conductive thick films, as to have the respective pre-determined patterns on the film formation surface defined by the layer formed of the particles having the higher melting point than the respective sintering temperatures (i.e., the first temperature) of the dielectric thick film and the conductive thick films, those paste films are subjected to a heat treatment at the first temperature at which the respective materials of the dielectric thick film and the conductive thick films can be sintered. Thus, the sheet member having the conductive layers on the dielectric core layer is produced. Since, in the high melting point particle layer, the high melting point particles are not sintered at the first temperature and the resin is burned out, only the particles remain in the layer. Therefore, the thus produced thick films are not fixed to the support member, and accordingly can be easily peeled from the film formation surface. The respective paste films of the respective materials of the dielectric thick film and the conductive thick films can be formed in the respective desired patterns on the film formation surface, using respective appropriate methods corresponding to the materials used and their uses, and using respective simple equipments. In addition, the paste films can be easily dealt with, because they are temporarily fixed, by application, to the film formation surface till they are sintered in the heat treatment. Thus, the sheet member constituting the sustaining electrodes can be easily produced and can be used in producing the gas-discharge display apparatus.

The conductive paste film forming step may be carried out, depending upon the construction of the sheet member, on one of the opposite surfaces of the dielectric core layer, before or after the dielectric paste film forming step, or on both of the opposite surfaces of the core layer before and after the dielectric paste film forming step. In addition, since the thick films are sintered on the layer consisting of the high melting point particles only, they are not subjected to any restraints when being sintered, unlike in the conventional thick-film forming process. Therefore, the thick films are free of warpage or deformation that would result from the resistance of the film formation surface to the shrinkage of the films, and eventually free of cracks accompanied by the warpage or deformation. Thus, the distortions of the sustaining electrodes can be minimized.

The above object has been achieved by a seventh invention according to which there is provided an AC-type gas-discharge display apparatus comprising a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, a plurality of pairs of sustaining electrodes which are covered with a dielectric element and each pair of which cooperate with each other to produce a gas discharge in a corresponding one of the discharge spaces, so that a light produced by the gas discharge is observed through the first substrate, and a plurality of writing electrodes which cooperate with the sustaining electrodes to produce respective gas discharges and thereby select respective light emission units and which are provided on the second substrate such that the writing electrodes extend parallel to each other in one direction, the apparatus being characterized by comprising a sheet member including (a) a dielectric core layer comprising a dielectric thick film having a grid pattern and a pre-determined thickness, (b) a conductive thick-film layer comprising a plurality of conductive thick films which are provided on at least one of opposite surfaces of the dielectric core layer, such that the conductive thick films extend parallel to each other in an other direction perpendicular to the one direction, and which include respective portions that are located between respective intersection points of the grid pattern of the dielectric core layer and that comprise a plurality of pairs of portions each pair of which are adjacent each other and cooperate with each other to produce a discharge, the pairs of portions functioning as the pairs of sustaining electrodes, such that, in each of the light emission units, at least two pairs of the sustaining electrodes produce respective discharges at respective locations different from each other in the one direction, and (c) a dielectric cover layer comprising a dielectric thick film which covers the conductive thick-film layer, the sheet member being provided between the first and second substrates, such that the sheet member extends parallel to each of the first and second substrates.

According to this invention, the conductive thick-film layer provided on at least one of the opposite surfaces of the sheet member having the grid pattern constitutes the plurality of pairs of sustaining electrodes and, in each of the light emission units, at least two pairs of sustaining electrodes are provided at respective locations distant from each other in a lengthwise direction of the writing electrodes. Thus, the pairs of sustaining electrodes can be provided by just placing the sheet member between the first and second substrates, and accordingly the first substrate need not be subjected to a heat treatment to form the sustaining electrodes on the inner surface of the first substrate. In addition, since no electrodes or dielectric elements need be formed on the inner surface of the first substrate through which the lights are emitted, the steps of forming the electrodes and the other elements on the first substrate need not be so complicated as to make the degree of transparency of the first substrate as high as possible. Moreover, since, in each light emission unit, at least two pairs of sustaining electrodes are provided at the respective locations distant from each other in the lengthwise direction of the writing electrodes, the area where the each light emission unit emits the light can be increased without increasing a drive voltage that has been used to drive conventional light emission units each including a single pair of electrodes, even if an interval of distance between respective centers of the light emission units in the lengthwise direction of the writing electrodes may be increased. Therefore, the present three-electrode-structure AC-type gas-discharge display apparatus can be produced in a simple method, can be freed of the distortions caused by the heat treatment to form the electrodes and the other elements, and can enjoy the increased light-emission area.

Since a conventional three-electrode type AC-type gas-discharge display apparatus needs to employ a front plate which can transmit light, as explained above, complicated steps have been employed to form conductive and dielectric films on an inner surface of the front plate. Meanwhile, in each light emission unit of the display apparatus, light is emitted from only an area where plasma or ultraviolet light is spread, i.e., an area slightly larger than an area actually occupied by each pair of sustaining electrodes. Therefore, in the case where a large-size display apparatus is produced such that each light emission unit thereof has a large light-emission area corresponding to a large size of the each unit, each of sustaining electrodes thereof need to have a large area. However, a distance between the two sustaining electrodes of the each pair needs to be kept at a substantially constant value, irrespective of the size of each light emission unit, for the purpose of using an appropriate discharge starting voltage in view of the pressure of the gas employed. In addition, the efficiency of discharge of the display apparatus decreases as the distance between of the two electrodes of each pair increases. Therefore, if the size of each light emission unit is increased while the discharge starting voltage is kept at an appropriate level, the area of each sustaining electrode is increased and accordingly the efficiency of discharge of the electrodes as a whole lowers, i.e., the efficiency of the display apparatus as a discharge apparatus significantly lowers.

Here, preferably, each pair of conductive thick films of the conductive thick-film layer that are adjacent each other include, as the respective portions thereof located between the respective intersection points of the grid pattern of the dielectric core layer, a plurality of pairs of opposing portions which are fixed to respective side surfaces of grid bars of the dielectric core layer, such that each pair of opposing portions oppose each other. According to this feature, the conductive thick-film layer includes the pairs of opposing portions which are provided on the inner wall surfaces of the grid pattern of the sheet member, such that each pair of opposing portions oppose each other in a corresponding one of the grid spaces of the sheet member, and those opposing portions substantially provide the respective discharge surfaces of the sustaining electrodes. Thus, the present display apparatus employs the opposing discharge structure in which each pair of discharge surfaces extend parallel to each other and accordingly enjoys a high efficiency than the efficiency of the conventional three-electrode-structure display apparatus in which the sustaining electrodes are provided on one plane. In addition, in the present display apparatus, the dielectric cover layer (or the dielectric cover layer and a protection film, in the case where the protection film, formed of, e.g., MgO, is employed) is prevented from local deterioration caused by local strengthening of discharge, and accordingly its life expectancy is increased. In particular, in a gas-discharge display apparatus of a type in which fluorescent layers are provided in discharge spaces, the discharge surfaces are located at an intermediate position between the first and second substrates, and the discharge direction in which the electrodes produce the discharges is parallel to the respective inner surfaces of the two plates. Therefore, the inner surfaces of the front and rear plates are less influenced by discharge-gas ions and accordingly the fluorescent layers can be provided in respective wider areas of those inner surfaces, so as to increase the degree of brightness.

In the conventional surface-discharge-type gas-discharge display apparatus, each pair of sustaining electrodes, provided on one plane, cooperate with each other to produce a discharge and accordingly the size of each discharge surface and the distance between two discharge surfaces are limited by, e.g., a cell pitch. That is, the designing of the display apparatus is largely limited. In addition, a distance between respective inner end portions of respective discharge surfaces of each pair of sustaining electrodes largely differs from a distance between respective outer end portions of the discharge surfaces. Therefore, if a discharge is produced from the outer end portions of the discharge surfaces so as to emit a light from the entirety of a light emission unit (i.e., a pixel or a cell), then the efficiency of discharge of the discharge surfaces lowers; and if a discharge is produced from the inner end portions of the discharge surfaces where the discharge can be more easily produced, then the display apparatus suffers the disadvantage that the dielectric cover layer is easily deteriorated by local discharge.

Also, preferably, the conductive thick films comprise a first group of thick films which are provided on one of the opposite surfaces of the dielectric core layer, and a second group of thick films which are provided on the other surface of the dielectric core layer, such that the thick films of the first group and the thick films of the second group are arranged alternately with each other in the one direction. According to this feature, each pair of conductive thick films that are adjacent each other in one direction of the dielectric core layer are provided on the opposite surfaces of the core layer, respectively. Therefore, respective portions of the conductive thick films that are fixed to the opposite surfaces of the core layer are prevented from producing surface discharges.

Also, preferably, in the each light emission unit, the conductive thick films of the at least two pairs comprise two inner conductive thick films and two outer conductive thick films which are located outside, and adjacent, the two inner conductive thick films, respectively, and cooperate with the two inner conductive thick films to produce the respective discharges. According to this feature, the inner conductive thick film cooperates with each of the outer conductive thick films located on either side thereof, to constitute a pair of discharge electrodes. That is, in each light emission unit, at least two pairs of sustaining electrodes can all produce respective discharges. Thus, each light emission unit can enjoy, with the smaller number of conductive thick films, a higher degree of brightness, as compared with a case where each of a plurality of conductive thick films cooperates with a single conductive thick film located on one side thereof.

The above object has been achieved by an eighth invention according to which there is provided a method of producing an AC-type gas-discharge display apparatus including a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, a plurality of pairs of sustaining electrodes which are covered with a dielectric element and each pair of which cooperate with each other to produce a gas discharge in a corresponding one of the discharge spaces, so that a light produced by the gas discharge is observed through the first substrate, and a plurality of writing electrodes which cooperate with the sustaining electrodes to produce respective gas discharges and thereby select respective light emission units and which are provided on the second substrate such that the writing electrodes extend parallel to each other in one direction, the method comprising superposing the first and second substrates on each other and gas-tightly sealing the superposed first and second substrates, the method being characterized by comprising a sheet-member fixing step of fixing a sheet member to an inner surface of one of the first and second substrates, the sheet member including (a) a dielectric core layer comprising a dielectric thick film having a grid pattern and a pre-determined thickness, (b) a conductive thick-film layer comprising a plurality of conductive thick films which are provided on at least one of opposite surfaces of the dielectric core layer, such that the conductive thick films extend parallel to each other in an other direction perpendicular to the one direction, and which include respective portions that are located between respective intersection points of the grid pattern of the dielectric core layer and that comprise a plurality of pairs of portions each pair of which are adjacent each other and cooperate with each other to produce a discharge, the pairs of portions functioning as the pairs of sustaining electrodes, such that, in each of the light emission units, at least two pairs of the sustaining electrodes produce respective discharges at respective locations different from each other in the one direction, and (c) a dielectric cover layer comprising a dielectric thick film which covers the conductive thick-film layer.

According to this invention, when the gas-discharge display apparatus is produced by superposing, and fixing, the first and second substrates on, and to, each other, the sheet member in which the conductive thick film is provided on at least one of the opposite surfaces of the dielectric core layer, such that, in each of the light emission units, at least two pairs of sustaining electrodes are provided at respective locations distant from each other in a lengthwise direction of the writing electrodes, is fixed to the first or second substrate, so that the pairs of sustaining electrodes are provided in the discharge spaces, respectively. Since the conductive thick films constituting the sustaining electrodes are provided on the sheet member, at least two pairs of sustaining electrodes can be provided in each light emission unit, by just placing the sheet member between the first and second substrates. Therefore, the gas-discharge display apparatus can be produced such that the first substrate and the sustaining electrodes are free of distortions resulting from a heat treatment which is needed in the case where the sustaining electrodes are formed on the first substrate. Moreover, since, in each light emission unit, at least two pairs of sustaining electrodes are provided at the respective locations distant from each other in the lengthwise direction of the writing electrodes, the area where the each light emission unit emits the light can be increased without increasing a drive voltage that has been used to drive conventional light emission units each including a single pair of electrodes, even if an interval of distance between respective centers of the light emission units in the lengthwise direction of the writing electrodes may be increased. Therefore, the present three-electrode-structure AC-type gas-discharge display apparatus can be produced in a simple method, can be freed of the distortions caused by the heat treatment to form the electrodes and the other elements, and can enjoy the increased light-emission area.

Here, preferably, the above-described gas-discharge display apparatus producing method further comprises (d) a support-member preparing step of preparing a support member having a film formation surface which is defined by a high melting point particle layer in which particles having a melting point higher than a first pre-selected temperature are bound together by a resin, (e) a dielectric paste film forming step of forming, on the film formation surface, and in a grid pattern corresponding to the grid pattern of the dielectric core layer, a dielectric paste film in which particles as a dielectric thick-film material which are sintered at the first temperature are bound together by a resin, (fi) a conductive paste film forming step of forming, on the film formation surface, and in a pre-determined pattern corresponding to the conductive thick-film layer, a plurality of conductive paste films which are separate from each other and in each of which particles as a conductive thick-film material which are sintered at the first temperature are bound together by a resin, and (g) a firing step of subjecting the support member to a heat treatment at the first temperature, so that the conductive paste films and the dielectric paste film are sintered while the high melting point particle layer is not sintered, whereby the conductive paste films and the dielectric paste film are processed into the conductive thick-film layer and the dielectric core layer, respectively.

According to this feature, after the respective paste films are so formed, using the respective materials of the dielectric thick films and the conductive thick films, as to have the respective pre-determined patterns on the film formation surface defined by the layer formed of the particles having the higher melting point than the respective sintering temperatures (i.e., the first temperature) of the dielectric thick film and the conductive thick films, those paste films are subjected to a heat treatment at the first temperature at which the respective materials of the dielectric thick film and the conductive thick films can be sintered. Thus, the sheet member having the conductive layers on the dielectric core layer is produced. Since, in the high melting point particle layer, the high melting point particles are not sintered at the first temperature and the resin is burned out, only the particles remain in the layer. Therefore, the thus produced thick films are not fixed to the support member, and accordingly can be easily peeled from the film formation surface. The respective paste films of the respective materials of the dielectric thick film and the conductive thick films can be formed in the respective desired patterns on the film formation surface, using respective appropriate methods corresponding to the materials used and their uses, and using respective simple equipments. In addition, the paste films can be easily dealt with, because they are temporarily fixed, by application, to the film formation surface till they are sintered in the heat treatment. Thus, the sheet member constituting the sustaining electrodes can be easily produced and can be used in producing the gas-discharge display apparatus.

The conductive paste film forming step may be carried out, depending upon the construction of the sheet member, on one of the opposite surfaces of the dielectric core layer, before or after the dielectric paste film forming step, or on both of the opposite surfaces of the core layer before and after the dielectric paste film forming step. In addition, since the thick films are sintered on the layer consisting of the high melting point particles only, they are not subjected to any restraints when being sintered, unlike in the conventional thick-film forming process. Therefore, the thick films are free of warpage or deformation that would result from the resistance of the film formation surface to the shrinkage of the films, and eventually free of cracks accompanied by the warpage or deformation. Thus, the distortions of the sustaining electrodes can be minimized.

Also, preferably, in the sixth or eighth invention, each pair of conductive thick films of the conductive thick-film layer that are adjacent each other include, as the respective portions thereof located between the respective intersection points of the grid pattern of the dielectric core layer, a plurality of pairs of opposing portions which are fixed to respective side surfaces of grid bars of the dielectric core layer, such that each pair of opposing portions oppose each other, and the method further comprises a wall-surface conductive paste film forming step of forming, on respective side surfaces of grid bars of the dielectric paste film, and in a pattern corresponding to the opposing portions, a plurality of wall-surface conductive paste films in each of which particles as a conductive thick-film material which are sintered at the first temperature are bound together by a resin. According to this feature, in the wall-surface conductive paste film forming step, the wall-surface conductive paste films constituting the opposing portions are formed. Since the conductive thick-film layer comprises the opposing portions, the gas-discharge display apparatus including the opposing portions substantially functioning as the sustaining electrodes can be produced by fixing the sheet member to the first or second substrate.

The above object has been achieved by a ninth invention according to which there is provided an AC-type gas-discharge display apparatus comprising a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, a plurality of pairs of sustaining electrodes which are covered with a dielectric element and each pair of which cooperate with each other to produce a gas discharge in a corresponding one of the discharge spaces, so that a light produced by the gas discharge is observed through the first substrate, and a plurality of writing electrodes which cooperate with the sustaining electrodes to produce respective gas discharges and thereby select respective light emission units, the apparatus being characterized by comprising a sheet member including (a) a dielectric core layer comprising a dielectric thick film having a grid pattern and a pre-determined thickness, (b) a first conductive thick-film layer comprising a plurality of first conductive thick films which are provided on one of opposite surfaces of the grid pattern of the dielectric core layer and extend parallel to each other in one direction of the grid pattern, and which include respective portions that are located between respective intersection points of the grid pattern and that function as the pairs of sustaining electrodes, (c) a second conductive thick-film layer comprising a plurality of second conductive thick films which are provided on the other surface of the grid pattern of the dielectric core layer and extend parallel to each other in an other direction perpendicular to the one direction, and which include respective portions that are located between the respective intersection points of the grid pattern of the dielectric core layer and that function as the writing electrodes, and (d) a dielectric cover layer comprising a dielectric thick film which covers the first conductive thick-film layer, the sheet member being provided between the first and second substrates, such that the sheet member extends parallel to each of the first and second substrates.

According to this invention, the first conductive thick-film layer and the second conductive thick-film layer respectively provided on the opposite surfaces of the sheet member having the grid pattern constitute the plurality of pairs of sustaining electrodes and the plurality of writing electrodes. Thus, the discharge electrodes can be provided by just placing the sheet member between the first and second substrates, and accordingly the first substrate and the second substrate need not be subjected to a heat treatment to form the discharge electrodes on the inner surfaces of those substrates. Therefore, the present three-electrode-structure AC-type gas-discharge display apparatus is freed of distortions of the first and second substrates and the electrodes that would otherwise be caused by the heat treatment. In addition, since the writing electrodes of the present display apparatus are freed of limitations with respect to their positions and size, in contrast to the case where sustaining electrodes and writing electrodes are provided on substrates, the writing electrodes can be located at respective appropriate positions and can be produced in an appropriate size. More specifically explained, since both the sustaining electrodes and the writing electrodes are provided in the single sheet member, the present display apparatus is freed of a problem with a conventional three-electrode-structure PDP in which sustaining electrodes and writing electrodes are provided, separately from each other, on a front plate and a rear plate, respectively, that is, the problem that the two sorts of electrodes cannot be sufficiently accurately positioned relative to each other when the front and rear plates are sealed to each other. Moreover, since respective distances between the sustaining electrodes and the writing electrodes are defined by a thickness of the dielectric core layer, independent of a distance between the two substrates, those distances can be sufficiently decreased. Furthermore, since the distances between the sustaining electrodes and the writing electrodes can be decreased, respective areas of the writing electrodes can be increased to enhance the reliability of writing, without producing erroneous discharges.

In the above-indicated conventional three-electrode-structure gas-discharge display apparatus including the writing electrodes, the sustaining electrodes which extend parallel to each other in one direction are provided on one of the front and rear plates, and the writing electrodes which extend in a direction perpendicular to the one direction are provided on the other plate. Therefore, when the front and rear plates are superposed on, and sealed to, each other, it is difficult to position accurately the sustaining electrodes and the writing electrodes relative to each other. In addition, though the speed of writing to select light emission units increases as the distances between the sustaining electrodes and the writing electrodes decrease, those distances cannot be decreased because they are defined by the distance between the front and rear plates (i.e., the distance between the two substrates). Though the distance between the two substrates is defined by the height of partition walls that separate the discharge spaces from each other, it is preferred that the partition walls be high to maintain a broad area where fluorescent layers are provided, and a high degree of brightness. In addition, though the reliability of writing increases as the area of each writing electrode increases, the distances between the writing electrodes and the sustaining electrodes are considerably great in the above-described structure, and accordingly the increased area of each writing electrode may lead to producing erroneous discharges (i.e., erroneous writings).

Here, preferably, each pair of first conductive thick films of the first conductive thick-film layer that are adjacent each other include, as the respective portions thereof located between the respective intersection points of the grid pattern of the dielectric core layer, a plurality of pairs of opposing portions which are fixed to respective side surfaces of grid bars of the dielectric core layer, such that each pair of opposing portions oppose each other. According to this feature, the first conductive thick-film layer includes the pairs of opposing portions which are provided on the side surfaces of the grid bars of the sheet member, such that each pair of opposing portions oppose each other in a corresponding one of the grid spaces of the sheet member, and those opposing portions substantially provide discharge electrodes. Thus, the present display apparatus employs the opposing discharge structure in which each pair of discharge surfaces extend parallel to each other. Therefore, the variation of respective discharge voltages (e.g., starting voltages or sustaining voltages) of respective light emission units (i.e., pixels or cells) is reduced, and the operation margin of the present apparatus is improved. In particular, in a gas-discharge display apparatus of a type in which a fluorescent layer is provided in each discharge space, the discharge surfaces are located at an intermediate height position between the first and second substrates, and the discharge direction is parallel to the respective inner surfaces of the two substrates. In this case, since the inner surfaces of the first and second substrates are less influenced by discharge-gas ions, the fluorescent layers can be provided in a large area or respective large areas of one or both of those inner surfaces so as to increase the degree of brightness.

Also, preferably, each of the first conductive thick films includes the opposing portions located on each of opposite sides of the each conductive thick film in a widthwise direction thereof. According to this feature, the pairs of opposing portions substantially functioning as the pairs of discharge electrodes are provided in all the grid spaces of the sheet member, respectively. Therefore, a first group of pairs of opposing portions which produce discharges in discharge spaces with respective odd numbers as counted from one end of the sheet member, and a second group of pairs of opposing portions which produce discharges in discharge spaces with respective even numbers as counted from the one end of the sheet member, can be alternately operated to display one frame (i.e., one image) in two fields, i.e., the present display apparatus can employ a 2:1 interlacing (i.e., jumping scanning) drive. Thus, without needing to increase the total number of the first conductive thick films, the number of the scanning lines of the present display apparatus can be doubled as compared with that of the conventional three-electrode structure, and the resolution of the present display apparatus can be accordingly increased.

Also, preferably, the second conductive thick-film layer includes a plurality of projecting portions which project toward a plurality of grid spaces, respectively, of the dielectric core layer in which the pairs of opposing portions are provided, respectively. According to this feature, since the projecting portions substantially function as the writing electrodes, writing discharges are produced with higher reliability, as compared with the case where no such projecting portions are provided.

In each of the above-described first, third, fifth, seventh, and ninth inventions, preferably, at least one of respective opposing surfaces of the first and second substrates that oppose each other has a plurality of grooves which extend in the one direction of the grid pattern of the dielectric core layer. According to this feature, the grooves and the grid spaces of the sheet member cooperate with each other to define the discharge spaces. Therefore, if the depth of the grooves and the thickness of the sheet member are appropriately selected, the present gas-discharge display apparatus can enjoy an appropriate size of each of the discharge spaces. More specifically explained, since ridge-like portions present between the grooves substantially function as partition walls, it is not needed to form, on the inner surfaces of the first and second substrates, any partition walls to define the discharge spaces, in a thick-film forming process including a firing step. In particular, in the case of a full-color display apparatus of a type in which fluorescent layers are provided in the discharge spaces, those fluorescent layers may be provided in the grooves, so as to prevent the sheet member from contacting the fluorescent layers, without needing to provide any partition walls on the inner surfaces of the first and second substrates.

In each of the fifth and seventh invention, the plurality of grooves extend in the one direction in which the plurality of writing electrodes extend, and are located at respective positions corresponding to respective intermediate positions between pairs of writing electrodes each pair of which are adjacent to each other in a direction perpendicular to the one direction. In addition, in the ninth invention, the plurality of grooves extend in a lengthwise direction of the plurality of second conductive thick films, and are located at respective positions corresponding to respective intermediate positions between pairs of writing electrodes each pair of which are adjacent to each other in a direction perpendicular to the lengthwise direction.

Also, preferably, the above-described grooves, or rib-like walls which are provided on at least one of the first and second substrates so as to define the discharge spaces have, with respect to the sheet member, such a positional relationship that the grid bars of the sheet member that extend in one direction are aligned with ridge-like portions of the first and/or second substrates. According to this feature, the sheet member can be prevented from interrupting a light produced from a portion of each discharge space that is opposite to an observer with respect to the sheet member, for example, a light emitted by a fluorescent layer provided in that portion of the each discharge space. Therefore, the gas-discharge display apparatus can enjoy a still higher degree of brightness.

The above object has been achieved by a tenth invention according to which there is provided a method of producing an AC-type gas-discharge display apparatus including a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, a plurality of pairs of sustaining electrodes which are covered with a dielectric element and each pair of which cooperate with each other to produce a gas discharge in a corresponding one of the discharge spaces, so that a light produced by the gas discharge is observed through the first substrate, and a plurality of writing electrodes which cooperate with the sustaining electrodes to produce respective gas discharges and thereby select respective light emission units, the method comprising superposing the first and second substrates on each other and gas-tightly sealing the superposed first and second substrates, the method being characterized by comprising a sheet-member fixing step of fixing a sheet member to an inner surface of one of the first and second substrates, the sheet member including (a) a dielectric core layer comprising a dielectric thick film having a grid pattern and a pre-determined thickness, (b) a first conductive thick-film layer comprising a plurality of first conductive thick films which are provided on one of opposite surfaces of the grid pattern of the dielectric core layer and extend parallel to each other in one direction of the grid pattern, and which include respective portions that are located between respective intersection points of the grid pattern of the dielectric core layer and that function as the pairs of sustaining electrodes, (c) a second conductive thick-film layer comprising a plurality of second conductive thick films which are provided on the other surface of the grid pattern of the dielectric core layer and extend parallel to each other in an other direction perpendicular to the one direction, and which include respective portions that are located between the respective intersection points of the grid pattern of the dielectric core layer and that function as the writing electrodes, and (d) a dielectric cover layer comprising a dielectric thick film which covers the first conductive thick-film layer.

According to this invention, when the gas-discharge display apparatus is produced by superposing, and fixing, the first and second substrates on, and to, each other, the sheet member in which the first conductive thick-film layer and the second conductive thick-film layer are respectively provided on the opposite surfaces of the dielectric core layer having the grid pattern, is fixed to the first or second substrate, so that the pairs of sustaining electrodes and the writing electrodes are provided in the discharge spaces, respectively. Since the conductive thick-film layers constituting the sustaining electrodes and the writing electrodes are provided on the sheet member, the sustaining electrodes and the writing electrodes can be provided, by just placing the sheet member between the first and second substrates. Therefore, the gas-discharge display apparatus can be produced such that the first and second substrates and the electrodes are free of distortions resulting from a heat treatment which is needed in the case where the sustaining electrodes and the writing electrodes are formed on the first and second substrates.

Here, preferably, the gas-discharge display apparatus producing method further comprises (e) a support-member preparing step of preparing a support member having a film formation surface which is defined by a high melting point particle layer in which particles having a melting point higher than a first pre-selected temperature are bound together by a resin, (f) a lower conductive paste film forming step of forming, on the film formation surface, and in a pre-determined pattern corresponding to one of the first and second conductive thick-film layers, a plurality of lower conductive paste films which are separate from each other and in each of which particles as a conductive thick-film material which are sintered at the first temperature are bound together by a resin, (g) a dielectric paste film forming step of forming, on respective surfaces of the lower conductive paste films, and in a grid pattern corresponding to the grid pattern of the dielectric core layer, a dielectric paste film in which particles as a dielectric thick-film material which are sintered at the first temperature are bound together by a resin, (h) an upper conductive paste film forming step of forming, on a surface of the dielectric paste film, and in a pre-determined pattern corresponding to the other of the first and second conductive thick-film layers, a plurality of upper conductive paste films which are separate from each other and in each of which particles as a conductive thick-film material which are sintered at the first temperature are bound together by a resin, and (i) a firing step of subjecting the support member to a heat treatment at the first temperature, so that the lower conductive paste films, the upper conductive paste films, and the dielectric paste film are sintered while the high melting point particle layer is not sintered, whereby the lower conductive paste films, the upper conductive paste films, and the dielectric paste film are processed into the first conductive thick-film layer, the second conductive thick-film layer, and the dielectric core layer.

According to this feature, after the respective paste films are so formed, using the dielectric thick-film material and the conductive thick-film materials, as to have the respective pre-determined patterns on the film formation surface defined by the layer formed of the particles having the higher melting point than the respective sintering temperatures (i.e., the first temperature) of the dielectric thick-film material and the conductive thick-film materials, those paste films are subjected to a heat treatment at the first temperature at which the dielectric thick-film material and the conductive thick-film materials can be sintered. Thus, the sheet member having the conductive thick-film layers on the dielectric thick-film layer is produced. Since, in the high melting point particle layer, the high melting point particles are not sintered at the first temperature and the resin is burned out, only the particles remain in the layer. Therefore, the thus produced thick films are not fixed to the support member, and accordingly can be easily peeled from the film formation surface. The respective paste films formed of the dielectric thick-film material and the conductive thick-film materials can be formed in the respective desired patterns on the film formation surface, using respective appropriate methods corresponding to the materials used and their uses, and using respective simple equipments. In addition, the paste films can be easily dealt with, because they are temporarily fixed, by application, to the film formation surface till they are sintered in the heat treatment. Thus, the sheet member constituting the sustaining electrodes and the writing electrodes can be easily produced, and the sheet member can be used in producing the gas-discharge display apparatus.

Since the thick films are sintered on the layer consisting of the high melting point particles only, those thick films are not bound by the film formation surface, when they are sintered, unlike in the conventional thick-film forming process. Therefore, the thick films are free of warpage or deformation that would otherwise result from the resistance of the film formation surface to the shrinkage of the thick films, and eventually are free of cracks caused by the warpage or deformation. Thus, the distortions of the discharge electrodes can be minimized.

Here, preferably, each pair of first conductive thick films of the first conductive thick-film layer that are adjacent each other include, as the respective portions thereof located between the respective intersection points of the grid pattern of the dielectric core layer, a plurality of pairs of opposing portions which are fixed to respective side surfaces of grid bars of the dielectric core layer, such that each pair of opposing portions oppose each other, and the method further comprises a wall-surface conductive paste film forming step of forming, on the side surfaces of the grid bars of the dielectric paste film, and in a pattern corresponding to the opposing portions, a plurality of wall-surface conductive paste films in each of which particles as a conductive thick-film material which are sintered at the first temperature are bound together by a resin. According to this feature, in the wall-surface conductive paste film forming step, the wall-surface conductive paste films constituting the opposing portions are formed. Since the first conductive thick-film layer is so formed as to include the opposing portions, the gas-discharge display apparatus including the opposing portions substantially functioning as the discharge electrodes can be produced by just fixing the sheet member to the first substrate or the second substrate.

In each of the above-described first, third, fifth, seventh, and ninth inventions, preferably, the support-member preparing step comprises forming the high melting point particle layer on a surface of a pre-selected substrate. According to this feature, the paste films are formed on the pre-selected substrate. Since this support member can maintain its shape even after the heat treatment, the sheet member can be easily dealt with in providing the discharge electrodes in the discharge spaces, as compared with the case where the support member consists of the high melting point particle layer only (e.g., the case where the support member consists of a ceramic green sheet). In addition, in the case where this support member is used, the paste films are not bound by the pre-selected substrate, when the paste films are subjected to a heat treatment, because the high melting point particle layer is interposed between the paste films and the pre-selected substrate. Moreover, since a degree of roughness of outer surface of the paste films is defined by only a degree of roughness of outer surface of the high melting point particle layer, a degree of flatness, a degree of roughness, and a thermal expansion coefficient, of the pre-selected substrate do not influence the quality of the sheet member. Thus, the pre-selected substrate need not have a high quality.

Also, preferably, the substrate is not deformed at the firing temperature. According to this feature, the film formation surface can maintain its initial shape, after the dielectric thick-film layer and the conductive thick-film layers are processed by the heat treatment. Therefore, the support member can be used repeatedly while the high melting point particle layer is formed repeatedly on the surface of the support member. Any sort of substrate may be selected, so long as the substrate satisfies the above-described conditions; such as a common glass, a heat-resisting glass, a ceramic plate, or a metallic plate.

Also, preferably, the gas-discharge display apparatus producing method further comprises a covering step of applying a dielectric thick-film paste in which particles as a dielectric thick-film material which are sintered at a pre-selected temperature are bound together by a resin, to an outer surface of the dielectric core layer, subjecting, to a heat treatment, the dielectric core layer and the dielectric thick-film paste applied thereto, and thereby providing the dielectric cover layer which covers the outer surface of the dielectric core layer. According to this feature, the dielectric cover layer which covers an outer surface of the sheet member can be easily formed. The above-indicated pre-selected temperature may be equal to the first temperature, or different from (i.e., higher or lower than) the same. More preferably, the application of the dielectric thick-film paste may be carried out by dipping.

Also, preferably, the paste film forming step comprises forming, in a thick-film screen printing method, each of the lower conductive paste film, the upper conductive paste film, the dielectric cover paste film, and the dielectric core paste film. The paste films may be formed in an appropriate method which is selected from various methods, e.g., printing, sand blasting, lift-off, and a photo process in which a photosensitive paste is used, depending upon cost, required accuracy, and consistency with other steps. In particular, in the case where the printing method is used as indicated above, the film materials are not applied to any portions on the film formation surface where no films are to be formed, and accordingly no amounts of the film materials are wasted. That is, as compared with a pressing method in which a ceramic green sheet is worked by pressing, a laser method in which a ceramic sheet is worked by laser, or a chemical etching method in which a metallic material is worked by etching, the printing method can minimize the amounts of wasted materials.

Also, preferably, the high melting point particles comprises an inorganic material such as ceramic or glass frit. The high melting point particles may be provided by any sort of inorganic material, so long as the inorganic material does not soften after the resin is burned out. An appropriate one of the inorganic materials may be selected depending upon the sort of the thick-film materials used to produce the sheet member and/or the firing temperatures of the thick-film materials.

BRIEF DESCRIPTION OF THE DRAWINGS

FIGS. 58g through 59(*i*) are views showing the substrate and the thick films in respective essential steps out of the producing steps shown in FIG. 57 that follow the step shown in FIG. 58(*e*).

BEST MODE FOR CARRYING OUT THE INVENTION

Hereinafter, there will be described an embodiment of the present invention in detail by reference to the drawings.

FIRST EMBODIMENT

Figure 1:
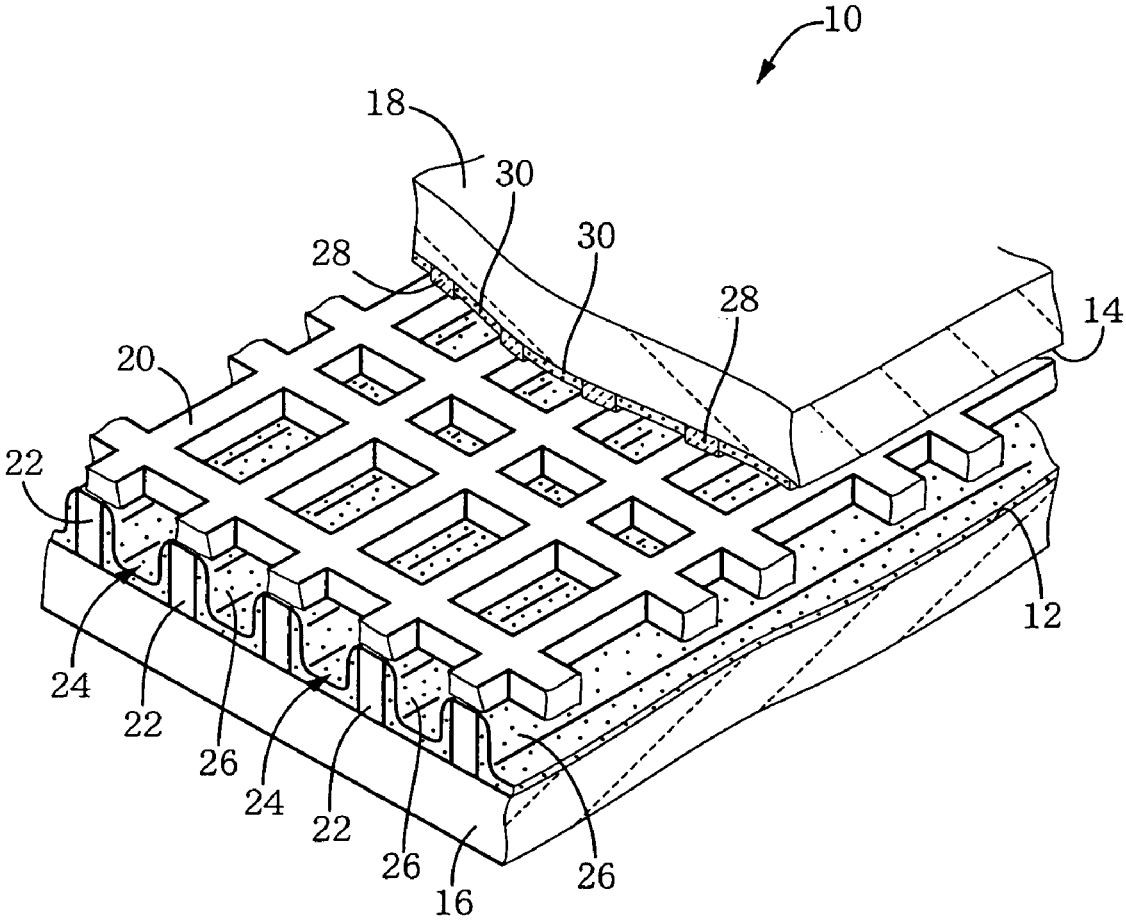
FIG. 1 is a perspective view of a color PDP as a gas-discharge display apparatus according to the present invention, with a portion of the PDP being cut away.

FIG. 1 is a perspective view for explaining a construction of an AC-type color PDP (hereafter, simply referred to as the PDP) 10 as an example of a gas-discharge display apparatus according to the present invention, such that a portion of the PDP 10 is cut away. In the figure, the PDP 10 includes a front plate 16 and a rear plate 18 which are provided such that the front and rear plates 16, 18 extend parallel to each other and are distant from each other by a pre-determined distance, so that respective one inner surfaces 12, 14 of the front and rear plates 16, 18 which surfaces are substantially flat, oppose each other. A sheet member 20 having a grid pattern is provided between the front and rear plates 16, 18, and peripheral portions of the front and rear plates 16, 18 are gas-tightly sealed. Thus, a gas-tight space is defined in the PDP 10. Each of the front and rear plates 16, 18 has a size of about 900 (mm)× about 500 (mm) and a uniform thickness of from about 1.1 (mm) to about 3 (mm), and those plates 16, 18 are formed of, e.g., respective soda lime glasses which are similar to each other and each of which is transparent and has a softening point of about 700 (° C.). In the present embodiment, the front plate 16 provides a first substrate; and the rear plate 18 provides a second substrate.

On the front plate 16, there are provided a plurality of elongate partition walls 22 which extend parallel to each other in one direction and whose centerlines are distant from each other at a regular interval of from about 200 (μm) to about 500 (μm). Thus, the gas-tight space defined between the front and rear plates 16, 18 is divided into a plurality of discharge spaces 24. The partition walls 22 are each formed of a thick film which contains, as a main component thereof, a glass having a low softening point, such as $PbO—B_2O_3—SiO_2—Al_2O_3—ZnO—TiO_2$ glasses or a combination of two or more of these glasses, and has a width of from about 80 (μm) to about 200 (μm) and a height of from about 30 (μm) to about 100 (μm). An inorganic filler such as alumina and/or other inorganic pigments are added, as needed, to the partition walls 22, so as to adjust a degree of compactness, a degree of strength, and/or a shape keeping ability of the partition walls 22. The sheet member 20 includes a plurality of elongate grid bars which extend in one direction and are placed on respective top ends of the partition walls 22.

On the inner surface 12 of the front plate 16 and on respective side surfaces of the partition walls 22, there are provided a plurality of fluorescent layers 26 which are distinguished from each other so as to correspond to the plurality of discharge spaces 24, respectively. A thickness of each of the fluorescent layers 26 is pre-determined to fall in the range of, e.g., from about 10 (μm) to about 20 (μm), depending upon its fluorescent color. The fluorescent layers 26 are grouped into three groups of layers 26 that emit, by ultraviolet-light excitation, three fluorescent colors, e.g., red color (R), green color (G), and blue color (B), respectively. The fluorescent layers 26 are arranged such that each one of the layers 26, and two layers 26 located on either side of the each layer 26 emit the three, different fluorescent colors, respectively, in the corresponding three discharge spaces 24, respectively.

Meanwhile, on the inner surface 14 of the rear plate 18, there are provided a plurality of partition walls 28 at respective positions where the partition walls 28 oppose the partition walls 22, respectively. Thus, the partition walls 28 have a stripe pattern. The partition walls 28 are each formed of, e.g., the same material as used to form each of the partition walls 22, and each have a thickness of, e.g., from about 20 (μm) to about 50 (μm). Between each pair of partition walls 28 that are adjacent each other on the inner surface 14 of the rear plate 18, there is provided a fluorescent layer 30 having a thickness falling in the range of, e.g., from about 10 (μm) to about 20 (μm). Thus, a plurality of fluorescent layers 30 are provided in a stripe pattern on the inner surface 14. The fluorescent layers 30 are arranged such that each of the layers 30 emits, in a corresponding one of the discharge spaces 24, the same fluorescent color as the fluorescent color emitted in the one discharge space 24 by a corresponding one of the fluorescent layers 26 provided on the front plate 16. The partition walls 28 have a height greater than the thickness of the fluorescent layers 30, for the purpose of preventing the sheet member 20 from contacting the fluorescent layers 30.

Figure 2:
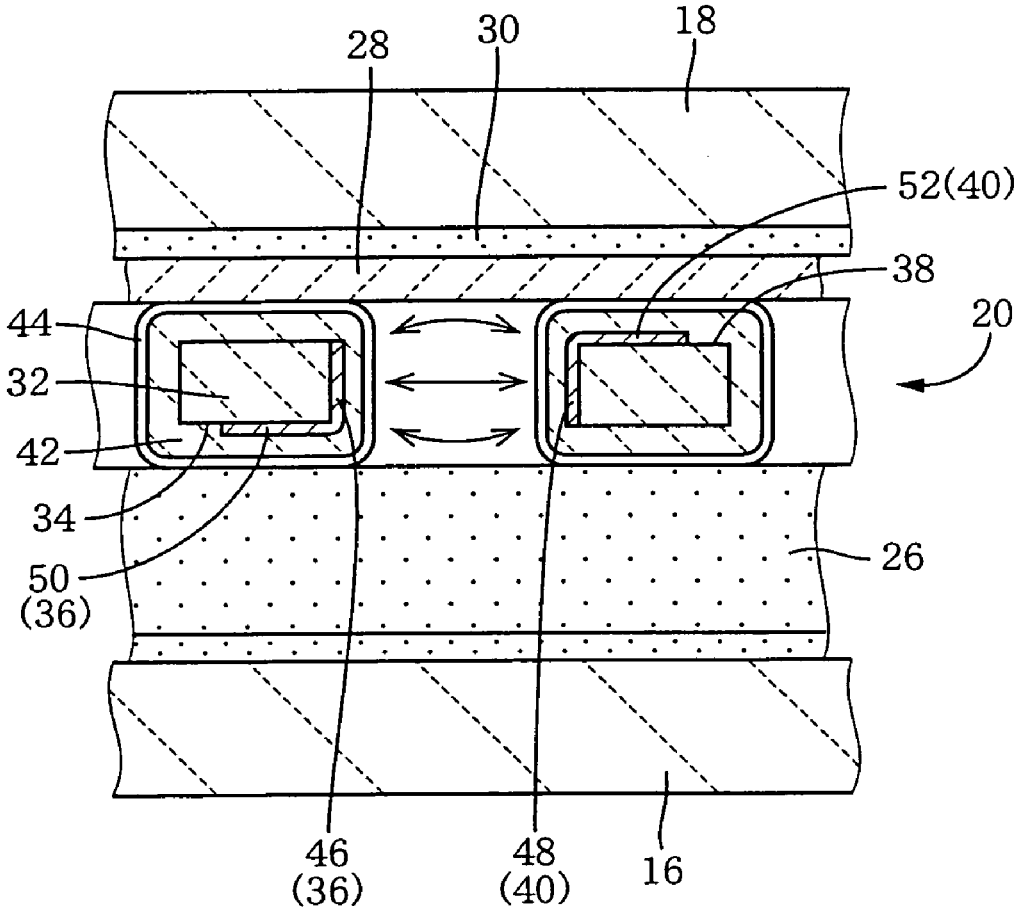
FIG. 2 is a cross-section view for explaining a construction of the PDP of FIG. 1, taken in a lengthwise direction of partition walls thereof.

FIG. 2 is a cross-section view, taken along a lengthwise direction of the partition walls 22, for explaining a construction of the PDP 10. The sheet member 20 includes a dielectric core layer 32 which has a grid pattern (see FIG. 1) constituting a skeleton of the grid pattern of the sheet member 20; an X wiring layer 36 which is placed on, and fixed to, an area continuing from one surface 34 (i.e., a lower surface, shown in the figure) of the core layer 32 to respective one side surfaces of the core layer 32 (i.e., respective one inner wall surfaces of the grid pattern thereof); a Y wiring layer 40 which is placed on, and fixed to, an area continuing from an opposite surface 38 (i.e., an upper surface, shown in the figure) of the core layer 32 to respective other side surfaces of the core layer 32 (i.e., respective other inner wall surfaces of the grid pattern thereof); a dielectric cover layer 42 which covers the core layer 32 and the X and Y wiring layers 36, 40; and a protection film 44 which covers the cover layer 42 and provides a surface layer of the sheet member 20. In the present embodiment, the X wiring layer 36 and the Y wiring layer 40 provide one, and the other, of a first conductive layer and a second conductive layer.

The dielectric core layer 32 has a thickness of from about 50 (μm) to about 150 (μm), for example, a thickness of 100 (μm), and respective grid bars of the core layer 32 that extend in lengthwise and width directions thereof and cooperate with each other to constitute the grid pattern thereof, have a width which is substantially equal to the width of the partition walls 22 or somewhat greater than the width of the same 22 in consideration of alignment margins, for example, a width of from about 80 (μm) to about 200 (μm). The dielectric core layer 32 is formed of a dielectric thick film which contains a glass having a low softening point, such as $PbO—B_2O_3—SiO_2—Al_2O_3—ZnO—TiO_2$ glasses or a combination of two or more of these glasses, and additionally contains a ceramic filler such as alumina.

The X and Y wiring layers 36, 40 are each formed of an electrically conductive thick film which contains, as an electrically conductive component thereof, silver (Ag), chromium (Cr), or copper (Cu), for example, and have a thickness of from about 5 (μm) to about 10 (μm). The X wiring layer 36 includes a plurality of portions 46 which cover respective one side surfaces of the grid bars of the core layer 32; and the Y wiring layer 40 includes a plurality of portions 48 which cover respective other side surfaces of the grid bars of the core layer 32. Those portions 46 and those portions 48 provide discharge electrodes, i.e., X electrodes and Y electrodes, respectively, which produce respective gas discharges in the respective discharge spaces 24. As shown in the figure, each of the X electrodes 46 and a corresponding one of the Y electrodes 48 are located, on the inner wall surfaces of the grid pattern of the sheet member 20, at respective positions where the each X electrode 46 and the one Y electrode 48 extend parallel to each other and oppose each other. Thus, the PDP 10 has an opposing discharge structure in which a discharge is produced between two electrodes opposing each other in each discharge space 24. In the present embodiment, the X electrodes 46 and the Y electrodes 48 provide ones, or the others, of first opposing portions and second opposing portions, i.e., first discharge electrodes and second discharge electrodes.

The dielectric cover layer 42 has a thickness falling in the range of, e.g., from about 10 (μm) to about 30 (μm), for example, a thickness of about 20 (μm), and is formed of a thick film which contains a glass having a low softening point, such as $PbO—B_2O_3—SiO_2—Al_2O_3—ZnO—TiO_2$ glasses or a combination of two or more of these glasses. The dielectric cover layer 42 is employed mainly for the purpose of storing electric charges on an outer surface thereof and thereby causing each pair of X and Y electrodes 46, 48 to produce an alternate-current discharge. In addition, since the cover layer 42 prevents exposure of the thick-film-based X and Y electrodes 46, 48, and thereby restrains the generation of outgas from those electrodes 46, 48 and the change of atmosphere in each discharge space 24.

The protection film 44 has a thickness of, e.g., about 0.5 (μm), and is formed of a thin or thick film which contains, e.g., MgO as a main component thereof. The protection film 44 is employed for the purpose of preventing discharge-gas ions from causing sputtering of the dielectric cover layer 42. Since, however, the protection film 44 is formed of a dielectric material having a high secondary electron emission factor, the protection film 44 substantially functions as the discharge electrodes.

Figure 3:
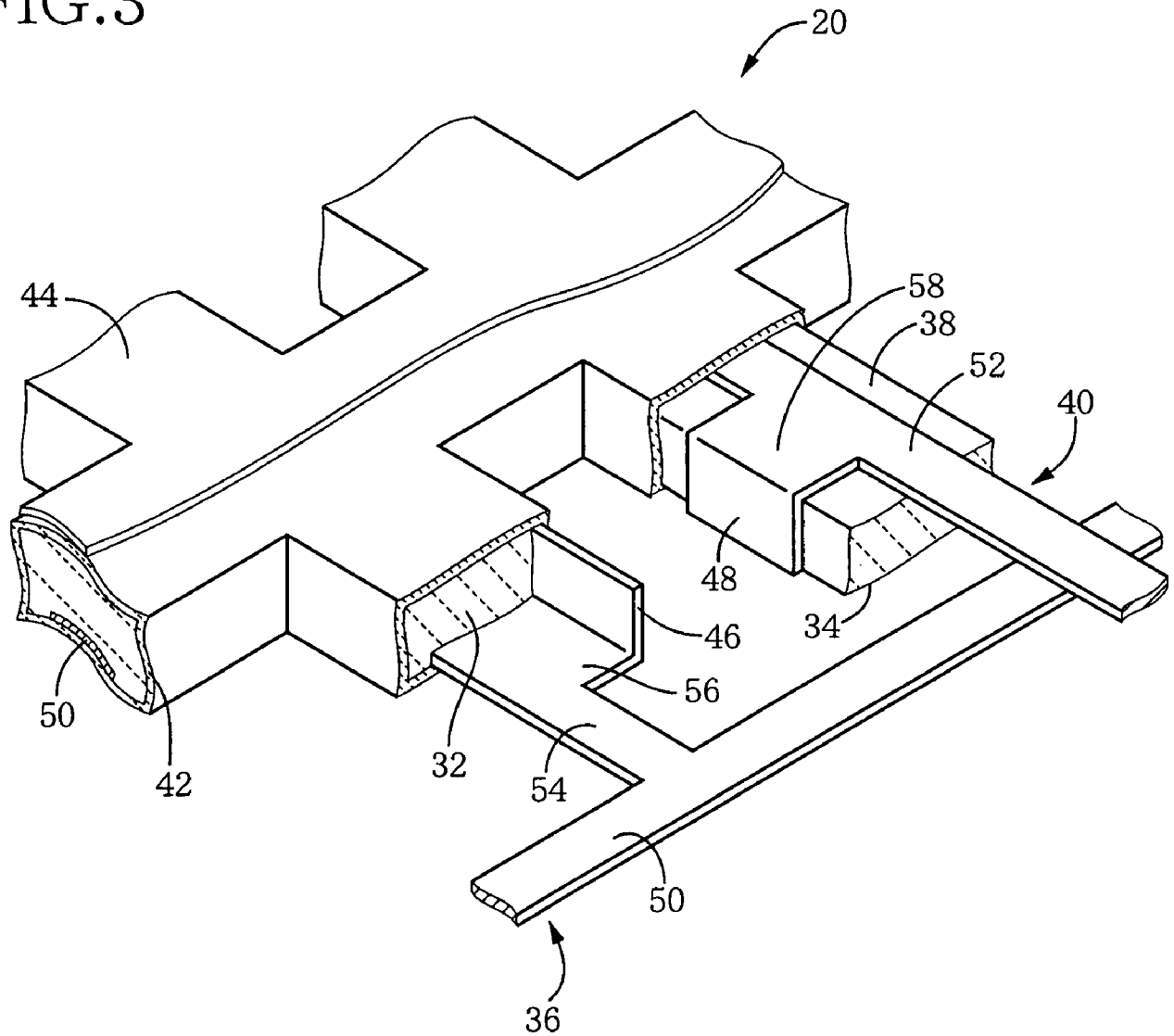
FIG. 3 is a view for explaining a construction of a sheet member of the PDP of FIG. 1.

FIG. 3 is a view for explaining in detail respective constructions of the X and Y wiring layers 36, 40, with a portion of the sheet member 20 being cut away. In the figure, the X wiring layer 36 includes a plurality of wiring portions 50 which extend in one direction of the grid pattern constituting the sheet member 20 and which are electrically insulated from each other; and the Y wiring layer 40 includes a plurality of wiring portions 52 which extend in another direction perpendicular to the one direction and which are electrically insulated from each other. Thus, the wiring portions 50 and the wiring portions 52 extend in the two directions, respectively, which are perpendicular to each other. Each of the wiring portions 50, 52 has a pre-determined width of from about 50 (μm) to about 80 (μm). In addition, each of the wiring portions 50, 52 is located on a widthwise middle portion of a corresponding one of the grid bars of the dielectric core layer 32.

Each of the wiring portions 50 of the X wiring layer 36 includes a plurality of branch portions 54 which laterally extend from a plurality of locations, respectively, that are distant from each other in a lengthwise direction of the each wring portion 50. Thus, the branch portions 54 extend substantially parallel to the wiring portions 52 of the Y wiring layer 40. Each of the branch portions 54 includes a base portion having a width substantially equal to that of a stem portion of each of the wiring portions 50; and an end portion or widened portion 56 that is widened toward one of the wiring portions 52 that is the nearest to that end portion 56. Each of the X electrodes 46 is continuous with one of opposite side ends of the widened portion 56 that is nearer than the other side end thereof to the nearest wiring portion 52, and extends in a vertically upward direction from the one side end of the widened portion 56. A length of each X electrode 46 in a direction parallel to a lengthwise direction of each wiring portion 52 is, e.g., about 100 (μm); and a height of each X electrode 46 in a direction parallel to a thickness direction of the sheet member 20 is substantially equal to, e.g., the thickness of the dielectric core layer 32, i.e., falls in the range of from about 50 (μm) to about 150 (μm), e.g., about 100 (μm).

Meanwhile, each of the wiring portions 52 of the Y wiring layer 40 includes a plurality of projecting portions 58 which laterally project from a plurality of locations, respectively, that are distant from each other in a lengthwise direction of the each wring portion 52. Each of the Y electrodes 48 is continuous with an end of the projecting portion 58 and extends in a vertically downward direction from that end. A length of each projecting portion 58 and each Y electrode 48 in the lengthwise direction of each wiring portion 52 is equal to that of each widened portion 56, that is, e.g., about 100 (μm); and a height of each Y electrode 48 is equal to that of each X electrode 46, i.e., substantially equal to the thickness of the dielectric core layer 32. Thus, the X electrodes 46 cover respective portions of respective one side surfaces of the grid bars of the dielectric core layer 32; and the Y electrodes 48 cover respective portions of respective different side surfaces of the grid bars of the core layer 32.

Figure 4:
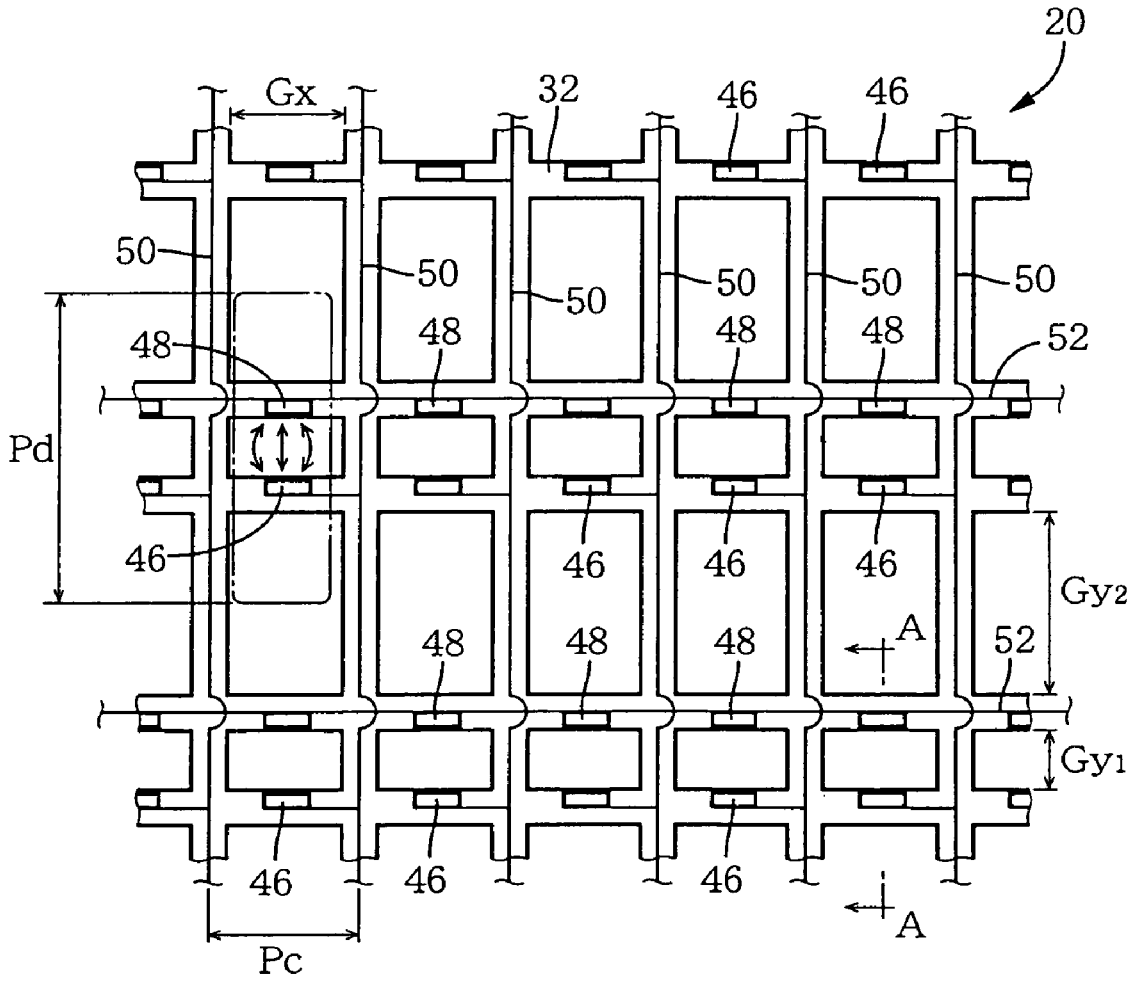
FIG. 4 is a view for explaining a manner in which wiring layers are formed in the sheet member shown in FIG. 3.

FIG. 4 is a schematic view for explaining a manner in which the wiring portions 50 of the X wiring layer 36 and the X electrodes 46 are connected to each other and the wiring portions 52 of the Y wiring layer 40 and the Y electrodes 48 are connected to each other. The plurality of wiring portions 50 of the X wiring layer 36 that extend in a vertical direction in the figure correspond, one to one, to a plurality of vertical grid bars of the dielectric core layer 32 that extend in the vertical direction in the figure. The branch portions 54 of each of the wiring portions 50 correspond to every second intersection point of a corresponding one of the vertical grid bars of the core layer 32, respectively. The branch portions 54 of all the wiring portions 50 of the X wiring layer 36 project in a same direction, e.g., a leftward direction in the figure. Thus, a plurality of X electrodes 46 that are arranged in an array in the vertical direction in the figure are connected to a common wiring portion 50.

Meanwhile, the plurality of wiring portions 52 of the Y wiring layer 40 that extend in a horizontal direction in the figure correspond to every second horizontal grid bar of the dielectric core layer 32, respectively, that is free of the branch portions 54 of the wiring portions 50. The projecting portions 58 of all the wiring portions 52 project in a same direction, e.g., a downward direction in the figure. Thus, a plurality of Y electrodes 46 that are arranged in an array in the horizontal direction in the figure are connected to a common wiring portion 52. As shown in the figure, the wiring portions 50 and the wiring portions 52 cross over each other in a space. Since, however, the branch portions 54 and the projecting portions 58 are designed as described above, the plurality of pairs of X and Y electrodes 46, 48 correspond, one to one, to a plurality of intersection points where the wiring portions 50 and the wiring portions 52 cross over each other.

The intervals of distance between the grid bars of the sheet member 20 are not uniform. More specifically described, the grid bars of the sheet member 20 that extend along the wiring portions 50 of the X wiring layer 36 are arranged at a regular interval, Gx, of, e.g., about 200 (μm), but the grid bars of the sheet member 20 that extend along the wiring portions 52 of the Y wiring layer 40 are arranged such that a relatively small interval, Gy1, of, e.g., about 100 (μm) and a relatively large interval, Gy2, of, e.g., about 600 (μm) are alternate with each other. The X and Y electrodes 46, 48 of each pair oppose each other at the relatively small interval Gy1. As indicated in a left-hand middle portion of FIG. 4, each pair of X and Y electrodes 46, 48 function as a pair of discharge electrodes whose discharge gap is substantially equal to the small interval Gy1, i.e., about 100 (μm). As is apparent from the comparison of FIG. 4 with FIG. 1, the grid bars of the sheet member 20 that extend along the wiring portions 50 are placed on the partition walls 22, respectively. FIG. 2 is a cross-section view taken along A—A in FIG. 4.

When an alternate-current pulse is applied to, e.g., the Y electrodes 48 each as one discharge electrode so as to scan sequentially the same 48, and concurrently an alternate-current pulse is applied to desired ones of the X electrodes each as the other discharge electrode that correspond to data (i.e., the X electrodes corresponding to the cells selected to emit light), in synchronism with the timing of scanning of the Y electrodes 48 with the first pulse, the first and second pulses are added to each other to exceed a discharge starting voltage, so that the X and Y electrodes cooperate with each other to produce gas discharges. These gas discharges are sustained for a pre-determined time by the wall electric charges produced on the dielectric cover layer 42. Consequently the fluorescent layers 26, 30 corresponding to the selected cells are excited by ultraviolet lights produced by the gas discharges, and accordingly generate visible lights, so that those lights are outputted through the front or rear plate 16, 18 and thus a desired image is displayed. Each time one-time scanning of the first discharge electrodes (e.g., the Y electrodes 48) are completed, desired ones of the second discharge electrodes (e.g., the X electrodes 46), to which the second pulse is to be applied, are re-selected, so that desired images are continuously displayed.

As shown in FIG. 4, each discharge is produced between each pair of discharge electrodes 46, 48 that are distant from each other by the small distance Gy1, e.g., about 100 (μm). However, each discharge space 24 is continuous in the vertical direction in the figure. Therefore, the ultraviolet light produced by the discharge is spread, as schematically indicated at one-dot chain line in the figure, outward of the discharge electrodes 46, 48, in a lengthwise direction of the each discharge space 24. Thus, respective portions of the fluorescent layers 26, 28 that are located, in the each discharge space 24, within the range bounded by the one-dot chain line are excited by the ultraviolet light generated by the discharge produced by the electrodes 46, 48, indicated in the left-hand middle portion of the figure, and accordingly emit light.

Therefore, light emission units (i.e., cells) of the PDP 10 are defined by the partition walls 22 with respect to the direction perpendicular to the same 22, i.e., the horizontal direction in FIG. 4, and are substantially defined by the range to which the ultraviolet light is spread, with respect to the lengthwise direction of the partition walls 22, i.e., the vertical direction in the figure. Thus, an interval of distance between respective centerlines of the light emission cells in the horizontal direction in the figure is a color cell pitch, Pc, of about 0.3 (mm); and an interval of distance between respective centerlines of the light emission cells in the vertical direction in the figure is a dot pitch, Pd, of about 0.9 (mm). In the present color PDP 10 in which the three colors R, G, B are used, three light emission units that are adjacent each other in the horizontal direction in the figure cooperate with each other to define one pixel. Therefore, a pitch of the pixels of the PDP 10 is about 0.9 (mm) with respect to each of the horizontal and vertical directions in the figure.

Thus, in the present embodiment, the sheet member 20 having the grid pattern includes the X wiring layer 36 and the Y wiring layer 40, and the respective portions of the X and Y wiring layers 36, 40 that are fixed to the mutually opposing, inner wall surfaces of the grid bars of the sheet member 20 provide the X and Y electrodes 46, 48, i.e., the pairs of discharge electrodes. That is, the PDP 10 has the opposing discharge structure in which each pair of discharge surfaces oppose each other. Therefore, the variation of respective discharge voltages (i.e., starting voltages and/or sustaining voltages) needed to operate the light emission units can be decreased, and the operation margin of the PDP 10 can be increased.

In addition, the respective discharge surfaces of the discharge electrodes 46, 48 are located at an intermediate height position that is distant from each of the front and rear plates 16, 18, and the discharge direction in which the discharge electrodes 46, 48 produce the respective discharges is parallel to each of the respective inner surfaces 12, 14 of the front and rear plates 16, 18. Therefore, the inner surfaces 12, 14 of the two plates 16, 18 are less influenced by the discharge-gas ions, and accordingly the fluorescent layers 26, 30 can be provided in respective wider areas on the inner surfaces 12, 14. Thus, as compared with a surface discharge structure in which fluorescent layers can be provided on only a substrate opposing a substrate to which discharge electrodes are fixed, the PDP 10 can enjoy a highly increased degree of brightness.

Figure 5:
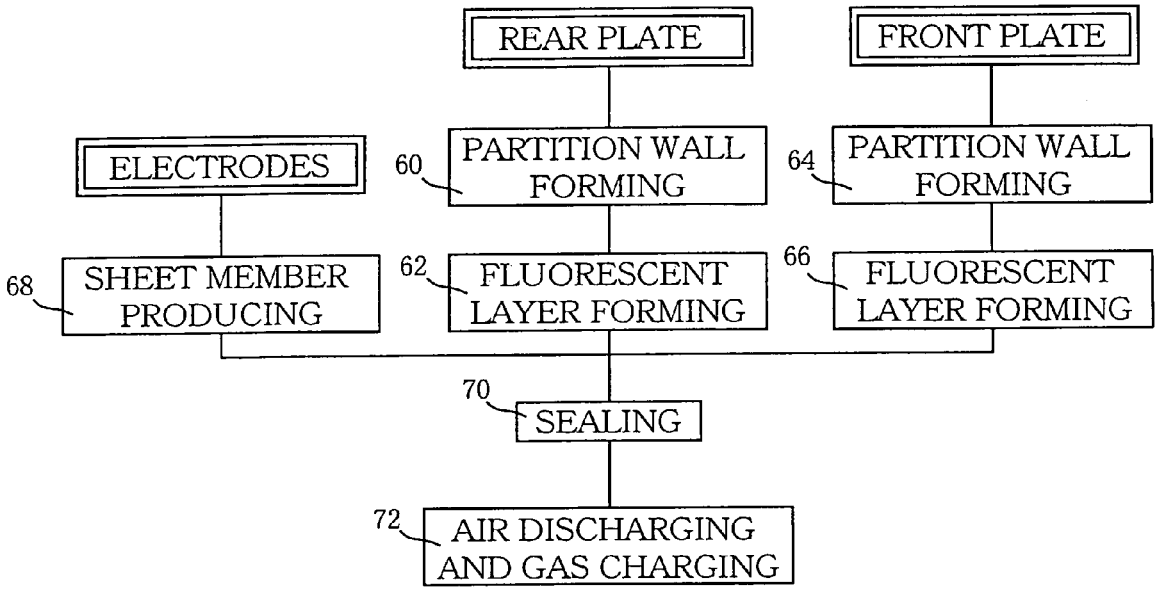
FIG. 5 is a flow chart for explaining a method of producing the PDP of FIG. 1.

Meanwhile, the PDP 10 constructed as described above can be produced by assembling the sheet member 20, the front plate 16, and the rear plate 18 that are processed (or produced) independent of each other according to the flow chart shown in FIG. 5.

The rear plate 18 is processed as follows: First, in a partition wall forming step 60, a thick-film forming technique such as a thick film screen printing method is used to print an electrically insulating paste containing, as main components thereof, a low softening point glass and an inorganic filler, to the surface 14 of the rear plate 18 so as to form thick films and, after drying of the films, fire the films at a temperature of, e.g., from about 500 (° C.) to about 650 (° C.) so as to obtain the partition walls 28. In the case where a desired height of the partition walls 28 cannot be obtained by one-time printing of the paste, the printing and the drying are repeated, as needed. Subsequently, in a fluorescent layer forming step 62, the thick-film screen printing method is used to apply each of three kinds of fluorescent pastes corresponding to the three colors R, G, B, to a corresponding one of the respective spaces between the partition walls 28 and then fire the applied pastes at a temperature of, e.g., about 450 (° C.) so as to obtain the fluorescent layers 30.

The front plate 16 is processed as follows: First, in a partition wall forming step 64 like the above-described step 60, a thick-film forming technique such as a thick-film screen printing method is used to print an electrically insulating paste containing, as main components thereof, a low softening point glass and an inorganic filler, to the inner surface 12 of the front plate 16 so as to form thick films and dry the same. These printing and drying are repeated, as needed. Subsequently, the films are fired at a heat treatment temperature that falls in the range of, e.g., from about 500 (° C.) to about 650 (° C.), depending upon the kind of the paste used. Thus, the partition walls 22 are obtained. Subsequently, in a fluorescent layer forming step 66, a technique such as a pouring printing is used to apply, from above the partition walls 22, each of three kinds of fluorescent pastes corresponding to the three colors R, G, B, to a corresponding one of the respective spaces between the partition walls 22 and then fire the applied pastes at a temperature of, e.g., about 450 (° C.) so as to obtain the fluorescent layers 26.

The sheet member 20 is produced in a sheet member producing step 68. The front and rear plates 16, 18 are superposed on each other via the sheet member 20, and are subjected, in a sealing step 70, to a heat treatment so that the two plates 16, 18 and the sheet member 20 are gas-tightly sealed with a sealing material, such as a sealing glass, that is applied in advance on respective interfaces of the same 16, 18, 20. Before this sealing step, the sheet member 20 may be fixed, as needed, to either one of the front and rear plates 16, 18, using a glass frit. Finally, in an air discharging and gas charging step 72, air is discharged from the thus obtained, gas-tight container, and an appropriate discharge gas is charged into the same so as to obtain the PDP 10.

Figure 6:
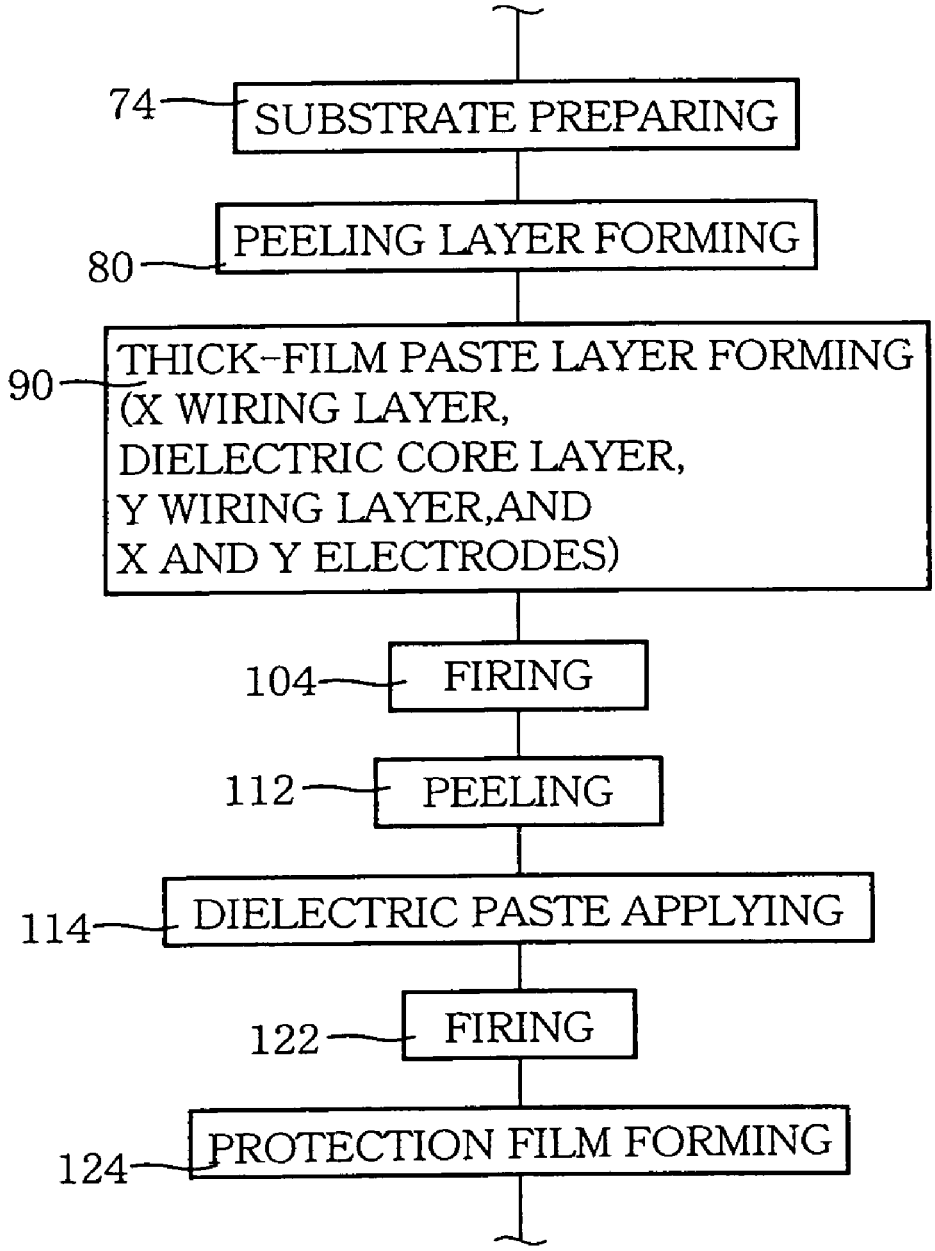
FIG. 6 is a flow chart for explaining a method of producing the sheet member.

In the above-described producing method, the sheet member producing step 68 is carried out according to the flow chart, shown in FIG. 6, in which a well known thick-film printing technique is used. Hereinafter, the method of producing the sheet member 20 will be explained by reference to FIGS. 7(*a*) through (*e*) showing respective states in essential steps of the method.

First, in a substrate preparing step 74, a substrate 76 (see FIG. 7) on which a thick-film printing is to be carried out, is prepared, and a surface 78 of the substrate 76 is subjected to an appropriate cleaning treatment. This substrate 76 is preferably provided by a glass substrate formed of, e.g., a soda lime glass that exhibits substantially no deformation or deterioration in a heat treatment, described later, and has a thermal expansion coefficient of about $87\times10^{-7}$ (/° C.), a softening point of about 740 (° C.), and a distorting point of about 510 (° C.). The substrate 76 has a thickness of, e.g., about 2.8 (mm), and the surface 78 of the substrate 76 is sufficiently larger than that of the sheet member 20.

Figure 7:
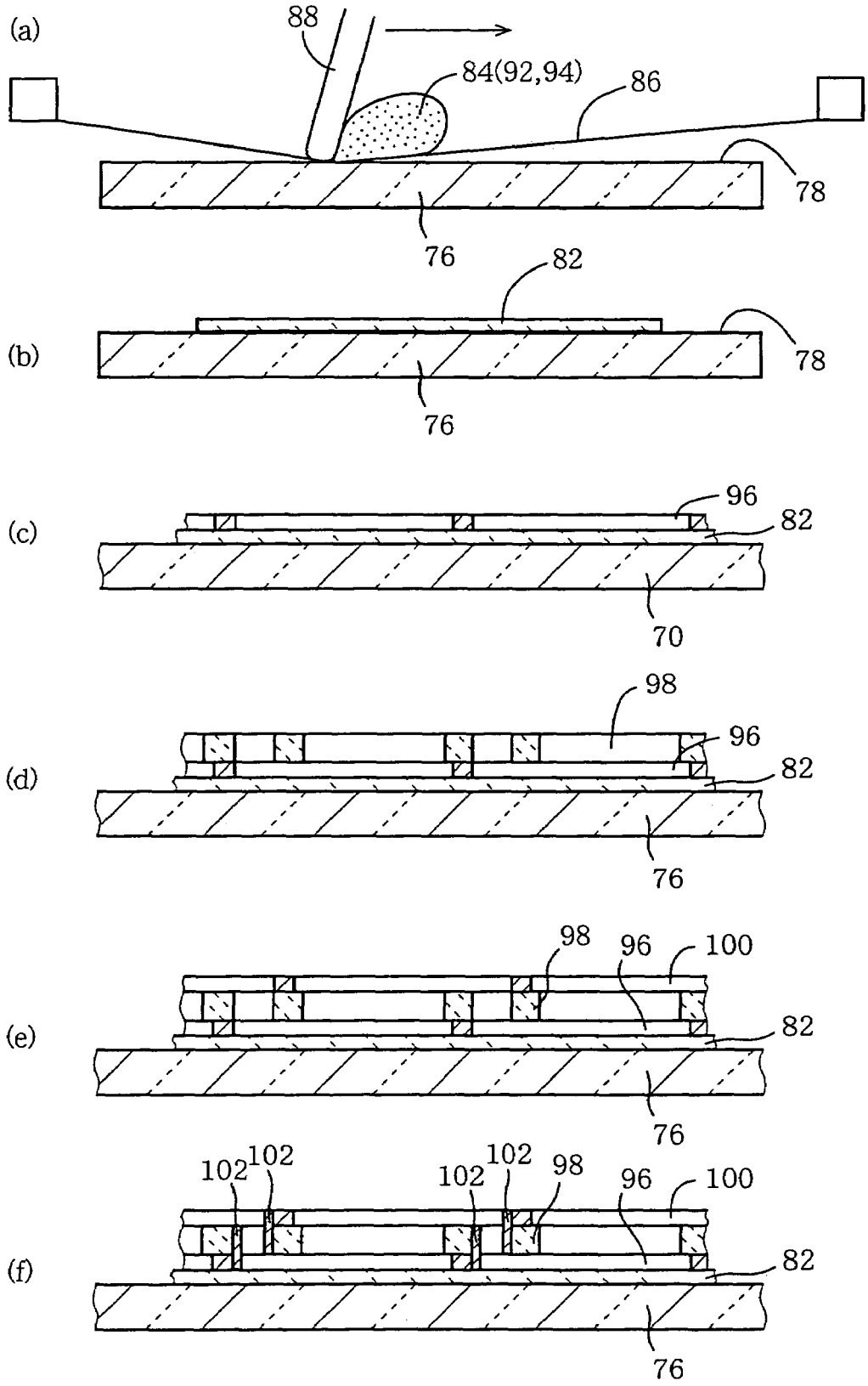
FIGS. 7(*a*) through 7(*f*) are views showing a substrate and one or more thick films, in respective essential steps out of the producing steps shown in FIG. 6.

Subsequently, in a peeling layer forming step 80, a peeling layer 82 that consists of particles having a high melting point and bound to each other with a resin, and has a thickness of, e.g., from about 5 (μm) to 50 (μm), is provided on the surface 78 of the substrate 76. The high melting point particles may be a mixture of a high softening point glass frit having an average particle size of from 0.5 (μm) to 3 (μm), and a ceramic filler, such as alumina or zirconia, having an average particle size of from 0.01 (μm) to 5 (μm). The high softening point glass may be a glass having a high softening point not lower than, e.g., about 550 (° C.), and the high melting point particles as the mixture may have a softening point not lower than, e.g., about 550 (° C.). The resin may be an ethyl cellulose resin that is burned out at, e.g., 350 (° C.). The peeling layer 82 is formed, as shown in FIG. 7(*a*), on the substrate 76 in such a manner that an inorganic material paste 84 in which the high melting point particles and the resin are dispersed in an organic solvent such as butyl carbitol acetate (BCA) is applied to substantially the entire surface of the substrate 76, by a screen printing method, and subsequently the applied paste 84 is dried at room temperature. However, the peeling layer 82 may be formed using a coater, or by adhesion of a film laminate. FIG. 7(*b*) shows a step in which the peeling layer 82 is thus formed on the substrate 76. In FIG. 7(*a*), numeral 86 designates a screen; and numeral 88 designates a squeegee. In the present embodiment, the substrate 76 and the peeling layer 82 formed thereon cooperate with each other to provide a support member; the surface of the peeling layer 82 provides a film formation surface on which films are formed; and the substrate preparing step 74 and the peeling layer forming step 80 cooperate with each other to provide a support member preparing step.

Subsequently, in a thick-film paste layer forming step 90, a thick-film conductive paste 92 for forming the X wiring layer 36, the Y wiring layer 40, the X electrodes 46, and the Y electrodes 48, and a thick-film dielectric paste 94 (see FIG. 7(*a*)) for forming the dielectric core layer 32 are sequentially applied, each in a predetermined pattern, on the peeling layer 82, and then dried, by utilizing, e.g., the screen printing method, like in the step 80 in which the inorganic material paste 84 is applied. Thus, a conductive printed layer 96 for forming the X wiring layer 36, a dielectric thick layer 98 for forming the dielectric core layer 32, a conductive printed layer 100 for forming the Y wiring layer 40, and a conductive printed layer 102 for forming the X and Y electrodes 46, 48 are formed in the order of description. The thick-film conductive paste 92 may be obtained by dispersing, in an organic solvent, a mixture of powder of conductive material such as powder of silver; a glass frit; and a resin. The thick-film dielectric paste 94 may be obtained by dispersing, in an organic solvent, a mixture of powder of dielectric material such as powder of alumina or zirconia; a glass frit; and a resin. Each glass frit is, e.g., a low softening point glass such as $PbO—B_2O_3—SiO_2—Al_2O_3—TiO_2$ glasses, and each resin and each organic solvent are, e.g., the same resin and organic solvent that are used to obtain the inorganic material paste 84.

For the purpose of forming the wiring layers 36, 40 and the dielectric core layer 32, those screens 86 are used which have respective slot patterns corresponding to the respective shapes of the wiring layers 36, 40 and the dielectric core layer 32, shown in FIGS. 1 and 3. The thick-film conductive paste 92 and the thick-film dielectric paste 94 are so applied as to have respective predetermined thickness values which assure that the three layers 36, 40, 32 have the above-described thickness values after being fired and shrunk. Meanwhile, for the purpose of forming the X electrodes 46 and the Y electrodes 48, those screens 86 are used which have slots that are slightly offset inward of the inner wall surfaces of the dielectric core layer 32, so that the thick-film conductive paste 92 flows down from the upper surface of the core layer 32 along the inner wall surfaces of the same 32. FIGS. 7(*c*) through 7(*f*) show respective steps in which the conductive printed layer 96, the dielectric thick layer 98, the conductive printed layer 100, and the conductive printed layer 102 are formed. Since the respective thickness values of the conductive printed layers 96, 100, 102 fall in the range of from about 5 (□m) to about 10 (□m), each of the layers 96, 100, 102 can be formed in a single printing operation.

However, since the dielectric printed layer 98 has the thickness of about 30 (□m), the layer 98 is formed by repeating, e.g., three printing and drying operations and thereby stacking three layers that have an appropriate thickness in total.

Figure 8:
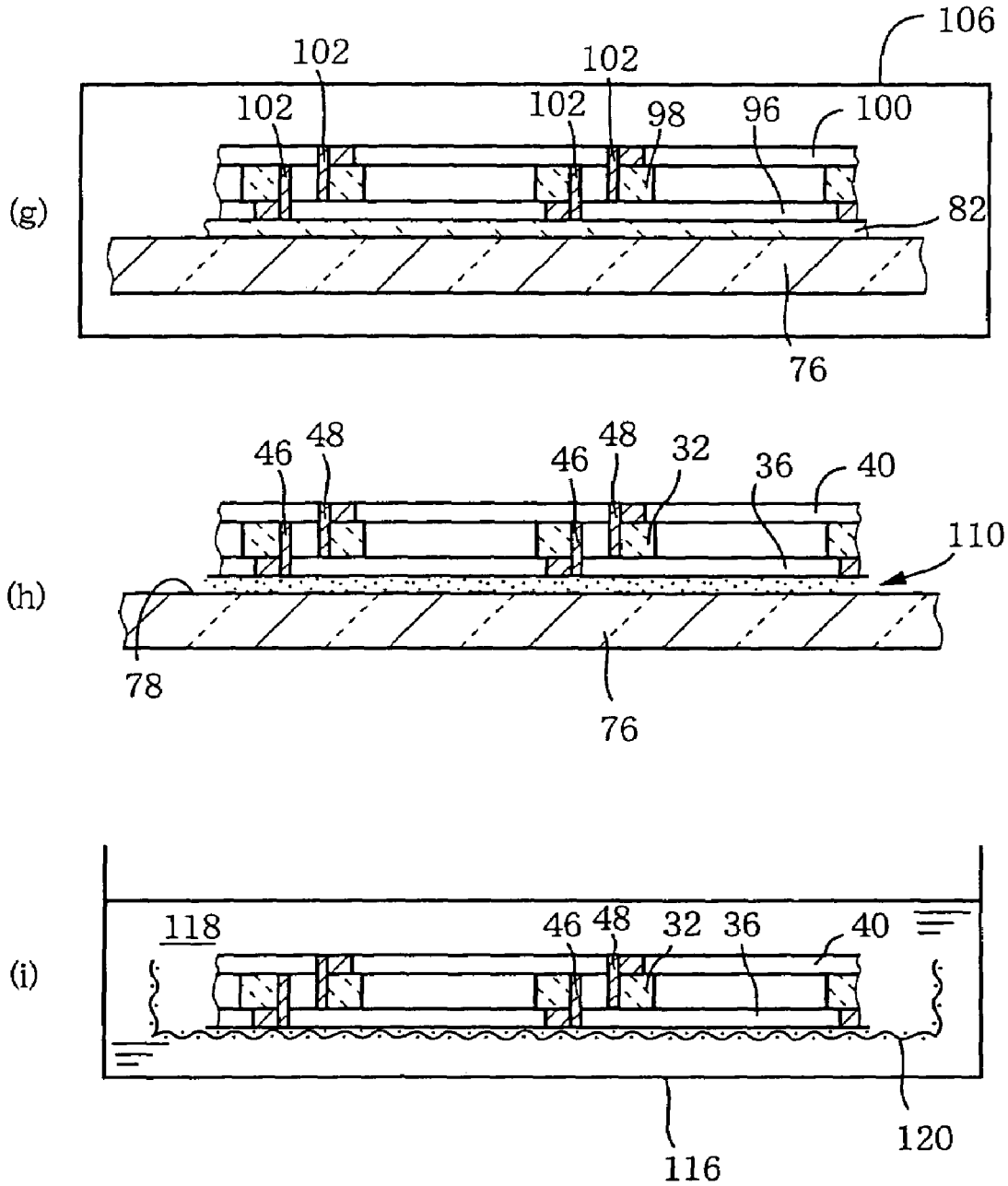
FIGS. 8(*g*) through 8(*i*) are views showing the substrate and the thick films in respective essential steps out of the producing steps shown in FIG. 6 that follow the step shown in FIG. 7(*f*).

After the thick-film printed layers 96, 98, 100, 102 are formed in this way and then dried to remove the solvents, a firing step 104 is carried out. In the firing step 104, the substrate 76 is put in a furnace 106 of an appropriate firing device, and is subjected to a heat treatment at a firing temperature, e.g., 550 (° C.), corresponding to each of the thick-film conductive paste 92 and the thick-film dielectric paste 94. FIG. 8(*g*) shows a state in which the heat treatment is carried out.

A sintering temperature of each of the thick-film printed layers 96, 98, 100, 102 is, e.g., about 550 (° C.). Therefore, during the heat treatment, the resins are removed, and the dielectric materials, the conductive materials, and the glass frit are sintered. Thus, the dielectric core 32 and the thick-film conductive layers (i.e., the X wiring layer 36 and the Y wiring layer 40), that is, a basic portion of the sheet member 20 is produced. FIG. 8(*h*) shows this state. As described above, the peeling layer 82 includes the inorganic material particles whose softening point is not lower than 550 (° C.). Therefore, the resin is removed by firing, but the high melting point particles (i.e., the glass powder and the ceramic filler) are not sintered. Thus, as the heat treatment processes, the resin is removed and accordingly the peeling layer 82 provides a particle layer 110 consisting of the high melting point particles 108 (see FIG. 9).

Figure 9:
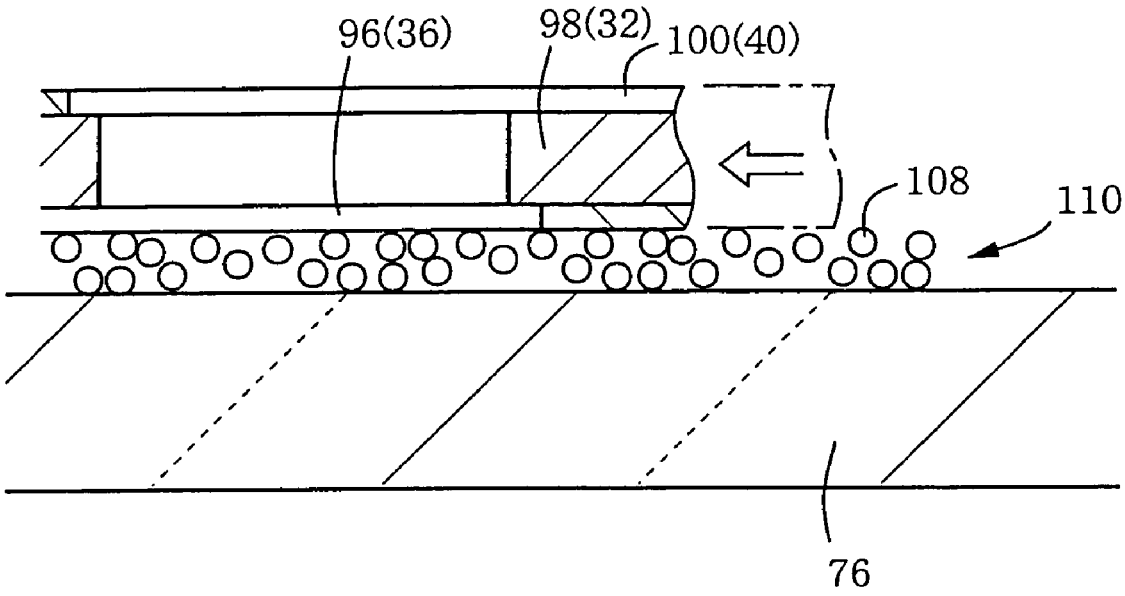
FIG. 9 is a view for explaining a manner in which the thick films are shrunk in a firing step shown in FIG. 6.

FIG. 9 is an enlarged, illustrative view corresponding to right-hand end portions of the thick-film printed layers 96 through 102, shown in FIG. 8(*h*), and showing how the sintering process advances in the heat treatment. The particle layer 110, produced by removing, by firing, the resin from the peeling layer 82, is a layer consisting of the high melting point particles 108 that just are gathered and are not bound to each other. Therefore, when the respective end portions of the thick-film printed layers 96 to 102 are shrunk from a position before firing, indicated at one-dot chain line in the figure, the high melting point particles 108 function as rollers. Thus, there are produced no forces that resist the shrinking of the printed layers 96 to 102, at an interface between a lower surface of the layers 96 to 102 and the substrate 76. Therefore, a lower portion of the layers 96 to 102 shrinks similarly to an upper portion of the same. Thus, the layers 96 to 102 are free of the difference of density and/or warpage resulting from the difference of amounts of shrinkage.

In the present embodiment, when the sintering of the thick-film printed layers 96 to 102 is started, the substrate 76 does not resist, owing to the presence of the particle layer 110, the sintering and shrinking of the layers 96 to 102. Thus, the thermal expansion of the substrate 76 does not substantially influence the quality of the thick films thus produced. However, in the case where the substrate 76 is repeatedly used or the heat treatment is carried out at a higher temperature, it is possible to use a heat-resisting glass having a still higher point (e.g., a borosilicate glass having a thermal expansion coefficient of about $32\times10^{-7}$ (/° C.) and a softening point of about 820 (° C.), or a quartz glass having a thermal expansion coefficient of about $5\times10^{-7}$ (/° C.) and a softening point of about 1580 (° C.)). In this case, too, the amount of thermal expansion of the substrate 76 is small in a temperature range in which the binding force of the dielectric material powder is small, and accordingly the thermal expansion does not influence the quality of the thick films produced.

Back to FIG. 6, in a peeling step 112, the thus produced thick films, i.e., the dielectric core layer 32 and the wiring layers 36, 40 that are integral with each other, are peeled from the substrate 76. Since the particle layer 110 interposed between the layers 32, 36, 40 and the substrate 76 consists of the high melting point particles 108 just being gathered, the peeling operation can be easily carried out without using any agents or tools. Although the high melting point particles 108 may be adhered, with a thickness corresponding to one layer of particles 108, to the layers 32, 36, 40, those particles 108 can be removed, as needed, using an adhesive tape or an air blower. The substrate 76 from which the thick films have been peeled can be used again and again for similar purposes, because the substrate 76 is not deformed or deteriorated at the above-described firing temperature.

Subsequently, in a dielectric paste applying step 114, the thus peeled layers 32, 36, 40 are dipped in a dielectric paste 118 accommodated in a dipping tank 116, so that the dielectric paste 118 is applied to the entire outer surfaces of the layers. The dielectric paste 118 may be obtained by dispersing, in a solvent such as water, a mixture of powder of a glass such as $PbO—B_2O_3—SiO_2—Al_2O_3—TiO_2$ glasses or a combination of two or more of those glasses, and a resin such as PVA. The dielectric paste 118 is so prepared as to have a viscosity lower than that of the thick-film dielectric paste 94. It is possible to use, as the above-indicated glass powder, one which does not contain lead and whose softening point is not lower than 630 (° C.). This softening point is equal to, or higher than, that of the glass powder contained in the thick-film dielectric paste 94. The reason why the paste 118 prepared to have a low viscosity is used is to prevent air bubbles from being mixed with the paste 118 when the paste 118 is applied, and thereby prevent the fired product from suffering defects. The layers 32, 36, 40 are slowly dipped in the dielectric paste 118, and then taken out from the same 118, while being supported on a wire net 120 such that the layers take a horizontal posture.

Subsequently, in a firing step 122, the layers 32, 36, 40 that have been taken out from the dipping tank 116 and then dried sufficiently, is put in a firing furnace, so that the layers are subjected to a heat treatment (i.e., a firing treatment) in which the layers are fired at a pre-determined temperature of, e.g., about 650 (° C.) that corresponds to the kind of the glass powder contained in the dielectric paste 118. This firing temperature is so pre-determined as to be sufficiently higher than the softening point of the glass powder, so that the glass powder may sufficiently soften and provide a compact dielectric layer (i.e., the dielectric cover layer 42). Therefore, the thus obtained dielectric cover layer 42 is free of porosity that would otherwise result from grain boundaries of the glass powder, and enjoys a high withstand voltage. In the present embodiment, the electric paste applying step 114 and the firing step 122 cooperate with each other to provide a covering step; and the dielectric cover layer 42 is formed in the covering step.

Then, in a protection film forming step 124, the protection film 44 is formed with a desired thickness on the substantially entire surface of the dielectric cover layer 42, e.g., by dipping and firing, or by a thick-film forming process such as sputtering. Thus, the sheet member 20 is obtained. Since the protection film 44 is thin as described above, it is considerably difficult to form the protection film 44 with a uniform thickness, by a thick-film forming process such as dipping. However, in the present embodiment, the respective distances between the pairs of X and Y electrodes 46, 48 are uniform, because each pair of electrodes produce an electric discharge while opposing each other. Therefore, irrespective of what shape the surface of the protection film 44 may have, local discharge hardly occurs. Thus, the protection film 44 is not required to be so uniform as a layer that is employed in the above-described surface discharge structure.

Thus, in the present embodiment, when the front and rear plates 16, 18 are superposed on, and fixed to, each other to obtain the PDP 10, the sheet member 20 including the X and Y wiring layers 36, 40, produced as described above, is fixed to the front or rear plate 16, 18, so that the X and Y electrodes 46, 48 are provided in the discharge spaces 24. Since the sheet member 20 includes the X and Y wiring layers 36, 40 as the thick-film conductive layers constituting the X and Y electrodes 46, 48, the X and Y electrodes 46, 48 can be provided by just placing the sheet member 20 between the front and rear plates 16, 18. Thus, the PDP 10 is advantageously freed of the problem with the case where discharge electrodes are formed, by using a heat treatment, on the front and rear plates 16, 18, i.e., the problem that the front and rear plates 16, 18 and the electrodes 46, 48 are distorted because of the heat treatment.

In addition, in the present embodiment, on the film formation surface defined by the peeling layer 82 having the higher melting point than the sintering temperature of the thick-film conductive paste 92 and the thick-film dielectric paste 94, the dielectric printed layer 98 and the conductive printed layers 96, 100 are formed in respective predetermined patterns and, subsequently, are subjected to the heat treatment at the sintering temperature, so as to obtain the sheet member 20 including the dielectric core layer 32 and the thick-film conductive layers that are formed on the opposite surfaces of the core layer 32, respectively, and constitute the X and Y wiring layers 36, 40, respectively. Although the peeling layer 82 is not sintered at the heat treatment temperature, the resin of the layer 82 is removed by firing, and accordingly the particle layer 110 consisting of only the high melting point particles 108 is obtained. Since, therefore, the thus produced thick films are not fixed to the substrate 76, those thick films can be easily peeled from the surface 78 of the substrate 76. Thus, the sheet member 20 constituting the discharge electrodes 46, 48 can be easily produced and can be easily used to produce the PDP 10.

In addition, in the present embodiment, the support member to which the thick-film pastes 92, 94 are applied is constituted by the substrate 76 and the peeling film 82 formed on the surface 78 of the substrate 76. Therefore, even after the heat treatment, the support member can maintain its shape. Thus, the sheet member 20 can be more easily dealt with after being produced, than in the case where the support member would be constituted by the peeling layer 82 only. Since the peeling layer 82 is located between the thick-film printed layers 96 to 102 and the substrate 76, the substrate 76 does not bind those layers 96 to 102 when the layers are subjected to the heat treatment. Therefore, the substrate 76 does not have any limitations with respect to degree of flatness and/or degree of surface roughness. For example, in the case where the surface 78 of the substrate 76 is warped, the thick-film printed layers 96 to 102 are also warped following the warped surface 78. Since, however, the sheet member 20 has a sufficiently high degree of softness even after being fired, the sheet member 20 can follow, when being placed on a flat surface, that flat surface and become flat.

In addition, in the present embodiment, the thick-film layers 96 to 102 are formed by the thick-film printing method. Therefore, the PDP 10 can be produced using the simple equipment and without wasting the materials. Thus, the PDP 10 can be produced at low cost.

In addition, in the present embodiment, the thick-film screen printing method is used to form the films and accordingly a so-called wet process is not used. Thus, no waste water treatments are needed. The wet processes have the problem that if a solution permeates the films and remains in the same, it may cause the generation of outgas from the vacuum container obtained by adhering the front and rear plates 16, 18 to each other. To avoid this problem, materials having a higher heat resisting temperature are used and, after the container is gas-tightly sealed, the gas is discharged at a higher temperature or in a longer time period. Those measures, however, lead to increasing the load of the process.

The above-described embodiment relates to the case where the first and second inventions are applied to the full-color AC-type PDP 10 and the method of producing the same 10, respectively. However, the first and second inventions may be applied to a monochrome AC-type PDP and a method of producing the same, respectively, or a DC-type PDP in which discharge electrodes are exposed, and a method of producing the same, respectively.

The full-color AC-type PDP 10 as the first embodiment employs the fluorescent layers 26, 30 that correspond to the three colors, and displays a full-color image. However, likewise, the first and second embodiments may be applied to such PDPs that employ fluorescent layers corresponding one color or two colors.

The thickness value of the sheet member 20 and the respective thickness values of the dielectric core layer 32 and the wiring layers 36, 40 that cooperate with each other to constitute the same 20 are selected depending upon respective mechanical strengths needed to deal with the same 20, and the respective thickness values of the wiring layers 36, 40 are selected depending upon respective electrical conductivities needed to function as electrical conductors. Therefore, those thickness values are not limited to the values exemplified in the description of the embodiment, and may be appropriately determined depending upon the size and structure of the gas-discharge display apparatus.

In addition, in the first embodiment, the wiring layers 36, 40 of the sheet member 20 are completely covered with the dielectric cover layer 42. However, the wiring layers 36, 40 may be partly exposed so long as the exposure does not influence the discharges of the electrodes or the atmosphere in the gas-tight container.

In addition, in the first embodiment, the sheet member 20 includes the dielectric core layer 32 and the wiring layers 36, 40 that are formed by using the thick-film screen printing method. However, a coater or a film laminate may be used to form uniformly thick-film paste layers on the film formation surface, and a photo process may be used to process those layers to have respective predetermined patterns.

In addition, in the first embodiment, the support member used to produce the sheet member 20 is constituted by the substrate 76 and the peeling layer 78 formed on the substrate 76. However, a ceramic green sheet (i.e., an unsintered sheet of ceramic) may be used as the support member. In the latter case, the composition of the green sheet is determined such that at the firing temperature in the firing step 104, the ceramic green sheet cannot be sintered but the resin contained therein can be fully removed by firing.

In addition, the PDP 10 employs the opposing discharge structure in which the discharges are produced between the X and Y electrodes 46, 48 partly covering the inner wall surfaces of the sheet member 20. However, it is possible to employ the surface discharge structure in which no electrodes cover the inner wall surfaces of the sheet member.

In addition, in the first embodiment, the partition walls 22 are provided in the stripe pattern. However, a grid-like partition wall may be used to separate the discharge spaces from each other, so long as there are no problems with the discharging and charging of gases after the sealing.

In addition, since the gas-tight space is divided into the light emission cells by the grid-like sheet member 20, the partition walls 22 may be omitted.

In addition, in the first embodiment, the front and rear plates 16, 18 are each formed of the transparent glass plate, so that the light emissions can be observed through each of the two plates 16, 18. However, one of the two plates 16, 18 may be formed of a translucent material, so that only the light transmitted through the other plate can be observed.

In addition, in the first embodiment, the fluorescent layers 26, 30 are provided on the inner surfaces 12, 14, respectively. However, it is possible to provide fluorescent layers on only one of the two surfaces 12, 14.

SECOND EMBODIMENT

Figure 10:
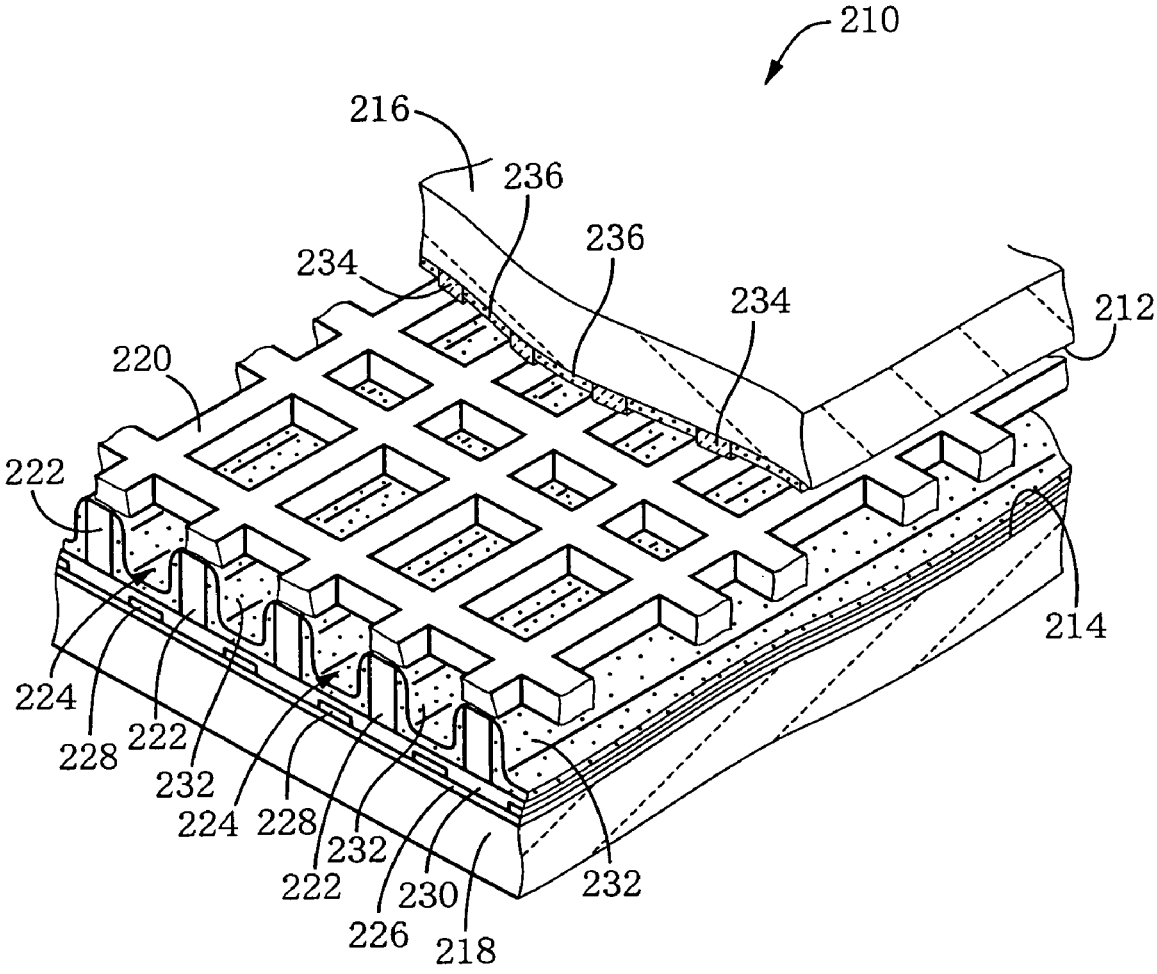
FIG. 10 is a perspective view of a color PDP as a three-electrode-structure AC-type gas-discharge display apparatus according to the present invention, with a portion of the PDP being cut away.

FIG. 10 is a perspective view for explaining a construction of an AC-type color PDP (hereafter, simply referred to as the PDP) 210 as an example of a gas-discharge display apparatus according to the third invention, such that a portion of the PDP 210 is cut away. In the figure, the PDP 210 includes a front plate 216 and a rear plate 218 which are provided such that the front and rear plates 216, 218 extend parallel to each other and are distant from each other by a pre-determined distance, so that respective one inner surfaces 212, 214 of the front and rear plates 216, 218 which surfaces are substantially flat, oppose each other. A sheet member 220 having a grid pattern is provided between the front and rear plates 216, 218, and peripheral portions of the front and rear plates 216, 218 are gas-tightly sealed. Thus, a gas-tight space is defined in the PDP 210. Each of the front and rear plates 216, 218 has a size of about 900 (mm)× about 500 (mm) and a uniform thickness of from about 1.1 (mm) to about 3 (mm), and those plates 216, 218 are formed of, e.g., respective soda lime glasses which are similar to each other and each of which is transparent and has a softening point of about 700 (° C.). In the present embodiment, the front plate 216 provides a first substrate; and the rear plate 218 provides a second substrate.

On the rear plate 218, there are provided a plurality of elongate partition walls 222 which extend parallel to each other in one direction and whose centerlines are distant from each other at a regular interval of from about 200 (μm) to about 500 (μm). Thus, the gas-tight space defined between the front and rear plates 216, 218 is divided into a plurality of discharge spaces 224. The partition walls 222 are each formed of a thick-film material which contains, as a main component thereof, a low softening point glass, such as $PbO—B_2O_3—SiO_2—Al_2O_3—ZnO—TiO_2$ glasses or a combination of two or more of these glasses, and has a width of from about 80 (μm) to about 200 (μm) and a height of from about 30 (μm) to about 100 (μm). An inorganic filler such as alumina and/or other inorganic pigments are added, as needed, to the partition walls 222, so as to adjust a degree of compactness, a degree of strength, and/or a shape keeping ability of the partition walls 222. The sheet member 220 includes a plurality of elongate grid bars which extend in one direction and are placed on respective top ends of the partition walls 222.

On the rear plate 218, there is provided an undercoat 226 which covers a substantially entire surface of the inner surface 214 of the same 218 and is formed of a low-alkali glass or a no-alkali glass. On the undercoat 226, there are provided a plurality of writing electrodes 228 which extend in a lengthwise direction of the partition walls 222 and each of which is formed of a silver thick film. The writing electrodes 228 are covered with an overcoat 230 which is formed of a mixture of a low softening point glass and an inorganic filler such as a white-color titanium oxide. The above-described partition walls 222 are formed on the overcoat 230.

On the surface of the overcoat 230 and on respective side surfaces of the partition walls 222, there are provided a plurality of fluorescent layers 232 which are distinguished from each other so as to correspond to the plurality of discharge spaces 224, respectively. A thickness of each of the fluorescent layers 232 is pre-determined to fall in the range of, e.g., from about 10 (μm) to about 20 (μm), depending upon its fluorescent color. The fluorescent layers 232 are grouped into three groups of layers 232 that emit, by ultraviolet-light excitation, three fluorescent colors, e.g., red color (R), green color (G), and blue color (B), respectively. The fluorescent layers 232 are arranged such that each one of the layers 232, and two layers 232 located on either side of the each layer 232 emit the three, different fluorescent colors, respectively, in the corresponding three discharge spaces 224, respectively. The undercoat 226 and the overcoat 228 are provided for the purpose of preventing the reaction between the silver-thick-film-based writing electrodes 228 and the rear plate 218, and preventing the contamination of the fluorescent layers 232.

Meanwhile, on the inner surface 212 of the front plate 216, there are provided a plurality of partition walls 234 at respective positions where the partition walls 234 oppose the partition walls 222, respectively. Thus, the partition walls 234 have a stripe pattern. The partition walls 234 are each formed of, e.g., the same material as used to form each of the partition walls 222, and each have a thickness of, e.g., from about 20 (μm) to about 50 (μm). Between each pair of partition walls 234 that are adjacent each other on the inner surface 212 of the front plate 216, there is provided a fluorescent layer 236 having a thickness falling in the range of, e.g., from about 10 (μm) to about 20 (μm). Thus, a plurality of fluorescent layers 236 are provided in a stripe pattern on the inner surface 212. The fluorescent layers 236 are arranged such that each of the layers 236 emits, in a corresponding one of the discharge spaces 224, the same fluorescent color as the fluorescent color emitted in the one discharge space 224 by a corresponding one of the fluorescent layers 232 provided on the rear plate 218. The partition walls 234 have a height greater than the thickness of the fluorescent layers 236, for the purpose of preventing the sheet member 220 from contacting the fluorescent layers 236.

Figure 11:
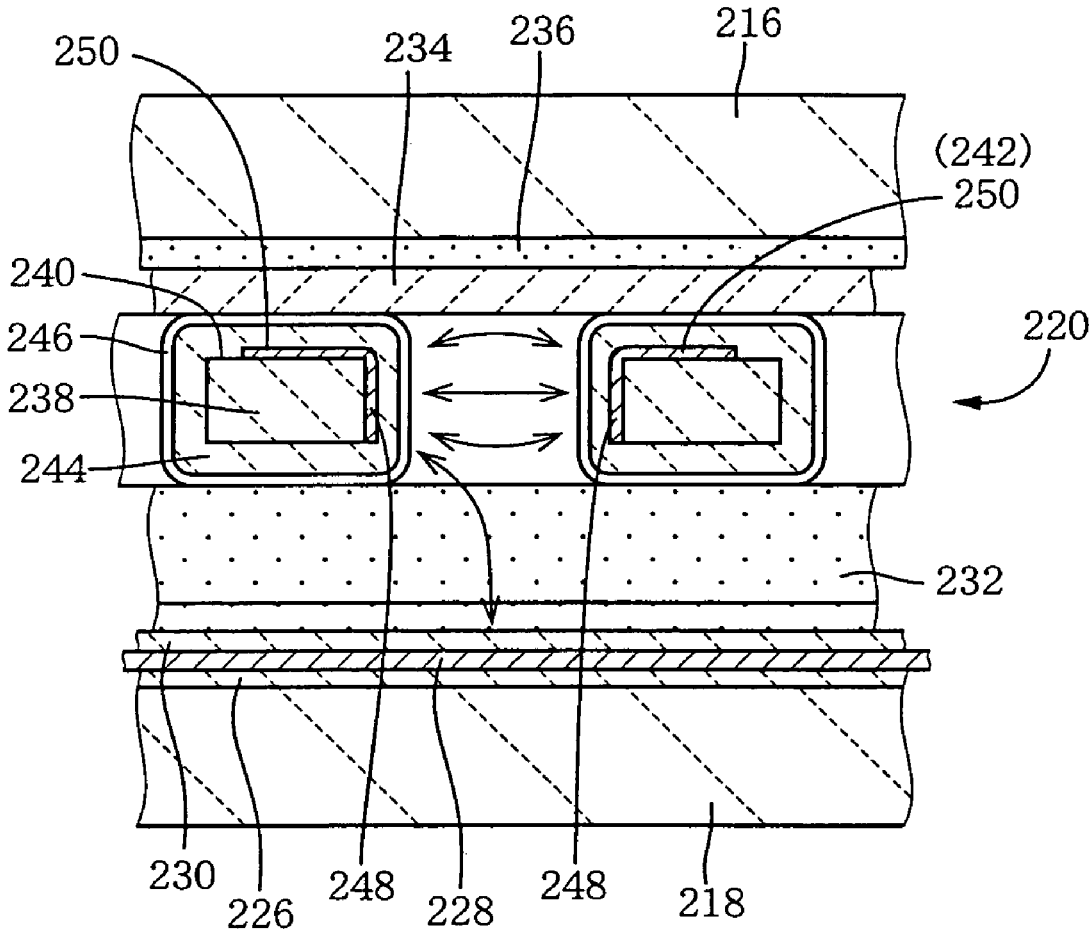
FIG. 11 is a cross-section view for explaining a construction of the PDP of FIG. 10, taken in a lengthwise direction of partition walls thereof.

FIG. 11 is a cross-section view, taken in a lengthwise direction of the partition walls 222 and along a widthwise centerline of one of the writing electrodes 228, for explaining a construction of the PDP 210. The sheet member 220 includes a dielectric core layer 238 which has a grid pattern (see FIG. 10) constituting a skeleton of the grid pattern of the sheet member 220; a sustaining wiring layer 242 which is placed on, and fixed to, an area continuing from one surface 240 (i.e., an upper surface, shown in the figure) of the core layer 238 to respective one side surfaces of the core layer 238 (i.e., respective one inner wall surfaces of the grid pattern thereof); a dielectric cover layer 244 which covers the dielectric core layer 238 and the sustaining wiring layer 242; and a protection film 246 which covers the dielectric cover layer 244 and provides a surface layer of the sheet member 220. In the present embodiment, the sustaining wiring layer 242 provide a conductive layer.

The dielectric core layer 238 has a thickness of from about 30 (μm) to about 50 (μm), for example, a thickness of 40 (μm), and respective grid bars of the core layer 238 that extend in lengthwise and width directions thereof and cooperate with each other to constitute the grid pattern thereof, have a width which is substantially equal to the width of the partition walls 222 or somewhat greater than the width of the same 222 in consideration of alignment margins, for example, a width of from about 100 (μm) to about 150 (μm). The dielectric core layer 238 is formed of a dielectric thick-film material which contains a low softening point glass, such as $PbO—B_2O_3—SiO_2—Al_2O_3—ZnO—TiO_2$ glasses or a combination of two or more of these glasses, and additionally contains a ceramic filler such as alumina.

The sustaining wiring layer 242 is formed of an electrically conductive thick film which contains, as an electrically conductive component thereof, silver (Ag), nickel (Ni), aluminum (Al), copper (Cu), or carbon (C), and have a thickness of from about 5 (μm) to about 10 (μm). The sustaining wiring layer 242 includes a plurality of portions 248 which cover respective one side surfaces of the grid bars of the dielectric core layer 238. Those portions 248 function as sustaining electrodes which produce respective gas discharges in the respective discharge spaces 224. As shown in the figure, each pair of sustaining electrodes 248 are located, on the inner wall surfaces of the grid pattern of the sheet member 220, at respective positions where the two sustaining electrodes 248 extend parallel to each other and oppose each other. Thus, the PDP 210 has an opposing discharge structure in which a discharge is produced between two sustaining electrodes 248 opposing each other in each discharge space 224. Thus, each pair of sustaining electrodes 248 are provided in each of the discharge spaces 224. One electrode 248 out of each pair of sustaining electrodes 248 additionally functions as a scanning electrode which cooperates with a corresponding one of the writing electrodes 228 to produce a writing discharge so as to operate a light emission unit (i.e., cell), as will be described later; and the other electrode 248 functions as a sustaining electrode only.

The dielectric cover layer 244 has a thickness falling in the range of, e.g., from about 10 (μm) to about 30 (μm), for example, a thickness of about 20 (μm), and is formed of a thick film which contains a glass having a low softening point, such as $PbO—B_2O_3—SiO_2—Al_2O_3—ZnO—TiO_2$ glasses or a combination of two or more of these glasses. The dielectric cover layer 244 is employed mainly for the purpose of storing electric charges on an outer surface thereof and thereby causing each pair of sustaining electrodes 248 to produce an alternate-current discharge. In addition, since the cover layer 244 prevents exposure of the thick-film-based sustaining electrodes 248, and thereby restrains the generation of outgas from those electrodes 248 and the change of atmosphere in each discharge space 224.

The protection film 246 has a thickness of, e.g., about 0.5 (μm), and is formed of a thin or thick film which contains, e.g., MgO as a main component thereof. The protection film 246 is employed for the purpose of preventing discharge-gas ions from causing sputtering of the dielectric cover layer 244. Since, however, the protection film 246 is formed of a dielectric material having a high secondary electron emission factor, the protection film 246 substantially functions as the discharge electrodes.

Figure 12:
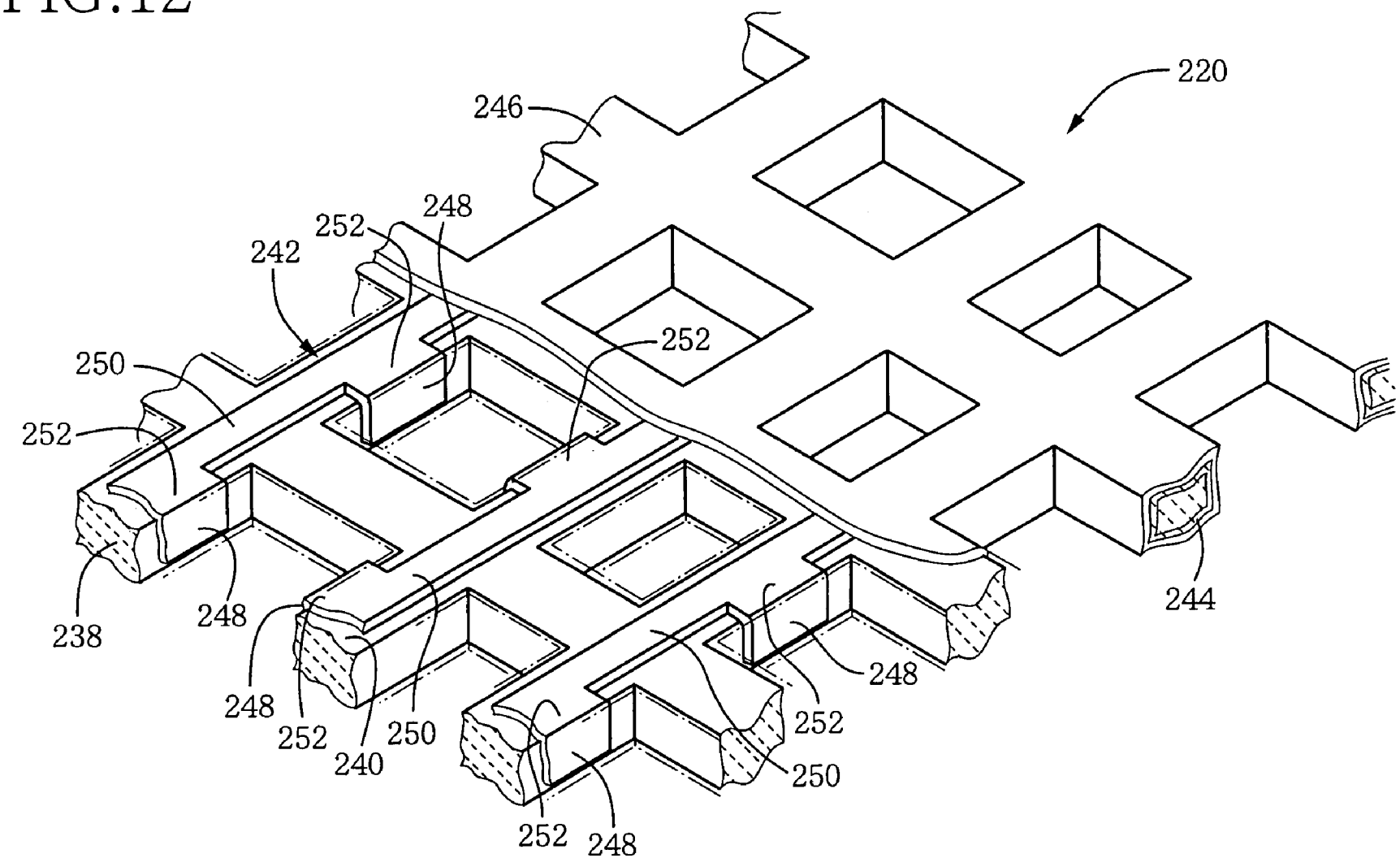
FIG. 12 is a view for explaining a construction of a sheet member of the PDP of FIG. 10.

FIG. 12 is a view for explaining in detail a construction of the sustaining wiring layer 242, with a portion of the sheet member 220 being cut away. In the figure, the sustaining wiring layer 242 includes a plurality of wiring portions 250 which extend in one direction of the grid pattern constituting the sheet member 220. A lengthwise direction of the wiring portions 250 is perpendicular to the lengthwise direction of the partition walls 222, i.e., a lengthwise direction of the writing electrodes 228. Each of the wiring portions 250 has a pre-determined width of from about 50 (μm) to about 80 (μm), and is located on a widthwise middle portion of a corresponding one of the grid bars of the dielectric core layer 238.

Each of the wiring portions 250 includes a plurality of projecting portions 252 which laterally project from a plurality of locations, respectively, that are distant from each other in the lengthwise direction of the each wring portion 250. Thus, each of the projecting portions 252 projects in a direction substantially perpendicular to the lengthwise direction of the each wiring portion 250. Each of the sustaining electrodes 248 is continuous with an end of the projecting portion 252, and extends from the end in a direction perpendicular to the same 252. A width of each sustaining electrode 248 (i.e., a dimension in the lengthwise direction of each wiring portion 250) is, e.g., about 100 (μm); and a height of each sustaining electrode 248 is substantially equal to the thickness of the sheet member 220, i.e., falls in the range of from about 30 (μm) to about 50 (μm), e.g., about 40 (μm).

Figure 13:
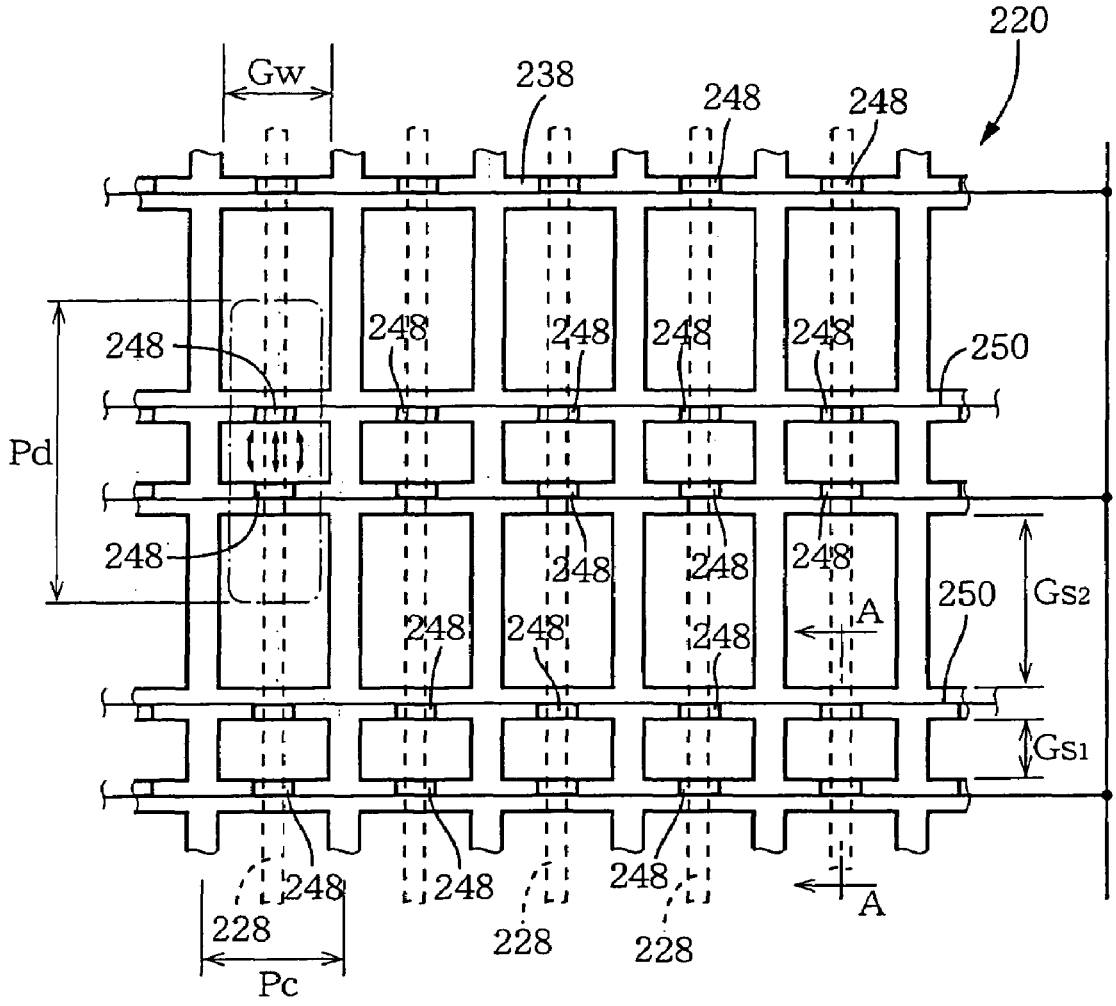
FIG. 13 is a view for explaining a manner in which a wiring layer is formed in the sheet member shown in FIG. 12.

FIG. 13 is a schematic view for explaining a manner in which the plurality of wiring portions 250 of the sustaining wiring layer 242 are connected, and a positional relationship between the wiring portions 250 and the writing electrodes 228. The plurality of wiring portions 250 that extend in a horizontal direction in the figure correspond, one to one, to a plurality of horizontal grid bars of the dielectric core layer 238 that extend in the horizontal direction in the figure. Thus, a plurality of sustaining electrodes 248 that are arranged in each array in the horizontal direction in the figure are connected to a common wiring portion 250. The wiring portions 250 include a first group of wiring portions 250 each of which is independent of all the other wiring portions 250, and a second group of wiring portions 250 all of which are connected to each other, and the wiring portions 250 of the first group and the wiring portions 250 of the second group are alternately arranged in a vertical direction in the figure.

As shown in the figure, the intervals of distance between the grid bars of the sheet member 220 are not uniform. More specifically described, the grid bars of the sheet member 220 that extend in a direction perpendicular to the wiring portions 250 of the sustaining wiring layer 242 are arranged at a regular interval, Gw, of, e.g., about 200 (μm), but the grid bars of the sheet member 220 that extend along the wiring portions 250 of the sustaining wiring layer 242 are arranged such that a relatively small interval, Gs1, of, e.g., about 100 (μm) and a relatively large interval, Gs2, of, e.g., about 600 (μm) are alternate with each other. The sustaining electrodes 248, 248 of each pair oppose each other at the relatively small interval Gs1. As indicated in a left-hand middle portion of FIG. 13, each pair of sustaining electrodes 248, 248 function as a pair of discharge electrodes whose discharge gap is substantially equal to the small interval Gs1, i.e., about 100 (μm). As is apparent from the comparison of FIG. 13 with FIG. 10, the grid bars of the sheet member 220 that extend in the direction perpendicular to the wiring portions 250 are placed on the partition walls 222, respectively. FIG. 11 is a cross-section view taken along A—A in FIG. 13.

When an alternate-current pulse is applied to the first group of wiring portions 250 each of which is independent of the other wiring portions 250 and to which a first group of sustaining electrodes 248 are connected, so as to scan sequentially the same 250, and concurrently an alternate-current pulse is applied to desired ones of the writing electrodes 228 that correspond to data (i.e., the writing electrodes corresponding to the light emission units each selected to emit light), in synchronism with the timing of scanning of the first group of wiring portions 250 with the first pulse, so that the desired writing electrodes 228 and the corresponding sustaining electrodes 248 of the first group cooperate with each other to produce respective writing discharges. Thus, electric charges are accumulated on respective portions of the protection films 246 that are located above those sustaining electrodes 248. After the scanning of all the sustaining electrodes 248 functioning as the scanning electrodes is ended in this way, an alternate-current pulse is applied to all pairs of sustaining electrodes 248 via the wiring portions 250, so that the thus applied voltage is added to the electric potential caused by the electric charges accumulated in each of the light emission units corresponding to the above-indicated sustaining electrodes 248 of the first group, so as to exceed a discharge starting voltage. Thus, those sustaining electrodes 248 of the first group and the corresponding sustaining electrodes of the second group cooperate with each other to produce respective discharges, and these discharges are sustained for a pre-determined time by the wall electric charges newly produced on the protection film 246. Consequently the fluorescent layers 232, 236 corresponding to the selected light emission units are excited by ultraviolet lights produced by the gas discharges, and accordingly generate visible lights, so that those lights are outputted through the front plate 216 and thus a desired image is displayed. Each time one-time scanning of the scanning electrodes (i.e., the sustaining electrodes 248) is completed, desired ones of the data electrodes (i.e., the writing electrodes 228), to which the pulse is to be applied, are re-selected, so that desired images are continuously displayed. As is apparent from the above explanation, the first group of sustaining electrodes 248 corresponding to the independent wiring portions function as the scanning electrodes which cooperate with the writing electrodes 228, and additionally function as sustaining electrodes (i.e., image-display discharge electrodes) which cooperate with the second group of sustaining electrodes 248.

As shown in FIG. 13, each discharge is produced between each pair of electrodes 248, 248 that are distant from each other by the small distance Gs1, e.g., about 100 (μm). However, each discharge space 224 is continuous in the vertical direction in the figure. Therefore, the ultraviolet light produced by the discharge is spread, as schematically indicated at one-dot chain line in FIG. 13, outward of the discharge electrodes 248, 248, in a lengthwise direction of the each discharge space 224. Thus, respective portions of the fluorescent layers 232, 236 that are located, in the each discharge space 224, within the range bounded by the one-dot chain line are excited by the ultraviolet light generated by the discharge produced by the electrodes 248, 248, indicated in the left-hand middle portion of the figure, and accordingly emit light.

Therefore, the light emission units (i.e., cells) of the PDP 210 are defined by the partition walls 222 with respect to the direction perpendicular to the same 222, i.e., the horizontal direction in the figure, and are substantially defined by the range to which the ultraviolet light is spread, with respect to the lengthwise direction of the partition walls 222, i.e., the vertical direction in the figure. Thus, an interval of distance between respective centerlines of the light emission cells in the horizontal direction in the figure is a color cell pitch, Pc, of about 0.3 (mm); and an interval of distance between respective centerlines of the light emission cells in the vertical direction in the figure is a dot pitch, Pd, of about 0.9 (mm). In the present color PDP 210 in which the three colors R, G, B are used, three light emission units that are adjacent each other in the horizontal direction in the figure cooperate with each other to define one pixel. Therefore, a pitch of the pixels of the PDP 210 is about 0.9 (mm) with respect to each of the horizontal and vertical directions in the figure.

Thus, in the present embodiment, the sheet member 220 having the grid pattern includes the sustaining wiring layer 242 provided on the one surface 240 of the grid pattern, and the respective portions of the sustaining wiring layer 242 that are fixed to the mutually opposing, inner wall surfaces of the grid bars of the sheet member 220 provide the pairs of sustaining electrodes 248, 248. That is, the PDP 210 has the opposing discharge structure in which each pair of discharge surfaces oppose each other. Therefore, as compared with the conventional three-electrode structure in which sustaining electrodes are provided on one plane, the PDP 210 enjoys a higher efficiency. In addition, the PDP 210 is free of the problem that the dielectric cover layer 244 and the protection film 246 are locally deteriorated because of local strengthening of discharge, and accordingly enjoys a longer life expectancy. Moreover, since the PDP 210 has the opposing discharge structure, occurrence of a cross-talk resulting from a gap produced between the partition walls 222 and the front plate 216 can be prevented even if the top ends of the partition walls 222 and/or the front plate 216 may have unevenness.

In addition, the respective discharge surfaces of the sustaining electrodes 248, 248 are located at an intermediate height position that is distant from each of the front and rear plates 216, 218, and the discharge direction in which the discharge electrodes produce the discharges is parallel to each of the respective inner surfaces 212, 214 of the front and rear plates 216, 218. Therefore, the inner surfaces 212, 214 of the two plates 216, 218 are less influenced by the discharge-gas ions, and accordingly the fluorescent layers 232, 236 can be provided in respective wider areas on the inner surfaces 212, 214. Thus, as compared with a surface discharge structure in which fluorescent layers 232 can be provided on only a substrate opposing a substrate to which sustaining electrodes are fixed, the PDP 210 can enjoy a highly increased degree of brightness.

In addition, since the sustaining electrodes 248 are not provided on the front plate 216, a phenomenon that the electrodes 248 each formed of a silver thick film may turn yellow is not observed. Therefore, it is not needed to use, as a component of the material of the sustaining electrodes 248, an expensive black-color conductive material such as ruthenium oxide.

Figure 14:
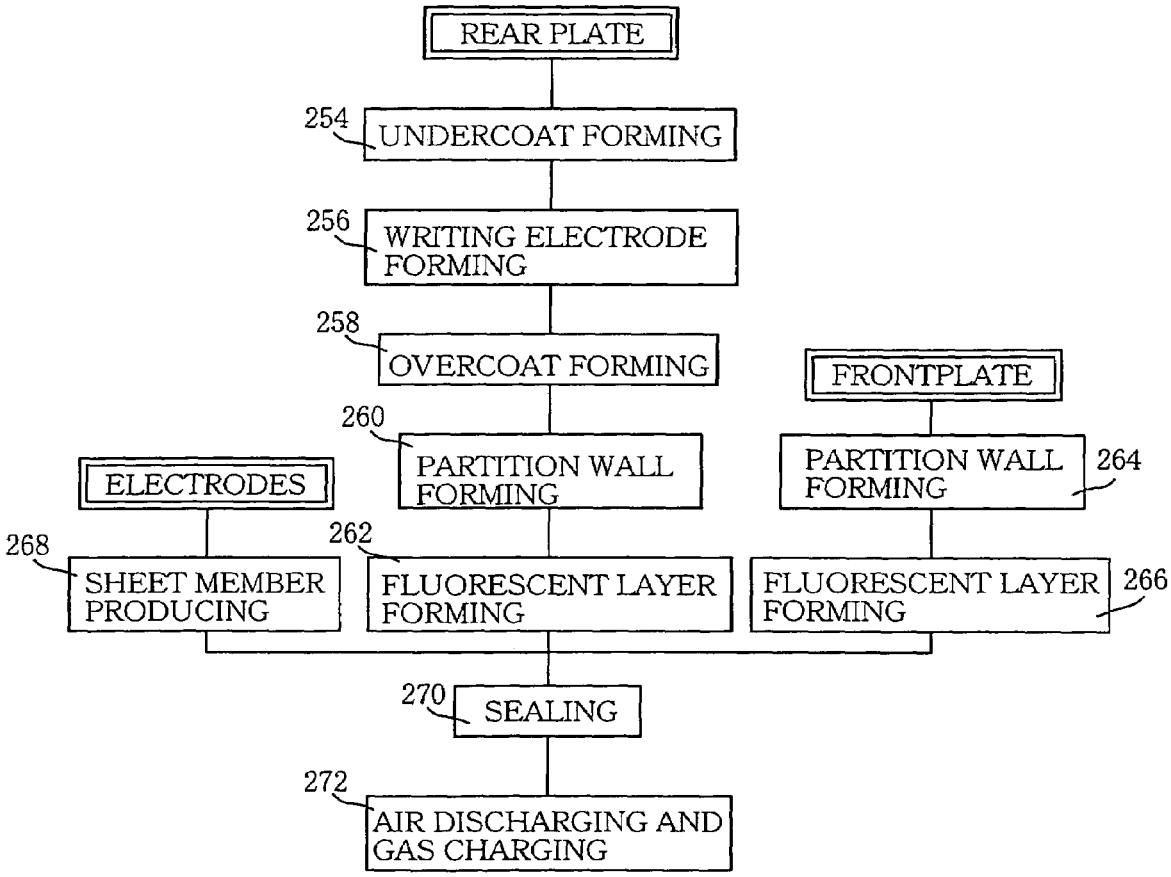
FIG. 14 is a flow chart for explaining a method of producing the PDP of FIG. 10.

Meanwhile, the PDP 210 constructed as described above can be produced, in the method according to the fourth invention, by assembling the sheet member 220, the front plate 216, and the rear plate 218 that are processed (or produced) independent of each other according to the flow chart shown in FIG. 14.

The rear plate 218 is processed as follows: First, in an undercoat forming step 254, a thick-film insulating paste is applied to the flat inner surface 214 of the rear plate 218 prepared, and then the applied paste is fired to form the previously-described undercoat 226. Subsequently, in a writing electrode forming step 256, the previously-described writing electrodes 228 are formed, using a thick-film conductive paste such as a thick-film silver paste and using, e.g., a thick-film screen printing method or a lithograph method, on the undercoat 226. Then, in an overcoat forming step 258, a thick-film insulating paste including a low softening point glass and an inorganic filler is repeatedly applied to cover a substantially entire surface of the undercoat 226 on which the writing electrodes 228 have been formed, and then the applied paste is fired to form the overcoat 230.

Next, in a partition wall forming step 260, a thick-film insulating paste containing, as main components thereof, a low softening point glass and an inorganic filler, is printed and dried, and then the paste is fired at a temperature of, e.g., from about 500 (° C.) to about 650 (° C.) so as to obtain the partition walls 222. In the case where a desired height of the partition walls 222 cannot be obtained by one-time printing of the paste, the printing and the drying are repeated, as needed. This is true with each of the above-described undercoat forming step 254 and the overcoat forming step 258. Subsequently, in a fluorescent layer forming step 262, a thick-film screen printing method or a pouring method is used to apply each of three kinds of fluorescent pastes corresponding to the three colors R, G, B, to a corresponding one of the respective spaces between the partition walls 222 and then fire the applied pastes at a temperature of, e.g., about 450 (° C.) so as to obtain the fluorescent layers 232.

The front plate 216 is processed as follows: First, in a partition wall forming step 264 like the above-described step 260, a thick-film forming technique such as the thick-film screen printing method is used to print repeatedly a thick-film insulating paste containing, as main components thereof, a low softening point glass and an inorganic filler, to the inner surface 212 of the front plate 216 and dry the printed paste. Subsequently, the printed paste is fired at a heat treatment temperature that falls in the range of, e.g., from about 500 (° C.) to about 650 (° C.), depending upon the kind of the paste used. Thus, the previously-described partition walls 234 are obtained. Subsequently, in a fluorescent layer forming step 266, a technique such as a thick-film screen printing method or a pouring printing is used to apply, from above the partition walls 234, each of three kinds of fluorescent pastes corresponding to the three colors R, G, B, to a corresponding one of the respective spaces between the partition walls 234 and then fire the applied pastes at a temperature of, e.g., about 450 (° C.) so as to obtain the fluorescent layers 236.

The sheet member 220 is produced in a sheet member producing step 268. The front and rear plates 216, 218 are superposed on each other via the sheet member 220, and are subjected, in a sealing step 270, to a heat treatment so that the two plates 216, 218 and the sheet member 220 are gas-tightly sealed with a sealing material, such as a sealing glass, that is applied in advance on respective interfaces of the same 216, 218, 220. Before this sealing step, the sheet member 220 may be fixed, as needed, to either one of the front and rear plates 216, 218, using a glass frit. Finally, in an air discharging and gas charging step 272, air is discharged from the thus obtained, gas-tight container, and an appropriate discharge gas is charged into the same so as to obtain the PDP 210.

Figure 15:
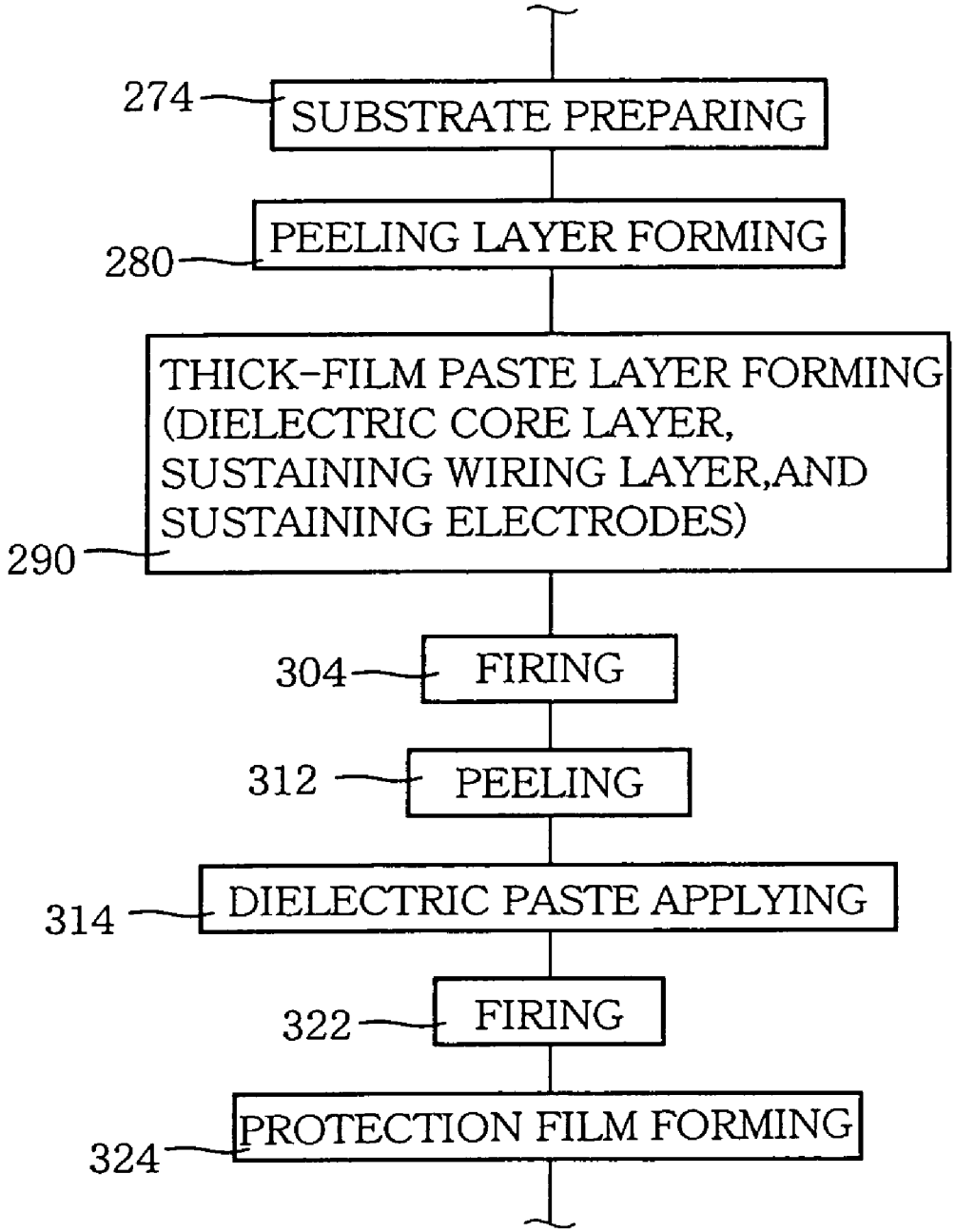
FIG. 15 is a flow chart for explaining a method of producing the sheet member.

In the above-described producing method, the sheet member producing step 268 is carried out according to the flow chart, shown in FIG. 15, in which a well known thick-film printing technique is used. Hereinafter, the method of producing the sheet member 220 will be explained by reference to FIGS. 16(*a*) through (*e*) and FIGS. 17(*f*) through 17(*h*) that show respective states in essential steps of the producing method.

First, in a substrate preparing step 274, a substrate 276 (see FIG. 16) on which a thick-film printing is to be carried out, is prepared, and a surface 278 of the substrate 276 is subjected to an appropriate cleaning treatment. This substrate 276 is preferably provided by a glass substrate formed of, e.g., a soda lime glass that exhibits substantially no deformation or deterioration in a heat treatment, described later, and has a thermal expansion coefficient of about $87\times10^{-7}$ (/° C.), a softening point of about 740 (° C.), and a distorting point of about 510 (° C.). The substrate 276 has a thickness of from about 2 (mm) to about 3 (mm), e.g., about 2.8 (mm), and the surface 278 of the substrate 276 is sufficiently larger than that of the sheet member 220.

Figure 16:
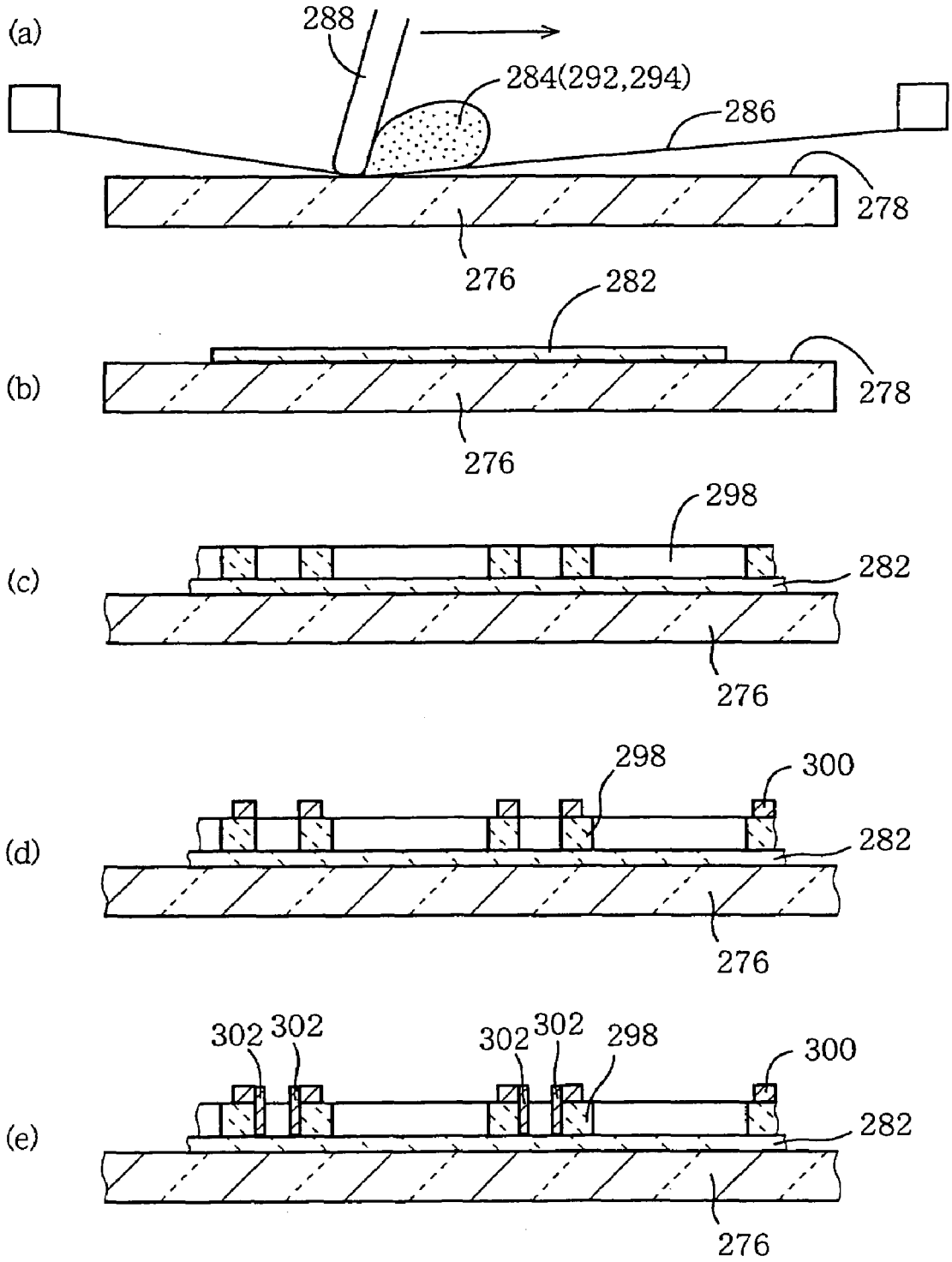
FIGS. 16(*a*) through 16(*e*) are views showing a substrate and one or more thick films, in respective essential steps out of the producing steps shown in FIG. 15.

Subsequently, in a peeling layer forming step 280, a peeling layer 282 that consists of particles having a high melting point and bound to each other with a resin, and has a thickness of, e.g., from about 5 (μm) to 50 (μm), is provided on the surface 278 of the substrate 276. The high melting point particles may be a mixture of a high softening point glass frit having an average particle size of from 0.5 (μm) to 3 (μm), and a ceramic filler, such as alumina or zirconia, having an average particle size of from 0.01 (μm) to 5 (μm), e.g., about 1 (μm) and a percentage of from about 30 (%) to 50 (%). The high softening point glass may be a glass having a high softening point not lower than, e.g., about 550 (° C.), and the high melting point particles as the mixture may have a softening point not lower than, e.g., about 550 (° C.). The resin may be an ethyl cellulose resin that is burned out at, e.g., 350 (° C.). The peeling layer 282 is formed, as shown in FIG. 16(*a*), on a substantially entire surface of the substrate 276 in such a manner that an inorganic material paste 284 in which the high melting point particles and the resin are dispersed in an organic solvent such as butyl carbitol acetate (BCA) or terpineol is applied to substantially the entire surface of the substrate 276, by a screen printing method, and subsequently the applied paste 284 is dried in a drying furnace, or at room temperature. However, the peeling layer 282 may be formed using a coater, or by adhesion of a film laminate. The drying furnace is preferably provided by a far infrared drying furnace that can be sufficiently ventilated so that the layer can enjoy an excellent surface roughness and the resin can be uniformly dispersed. FIG. 16(*b*) shows a step in which the peeling layer 282 is thus formed on the substrate 276. In FIG. 16(*a*), numeral 286 designates a screen; and numeral 288 designates a squeegee. In the present embodiment, the substrate 276 and the peeling layer 282 formed thereon cooperate with each other to provide a support member; the surface of the peeling layer 282 provides a film formation surface on which films are formed; and the substrate preparing step 274 and the peeling layer forming step 280 cooperate with each other to provide a support member preparing step.

Subsequently, in a thick-film paste layer forming step 290, a thick-film conductive paste 292 for forming the sustaining wiring layer 242 and the sustaining electrodes 248, and a thick-film dielectric paste 294 (see FIG. 16(*a*)) for forming the dielectric core layer 238 are sequentially applied, each in a predetermined pattern, on the peeling layer 282, and then dried, by utilizing, e.g., the screen printing method, like in the step 280 in which the inorganic material paste 284 is applied. Thus, a dielectric thick layer 298 for forming the dielectric core layer 238, a conductive printed layer 300 for forming the wiring portions 250 and the projecting portions 252 of the sustaining wiring layer 242, and a conductive printed layer 302 for forming the sustaining electrodes 248 are formed in the order of description. The thick-film conductive paste 292 may be obtained by dispersing, in an organic solvent, a mixture of powder of conductive material, such as powder of silver; a glass frit; and a resin. The thick-film dielectric paste 294 may be obtained by dispersing, in an organic solvent, a mixture of powder of dielectric material such as powder of alumina or zirconia; a glass frit; and a resin. Each glass frit is, e.g., a low softening point glass such as $PbO—B_2O_3—SiO_2—Al_2O_3—TiO_2$ glasses, and each resin and each organic solvent are, e.g., the same resin and organic solvent that are used to obtain the inorganic material paste 284.

For the purpose of forming the wiring portions 250 and the projecting portions 252 of the sustaining wiring layer 242, and the dielectric core layer 238, those screens 286 are used which have respective slot patterns corresponding to the respective shapes of the layers 242, 238, shown in FIGS. 10 and 12. The thick-film conductive paste 292 and the thick-film dielectric paste 294 are so applied as to have respective predetermined thickness values which assure that the layers 250, 252, 238 have the above-described thickness values after being fired and shrunk.

Figure 18:
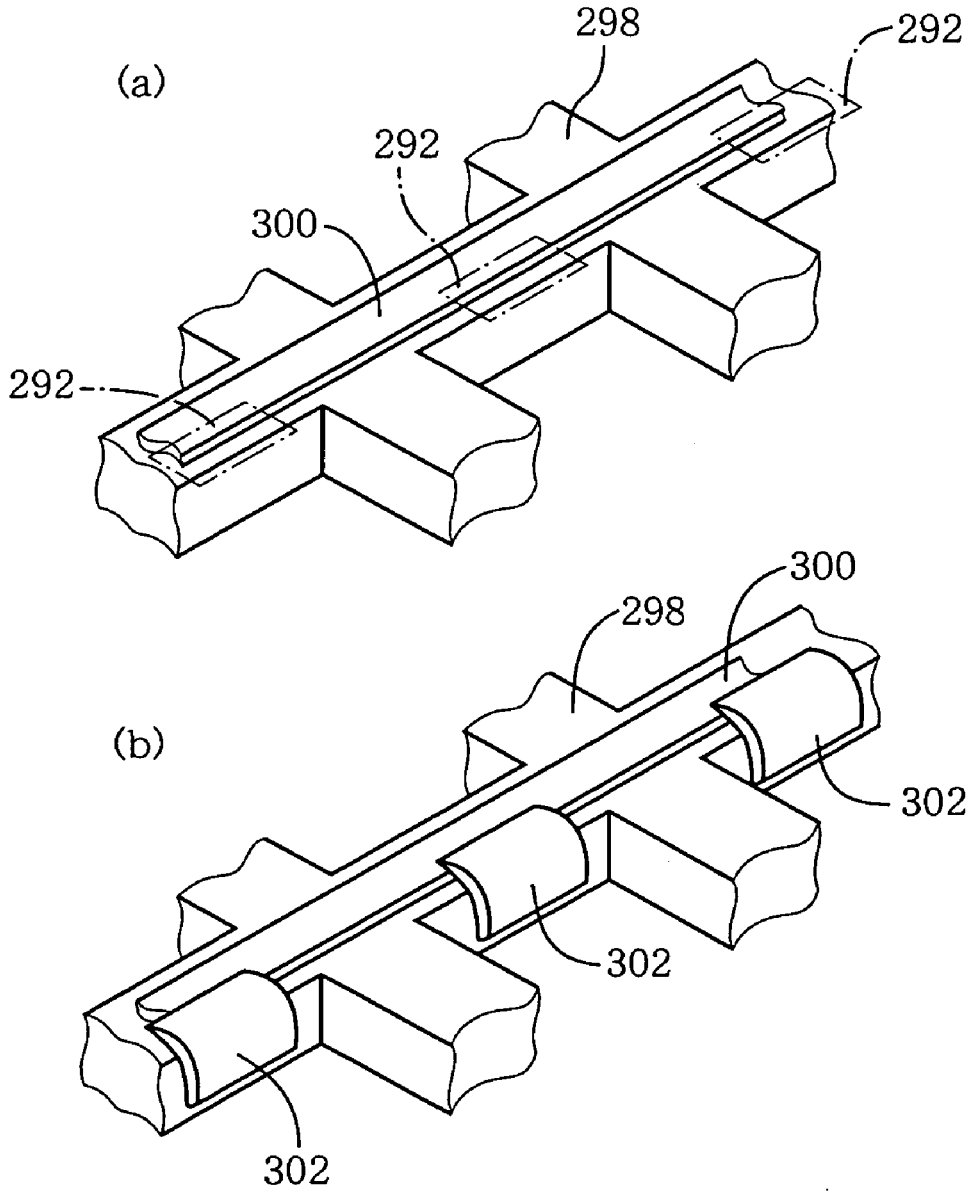
FIGS. 18(*a*) and 18(*b*) are views for explaining a method of forming a conductive printed layer constituting sustaining electrodes.

Meanwhile, for the purpose of forming the sustaining electrodes 248 (i.e., the conductive printed layer 302) on the inner wall surfaces of the grid bars of the dielectric core layer 238, such a screen 286 is used which has slots that are slightly offset inward of the inner wall surfaces of the dielectric core layer 238, so that, as shown in FIG. 18(*a*), the thick-film conductive paste 292 partly projects from the upper surface of the dielectric core layer 238, and has an island-like shape that is connected to the conductive printed layer 300 and, as shown in FIG. 18(*b*) the paste 292 flows downward from the upper surface of the core layer 238 along the inner wall surfaces of the same 238. The thick-film conductive paste 292 used for forming the conductive printed layer 302 is prepared such that the paste 292 flows downward along the inner wall surfaces of the dielectric printed layer 298. For example, the prepared paste 292 contains, as a conductive component thereof, fine silver particles whose average diameter is from about 0.1 (μm) to about 3 (μm), has a considerably low viscosity of from 10 (Pa·s) to 50 (Pa·s), and enjoys a good degree of leveling (i.e., a high degree of fluidity). In contrast thereto, the thick-film conductive paste 292 for forming the wiring portions 250 contains, as a conductive component thereof, large silver particles whose average diameter is from about 3 (μm) to about 5 (μm), has a high viscosity of from 3 (Pa·s) to 5 (Pa·s), and enjoys a good degree of fine line. In the present embodiment, the conductive printed layer forming step (i.e., a wiring conductive paste film forming step) for forming the sustaining wiring layer 242, and the conductive printed layer forming step (i.e., an electrode conductive paste film forming step) for forming the sustaining electrodes 248 are carried out independent of each other, because the different conductive pastes are used as described above. When the thick-film conductive paste 292 flows down onto the peeling layer 282, the solvent of the paste 292 is absorbed by the peeling layer 282, so that the paste 292 is not spread on the surface of the layer 282.

FIGS. 16(*c*) through 16(*e*) show respective steps in which the dielectric printed layer 298, the conductive printed layer 300, and the conductive printed layer 302 are formed. Since the respective thickness values of the conductive printed layers 300, 302 fall in the range of from about 5 (μm) to about 10 (μm), each of the layers 300, 302 can be formed in a single printing operation. However, since the dielectric printed layer 298 has the thickness of about 30 (μm), the layer 298 is formed by repeating, e.g., three printing and drying operations and thereby stacking three layers on each other that have an appropriate thickness in total.

Figure 17:
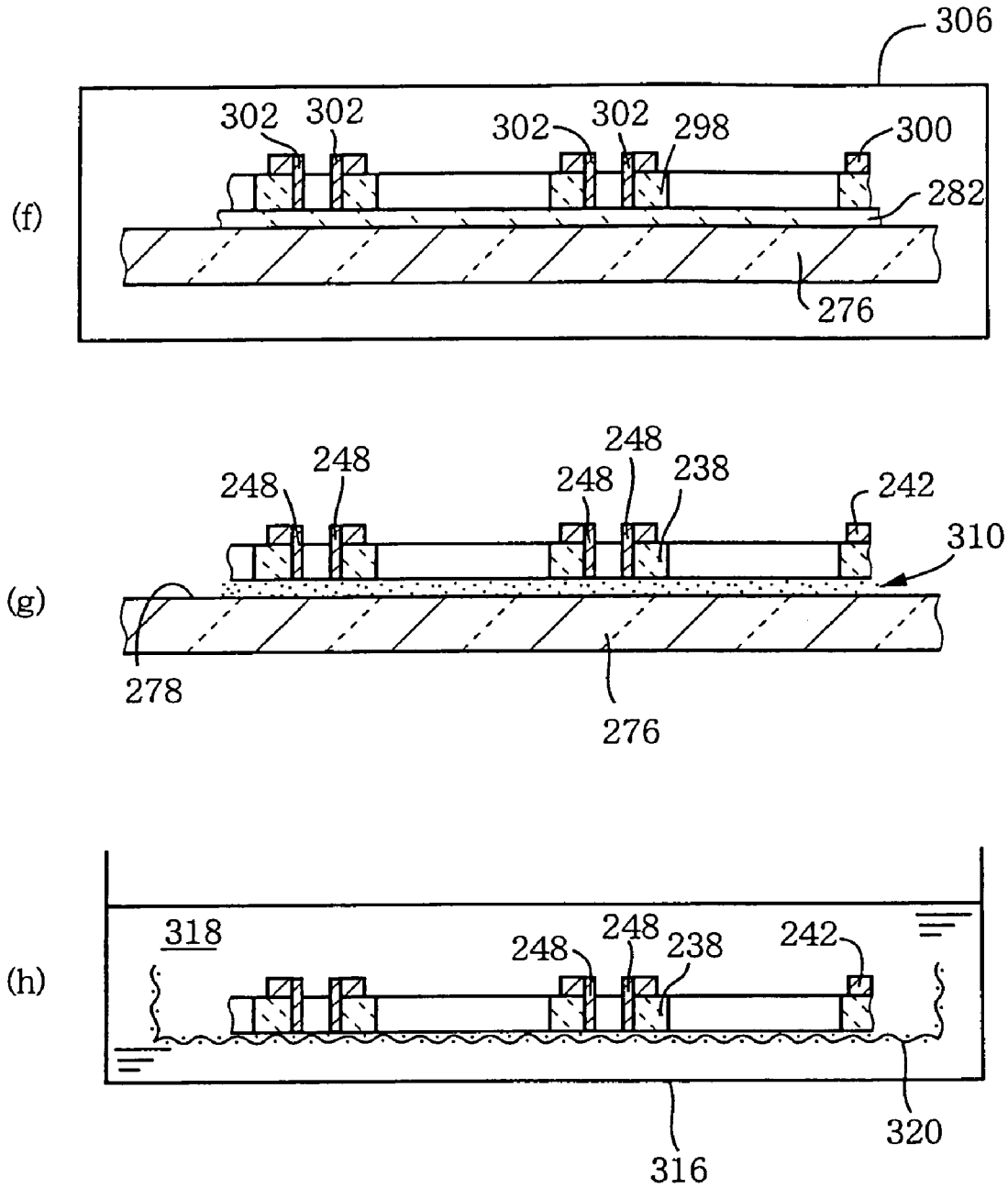
FIGS. 17(*f*) through 17(*h*) are views showing the substrate and the thick films in respective essential steps out of the producing steps shown in FIG. 15 that follow the step shown in FIG. 16(*e*).

After the thick-film printed layers 298, 300, 302 are formed in this way and then dried to remove the solvents, a firing step 304 is carried out. In the firing step 304, the substrate 276 is put in a furnace 306 of an appropriate firing device, and is subjected to a heat treatment at a firing temperature, e.g., 550 (° C.), corresponding to each of the thick-film conductive paste 292 and the thick-film dielectric paste 294. FIG. 17(*f*) shows a state in which the heat treatment is carried out.

A sintering temperature of each of the thick-film printed layers 298, 300, 302 is, e.g., about 550 (° C.). Therefore, during the heat treatment, the resins are removed, and the dielectric materials, the conductive materials, and the glass frit are sintered. Thus, the dielectric core layer 238 and the thick-film conductive layers (i.e., the sustaining wiring layer 242 and the writing wiring layer 240), that is, a basic portion of the sheet member 220 is produced. FIG. 17(*g*) shows this state. As described above, the peeling layer 282 includes the inorganic material particles whose softening point is not lower than 550 (° C.). Therefore, the resin is removed by firing, but the high melting point particles (i.e., the glass powder and the ceramic filler) are not sintered. Thus, as the heat treatment processes, the resin is removed and accordingly the peeling layer 282 is processed into a particle layer 310 consisting of the high melting point particles 308 (see FIG. 19).

Figure 19:
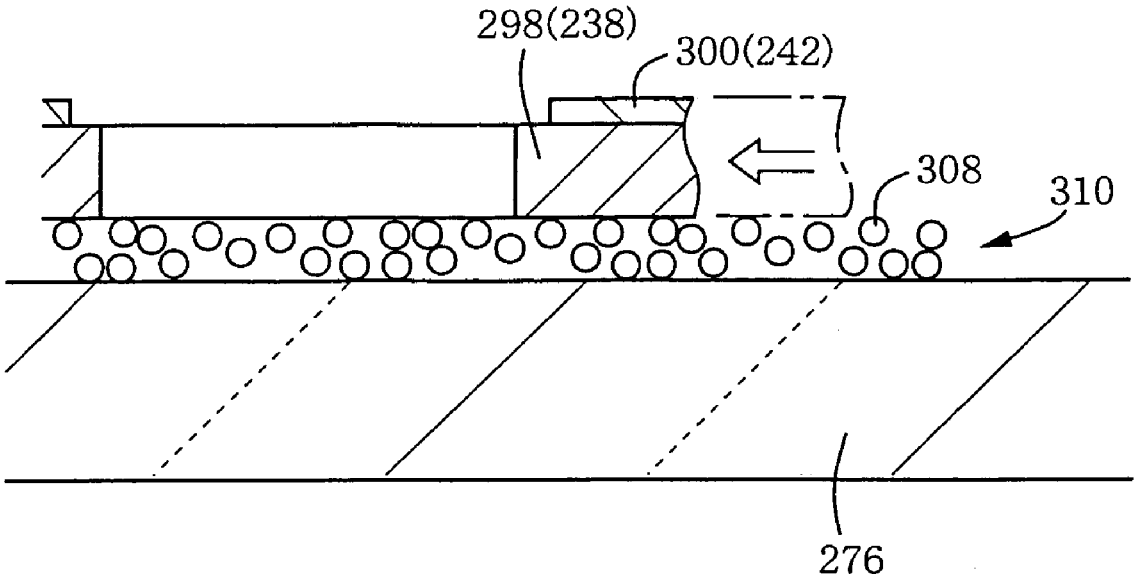
FIG. 19 is a view for explaining a manner in which the thick films are shrunk in a firing step shown in FIG. 15.

FIG. 19 is an enlarged, illustrative view corresponding to right-hand end portions of the thick-film printed layers 298 through 302, shown in FIG. 17(*g*), and showing how the sintering process advances in the heat treatment. The particle layer 310, produced by removing, by firing, the resin from the peeling layer 282, is a layer consisting of the high melting point particles 308 that just are gathered and are not bound to each other. Therefore, when the respective end portions of the thick-film printed layers 298 to 302 are shrunk from a position before firing, indicated at one-dot chain line in the figure, the high melting point particles 308 function as rollers. Thus, there are produced no forces that resist the shrinking of the printed layers 298 to 302, at an interface between a lower surface of the layers 298 to 302 and the substrate 276. Therefore, a lower portion of the layers 298 to 302 shrinks similarly to an upper portion of the same. Thus, the layers 298 to 302 are free of the difference of density and/or warpage resulting from the difference of amounts of shrinkage.

In the present embodiment, when the sintering of the thick-film printed layers 298 to 302 is started, the substrate 276 does not resist, owing to the presence of the particle layer 310, the sintering and shrinking of the layers 298 to 302. Thus, the thermal expansion of the substrate 276 does not substantially influence the quality of the thick films thus produced. However, in the case where the substrate 276 is repeatedly used or the heat treatment is carried out at a higher temperature, it is possible to use a heat-resisting glass having a still higher point (e.g., a borosilicate glass having a thermal expansion coefficient of about $32\times10^{-7}$ (/° C.) and a softening point of about 820 (° C.), or a quartz glass having a thermal expansion coefficient of about $5\times10^{-7}$ (/° C.) and a softening point of about 1580 (° C.)). In this case, too, the amount of thermal expansion of the substrate 276 is small in a temperature range in which the binding force of the dielectric material powder is small, and accordingly the thermal expansion does not influence the quality of the thick films produced.

Back to FIG. 15, in a peeling step 312, the thus produced thick films, i.e., the dielectric core layer 238 and the wiring layer 242 that are stacked on each other, are peeled from the substrate 276. Since the particle layer 310 interposed between the layers 238, 242 and the substrate 276 consists of the high melting point particles 308 just being gathered, the peeling operation can be easily carried out without using any agents or tools. Although the high melting point particles 308 may be adhered, with a thickness corresponding to one layer of particles 308, to the layers 238, 242, those particles 308 can be removed, as needed, using an adhesive tape or an air blower. The substrate 276 from which the thick films have been peeled can be used again and again for similar purposes, because the substrate 276 is not deformed or deteriorated at the above-described firing temperature.

Subsequently, in a dielectric paste applying step 314, the thus peeled layers 238, 242 are dipped in a dielectric paste 318 accommodated in a dipping tank 316, so that the dielectric paste 318 is applied to the entire outer surfaces of the layers. The dielectric paste 318 may be obtained by dispersing, in a solvent such as water, a mixture of powder of a glass such as $PbO—B_2O_3—SiO_2—Al_2O_3—TiO_2$ glasses or a combination of two or more of those glasses, and a resin such as PVA. The dielectric paste 318 is so prepared as to have a viscosity lower than that of the thick-film dielectric paste 294. It is possible to use, as the above-indicated glass powder, one which does not contain lead and whose softening point is not lower than 630 (° C.). This softening point is equal to, or higher than, that of the glass powder contained in the thick-film dielectric paste 294. The reason why the paste 318 prepared to have a low viscosity is used is to prevent air bubbles from being mixed with the paste 318 when the paste 318 is applied, and thereby prevent the fired product from suffering defects. The layers 238, 242 are slowly dipped in the dielectric paste 318, and then taken out from the same 318, while being supported on a wire net 320 such that the layers take a horizontal posture.

Subsequently, in a firing step 322, the layers 238, 242 that have been taken out from the dipping tank 316 and then dried sufficiently, is put in a firing furnace, so that the layers are subjected to a heat treatment (i.e., a firing treatment) in which the layers are fired at a pre-determined temperature of, e.g., about 650 (° C.) that corresponds to the kind of the glass powder contained in the dielectric paste 318. This firing temperature is so pre-determined as to be sufficiently higher than the softening point of the glass powder, so that the glass powder may sufficiently soften and provide a compact dielectric layer (i.e., the dielectric cover layer 244). Therefore, the thus obtained dielectric cover layer 244 is free of porosity that would otherwise result from grain boundaries of the glass powder, and enjoys a high withstand voltage. In the present embodiment, the electric paste applying step 314 and the firing step 322 cooperate with each other to provide a covering step.

Figure 20:
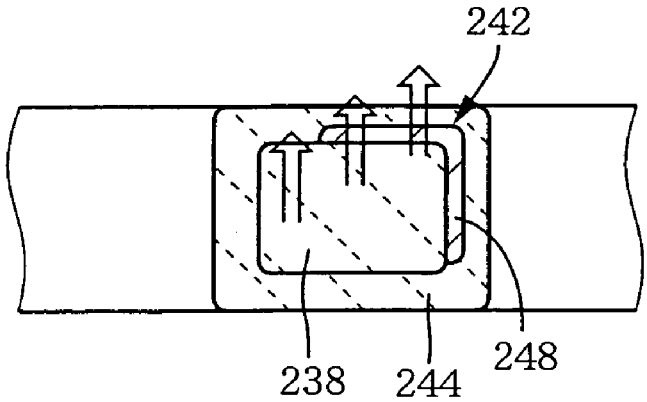
FIG. 20 is a view for explaining a direction in which gas moves out of a dielectric cover layer in the firing step.

In the case where the firing step 322 is carried out at a considerably high temperature, gas is produced from the dielectric core layer 238 and the sustaining wiring layer 242 that are located inside, because the organic components remaining in those layers 238, 242 are burned. This gas produces bubbles in the dielectric cover layer 244, and those bubbles move upward as indicated at arrows in FIG. 20. Therefore, the bubbles produced in the cover layer 244 gather in an upper portion thereof as seen in the figure, and do not gather in the respective portions thereof that function as the discharge surfaces, i.e., cover the side surfaces of the dielectric core layer 238. Thus, even if the treatment temperature used in the firing step 322 may be considerably high, the high temperature does not cause any bubbles to be produced in the portions of the dielectric cover layer 244 that cover the sustaining electrodes 248. That is, a high firing temperature can be used to increase the degree of compactness of the layer 244 and thereby improve the properties of the same 244 such as a withstand voltage.

Then, in a protection film forming step 324, the protection film 246 is formed with a desired thickness on a substantially entire surface of the dielectric cover layer 244, e.g., by dipping and firing, or by a thick-film forming process such as electronic-beam method or sputtering. Thus, the sheet member 220 is obtained. Since the protection film 246 is thin as described above, it is considerably difficult to form the protection film 246 with a uniform thickness, by a thick-film forming process such as dipping. However, in the present embodiment, the respective distances between the pairs of sustaining electrodes 248, 248 are uniform, because each pair of electrodes produce an electric discharge while opposing each other. Therefore, irrespective of what shape the surface of the protection film 246 may have, local discharge hardly occurs. Thus, the protection film 246 is not required to be so uniform as a layer that is employed in the above-described surface discharge structure. In addition, the protection film 246 is not present on a path of emission of light, the film 246 is not required to be transparent.

Thus, in the present embodiment, when the front and rear plates 216, 218 are superposed on, and fixed to, each other to obtain the PDP 210, the sheet member 220 including the sustaining wiring layer 242 produced as described above, is fixed to the front or rear plate 216, 218, so that the sustaining electrodes 248 are provided in the discharge spaces 224. Since the sheet member 220 includes the sustaining wiring layer 242 as the thick-film conductive layer constituting the sustaining electrodes 248, the sustaining electrodes 248 can be provided by just placing the sheet member 220 between the front and rear plates 216, 218. Thus, the PDP 210 is advantageously freed of the problem with the case where discharge electrodes are formed, by using a heat treatment, on the front plate 216, i.e., the problem that the front plate 216 and the electrodes 248 are distorted because of the heat treatment. In addition, the sustaining electrodes 248 are provided by applying, after the conductive printed layer 300 constituting the wiring layers 250 is formed on the dielectric printed layer 298, the thick-film conductive paste 292 in an island-like pattern on the surface of the conductive printed layer 300, while allowing the paste 292 to flow down along the respective side surfaces of the grid bars of the dielectric printed layer 298, and thereby forming the conductive printed layer 302 connected to the conductive printed layer 300. Therefore, the three-electrode-structure AC-type PDP 210 that is free of the distortions caused by the heat treatment that would otherwise be carried out to form the electrodes and of the disadvantages with the surface discharge structure, such as local discharge or dielectric breakdown, can be produced by a simple method.

In addition, in the present embodiment, the thick-film conductive paste 292 used to form the sustaining electrodes 248 (i.e., the conductive printed layer 302) has the higher fluidity than that of the thick-film conductive paste 292 used to form the wiring portions 250 (i.e., the conductive printed layer 300). That is, the former thick-film conductive paste 292 is prepared to have such a high fluidity that assures that the paste 292 can easily flow down along the side surfaces of the dielectric printed layer 298; and the latter thick-film conductive paste 292 is prepared to have such a nature that assures that the paste 292 can be applied to form a film having a great thickness and an accurately defined pattern. Thus, the thick films having the respective required properties can be obtained. That is, the conductive printed layer 302 can have a smooth surface and thereby improve the uniformity of respective distances between the pairs of sustaining electrodes 248, 248 each pair of which oppose each other.

In addition, in the present embodiment, on the film formation surface defined by the peeling layer 282 having the higher melting point than the respective sintering temperatures of the thick-film conductive paste 292 and the thick-film dielectric paste 294, the dielectric printed layer 298 and the conductive printed layers 300 are formed in the respective predetermined patterns and, subsequently, are subjected to the heat treatment at the sintering temperature, so as to obtain the sheet member 220 including the dielectric core layer 238 and the thick-film conductive layer that is formed on the surface 240 of the core layer 238 and constitute the sustaining wiring layer 242. Although the peeling layer 282 is not sintered at the heat treatment temperature, the resin of the layer 282 is burned out, and accordingly the particle layer 310 consisting of only the high melting point particles 308 is obtained. Since, therefore, the thus produced thick films are not fixed to the substrate 276, those thick films can be easily peeled from the surface 278 of the substrate 276. Thus, the sheet member 220 constituting the sustaining electrodes 248 can be easily produced and can be easily used to produce the PDP 210.

In addition, in the present embodiment, the support member to which the thick-film pastes 292, 294 are applied is constituted by the substrate 276 and the peeling film 282 formed on the surface 278 of the substrate 276. Therefore, even after the heat treatment, the support member can maintain its shape. Thus, the sheet member 220 can be more easily dealt with after being produced, than in the case where the support member would be constituted by the peeling layer 282 only. Since the peeling layer 282 is located between the thick-film printed layers 298 to 302 and the substrate 276, the substrate 276 does not bind those layers 298 to 302 when the layers are subjected to the heat treatment. Therefore, the substrate 276 does not have any limitations with respect to its degree of flatness and/or its degree of surface roughness. For example, in the case where the surface 278 of the substrate 276 is warped, the thick-film printed layers 298 to 302 are also warped following the warped surface 278. Since, however, the sheet member 220 has a sufficiently high degree of flexibility even after being fired, the sheet member 220 can follow, when being placed on a flat surface, that flat surface and become flat.

In addition, in the present embodiment, the thick-film layers 298 to 302 are formed by the thick-film printing method. Therefore, the PDP 210 can be produced using the simple equipment and without wasting the materials. Thus, the PDP 210 can be produced at low cost.

In addition, in the present embodiment, the thick-film screen printing method is used to form the thick films and accordingly no so-called wet processes are used. Thus, it is not needed to treat the waste water. The wet processes have the problem that if a solution permeates the films and remains in the same, it may cause the generation of outgas from the vacuum container obtained by adhering the front and rear plates 216, 218 to each other. To avoid this problem, materials having a higher heat resisting temperature are used and, after the container is gas-tightly sealed, air is discharged at a higher temperature or in a longer time period. Those measures, however, lead to increasing the load of the processes.

THIRD EMBODIMENT

Next, there will be described another embodiment according to the third and fourth inventions. In the following description, the same reference numerals as used in the above-described embodiment are used to designate the corresponding elements of other embodiments and the description of those elements is omitted.

Figure 21:
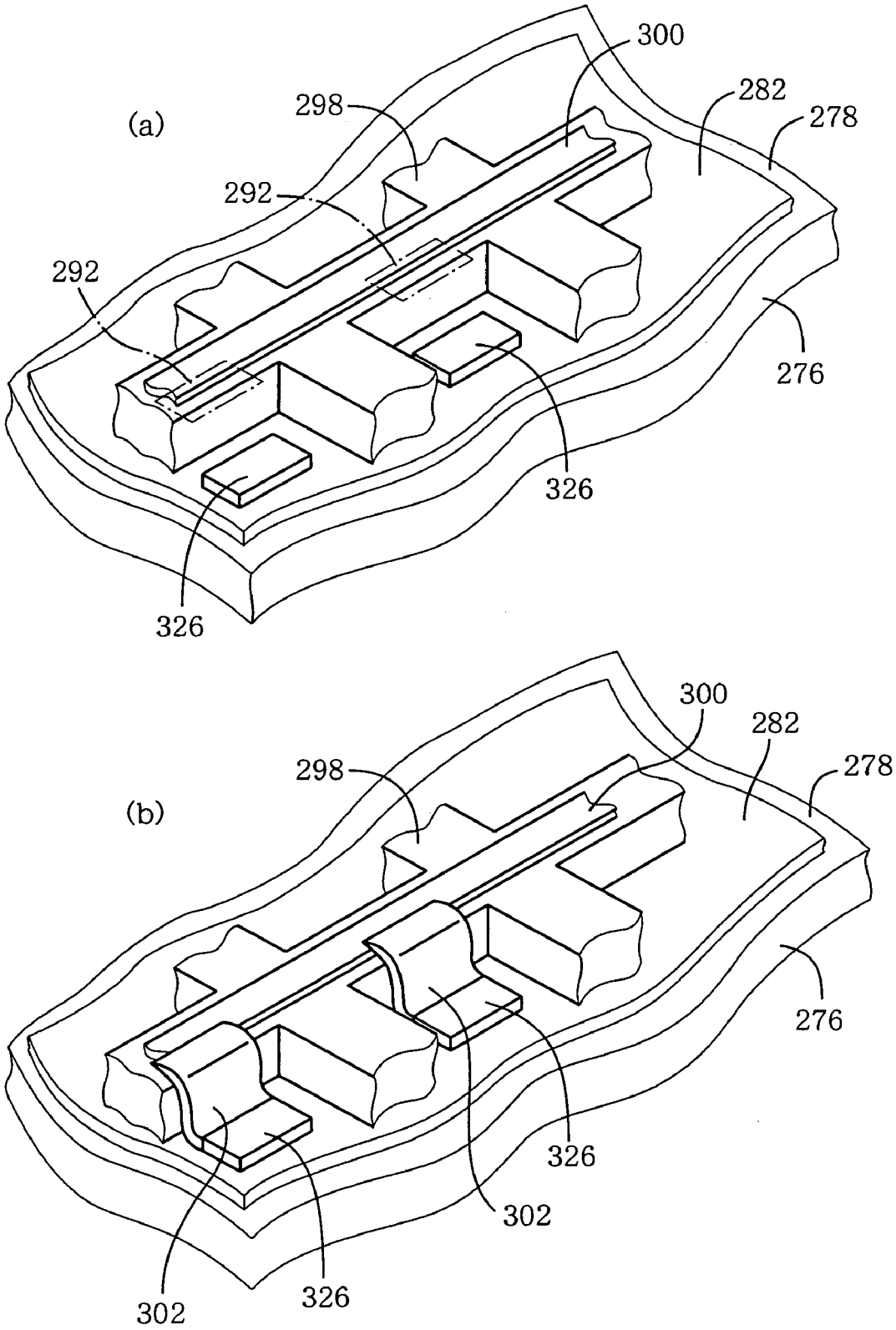
FIGS. 21(*a*) and 21(*b*) are views corresponding to FIG. 18, for explaining another method of producing sustaining electrodes.

FIG. 21 are views corresponding to FIG. 18, for explaining another method of producing the sheet member 220 as described above, that is, a view showing a thick-film paste layer forming step 290, i.e., a step in which the conductive printed layer 302 constituting the sustaining electrodes 248 is formed. In FIG. 21(*a*), on a film formation surface 278 of a substrate 276 for forming the sheet member 220, there are provided flow stoppers 326 at respective positions inside respective grid bars of the dielectric printed layer 298 (i.e., the dielectric core layer 238) where the sustaining electrodes 248 are to be provided. The flow stoppers 326 are formed of a material containing the above-described high melting point particles and the ethyl cellulose resin for binding the particles to each other, i.e., the same material as that used for forming the above-described peeling layer 282. Each of the flow stoppers 326 is distant from the dielectric printed layer 298 by a small distance of from about 5 (□m) to about 30 (□m), more preferably, a distance of from about 5 (□m) to about 10 (□m) corresponding to the thickness of each sustaining electrode 248. A width of each flow stopper 326 in a lengthwise direction of wiring portions 250 is equal to, or somewhat greater than, that of each sustaining electrode 248. Each flow stopper 326 is formed by applying, after the peeling layer 282 is formed, and before the dielectric printed layer 298 is formed or after just one printing operation has been done for forming the dielectric printed layer 298, the inorganic material paste 284, using a screen 286 having island-like slots, to the peeling layer 282. In the present embodiment, the other steps than the step for forming the flow stoppers 326 are identical with those employed by the above-described embodiment.

After the flow stoppers 326 have been formed as described above, the thick-film conductive paste 292 is applied to form the above-described conductive printed layer 302. In the present embodiment, too, the thick-film conductive paste 292 is applied to a top portion of the dielectric printed layer 298, so as to form an island-like pattern as indicated at one-dot chain line in FIG. 21(*a*), while allowing the paste 292 to flow down along the respective side surfaces of the printed layer 298, as described above. Thus, the paste 292 is applied to the side surfaces of the printed layer 298. When the paste 292 reaches the peeling layer 282 (i.e., the film formation surface 278), the paste 292 should spread there because of its own fluidity. Since, however, the flow stopper 326 is present in front of the paste 292, the flow of the paste 292 is stopped there by one side surface of the flow stopper 326, as shown in FIG. 21(*b*). Although the figure shows only one of each pair of island-like portions of the conductive printed layer 302 (i.e., each pair of sustaining electrodes 248), the other island-like portion opposing the one island-like portion is formed such that the flow of a lower end portion of the other island-like portion is stopped by the opposite side surface of the flow stopper 326. Thus, in the present embodiment, the lower end portion of the paste 292, i.e., the lower end portion of the one sustaining electrode 248 is prevented from approaching excessively the other sustaining electrode 248 opposing the one electrode 248, and accordingly local discharge is more effectively prevented from occurring to the lower end portion of each sustaining electrode 248. In addition, the variation of respective positions of respective lower end portions of the sustaining electrodes 248, resulting from the variation of surface natures of the peeling layer 282 at respective locations and/or the variation of application amounts of the paste 292 at the respective locations, can be advantageously reduced.

In the present embodiment, since the flow stoppers 326 are formed of the same material as that used to form the peeling layer 282, i.e., the material containing the high melting point particles 308 bound to each other by the resin, the stoppers 326 can be removed, like the peeling layer 282, in the firing step 304. Thus, the lower end portion of each island-like portion of the conductive printed layer 302, hidden by the flow stopper 282, is exposed after the firing operation. Therefore, each sustaining electrode 248 can enjoy its effective electrode area, notwithstanding the provision of the flow stopper 326. In addition, in the case where fluorescent layers are provided on the rear plate 218 as well, lights emitted by the fluorescent layers are not interrupted by the flow stoppers 326.

FOURTH EMBODIMENT

Figure 22:
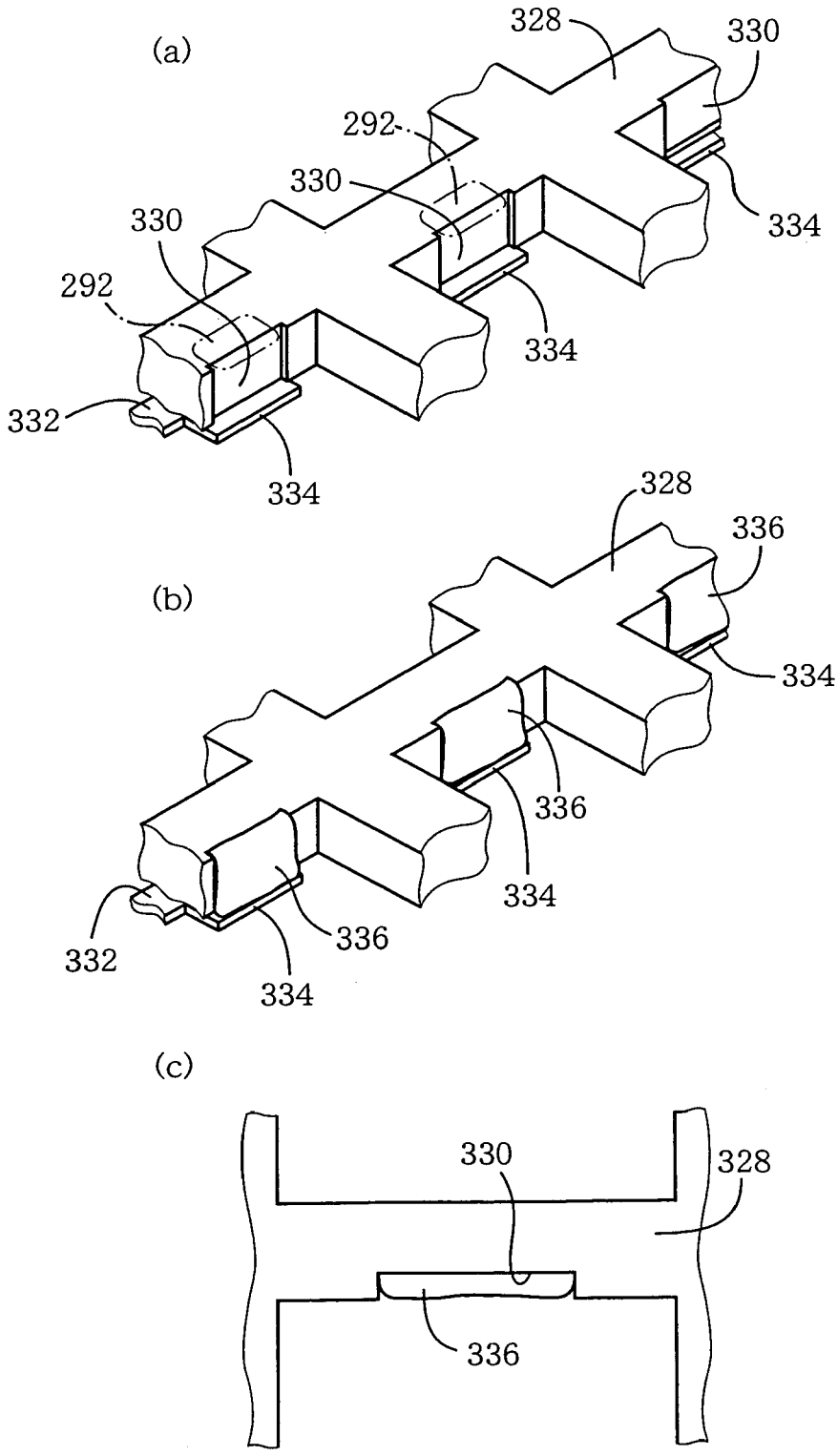
FIGS. 22(*a*) through 22(*c*) are views for explaining a method of producing another sheet member that can be used in place of the sheet member shown in FIG. 12.

FIG. 22 are views for explaining a method of producing another sheet member that can be used in place of the sheet member 220. FIG. 22(*a*) shows a step in which a dielectric printed layer 328 has been formed, by printing, on a peeling layer 282, not shown. The dielectric printed layer 328 is formed of the same material as that used to form the above-described dielectric printed layer 298, but has a different configuration than that of the latter printed layer 298, in that the former printed layer 328 has respective recesses 330 at respective locations where sustaining electrodes 248 are to be formed in a subsequent step. Each of the recesses 330 has a width corresponding to that of each sustaining electrode 248, and a length equal to a distance between upper and lower surfaces of the dielectric printed layer 328. Each recess 330 has a depth of from about 5 (μm) to about 10 (μm) that is substantially equal to the thickness of each sustaining electrode 248. Although the figure shows the recesses 330 formed in only respective one side surfaces of the grid bars of the dielectric printed layer 328, the printer layer 328 additionally has, in respective side surfaces thereof opposing the respective one side surfaces, respective recesses 330 opposing the recesses 330 shown in the figure. Thus, in the present embodiment, in a dielectric paste film forming step for forming the dielectric printed layer 328, a thick-film dielectric paste 294 is applied such that the applied paste 294 has, in respective side surfaces of the grid bars where the electrodes 248 are to be provided, the recesses 330 each of which has a predetermined depth as measured from respective upper surfaces of those grid bars. The predetermined depth is equal to the thickness of the dielectric printed film 328.

In FIG. 22(*a*), under the dielectric printed layer 328, there is provided a conductive printed layer 332 constituting wiring portions to which the sustaining electrodes 248 are to be connected. That is, in the present embodiment, before the dielectric printed layer 328 is formed, the conductive printed layer 332 is formed on the peeling layer 282. The conductive printed layer 332 includes projecting portions 334 that are located below the respective recesses 330 and project into respective inner spaces defined by the grid bars of the dielectric printed layer 328. In a state in which the dielectric printed layer 328 has been formed, respective end portions of the projecting portions 34 project, by a small distance, from the printed layer 328, at respective positions where the recesses 330 are provided.

When the thick-film conductive paste 292 for forming the sustaining electrodes 248 is applied from above the dielectric printed layer 328 constructed as described above (see FIG. 22(*a*)), using a screen 286 having island-like slots, like in the above-described embodiments, the paste 292 easily flows into each recess 330 because an edge of the each recess 330 (i.e., an edge between the upper and side surfaces of the dielectric printed layer 328) is considerably near to the paste 292 applied. Thus, in the present embodiment, as shown in FIGS. 22(*b*) and (*c*), each of island-like portions of a conductive printed layer 336 is substantially entirely accommodated by a corresponding one of the recesses 330, such that a lower end portion of the each island-like portion is connected to a corresponding one of the projecting portions 334. FIG. 22(*c*) is a plan view showing the step, shown in FIG. 22(*b*), in which the thick-film conductive paste 292 has been applied.

Thus, in the present embodiment, a dielectric core layer constituted by the dielectric printed layer 328 has, in each of inner spaces defined by grid bars thereof, a pair of recesses 330 that oppose each other and accommodate a pair of sustaining electrodes 248 (i.e., a pair of island-like portions of the conductive printed layer 336). Therefore, widthwise opposite ends of each sustaining electrode 248 are prevented from discharging, by inner wall surfaces of the recess 330, and local discharge is prevented from occurring to those ends of the each electrode 248.

In addition, when the paste 292 flows down in each recess 330, the paste 292 is prevented from spreading in the widthwise (i.e., lateral) direction of the each recess 330. Thus, as shown in FIG. 22(*c*), each island-like portion of the conductive printed layer 328 has a surface that is flat over a substantially entire width thereof. Therefore, each electrode 248 can enjoy an increased effective electrode area, and local discharge or dielectric breakdown can be more reliably prevented. In addition, since the paste 292 is prevented from spreading in the lateral direction, the printed layer 328 is free of a problem that the paste 292 flows down while spreading in the lateral direction, i.e., only a reduced amount of the paste 292 flows down. Thus, each sustaining electrode 248 can be formed with a desired shape (i.e., desired width and length).

FIFTH EMBODIMENT

Figure 23:
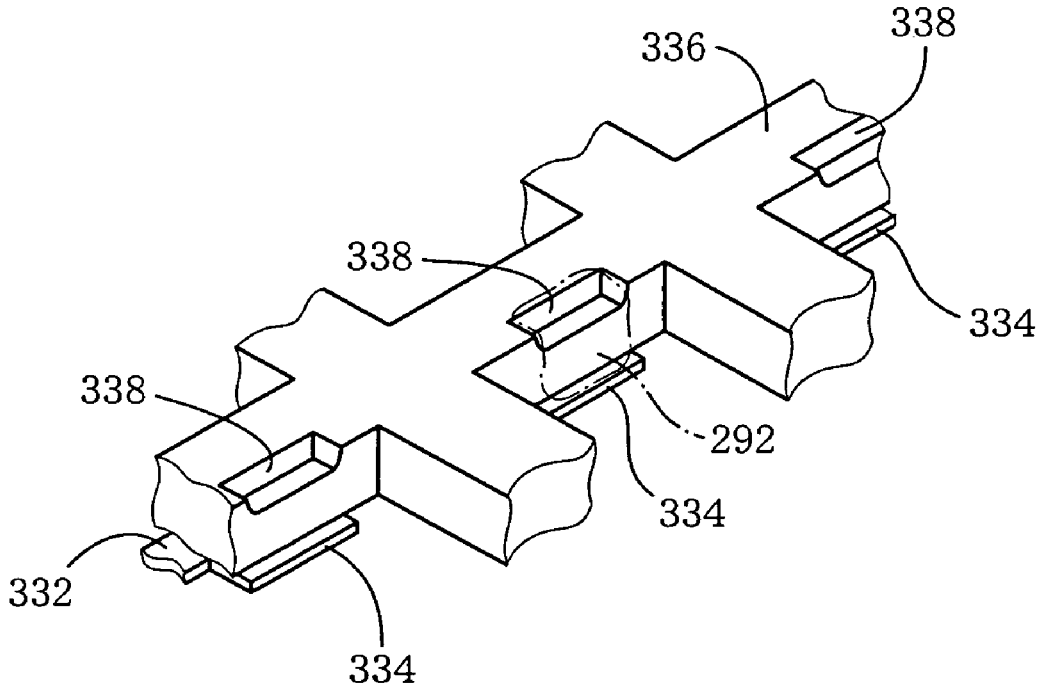
FIG. 23 is a view for explaining a method of producing yet another sheet member that can be used in place of the sheet member shown in FIG. 12.

In a fifth embodiment shown in FIG. 23, recesses 338 are formed in edges between an upper surface, and side surfaces, of a dielectric printed layer 336. Each of the recesses 338 has the same width and depth as those of each of the above-described recesses 330, but a dimension (i.e., a height) of each recess 338 in a direction of thickness of the dielectric printed layer 336 is equal to, e.g., from about 5 (μm) to about 20 (μm) corresponding to a thickness of a one-time printed layer 336, that is, each recess 338 reaches only an intermediate portion of the fully printed layer 336 in the direction of thickness thereof. Thus, in the present embodiment, too, in a dielectric paste film forming step for forming the dielectric printed layer 336, a thick-film dielectric paste 294 is applied such that the applied paste 294 has, in respective side surfaces of the grid bars where the electrodes 248 are to be provided, the recesses 338 each of which has a predetermined depth as measured from respective upper surfaces of those grid bars. The predetermined depth is sufficiently smaller than the thickness of the dielectric printed film 328.

Since the dielectric printed layer 336 has the recesses 338, when the thick-film conductive paste 292 is applied in an island-like pattern on the recesses 338, the paste 292 can easily flows into each of the recesses 338, as indicated at one-dot chain line in FIG. 23. Therefore, the paste 292 is preferably prevented from spreading unnecessarily in lateral directions of each recess 338, and accordingly end portions of each sustaining electrode 248 can enjoy a stable shape and can be prevented from producing local discharges. Thus, the sustaining electrodes 248 each having the desired height and width can be provided.

SIXTH EMBODIMENT

Figure 24:
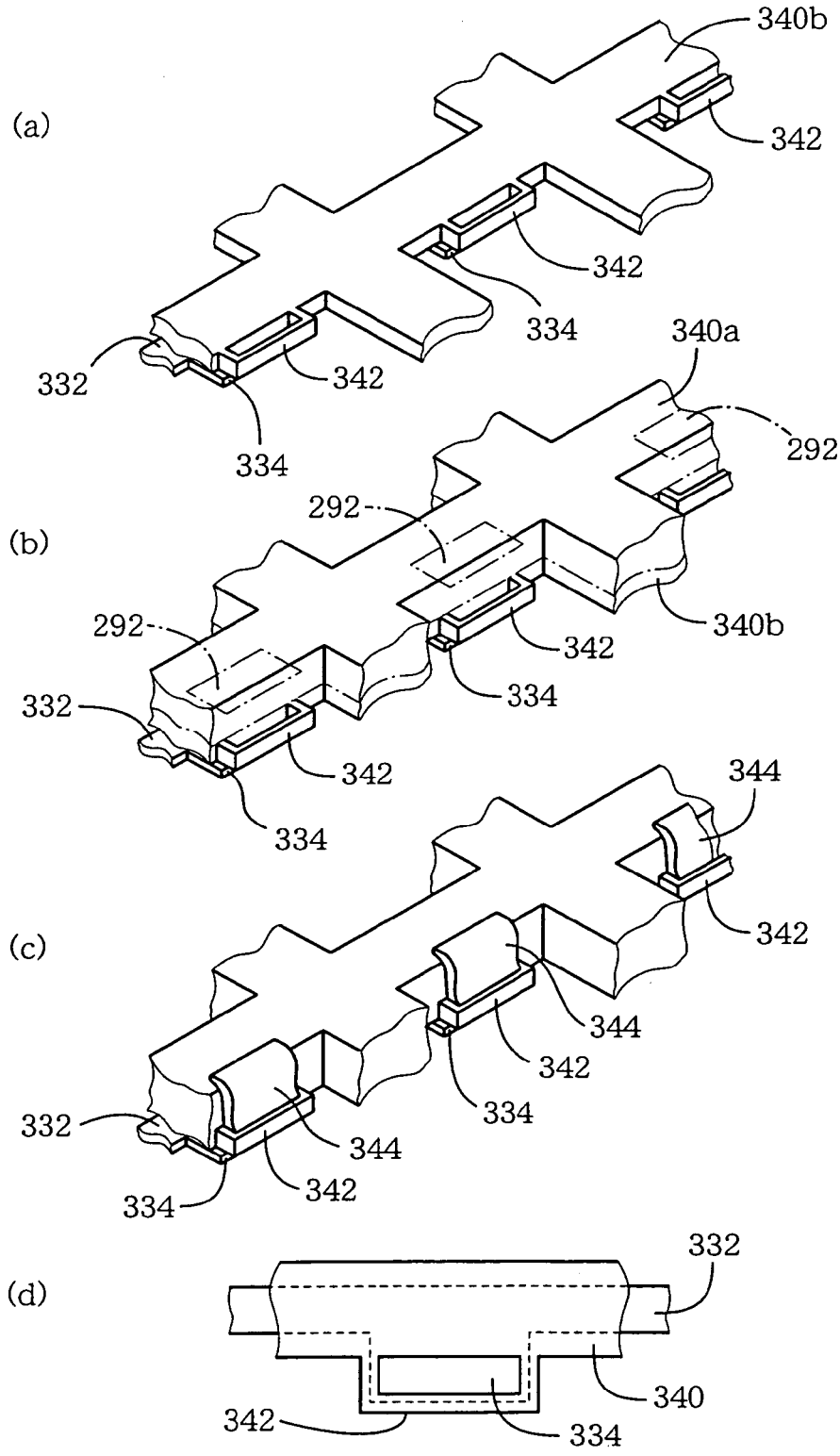
FIGS. 24(*a*) through 24(*d*) are views for explaining a method of producing another sheet member that can be used in place of the sheet member shown in FIG. 12.

FIGS. 24(*a*) through 24(*c*) are views for explaining a method of producing yet another sheet member. In this embodiment, a dielectric printed layer 340 constituting a dielectric core layer includes a lower layer portion 340*a* that is provided by a thick film formed by one-time printing operation, and an upper layer portion 340*b* that is stacked on the lower layer portion 340*a* and is provided by two or more thick films formed by two or more times printing operations and stacked on each other, so that the dielectric printed layer 340 has a predetermined thickness in total. The upper layer portion 340*b* has a shape identical with that of the above-described dielectric printed layer 298, but the lower layer portion 340*a* includes a plurality of paste receiving portions 342 that project laterally to overlap a plurality of projecting portions 334 of a conductive printed layer 332 underlying the lower layer portion 340*a*. Therefore, the lower layer portion 340*a* and the upper layer portion 340*b* are formed by printing using different screens 286 having different slot patterns.

Each of the paste receiving portions 342 includes two portions projecting from two locations on one side surface of the dielectric printed layer 340, parallel to each other; and a portion extending parallel to the one side surface to connect between respective end portions of the two projecting portions. Thus, each paste receiving portion 342 has a generally U-shaped plan view, and cooperates with an inner wall surface of a corresponding one of grid bars of the printed layer 340 to define a space. Although FIGS. 24(*a*) through 24(*c*) show that each of the projecting portions 334 projects from a corresponding one of the paste receiving portions 342, the each projecting portion 334 is, in fact, fully covered by the corresponding paste receiving portion 342, as shown in FIG. 24(*d*). In each of grid spaces of the printed layer 340, a pair of paste receiving portions 342 are provided such that the two portions 342 oppose each other.

In the present embodiment, too, on an upper surface of the dielectric printed layer 340 constructed as described above, a plurality of sustaining electrodes 248 are provided by applying a thick-film conductive paste 292 in an island-like pattern as shown in FIG. 24(*b*). Like in each of the above-described embodiments, the paste 292 flows down along the side surfaces of the printed layer 340. However, respective lower ends of respective island-like portions 344 of a conductive printed layer that are flowing down are received by the respective paste receiving portions 342, and thus are prevented from spreading over a film formation surface, as shown in FIG. 24(*c*). This is true with other island-like portions, not shown, of the conductive printed layer that oppose the island-like portions 344 shown in the figure. A size of each paste receiving portion 342 is so pre-determined, in view of the lateral spreading of the thick-film conductive paste 292 applied in the island-like pattern and flowing down, and the amount of flowing-down of the paste 292, that the inner space of the each paste receiving portion 342 can accommodate the entire lower end of each island-like portion 344 of the paste 292. In addition, each island-like portion 344 of the conductive printed layer is connected, in the inner space of a corresponding one of the paste receiving portions 342, to a corresponding one of the projecting portions 344 that is exposed in that inner space. In the present embodiment, a thick-film dielectric material containing particles and a resin as a binder of the particles, is used, and the paste receiving portions 342 that are integral with the dielectric printed layer 340 provide respective flow stoppers that stop the flow of the conductive paste 292.

After the conductive paste 292 is applied as described above, the thick films 332, 340, 344 are fired to obtain a sheet member. Since, in the present embodiment, the paste receiving portions 342 are integral with the dielectric printed layer 340, the receiving portions 342 are not burned out after firing and remain to cover the respective lower end portions of the sustaining electrodes 248. Thus, in the present embodiment, the respective lower end portions of each pair of opposing sustaining electrodes 248 that project farthest toward each other are covered by the paste receiving portions 342 formed of the dielectric material. Therefore, the lower end portions of the sustaining electrodes 248 are advantageously prevented from local discharge or dielectric breakdown.

The above-described second through sixth embodiments relate to the cases where the third and fourth inventions are applied to the full-color AC-type PDP 210 and the method of producing the same 210, respectively. However, the third and fourth inventions may be applied to a monochrome AC-type PDP and a method of producing the same, respectively.

The PDPs 210 as the second through sixth embodiments employ the fluorescent layers 232, 236 that correspond to the three colors, and display a full-color image. However, likewise, the third and fourth embodiments may be applied to such PDPs that employ fluorescent layers corresponding to one color, two colors, or four or more colors.

The size and/or shape of the recesses 330 can be changed, as needed, depending upon the nature of the thick-film conductive paste 292, so as to obtain the sustaining electrodes 248 that have a desired shape.

In the second through sixth embodiments, the sustaining wiring layer 242 is provided on only the one surface 240 of the dielectric core layer 238. However, it is possible to provide two sustaining wiring layers 242 on the opposite surfaces of the dielectric core layer 238, respectively, depending upon the method used to drive the panel.

In addition, in the second through sixth embodiments, the thick-film conductive paste 292 for forming the wiring portions 250 and the thick-film conductive paste 292 for forming the sustaining electrodes 248 are prepared to have different degrees of fluidity. However, so long as the respective demand characteristics of the wiring portions 250 and the sustaining electrodes 248 are satisfied, it is possible to use a same paste to form both of the wiring portions 250 and the sustaining electrodes 248, or to form the wiring portions 250 with a paste whose fluidity is higher than that of a paste used to form the sustaining electrodes 248. In the latter cases, the step of forming the conductive paste film constituting the wiring portions 250 and the step of forming the conductive paste film constituting the sustaining electrodes 248 may be simultaneously carried out.

The thickness value of the sheet member 220 and the respective thickness values of the dielectric core layer 238 and the wiring layer 242 that cooperate with each other to constitute the same 220 are selected depending upon respective mechanical strengths needed to deal with the same 220, and the thickness value of the wiring layer 242 is selected depending upon an electrical conductivity needed to function as an electrical conductor. Therefore, those thickness values are not limited to the values exemplified in the description of the embodiments, and may be appropriately determined depending upon the size and structure of the gas-discharge display apparatus.

In addition, in the second through sixth embodiments, the wiring layer 242 of the sheet member 220 is completely covered with the dielectric cover layer 244. However, the wiring layer 242 may be partly exposed so long as the exposure does not influence the discharges of the electrodes or the atmosphere in the gas-tight container.

In addition, in the second through sixth embodiments, the sheet member 220 includes the dielectric core layer 238 and the wiring layer 242 that are formed by using the thick-film screen printing method. However, a coater or a film laminate may be used to form uniformly each of thick-film paste layers on the film formation surface, and a photo process may be used to process the each layer to have a predetermined pattern.

In addition, in the second through sixth embodiments, the support member used to produce the sheet member 220 is constituted by the substrate 276 and the peeling layer 282 formed on the surface 278 of the substrate 76. However, a ceramic green sheet (i.e., an unfired ceramic sheet) may be used as the support member. In the latter case, the composition of the green sheet is determined such that at the heat treatment temperature employed in the firing step 304, the ceramic green sheet cannot be sintered but the resin contained therein can be fully burned off.

In addition, in the second through sixth embodiments, the partition walls 222 are provided in the stripe pattern. However, a grid-like partition wall may be used to separate the discharge spaces from each other, so long as there are no problems with the air discharging and gas charging operation after the sealing operation. In addition, in the illustrated embodiments, both the front and rear plates 216, 218 have the respective partition walls 222, 234. However, it is possible that only one of the two plates 216, 218 have the partition walls. In the latter case, it is preferred that the other plate free of the partition walls be free of the fluorescent layers, for the purpose of preventing the sheet member 220 from contacting the fluorescent body.

In addition, in the second through sixth embodiments, the fluorescent layers 232, 236 are provided on the inner surfaces 212, 214, respectively. However, it is possible to provide the fluorescent layers on only one of the two surfaces 212, 214.

The layout of the sustaining electrodes 248 and the wiring portions 250 for supplying electricity to the same 248 is not limited to that employed in the illustrated embodiments, but may be modified according to the construction of drive circuit of the PDP 210.

SEVENTH EMBODIMENT

Figure 25:
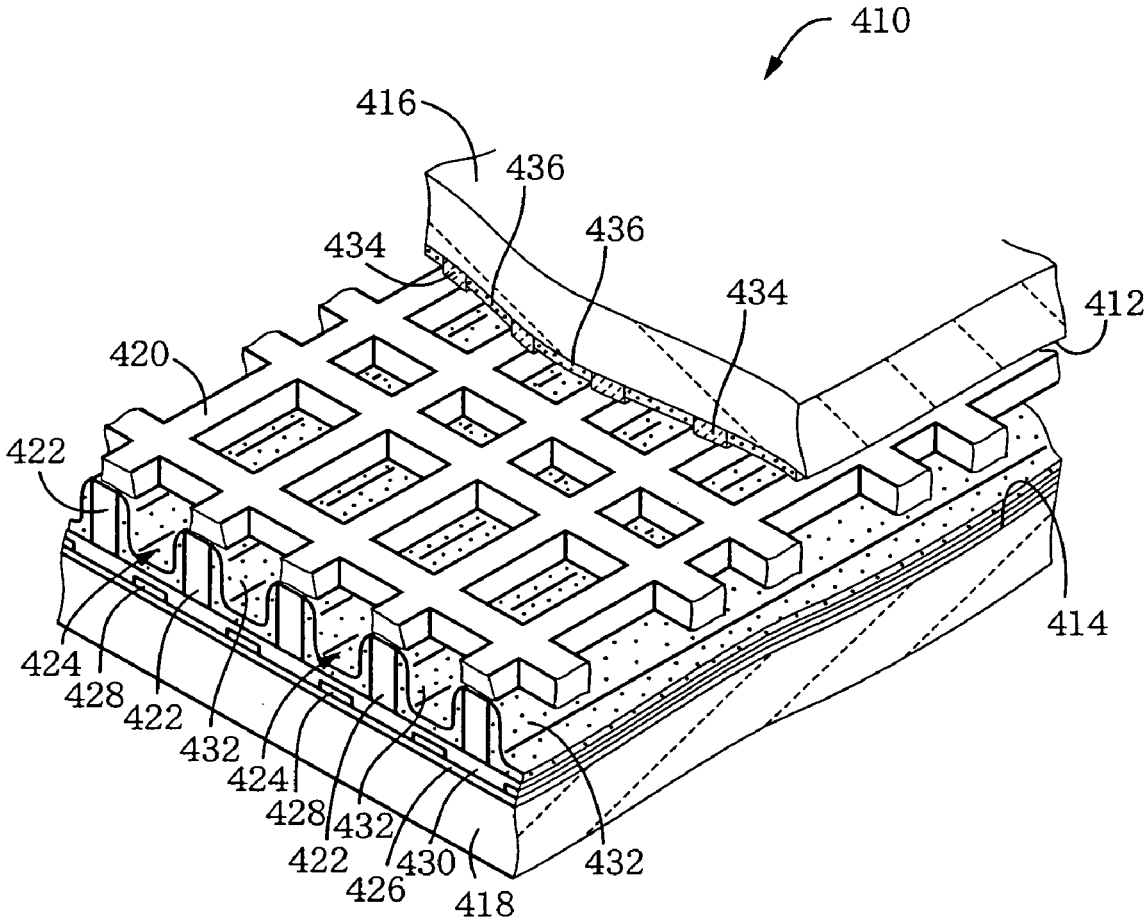
FIG. 25 is a perspective view of another color PDP as another three-electrode-structure AC-type gas-discharge display apparatus according to the present invention, with a portion of the PDP being cut away.

FIG. 25 is a perspective view for explaining a construction of an AC-type color PDP (hereafter, simply referred to as the PDP) 410 as an example of a gas-discharge display apparatus according to the fifth invention, such that a portion of the PDP 410 is cut away. In the figure, the PDP 410 includes a front plate 416 and a rear plate 418 which are provided such that the front and rear plates 416, 418 extend parallel to each other and are distant from each other by a pre-determined distance, so that respective one inner surfaces 412, 414 of the front and rear plates 416, 418 which surfaces are substantially flat, oppose each other. A sheet member 420 having a grid pattern is provided between the front and rear plates 416, 418, and peripheral portions of the front and rear plates 416, 418 are gas-tightly sealed. Thus, a gas-tight space is defined in the PDP 410. Each of the front and rear plates 416, 418 has a size of about 900 (mm)× about 500 (mm) and a uniform thickness of from about 1.1 (mm) to about 3 (mm), and those plates 416, 418 are formed of, e.g., respective soda lime glasses which are similar to each other and each of which is transparent and has a softening point of about 700 (° C.). In the present embodiment, the front plate 416 provides a first substrate; and the rear plate 418 provides a second substrate.

On the rear plate 418, there are provided a plurality of elongate partition walls 422 which extend parallel to each other in one direction and whose centerlines are distant from each other at a regular interval of from about 200 (μm) to about 500 (μm). Thus, the gas-tight space defined between the front and rear plates 416, 418 is divided into a plurality of discharge spaces 424. The partition walls 422 are each formed of a thick-film material which contains, as a main component thereof a low softening point glass, such as $PbO—B_2O_3—SiO_2—Al_2O_3—ZnO—TiO_2$ glasses or a combination of two or more of these glasses, and has a width of from about 80 (μm) to about 200 (μm) and a height of from about 30 (μm) to about 100 (μm). An inorganic filler such as alumina and/or other inorganic pigments are added, as needed, to the partition walls 422, so as to adjust a degree of compactness, a degree of strength, and/or a shape keeping ability of the partition walls 422. The sheet member 420 includes a plurality of elongate grid bars which extend in one direction and are placed on respective top ends of the partition walls 422.

On the rear plate 418, there is provided an undercoat 426 which covers a substantially entire surface of the inner surface 414 of the same 418 and is formed of a low-alkali glass or a no-alkali glass. On the undercoat 426, there are provided a plurality of writing electrodes 428 which extend in a lengthwise direction of the partition walls 422 and each of which is formed of a silver thick film. The writing electrodes 428 are covered with an overcoat 430 which is formed of a mixture of a low softening point glass and an inorganic filler such as a white-color titanium oxide. The above-described partition walls 422 are formed on the overcoat 430.

On the surface of the overcoat 430 and on respective side surfaces of the partition walls 422, there are provided a plurality of fluorescent layers 432 which are distinguished from each other so as to correspond to the plurality of discharge spaces 424, respectively. A thickness of each of the fluorescent layers 432 is pre-determined to fall in the range of, e.g., from about 10 (μm) to about 20 (μm), depending upon its fluorescent color. The fluorescent layers 432 are grouped into three groups of layers 432 that emit, by ultraviolet-light excitation, three fluorescent colors, e.g., red color (R), green color (G), and blue color (B), respectively. The fluorescent layers 432 are arranged such that each one of the layers 432, and two layers 432 located on either side of the each layer 432 emit the three, different fluorescent colors, respectively, in the corresponding three discharge spaces 424, respectively. The undercoat 426 and the overcoat 428 are provided for the purpose of preventing the reaction between the silver-thick-film-based writing electrodes 428 and the rear plate 418, and preventing the contamination of the fluorescent layers 432.

Meanwhile, on the inner surface 412 of the front plate 416, there are provided a plurality of partition walls 434 at respective positions where the partition walls 434 oppose the partition walls 422, respectively. Thus, the partition walls 434 have a stripe pattern. The partition walls 434 are each formed of, e.g., the same material as used to form each of the partition walls 422, and each have a thickness of, e.g., from about 20 (μm) to about 50 (μm). Between each pair of partition walls 434 that are adjacent each other on the inner surface 412 of the front plate 416, there is provided a fluorescent layer 436 having a thickness falling in the range of, e.g., from about 10 (μm) to about 20 (μm). Thus, a plurality of fluorescent layers 436 are provided in a stripe pattern on the inner surface 412. The fluorescent layers 436 are arranged such that each of the layers 436 emits, in a corresponding one of the discharge spaces 424, the same fluorescent color as the fluorescent color emitted in the one discharge space 424 by a corresponding one of the fluorescent layers 432 provided on the rear plate 418. The partition walls 434 have a height greater than the thickness of the fluorescent layers 436, for the purpose of preventing the sheet member 420 from contacting the fluorescent layers 436.

Figure 26:
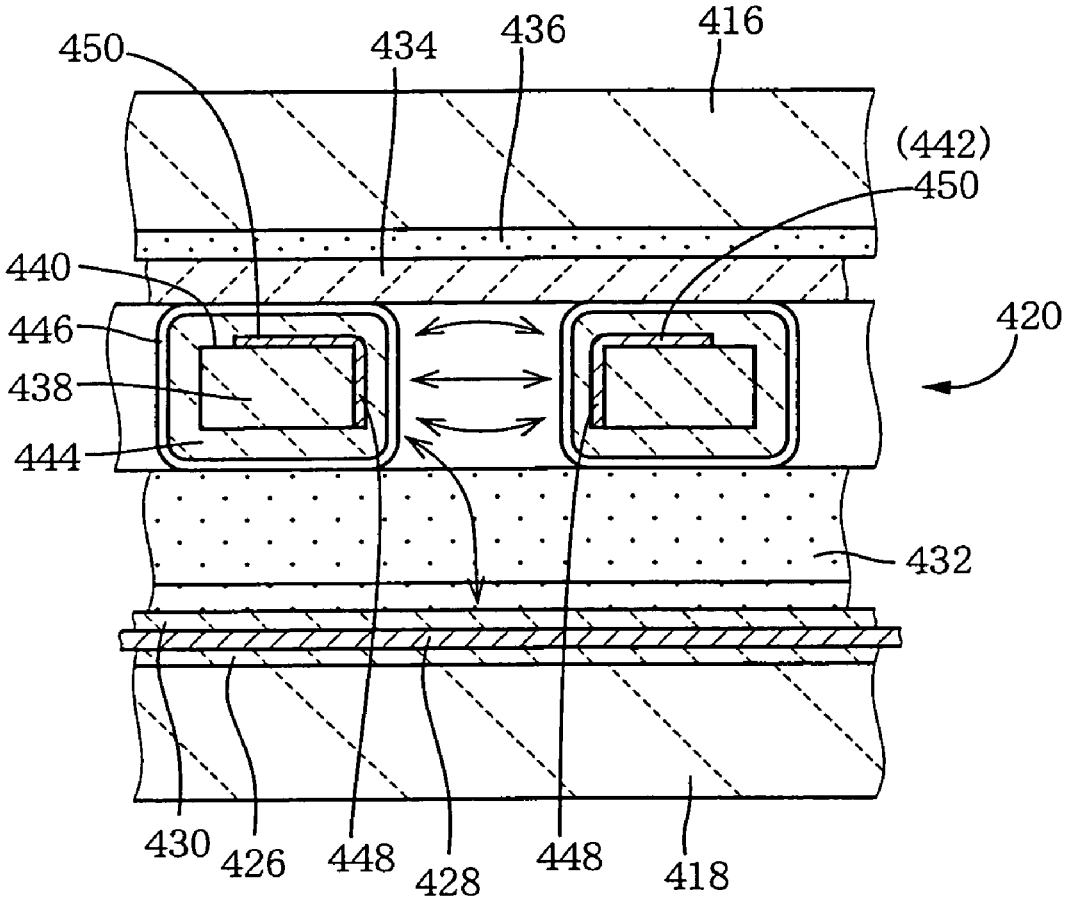
FIG. 26 is a cross-section view for explaining a construction of the PDP of FIG. 25, taken in a lengthwise direction of partition walls thereof.

FIG. 26 is a cross-section view, taken in a lengthwise direction of the partition walls 422 and along a widthwise centerline of one of the writing electrodes 428, for explaining a construction of the PDP 410. The sheet member 420 includes a dielectric core layer 438 which has a grid pattern (see FIG. 25) constituting a skeleton of the grid pattern of the sheet member 420; a sustaining wiring layer 442 which is placed on, and fixed to, an area continuing from one surface 440 (i.e., an upper surface, shown in the figure) of the core layer 438 to respective one side surfaces of the core layer 438 (i.e., respective one inner wall surfaces of the grid pattern thereof); a dielectric cover layer 444 which covers the dielectric core layer 438 and the sustaining wiring layer 442; and a protection film 446 which covers the dielectric cover layer 444 and provides a surface layer of the sheet member 420. In the present embodiment, the sustaining wiring layer 442 provide a conductive thick-film layer.

The dielectric core layer 438 has a thickness of from about 30 (μm) to about 50 (μm), for example, a thickness of 40 (μm), and respective grid bars of the core layer 438 that extend in lengthwise and width directions thereof and cooperate with each other to constitute the grid pattern thereof, have a width which is substantially equal to the width of the partition walls 422 or somewhat greater than the width of the same 422 in consideration of alignment margins, for example, a width of from about 100 (μm) to about 150 (μm). The dielectric core layer 438 is formed of a thick-film dielectric material which contains a low softening point glass, such as $PbO—B_2O_3—SiO_2—Al_2O_3—ZnO—TiO_2$ glasses or a combination of two or more of these glasses, and additionally contains a ceramic filler such as alumina.

The sustaining wiring layer 442 is formed of an electrically conductive thick film which contains, as an electrically conductive component thereof, silver (Ag), chromium (Cr), or copper (Cu), and have a thickness of from about 5 (μm) to about 10 (μm). The sustaining wiring layer 442 includes a plurality of portions 448 which cover respective one side surfaces of the grid bars of the dielectric core layer 438. Those portions 448 function as pairs of sustaining electrodes which produce respective gas discharges in the respective discharge spaces 424. As shown in the figure, each pair of sustaining electrodes 448 are located, on the inner wall surfaces of the grid bars of the sheet member 420, at respective positions where the two sustaining electrodes 448 extend parallel to each other and oppose each other. Thus, the PDP 410 has an opposing discharge structure in which a discharge is produced between two sustaining electrodes 448 opposing each other in each discharge space 424. Thus, each pair of sustaining electrodes 448 are provided in each of the discharge spaces 424. One electrode 448 out of each pair of sustaining electrodes 448 additionally functions as a scanning electrode which cooperates with a corresponding one of the writing electrodes 428 to produce a writing discharge so as to select a light emission unit (i.e., cell), as will be described later; and the other electrode 448 of the each pair functions as a sustaining electrode only.

The dielectric cover layer 444 has a thickness falling in the range of, e.g., from about 10 (μm) to about 30 (μm), for example, a thickness of about 20 (μm), and is formed of a thick film which contains a glass having a low softening point, such as $PbO—B_2O_3—SiO_2—Al_2O_3—ZnO—TiO_2$ glasses or a combination of two or more of these glasses. The dielectric cover layer 444 is employed mainly for the purpose of storing electric charges on an outer surface thereof and thereby causing each pair of sustaining electrodes 448 to produce an alternate-current discharge. In addition, since the cover layer 444 prevents exposure of the thick-film-based sustaining electrodes 448, and thereby restrains the generation of outgas from those electrodes 448 and the change of atmosphere in each discharge space 424.

The protection film 446 has a thickness of e.g., about 0.5 (μm), and is formed of a thin or thick film which contains, e.g., MgO as a main component thereof. The protection film 446 is employed for the purpose of preventing discharge-gas ions from causing sputtering of the dielectric cover layer 444. Since, however, the protection film 446 is formed of a dielectric material having a high secondary electron emission factor, the protection film 446 substantially functions as the discharge electrodes.

Figure 27:
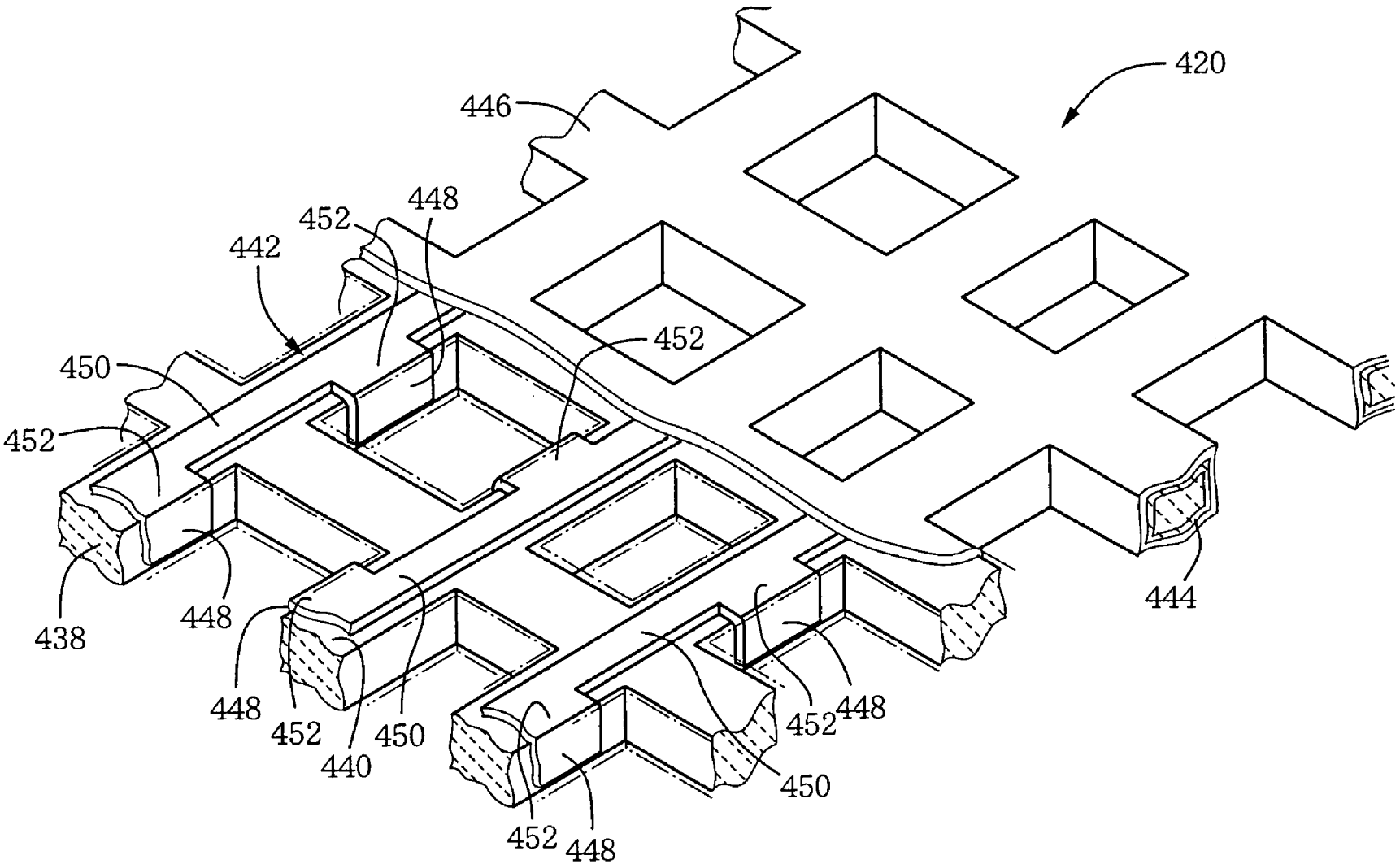
FIG. 27 is a view for explaining a construction of a sheet member of the PDP of FIG. 25.

FIG. 27 is a view for explaining in detail a construction of the sustaining wiring layer 442, with a portion of the sheet member 420 being cut away. In the figure, the sustaining wiring layer 442 includes a plurality of wiring portions 450 which extend in one direction of the grid pattern constituting the sheet member 420. A lengthwise direction of the wiring portions 450 is perpendicular to the lengthwise direction of the partition walls 422, i.e., a lengthwise direction of the writing electrodes 428. Each of the wiring portions 450 has a pre-determined width of from about 50 (μm) to about 80 (μm), and is located on a widthwise middle portion of a corresponding one of the grid bars of the dielectric core layer 438.

Each of the wiring portions 450 includes a plurality of projecting portions 452 which laterally project from a plurality of locations, respectively, that are distant from each other in the lengthwise direction of the each wring portion 450. Thus, each of the projecting portions 452 projects in a direction substantially perpendicular to the lengthwise direction of the each wiring portion 450. Each of the sustaining electrodes 448 is continuous with an end of the projecting portion 452, and extends from the end in a direction perpendicular to the same 452. A width of each sustaining electrode 448 (i.e., a dimension of the same 448 in the lengthwise direction of each wiring portion 450) is, e.g., about 100 (μm); and a height of each sustaining electrode 448 is substantially equal to the thickness of the sheet member 420, i.e., falls in the range of from about 30 (μm) to about 50 (μm), e.g., about 40 (μm).

Figure 28:
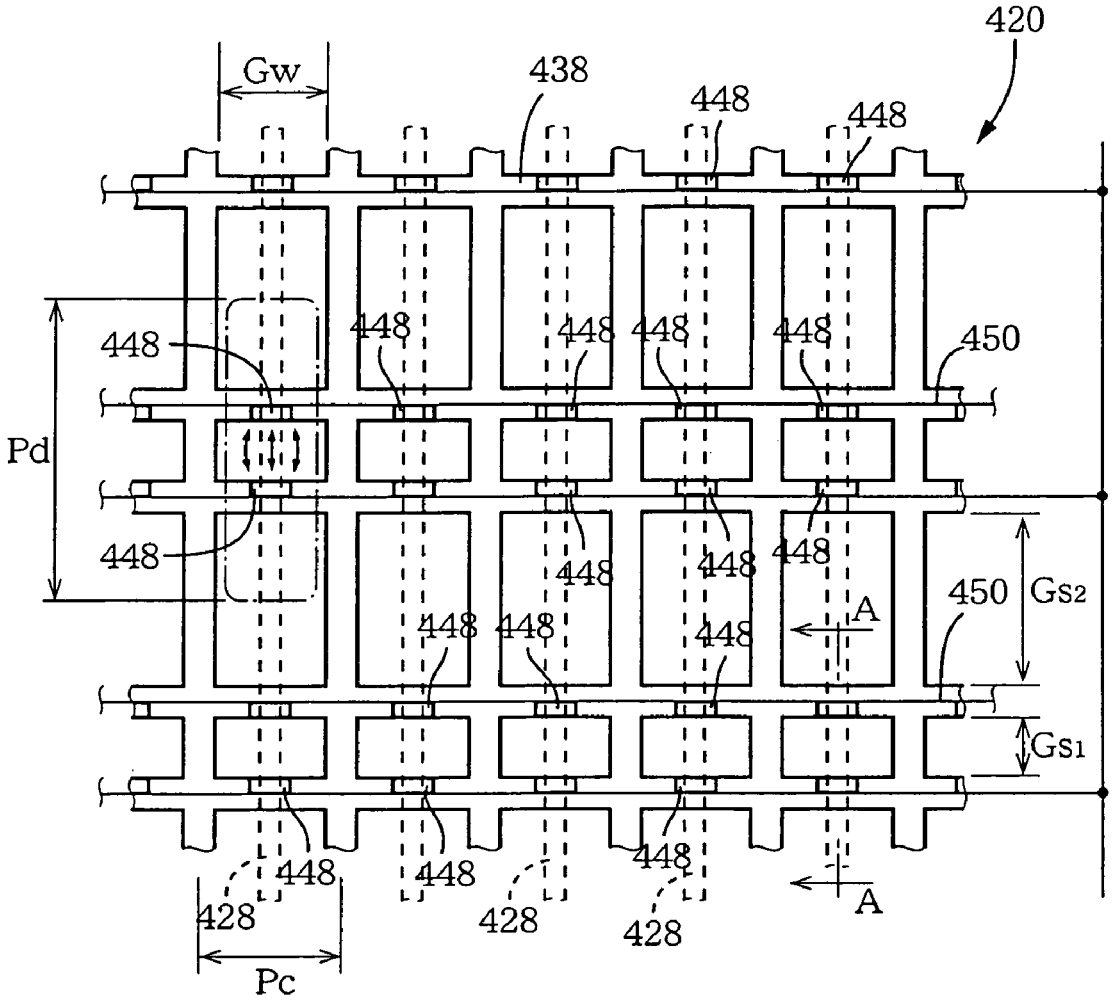
FIG. 28 is a view for explaining a manner in which a wiring layer is formed in the sheet member shown in FIG. 27.

FIG. 28 is a schematic view for explaining a manner in which the plurality of wiring portions 450 of the sustaining wiring layer 442 are connected, and a positional relationship between the wiring portions 450 and the writing electrodes 428. The plurality of wiring portions 450 that extend in a horizontal direction in the figure correspond, one to one, to a plurality of horizontal grid bars of the dielectric core layer 438 that extend in the horizontal direction in the figure. Thus, a plurality of sustaining electrodes 448 that are arranged in each array in the horizontal direction in the figure are connected to a common wiring portion 450. The wiring portions 450 include a first group of wiring portions 450 each of which is independent of all the other wiring portions 450, and a second group of wiring portions 450 all of which are connected to each other, and the wiring portions 450 of the first group and the wiring portions 450 of the second group are alternately arranged in a vertical direction in the figure.

As shown in the figure, the intervals of distance between the grid bars of the sheet member 420 are not uniform. More specifically described, the grid bars of the sheet member 420 that extend in a direction perpendicular to the wiring portions 450 of the sustaining wiring layer 442 are arranged at a regular interval, Gw, of, e.g., about 200 (μm), but the grid bars of the sheet member 420 that extend along the wiring portions 450 of the sustaining wiring layer 442 are arranged such that a relatively small interval, Gs1, of, e.g., about 100 (μm) and a relatively large interval, Gs2, of, e.g., about 600 (μm) are alternate with each other. The sustaining electrodes 448, 448 of each pair oppose each other at the relatively small interval Gs1. As indicated in a left-hand middle portion of FIG. 28, each pair of sustaining electrodes 448, 448 function as a pair of discharge electrodes whose discharge gap is substantially equal to the small interval Gs1, i.e., about 100 (μm). As is apparent from the comparison of FIG. 28 with FIG. 25, the grid bars of the sheet member 420 that extend in the direction perpendicular to the wiring portions 450 are placed on the partition walls 422, respectively. FIG. 26 is a cross-section view taken along A—A in FIG. 28.

When an alternate-current pulse is applied to the first group of wiring portions 450 each of which is independent of the other wiring portions 450 and to which a first group of sustaining electrodes 448 are connected, so as to scan sequentially the same 450, and concurrently an alternate-current pulse is applied to desired ones of the writing electrodes 428 that correspond to data (i.e., the writing electrodes 428 corresponding to the light emission units each selected to emit light), in synchronism with the timing of scanning of the first group of wiring portions 450, so that the desired writing electrodes 428 and the corresponding sustaining electrodes 448 of the first group cooperate with each other to produce respective writing discharges. Thus, electric charges are accumulated on respective portions of the protection films 446 that are located above those sustaining electrodes 448. After the scanning of all the sustaining electrodes 448 functioning as the scanning electrodes is ended in this way, an alternate-current pulse is applied to all pairs of sustaining electrodes 448 via the wiring portions 450, so that the thus applied voltage is added to the electric potential caused by the electric charges accumulated in each of the light emission units corresponding to the above-indicated sustaining electrodes 448 of the first group, so as to exceed a discharge starting voltage. Thus, those sustaining electrodes 448 of the first group and the corresponding sustaining electrodes 448 of the second group cooperate with each other to produce respective discharges, and these discharges are sustained for a pre-determined time by the wall electric charges newly produced on the protection film 446. Consequently the fluorescent layers 432, 436 corresponding to the selected light emission units are excited by ultraviolet lights produced by the gas discharges, and accordingly generate visible lights, so that those lights are outputted through the front plate 416 and thus a desired image is displayed. Each time one-time scanning of the scanning electrodes (i.e., the sustaining electrodes 448) is finished, desired ones of the data electrodes (i.e., the writing electrodes 428), to which the pulse is to be applied, are re-selected, so that desired images are continuously displayed. As is apparent from the above explanation, the first group of sustaining electrodes 448 corresponding to the independent wiring portions 450 function as the scanning electrodes which cooperate with the writing electrodes 428, and additionally function as sustaining electrodes (i.e., image-display discharge electrodes) which cooperate with the second group of sustaining electrodes 448.

As shown in FIG. 28, each discharge is produced between each pair of electrodes 448, 448 that are distant from each other by the small distance Gs1, e.g., about 100 (μm). However, each discharge space 424 is continuous in the vertical direction in the figure. Therefore, the ultraviolet light produced by the discharge is spread, as schematically indicated at one-dot chain line in FIG. 28, outward of the each pair of discharge electrodes 448, 448, in a lengthwise direction of the each discharge space 424. Thus, respective portions of the fluorescent layers 432, 436 that are located, in the each discharge space 424, within the range bounded by the one-dot chain line are excited by the ultraviolet light generated by the discharge produced by the each pair of electrodes 448, 448, indicated in the left-hand middle portion of the figure, and accordingly emit a light.

Therefore, the light emission units (i.e., cells) of the PDP 410 are defined by the partition walls 422 with respect to the direction perpendicular to the same 422, i.e., the horizontal direction in the figure, and are substantially defined by the range to which the ultraviolet light is spread, with respect to the lengthwise direction of the partition walls 422, i.e., the vertical direction in the figure. Thus, an interval of distance between respective centerlines of the light emission cells in the horizontal direction in the figure is a color cell pitch, Pc, of about 0.3 (mm); and an interval of distance between respective centerlines of the light emission cells in the vertical direction in the figure is a dot pitch, Pd, of about 0.9 (mm). In the present color PDP 410 in which the three colors R, G, B are used, three light emission units that are adjacent each other in the horizontal direction in the figure cooperate with each other to define one pixel. Therefore, a pitch of the pixels of the PDP 410 is about 0.9 (mm) with respect to each of the horizontal and vertical directions in the figure.

Thus, in the present embodiment, the sheet member 420 having the grid pattern includes the sustaining wiring layer 442 provided on the one surface 440 of the grid pattern, and the respective portions of the sustaining wiring layer 442 that are fixed to the mutually opposing, inner wall surfaces of the grid bars of the sheet member 420 provide each pair of sustaining electrodes 448, 448. That is, the PDP 410 has the opposing discharge structure in which each pair of discharge surfaces oppose each other. Therefore, as compared with the conventional three-electrode structure in which sustaining electrodes are provided on one plane, the PDP 410 enjoys a higher efficiency. In addition, the PDP 410 is free of the problem that the dielectric cover layer 444 and the protection film 446 are locally deteriorated because of local strengthening of discharge, and accordingly enjoys a longer life expectancy. Moreover, since the PDP 410 has the opposing discharge structure, occurrence of a cross-talk resulting from a gap produced between the partition walls 422 and the front plate 416 can be prevented even if the top ends of the partition walls 422 and/or the front plate 416 may have unevenness.

In addition, the respective discharge surfaces of the sustaining electrodes 448, 448 are located at an intermediate height position that is distant from each of the front and rear plates 416, 418, and the discharge direction in which the discharge electrodes 448 produce the discharges is parallel to each of the respective inner surfaces 412, 414 of the front and rear plates 416, 418. Therefore, the inner surfaces 412, 414 of the two plates 416, 418 are less influenced by the discharge-gas ions, and accordingly the fluorescent layers 432, 436 can be provided in respective wider areas on the inner surfaces 412, 414. Thus, as compared with a surface discharge structure in which fluorescent layers can be provided on only a substrate opposing a substrate to which sustaining electrodes are fixed, the PDP 410 can enjoy a highly increased degree of brightness.

In addition, since the sustaining electrodes 448 are not provided on the front plate 416, a phenomenon that the electrodes 448 each formed of a silver thick film may turn yellow is not observed. Therefore, it is not needed to use, as a component of the material of the sustaining electrodes 448, an expensive black-color conductive material such as ruthenium oxide.

Figure 29:
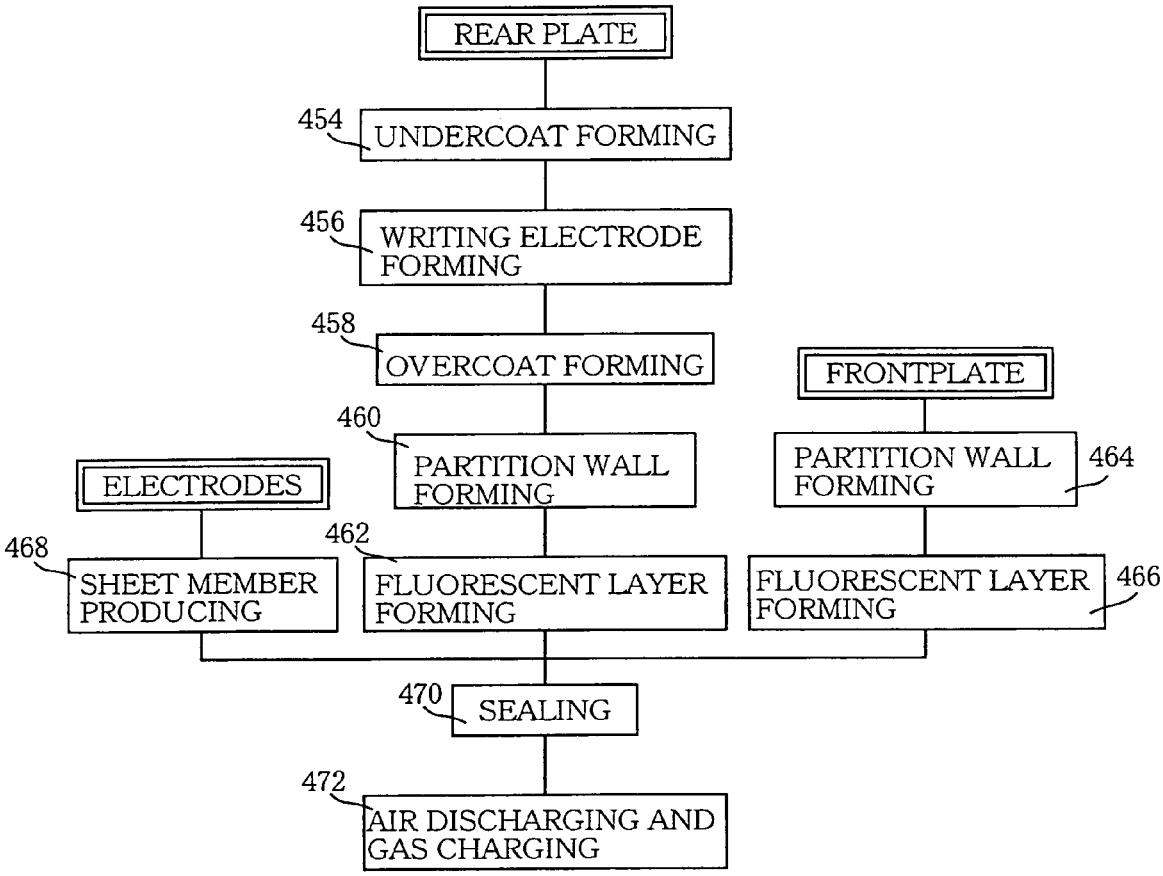
FIG. 29 is a flow chart for explaining a method of producing the PDP of FIG. 25.

Meanwhile, the PDP 410 constructed as described above can be produced, in the method according to the sixth invention, by assembling the sheet member 420, the front plate 416, and the rear plate 418 that are processed (or produced) independent of each other according to the flow chart shown in FIG. 29.

The rear plate 418 is processed as follows: First, in an undercoat forming step 454, a thick-film insulating paste is applied to the flat inner surface 414 of the rear plate 418 prepared, and then the applied paste is fired to form the previously-described undercoat 426. Subsequently, in a writing electrode forming step 456, the previously-described writing electrodes 428 are formed, using a thick-film conductive paste such as a thick-film silver paste and using, e.g., a thick-film screen printing method or a lithograph method, on the undercoat 426. Then, in an overcoat forming step 458, a thick-film insulating paste including a low softening point glass and an inorganic filler is repeatedly applied to cover a substantially entire surface of the undercoat 426 on which the writing electrodes 428 have been formed, and then the applied paste is fired to form the overcoat 430.

Next, in a partition wall forming step 460, a thick-film insulating paste containing, as main components thereof, a low softening point glass and an inorganic filler, is printed and dried, and then the paste is fired at a temperature of, e.g., from about 500 (° C.) to about 650 (° C.) so as to obtain the partition walls 422. In the case where a desired height of the partition walls 422 cannot be obtained by one-time printing of the paste, the printing and the drying are repeated, as needed. This is true with each of the above-described undercoat forming step 454 and the overcoat forming step 458. Subsequently, in a fluorescent layer forming step 462, a thick-film screen printing method or a pouring method is used to apply each of three kinds of fluorescent pastes corresponding to the three colors R, G, B, to a corresponding one of the respective spaces between the partition walls 422 and then fire the applied pastes at a temperature of, e.g., about 450 (° C.) so as to obtain the fluorescent layers 432.

The front plate 416 is processed as follows: First, in a partition wall forming step 464 like the above-described step 460, a thick-film forming technique such as a thick-film screen printing method is used to print repeatedly a thick-film insulating paste containing, as main components thereof, a low softening point glass and an inorganic filler, to the inner surface 412 of the front plate 416 and dry the printed paste. Subsequently, the printed paste is fired at a heat treatment temperature that falls in the range of, e.g., from about 500 (° C.) to about 650 (° C.), depending upon the kind of the paste used. Thus, the previously-described partition walls 434 are obtained. Subsequently, in a fluorescent layer forming step 466, a technique such as a thick-film screen printing method or a pouring printing is used to apply, from above the partition walls 434, each of three kinds of fluorescent pastes corresponding to the three colors R, G, B, to a corresponding one of the respective spaces between the partition walls 434 and then fire the applied pastes at a temperature of, e.g., about 450 (° C.) so as to obtain the fluorescent layers 436.

The sheet member 420 is produced in a sheet member producing step 468. The front and rear plates 416, 418 are superposed on each other via the sheet member 420, and are subjected, in a sealing step 470, to a heat treatment so that the two plates 416, 418 and the sheet member 420 are gas-tightly sealed with a sealing material, such as a sealing glass, that is applied in advance on respective interfaces of the same 416, 418, 420. Before this sealing step, the sheet member 420 may be fixed, as needed, to either one of the front and rear plates 416, 418, using a glass frit. Finally, in an air discharging and gas charging step 472, air is discharged from the thus obtained, gas-tight container, and an appropriate discharge gas is charged into the same so as to obtain the PDP 410.

Figure 30:
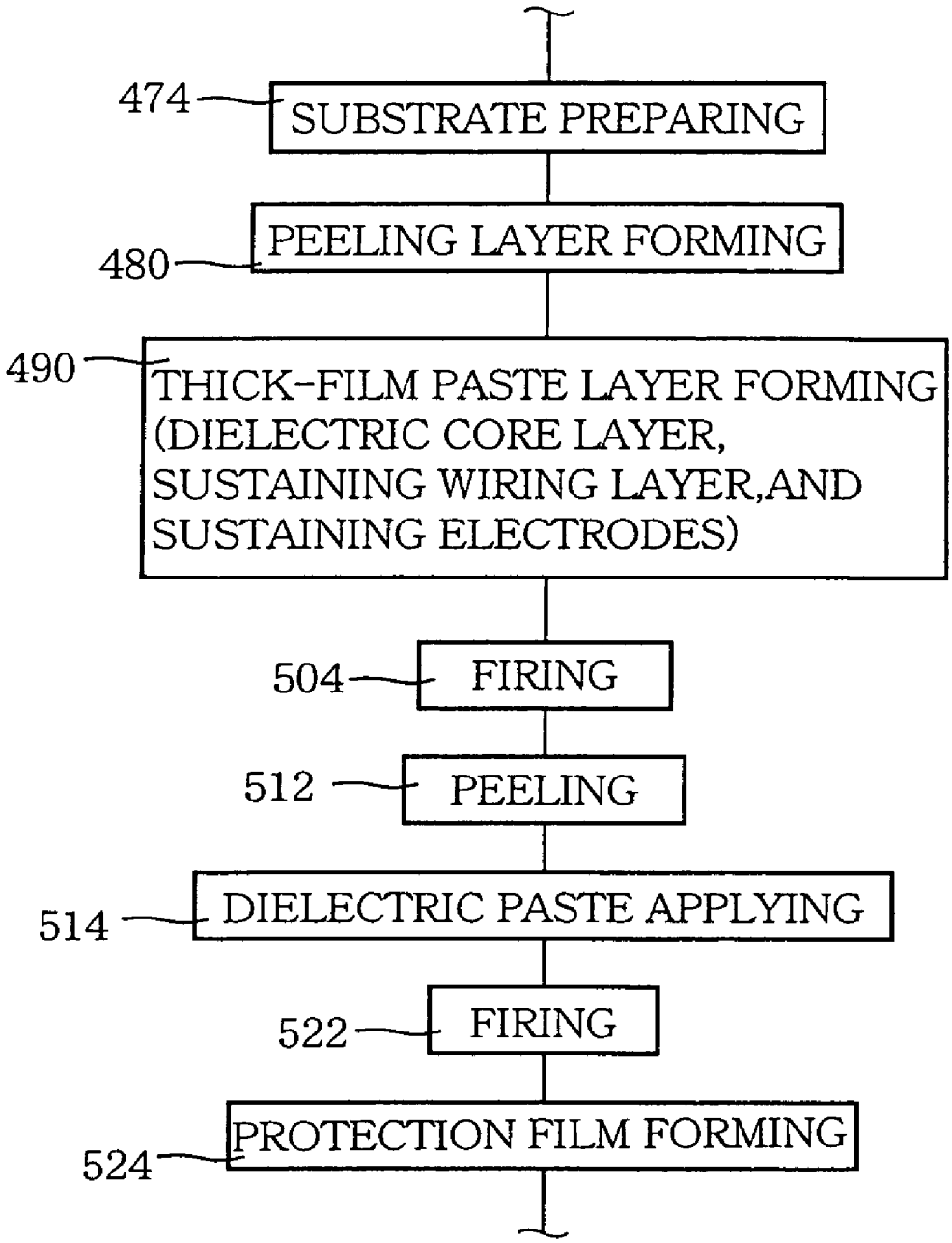
FIG. 30 is a flow chart for explaining a method of producing the sheet member.

In the above-described producing method, the sheet member producing step 468 is carried out according to the flow chart, shown in FIG. 30, in which a well known thick-film printing technique is used. Hereinafter, the method of producing the sheet member 420 will be explained by reference to FIGS. 31(*a*) through 31(*e*) and FIGS. 32(*f*) through 32(*h*) that show respective states in essential steps of the producing method.

First, in a substrate preparing step 474, a substrate 476 (see FIG. 31) on which a thick-film printing is to be carried out, is prepared, and a surface 478 of the substrate 476 is subjected to an appropriate cleaning treatment. This substrate 476 is preferably provided by a glass substrate formed of, e.g., a soda lime glass that exhibits substantially no deformation or deterioration in a heat treatment, described later, and has a thermal expansion coefficient of about $87\times10^{-7}$ (/° C.), a softening point of about 740 (° C.), and a distorting point of about 510 (° C.). The substrate 476 has a thickness of from about 2 (mm) to about 3 (mm), e.g., about 2.8 (mm), and the surface 478 of the substrate 476 is sufficiently larger than that of the sheet member 420.

Figure 31:
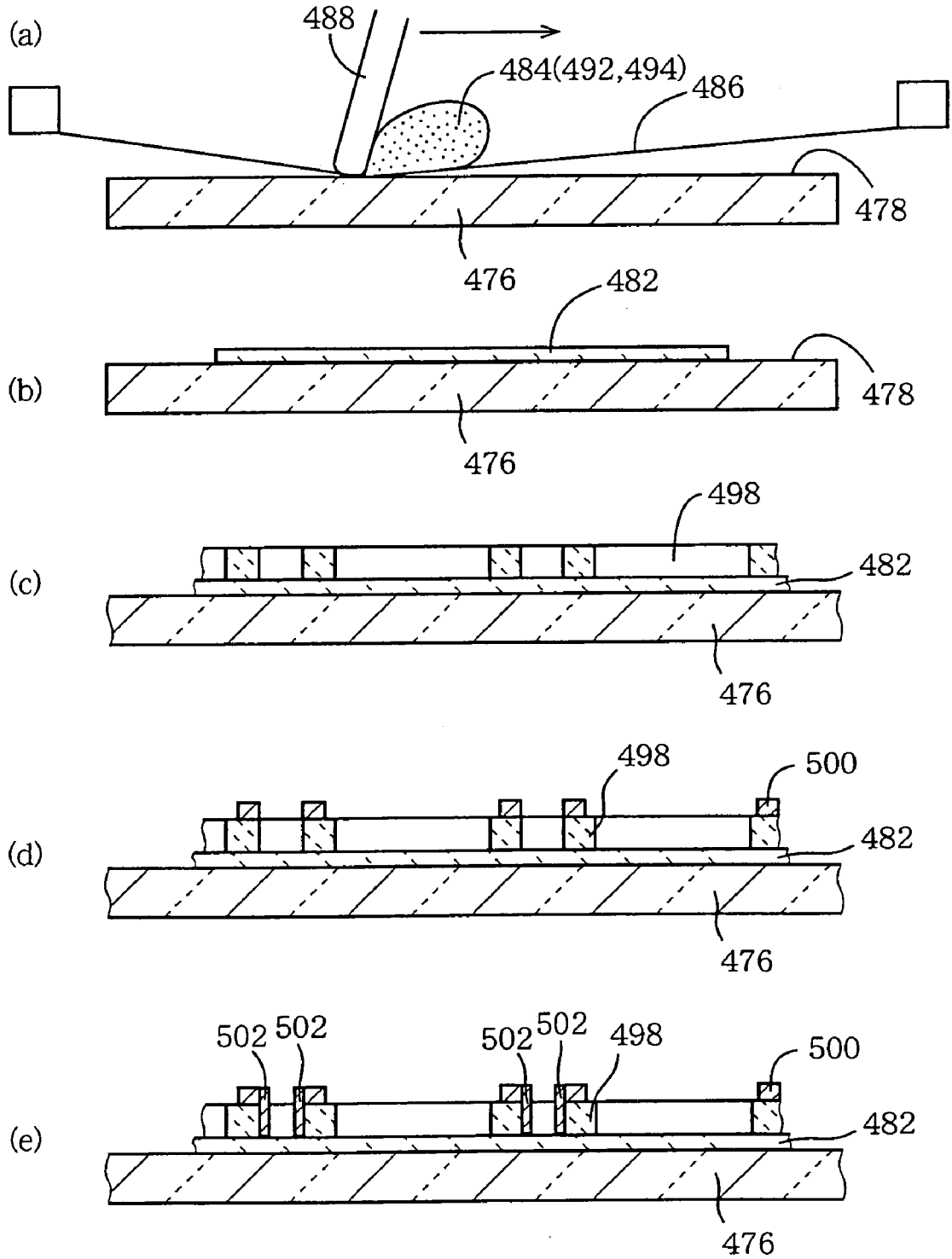
FIGS. 31(*a*) through 31(*e*) are views showing a substrate and one or more thick films, in respective essential steps out of the producing steps shown in FIG. 30.

Subsequently, in a peeling layer forming step 480, a peeling layer 482 that consists of particles having a high melting point and bound to each other with a resin, and has a thickness of, e.g., from about 5 (μm) to 50 (μm), is provided on the surface 478 of the substrate 476. The high melting point particles may be a mixture of a high softening point glass frit having an average particle size of from 0.5 (μm) to 3 (μm), and a ceramic filler, such as alumina or zirconia, having an average particle size of from 0.01 (μm) to 5 (μm), e.g., about 1 (μm) and a percentage of from about 30 (%) to 50 (%). The high softening point glass may be a glass having a high softening point not lower than, e.g., about 550 (° C.), and the high melting point particles as the mixture may have a softening point not lower than, e.g., about 550 (° C.). The resin may be an ethyl cellulose resin that is burned out at, e.g., 350 (° C.). The peeling layer 482 is formed, as shown in FIG. 31(*a*), on a substantially entire surface of the substrate 476 in such a manner that an inorganic material paste 484 in which the high melting point particles and the resin are dispersed in an organic solvent such as butyl carbitol acetate (BCA) or terpineol is applied to substantially the entire surface of the substrate 476, by a screen printing method, and subsequently the applied paste 484 is dried in a drying furnace, or at room temperature. However, the peeling layer 482 may be formed using a coater, or by adhesion of a film laminate. The drying furnace is preferably provided by a far infrared drying furnace that can be sufficiently ventilated so that the layer can enjoy an excellent surface roughness and the resin can be uniformly dispersed. FIG. 31(*b*) shows a step in which the peeling layer 482 is thus formed on the substrate 476. In FIG. 31(*a*), numeral 486 designates a screen; and numeral 488 designates a squeegee. In the present embodiment, the substrate 476 and the peeling layer 482 formed thereon cooperate with each other to provide a support member; the surface of the peeling layer 482 provides a film formation surface on which films are formed; and the substrate preparing step 474 and the peeling layer forming step 480 cooperate with each other to provide a support member preparing step.

Subsequently, in a thick-film paste layer forming step 490, a thick-film conductive paste 492 for forming the sustaining wiring layer 442 and the sustaining electrodes 448, and a thick-film dielectric paste 494 (see FIG. 31(*a*)) for forming the dielectric core layer 438 are sequentially applied, each in a predetermined pattern, on the peeling layer 482, and then dried, by utilizing, e.g., the screen printing method, like in the step 480 in which the inorganic material paste 484 is applied. Thus, a dielectric thick layer 498 constituting the dielectric core layer 438, a conductive printed layer 500 constituting the wiring portions 450 and the projecting portions 452 of the sustaining wiring layer 442, and a conductive printed layer 502 constituting the sustaining electrodes 448 are formed in the order of description. The thick-film conductive paste 492 may be obtained by dispersing, in an organic solvent, a mixture of powder of conductive material, such as powder of silver; a glass frit; and a resin. The thick-film dielectric paste 494 may be obtained by dispersing, in an organic solvent, a mixture of powder of dielectric material such as powder of alumina or zirconia; a glass frit; and a resin. Each glass frit is, e.g., a low softening point glass such as $PbO—B_2O_3—SiO_2—Al_2O_3—TiO_2$ glasses, and each resin and each organic solvent are, e.g., the same resin and organic solvent that are used to obtain the inorganic material paste 484.

For the purpose of forming the wiring portions 450 and the projecting portions 452 of the sustaining wiring layer 442, and the dielectric core layer 438, those screens 486 are used which have respective slot patterns corresponding to the respective shapes of the layers 442, 438, shown in FIGS. 25 and 27. The thick-film conductive paste 492 and the thick-film dielectric paste 494 are so applied as to have respective predetermined thickness values which assure that the layers 442, 438 have the above-described thickness values after being fired and shrunk. Meanwhile, for the purpose of forming the sustaining electrodes 448, such a screen 486 is used which has slots that are slightly offset inward of the inner wall surfaces of the grid pattern of the dielectric core layer 438, so that the thick-film conductive paste 492 applied flow down from the upper surface of the dielectric core layer 438 along the inner wall surfaces of the same 438. FIGS. 31(*c*) through 31(*e*) show respective steps in which the dielectric printed layer 498, the conductive printed layer 500, and the conductive printed layer 502 are formed. Since the respective thickness values of the conductive printed layers 500, 502 fall in the range of from about 5 (μm) to about 10 (μm), each of the layers 500, 502 can be formed in a single printing operation. However, since the dielectric printed layer 498 has the thickness of about 30 (μm), the layer 498 is formed by repeating, e.g., three printing and drying operations and thereby stacking three layers on each other that have an appropriate thickness in total. Meanwhile, the thick-film conductive paste 492 used for forming the conductive printed layer 502 is prepared such that the paste 492 flows downward along the inner wall surfaces of the dielectric printed layer 498. For example, the prepared paste 492 has a considerably low viscosity of from 10 (Pa·s) to 50 (Pa·s). When the thick-film conductive paste 492 flows down onto the peeling layer 482, the solvent of the conductive paste 492 is absorbed by the peeling layer 482, so that the paste 492 is not spread on the surface of the layer 482.

Figure 32:
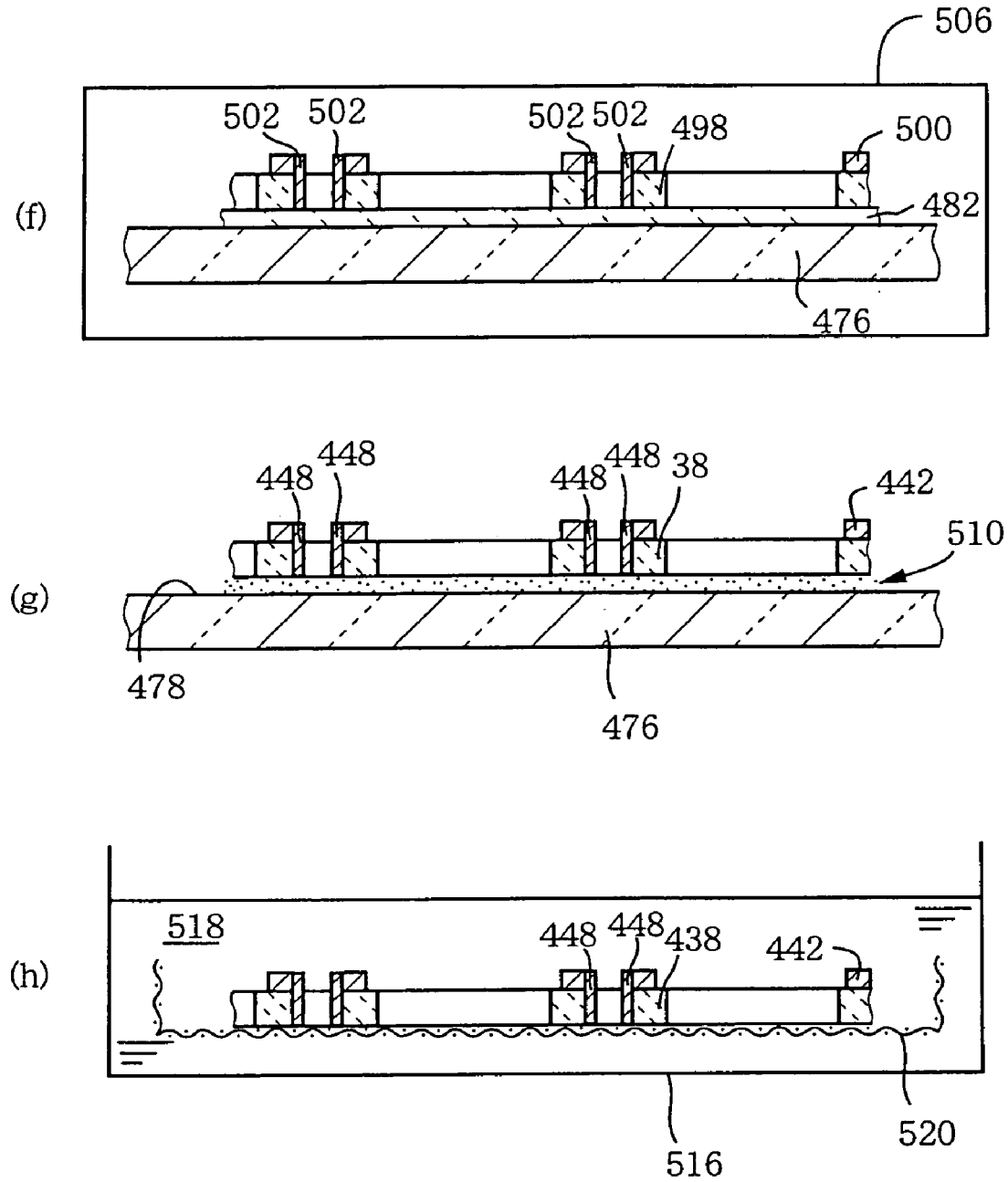
FIGS. 32(*f*) through 32(*h*) are views showing the substrate and the thick films in respective essential steps out of the producing steps shown in FIG. 30 that follow the step shown in FIG. 31(*e*).

After the thick-film printed layers 498, 500, 502 are formed in this way and then dried to remove the solvents, a firing step 504 is carried out. In the firing step 504, the substrate 476 is put in a furnace 506 of an appropriate firing device, and is subjected to a heat treatment at a firing temperature, e.g., 550 (° C.), corresponding to each of the thick-film conductive paste 492 and the thick-film dielectric paste 494. FIG. 32(*f*) shows a step in which the heat treatment is carried out.

A sintering temperature of each of the thick-film printed layers 498, 500, 502 is, e.g., about 550 (° C.). Therefore, during the heat treatment, the resins are burned, and the dielectric material, the conductive material, and the glass frit are sintered. Thus, the dielectric core layer 438 and the conductive thick-film layers (i.e., the sustaining wiring layer 442 and the writing wiring layer 440), that is, a basic portion of the sheet member 420 is produced. FIG. 32(*g*) shows this state. As described above, the peeling layer 482 includes the inorganic material particles whose softening point is not lower than 550 (° C.). Therefore, the resin is burned by firing, but the high melting point particles (i.e., the glass powder and the ceramic filler) are not sintered. Thus, as the heat treatment progresses, the resin is removed and accordingly the peeling layer 482 is processed into a particle layer 510 consisting of the high melting point particles 508 (see FIG. 33) only.

Figure 33:
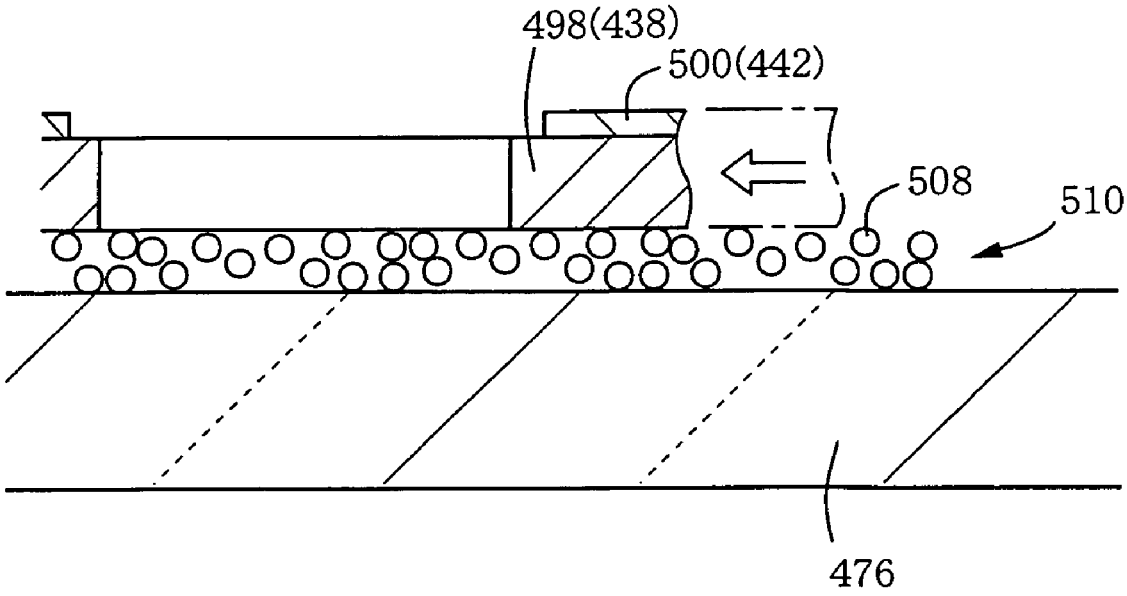
FIG. 33 is a view for explaining a manner in which the thick films are shrunk in a firing step shown in FIG. 30.

FIG. 33 is an enlarged, illustrative view corresponding to right-hand end portions of the thick-film printed layers 498 through 502, shown in FIG. 32(*g*), and showing how the sintering process progresses in the heat treatment. The particle layer 510, produced by removing, by firing, the resin from the peeling layer 482, is a layer consisting of the high melting point particles 508 that just are gathered and are not bound to each other. Therefore, when the respective end portions of the thick-film printed layers 498 to 502 are shrunk from a position before firing, indicated at one-dot chain line in the figure, the high melting point particles 508 function as rollers. Thus, there are produced no forces that resist the shrinking of the printed layers 498 to 502, at an interface between a lower surface of the layers 498 to 502 and an upper surface of the substrate 476. Therefore, a lower portion of the layers 498 to 502 shrinks similarly to an upper portion of the same. Thus, the layers 498 to 502 are free of the difference of density and/or warpage resulting from the difference of amounts of shrinkage.

In the present embodiment, when the sintering of the thick-film printed layers 498 to 502 is started, the substrate 476 does not resist, owing to the presence of the particle layer 510, the sintering and shrinking of the layers 498 to 502. Thus, the thermal expansion of the substrate 476 does not substantially influence the quality of the thick films thus produced. However, in the case where the substrate 476 is repeatedly used or the heat treatment is carried out at a higher temperature, it is possible to use a heat-resisting glass having a still higher distorting point (e.g., a borosilicate glass having a thermal expansion coefficient of about $32\times10^{-7}$ (/° C.) and a softening point of about 820 (° C.), or a quartz glass having a thermal expansion coefficient of about $5\times10^{-7}$ (/° C.) and a softening point of about 1580 (° C.)). In this case, too, the amount of thermal expansion of the substrate 476 is small in a temperature range in which the binding force of the dielectric material powder is small, and accordingly the thermal expansion does not influence the quality of the thick films produced.

Back to FIG. 30, in a peeling step 512, the thus produced thick films, i.e., the dielectric core layer 438 and the wiring layer 442 that are stacked on each other, are peeled from the substrate 476. Since the particle layer 510 interposed between the layers 438, 442 and the substrate 476 consists of the high melting point particles 508 just being gathered, the peeling operation can be easily carried out without using any agents or tools. Although the high melting point particles 508 may adhere, with a thickness corresponding to one layer of particles 508, to the layers 438, 442, those particles 508 can be removed, as needed, using an adhesive tape or an air blower. The substrate 476 from which the thick films have been peeled can be used again and again for similar purposes, because the substrate 476 is not deformed or deteriorated at the above-described firing temperature.

Subsequently, in a dielectric paste applying step 514, the thus peeled layers 438, 442 are dipped in a dielectric paste 518 accommodated in a dipping tank 516, so that the dielectric paste 518 is applied to the entire outer surfaces of those layers. The dielectric paste 518 may be obtained by dispersing, in a solvent such as water, a mixture of powder of a glass such as $PbO—B_2O_3—SiO_2—Al_2O_3—TiO_2$ glasses or a combination of two or more of those glasses, and a resin such as PVA. The dielectric paste 518 is so prepared as to have a viscosity lower than that of the thick-film dielectric paste 494. It is possible to use, as the above-indicated glass powder, one which does not contain lead and whose softening point is not lower than 630 (° C.). This softening point is equal to, or higher than, that of the glass powder contained in the thick-film dielectric paste 494. The reason why the paste 518 prepared to have the low viscosity is used is to prevent air bubbles from being mixed with the paste 518 when the paste 518 is applied, and thereby prevent the fired product from suffering defects. The layers 438, 442 are slowly dipped in the dielectric paste 518, and then taken out from the same 518, while being supported on a wire net 520 such that those layers take a horizontal posture.

Subsequently, in a firing step 522, the layers 438, 442 that have been taken out from the dipping tank 516 and then dried sufficiently, is put in a firing furnace, so that those layers are subjected to a heat treatment (i.e., a firing process) in which the layers are fired at a pre-determined temperature of, e.g., about 650 (° C.) that corresponds to the kind of the glass powder contained in the dielectric paste 518. This firing temperature is so pre-determined as to be sufficiently higher than the softening point of the glass powder, so that the glass powder may sufficiently soften and provide a compact dielectric layer (i.e., the dielectric cover layer 444). Therefore, the thus obtained dielectric cover layer 444 is free of porosity that would otherwise result from grain boundaries of the glass powder, and enjoys a high withstand voltage. In the present embodiment, the electric paste applying step 514 and the firing step 522 cooperate with each other to provide a covering step.

Figure 34:
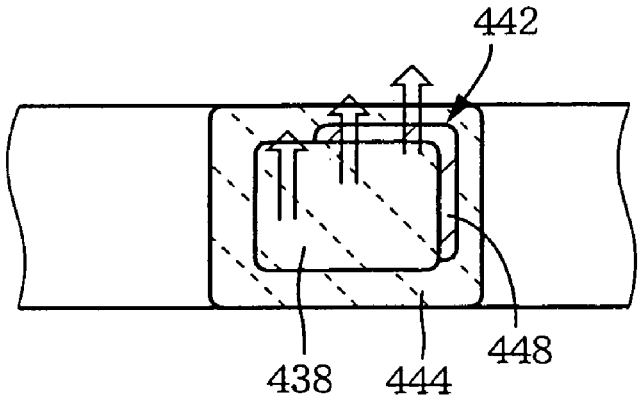
FIG. 34 is a view for explaining a direction in which gas moves out of a dielectric cover layer in the firing step.

In the case where the firing step 522 is carried out at a considerably high temperature, gas is produced from the dielectric core layer 438 and the sustaining wiring layer 442 that are located inside, because the organic components remaining in those layers 438, 442 are burned. This gas produces bubbles in the dielectric cover layer 444, and those bubbles move upward as indicated at arrows in FIG. 34. Therefore, the bubbles produced in the cover layer 444 gather in an upper portion thereof as seen in the figure, and do not gather in the respective portions thereof that function as the discharge surfaces, i.e., cover the side surfaces of the dielectric core layer 438. Thus, even if the treatment temperature used in the firing step 522 may be considerably high, the high temperature does not cause any bubbles to be produced in the portions of the dielectric cover layer 444 that cover the sustaining electrodes 448. That is, a high firing temperature can be used to increase the degree of compactness of the layer 444 and thereby improve the properties of the same 444 such as a withstand voltage.

Then, in a protection film forming step 524, the protection film 446 is formed with a desired thickness on a substantially entire surface of the dielectric cover layer 444, e.g., by dipping and firing, or by a thick-film forming process such as electronic-beam method or sputtering. Thus, the sheet member 420 is obtained. Since the protection film 446 is thin as described above, it is considerably difficult to form the protection film 446 with a uniform thickness, by a thick-film forming process such as dipping. However, in the present embodiment, the respective distances between the pairs of sustaining electrodes 448, 448 are uniform, because each pair of electrodes 448 produce an electric discharge while opposing each other. Therefore, irrespective of what shape the surface of the protection film 446 may have, local discharge hardly occurs. Thus, the protection film 446 is not required to be so highly uniform as a layer is required which is employed in the above-described surface discharge structure. In addition, the protection film 446 is not present on a path of emission of light, the film 446 is not required to be transparent.

Thus, in the present embodiment, when the front and rear plates 416, 418 are superposed on, and fixed to, each other to obtain the PDP 410, the sheet member 420 including the sustaining wiring layer 442 produced as described above, is fixed to the front or rear plate 416, 418, so that the sustaining electrodes 448 are provided in the discharge spaces 424. Since the sheet member 420 includes the sustaining wiring layer 442 as the thick-film conductive layer constituting the sustaining electrodes 448, the sustaining electrodes 448 can be provided by just placing the sheet member 420 between the front and rear plates 416, 418. Thus, the PDP 410 is advantageously freed of the problem with the case where discharge electrodes are formed, by using a heat treatment, on the front plate 416, i.e., the problem that the front plate 416 and the electrodes 448 are distorted because of the heat treatment. Therefore, the three-electrode-structure AC-type PDP 410 that is free of the distortions caused by the heat treatment that would otherwise be carried out to form the electrodes, can be produced by a simple method. Thus, the present method does not need any complicated processes in which a $SiO_2$ coat, an ITO film, and/or bus electrodes are provided.

In addition, in the present embodiment, on the film formation surface defined by the peeling layer 482 having the higher melting point than the respective sintering temperatures of the thick-film conductive paste 492 and the thick-film dielectric paste 494, the dielectric printed layer 498 and the conductive printed layers 500 are formed in the respective predetermined patterns and, subsequently, are subjected to the heat treatment at the sintering temperature, so as to obtain the sheet member 420 including the dielectric core layer 438 and the thick-film conductive layer that is formed on the surface 440 of the core layer 438 and constitute the sustaining wiring layer 442. Although the peeling layer 482 is not sintered at the heat treatment temperature, the resin of the layer 482 is burned out, and accordingly the particle layer 510 consisting of only the high melting point particles 508 is obtained. Since, therefore, the thus produced thick films are not fixed to the substrate 476, those thick films can be easily peeled from the surface 478 of the substrate 476. Thus, the sheet member 420 constituting the sustaining electrodes 448 can be easily produced and can be easily used to produce the PDP 410.

In addition, in the present embodiment, the support member to which the thick-film pastes 492, 494 are applied is constituted by the substrate 476 and the peeling film 482 formed on the surface 478 of the substrate 476. Therefore, even after the heat treatment, the support member can maintain its shape. Thus, the sheet member 420 can be more easily dealt with after being produced, than in the case where the support member would be constituted by the peeling layer 482 only. Since the peeling layer 482 is located between the thick-film printed layers 498 to 502 and the substrate 476, the substrate 476 does not bind those layers 498 to 502 when those layers are subjected to the heat treatment. Therefore, the substrate 476 does not have any limitations with respect to its degree of flatness and/or its degree of surface roughness. For example, in the case where the surface 478 of the substrate 476 is warped, the thick-film printed layers 498 to 502 are also warped following the warped surface 478. Since, however, the sheet member 420 has a sufficiently high degree of flexibility even after being fired, the sheet member 420 can follow, when being placed on a flat surface, that flat surface and become flat.

In addition, in the present embodiment, the thick-film layers 498 to 502 are formed by the thick-film printing method. Therefore, the PDP 410 can be produced using the simple equipment and without wasting the materials. Thus, the PDP 410 can be produced at low cost.

In addition, in the present embodiment, the thick-film screen printing method is used to form the thick films and accordingly no so-called wet processes are used. Thus, it is not needed to treat the waste water. The wet processes have the problem that if a solution permeates the films and remains in the same, it may cause the generation of outgas from the vacuum container obtained by adhering the front and rear plates 416, 418 to each other. To avoid this problem, materials having a higher heat-resisting temperature are used and, after the container is gas-tightly sealed, air is discharged at a higher temperature or in a longer time period. Those measures, however, lead to increasing the load of the processes.

EIGHTH EMBODIMENT

Figure 35:
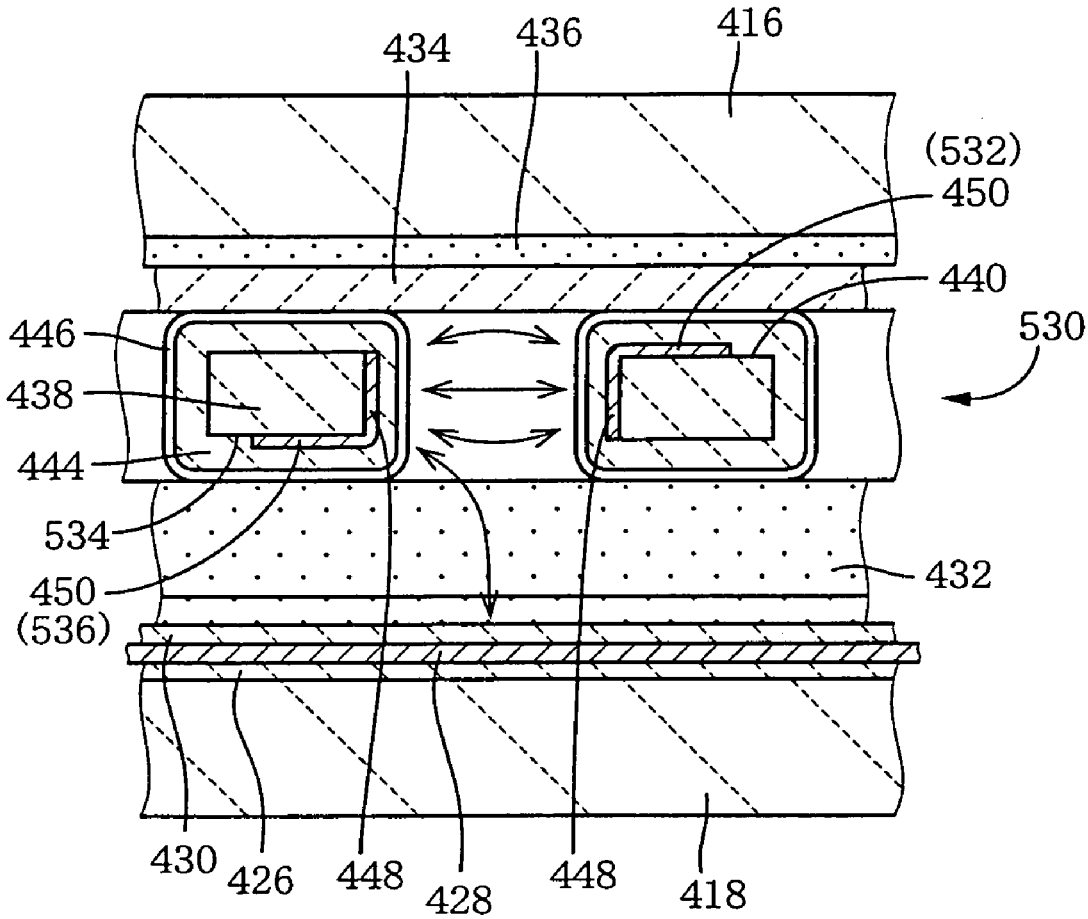
FIG. 35 is a cross-section view corresponding to FIG. 26, for explaining another sheet member employed by another PDP according to the present invention.
Figure 36:
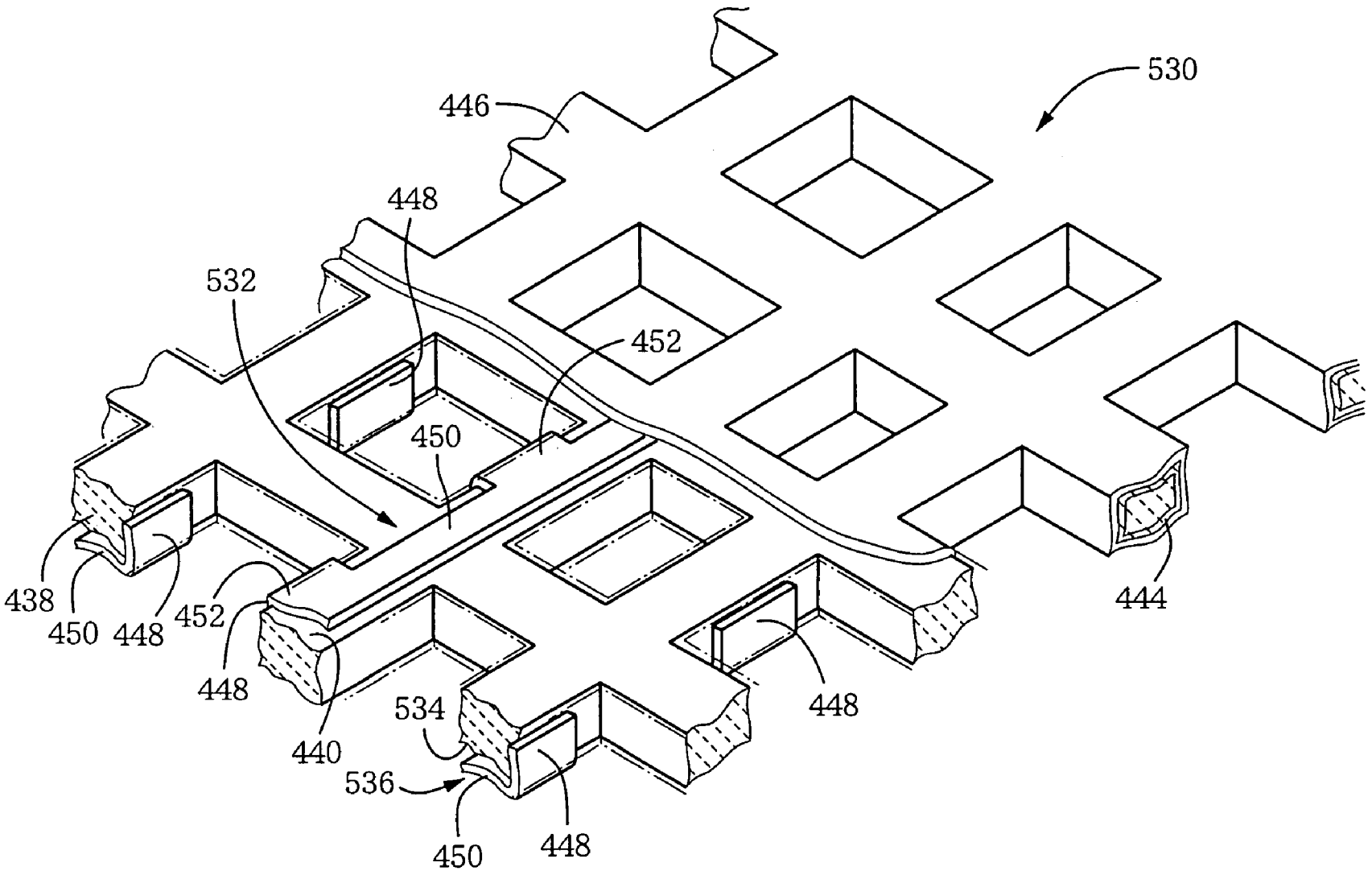
FIG. 36 is a perspective view corresponding to FIG. 27, for explaining an entire structure of the sheet member of FIG. 35.

FIGS. 35 and 36 are views corresponding to FIGS. 26 and 27, respectively, for explaining a construction of a sheet member 530 which can be employed by another PDP as another embodiment according to the fifth invention. In the present embodiment, a sustaining wiring layer 532 in place of the above-described sustaining wiring layer 442 is provided on one surface 440 of a dielectric core layer 438, and a sustaining and scanning wiring layer 536 is provided on the opposite surface 534 of the core layer 438. The sustaining wiring layer 532 differs from the sustaining wiring layer 442 in that wiring portions 450 of the former sustaining wiring layer 532 are provided along every second grid bar of the dielectric core layer 438. The sustaining and scanning wiring layer 536 consists of similar wiring portions 45 which are provided along every second grid bar of the core layer 438 that differs from the every second grid bar along which the wiring portions 450 of the sustaining wiring layer 532 are provided. The sustaining and scanning wiring layer 536 include sustaining electrodes 448 which are continuous with a plurality of locations of each of the wiring portions 450 thereof in a lengthwise direction of the each wiring portion 450 and extend along respective inner wall surfaces of a grid pattern of the dielectric core layer 438. Thus, the sheet member 530 includes a plurality of pairs of electrodes 448, 448 each pair of which oppose each other in a corresponding one of a plurality of grid spaces of the dielectric core layer 438.

Since the respective wiring portions 450 of the sustaining wiring layer 532 and the respective wiring portions 450 of the sustaining and scanning wiring layer 536 are alternate with each other, such that each pair of respective wiring portions 450 of the two layers 532, 536 that are adjacent each other are provided on the opposite surfaces 440, 534 of the dielectric core layer 438, respectively, surface discharges are advantageously prevented from being produced between the wiring portions 450 and/or between projecting portions 452.

The above-described sheet member 530 can be produced by a method similar to the method of producing the sheet member 420. In the similar method, a conductive printed layer constituting the sustaining and scanning wiring layer 536 is formed prior to the formation of the dielectric printed layer 498. A first conductive printed layer 502 constituting the sustaining electrodes 448 corresponding to the sustaining wiring layer 532 and a second conductive printed layer 502 constituting the sustaining electrodes 448 corresponding to the sustaining and scanning wiring layer 536 can be formed by applying, after conductive printed layers 500 are formed, a conductive paste onto those conductive printed layers 500, respectively.

NINTH EMBODIMENT

Figure 37:
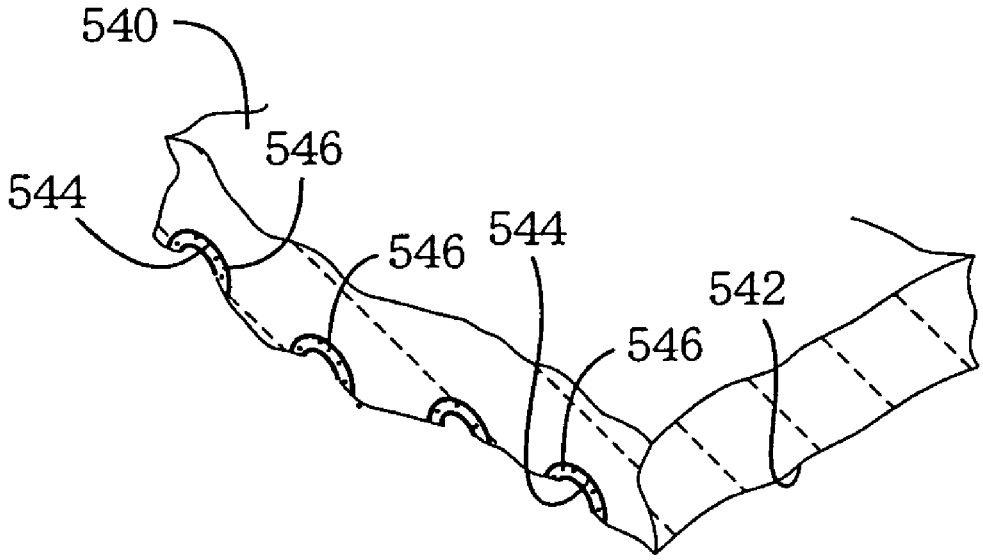
FIG. 37 is a view for explaining a construction of another front plate which may be employed by the PDP of FIG. 25.

FIG. 37 is a view for explaining a construction of a front plate 540 which can be used in place of the front plate 416. In the figure, the front plate 540 has the same dimensions and shape as those of the front plate 416, and is formed of the same material as that used to form the plate 416. However, an inner surface 542 of the front plate 540 that is located in a gas-tight space has, in place of the partition walls 434, a plurality of grooves 544 which extend parallel to each other in one direction, such that a plurality of ridges present between the grooves 544 are located at the respective same positions as the positions where the partition walls 434 are located on the front plate 416, and such that a plurality of fluorescent layers 546 are provided in the grooves 544, respectively. Since this front plate 540 allows the sheet member 420 to be placed on the inner surface 542 thereof without contacting the fluorescent layers 546, the PDP can enjoy a high degree of brightness like the PDP 410 having the front plate 416 on which the partition walls 434 are provided. In addition, since the grooves 544 can be easily formed by, e.g., grinding, the front plate 540 can be produced in a simpler method than the method in which the partition walls 434 are formed by the thick-film forming process.

The above-described seventh through ninth embodiments relate to the cases where the fifth and sixth inventions are applied to the full-color AC-type PDP 410 and the method of producing the same 410, respectively. However, likewise, those inventions may be applied to a monochrome AC-type PDP and a method of producing the same, respectively.

The PDP 410 as the seventh embodiment employs the fluorescent layers 432, 436 that correspond to the three colors, and display a full-color image. However, likewise, the fifth and sixth inventions may be applied to such PDPs that employ fluorescent layers corresponding to one or two colors.

The thickness value of the sheet member 420, 530 and the respective thickness values of the dielectric core layer 438 and the wiring layer 442, 532, 536 that cooperate with each other to constitute the same 420 are selected depending upon respective mechanical strengths needed to deal with the same 420, and the thickness value of the wiring layer is selected depending upon an electrical conductivity needed to function as an electrical conductor. Therefore, those thickness values are not limited to the values exemplified in the description of the embodiments, and may be appropriately determined depending upon the size and structure of the gas-discharge display apparatus.

In addition, in the seventh through ninth embodiments, the wiring layer 442, 532, 536 of the sheet member 420, 530 is completely covered with the dielectric cover layer 444. However, the wiring layer may be partly exposed so long as the exposure does not influence the discharges of the electrodes or the atmosphere in the gas-tight container.

In addition, in the seventh through ninth embodiments, the sheet member 420 includes the dielectric core layer 438 and the wiring layer 442 that are formed by using the thick-film screen printing method. However, a coater or a film laminate may be used to form uniformly each of thick-film paste layers on the film formation surface, and a photo process may be used to process the each layer to have a predetermined pattern.

In addition, in the seventh through ninth embodiments, the support member used to produce the sheet member 420 is constituted by the substrate 476 and the peeling layer 482 formed on the surface 478 of the substrate 476. However, a ceramic green sheet (i.e., an unfired ceramic sheet) may be used as the support member. In the latter case, the composition of the green sheet is determined such that at the heat treatment temperature employed in the firing step 504, the ceramic green sheet cannot be sintered but the resin contained therein can be fully burned off.

In addition, in the seventh through ninth embodiments, the PDP employs the opposing discharge structure in which the discharges are produced between the sustaining electrodes 448, 448 partly covering the inner wall surfaces of the sheet member 420. However, it is possible to employ the surface discharge structure in which no electrodes cover the inner wall surfaces of the sheet member. In the latter case, it is preferred that the projecting portions 452 be provided to cause the discharges to be produced at desired positions.

In addition, in the seventh through ninth embodiments, the partition walls 422 are provided in the stripe pattern. However, a grid-like partition wall may be used to separate the discharge spaces from each other, so long as there are no problems with the air discharging and gas charging operation after the sealing operation. In addition, in the illustrated embodiments, both the front and rear plates 416, 418 have the respective partition walls 422, 434. However, it is possible that only one of the two plates 416, 418 have the partition walls. In the latter case, it is preferred that the other plate free of the partition walls be free of the fluorescent layers, for the purpose of preventing the sheet member 420 from contacting the fluorescent body.

In addition, in the seventh through ninth embodiments, the fluorescent layers 432, 436 are provided on the inner surfaces 412, 414, respectively. However, it is possible to provide the fluorescent layers on only one of the two surfaces 412, 414.

In addition, boundary portions between the discharge spaces 424, more specifically described, the respective top and/or base portions of the partition walls 422, 434, or the ridges between the grooves 544 of the front plate 540 may be provided with a black stripe (i.e., a black mask) formed using, e.g., a glass paste (i.e., an insulating thick film) containing a black pigment.

In addition, in the seventh through ninth embodiments, the sustaining electrodes 448 are located on one side of each of the wiring portions 450 as seen in the widthwise direction thereof. However, the fifth and sixth embodiments can be advantageously applied to PDPs in which sustaining electrodes are located on either side of each wiring portion and a 2:1 interlacing drive is performed.

TENTH EMBODIMENT

Figure 38:
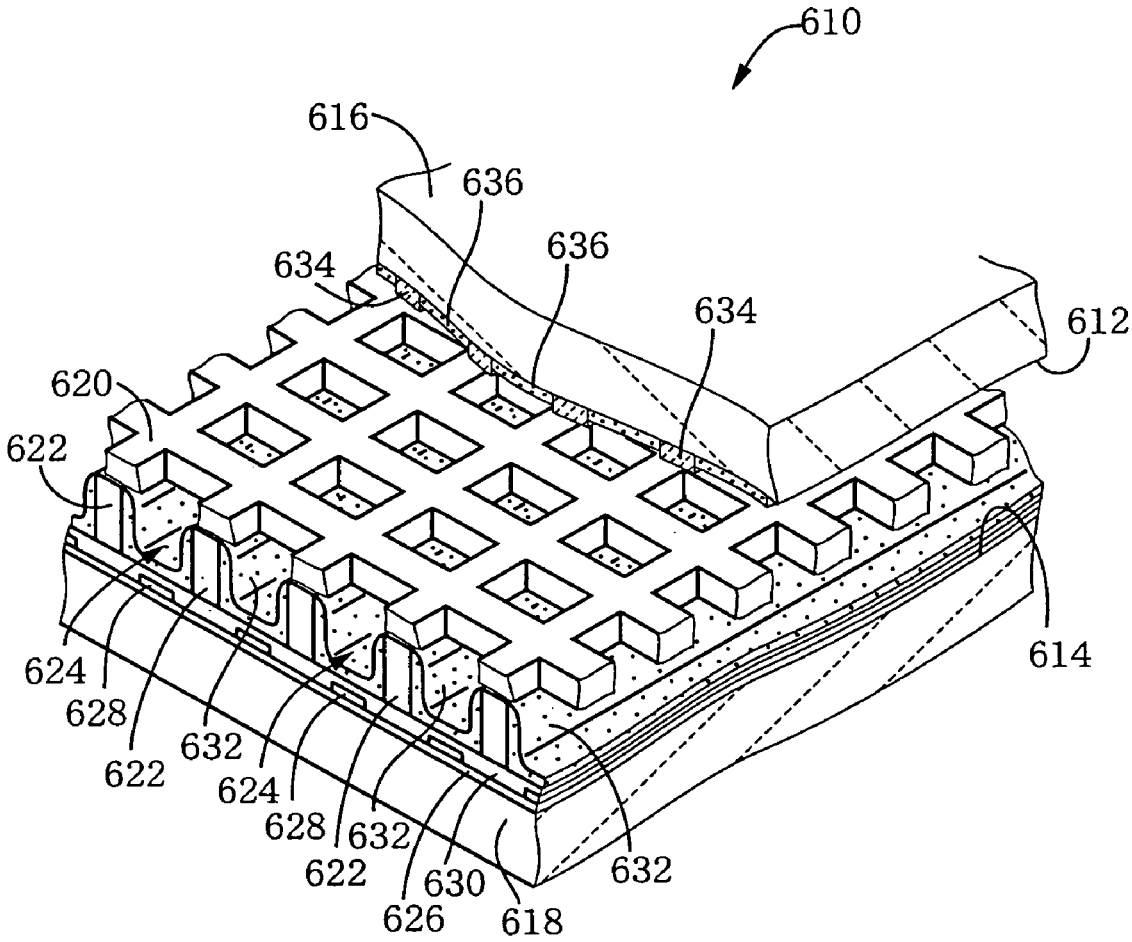
FIG. 38 is a perspective view of another color PDP as another three-electrode-structure AC-type gas-discharge display apparatus according to the present invention, with a portion of the PDP being cut away.

FIG. 38 is a perspective view for explaining a construction of an AC-type color PDP (hereafter, simply referred to as the PDP) 610 as an example of a gas-discharge display apparatus according to the seventh invention, such that a portion of the PDP 610 is cut away. In the figure, the PDP 610 includes a front plate 616 and a rear plate 618 which are provided such that the front and rear plates 616, 618 extend parallel to each other and are distant from each other by a pre-determined distance, so that respective one inner surfaces 612, 614 of the front and rear plates 616, 618 which surfaces are substantially flat, oppose each other. A sheet member 620 having a grid pattern is provided between the front and rear plates 616, 618, and peripheral portions of the front and rear plates 616, 618 are gas-tightly sealed. Thus, a gas-tight space is defined in the PDP 610. Each of the front and rear plates 616, 618 has a size of about 900 (mm)× about 500 (mm) and a uniform thickness of from about 1.1 (mm) to about 3 (mm), and those plates 616, 618 are formed of, e.g., respective soda lime glasses which are similar to each other and each of which is transparent and has a softening point of about 700 (° C.). In the present embodiment, the front plate 616 provides a first substrate; and the rear plate 618 provides a second substrate.

On the rear plate 618, there are provided a plurality of elongate partition walls 622 which extend parallel to each other in one direction and whose centerlines are distant from each other at a regular interval of from about 0.5 (mm) to about 1 (mm). Thus, the gas-tight space defined between the front and rear plates 616, 618 is divided into a plurality of discharge spaces 624. The partition walls 622 are each formed of a thick-film material which contains, as a main component thereof, a low softening point glass, such as PbO—$B_2O_3$—$SiO_2$—$Al_2O_3$—ZnO—$TiO_2$ glasses or a combination of two or more of these glasses, and has a width of from about 80 (μm) to about 200 (μm) and a height of from about 30 (μm) to about 100 (μm). An inorganic filler such as alumina and/or other inorganic pigments are added, as needed, to the partition walls 622, so as to adjust a degree of compactness, a degree of strength, and/or a shape keeping ability of the partition walls 622. The sheet member 620 includes a plurality of elongate grid bars which extend in one direction and are placed on respective top ends of the partition walls 622.

On the rear plate 618, there is provided an undercoat 626 which covers a substantially entire surface of the inner surface 614 of the same 618 and is formed of a low-alkali glass or a no-alkali glass. On the undercoat 626, there are provided a plurality of writing electrodes 628 which extend in a lengthwise direction of the partition walls 622 and each of which is formed of a silver thick film. The writing electrodes 628 are covered with an overcoat 630 which is formed of a mixture of a low softening point glass and an inorganic filler such as a white-color titanium oxide. The above-described partition walls 622 are formed on the overcoat 630.

On the surface of the overcoat 630 and on respective side surfaces of the partition walls 622, there are provided a plurality of fluorescent layers 632 which are distinguished from each other so as to correspond to the plurality of discharge spaces 624, respectively. A thickness of each of the fluorescent layers 632 is pre-determined to fall in the range of, e.g., from about 10 (μm) to about 20 (μm), depending upon its fluorescent color. The fluorescent layers 632 are grouped into three groups of layers 632 that emit, by ultraviolet-light excitation, three fluorescent colors, e.g., red color (R), green color (G), and blue color (B), respectively. The fluorescent layers 632 are arranged such that each one of the layers 632, and two layers 632 located on either side of the each layer 632 emit the three, different fluorescent colors, respectively, in the corresponding three discharge spaces 624, respectively. The undercoat 626 and the overcoat 628 are provided for the purpose of preventing the reaction between the silver-thick-film-based writing electrodes 628 and the rear plate 618, and preventing the contamination of the fluorescent layers 632.

Meanwhile, on the inner surface 612 of the front plate 616, there are provided a plurality of partition walls 634 at respective positions where the partition walls 634 oppose the partition walls 622, respectively. Thus, the partition walls 634 have a stripe pattern. The partition walls 634 are each formed of, e.g., a material obtained by dispersing powder of a black pigment (e.g., powder of a black metallic oxide) in the same material as used to form each of the partition walls 622, so that the partition walls 634 can function as a black stripe. Each of the partition walls 634 has a thickness of, e.g., from about 10 (μm) to about 30 (μm). Between each pair of partition walls 634 that are adjacent each other on the inner surface 612 of the front plate 616, there is provided a fluorescent layer 636 having a thickness falling in the range of, e.g., from about 5 (μm) to about 20 (μm). Thus, a plurality of fluorescent layers 636 are provided in a stripe pattern on the inner surface 612. The fluorescent layers 636 are arranged such that each of the layers 636 emits, in a corresponding one of the discharge spaces 624, the same fluorescent color as the fluorescent color emitted in the one discharge space 624 by a corresponding one of the fluorescent layers 632 provided on the rear plate 618. The partition walls 634 have a height greater than the thickness of the fluorescent layers 636, for the purpose of preventing the sheet member 620 from contacting the fluorescent layers 636.

Figure 39:
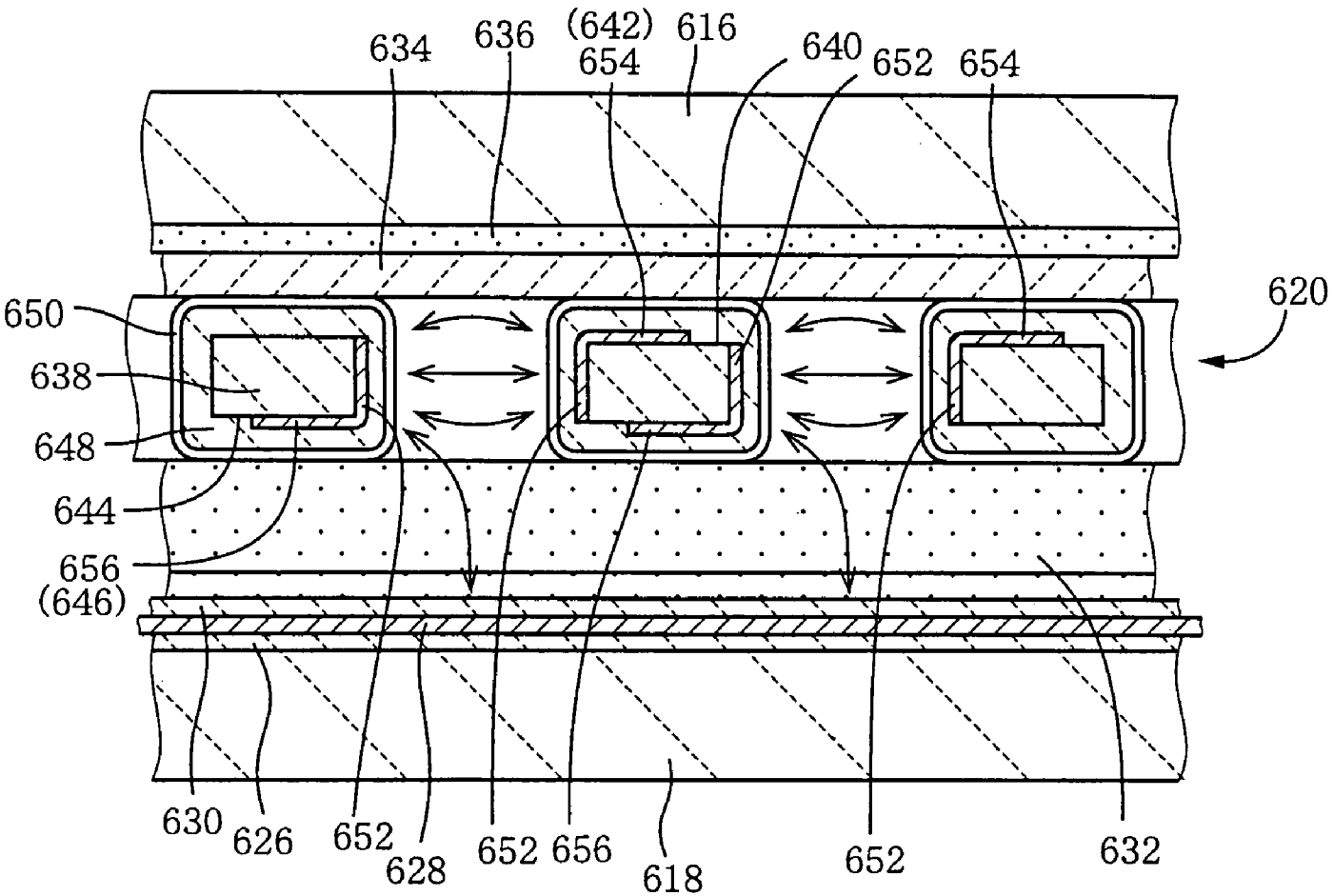
FIG. 39 is a cross-section view for explaining a construction of the PDP of FIG. 38, taken in a lengthwise direction of partition walls thereof.

FIG. 39 is a cross-section view, taken in a lengthwise direction of the partition walls 622 and along a widthwise centerline of one of the writing electrodes 628, for explaining a construction of the PDP 610. The sheet member 620 includes a dielectric core layer 638 which has a grid pattern (see FIG. 38) constituting a skeleton of the grid pattern of the sheet member 620; a first sustaining wiring layer 642 which is placed on, and fixed to, an area continuing from one surface 640 (i.e., an upper surface, shown in the figure) of the core layer 638 to respective one side surfaces of the core layer 638 (i.e., respective one inner wall surfaces of the grid pattern thereof); a second sustaining wiring layer 646 which is placed on, and fixed to, an area continuing from an opposite surface 644 (i.e., a lower surface, shown in the figure) of the core layer 638 to respective opposite side surfaces of the core layer 638 (i.e., respective opposite inner wall surfaces of the grid pattern thereof; a dielectric cover layer 648 which covers the dielectric core layer 638 and the first and second sustaining wiring layers 642, 646; and a protection film 650 which covers the dielectric cover layer 648 and provides a surface layer of the sheet member 620. In the present embodiment, the first sustaining wiring layer 642 and the second sustaining wiring layer 646 (hereinafter, referred to as the "sustaining wiring layers 642, 646", where the sustaining wiring layers need not be distinguished from each other) provide conductive thick-film layers.

The dielectric core layer 638 has a thickness of from about 50 (μm) to about 100 (μm), for example, a thickness of 70 (μm), and respective grid bars of the core layer 638 that extend in lengthwise and width directions thereof and cooperate with each other to constitute the grid pattern thereof, have a width which is substantially equal to the width of the partition walls 622 or somewhat greater than the width of the same 622 in consideration of alignment margins, for example, a width of from about 100 (μm) to about 200 (μm). The dielectric core layer 638 is formed of a thick-film dielectric material which contains a low softening point glass, such as PbO—$B_2O_3$—$SiO_2$—$Al_2O_3$—ZnO—$TiO_2$ glasses or a combination of two or more of these glasses, and additionally contains a ceramic filler such as alumina.

The first and second sustaining wiring layers 642, 646 are each formed of an electrically conductive thick film which contains, as an electrically conductive component thereof, silver (Ag), nickel (Ni), aluminum (Al), or copper (Cu), and each have a thickness of from about 3 (μm) to about 30 (μm), although the resistance of each wire is defined by the specific resistance of the material and the width and thickness of the each wire. The first and second sustaining wiring layers 642, 646 include a plurality of portions 652 which cover respective side surfaces of the grid bars of the dielectric core layer 638. Those portions 652 function as pairs of sustaining electrodes which produce respective gas discharges in the respective discharge spaces 624. As shown in the figure, each pair of sustaining electrodes 652 are located, on the inner wall surfaces of the grid bars of the sheet member 620, at respective positions where the two sustaining electrodes 652 extend parallel to each other and oppose each other. Thus, the PDP 610 has an opposing discharge structure in which a discharge is produced between two sustaining electrodes 652 opposing each other in each discharge space 624. Thus, each pair of sustaining electrodes 652 are provided in each of the discharge spaces 624. One electrode 652 out of each pair of sustaining electrodes 652 additionally functions as a scanning electrode which cooperates with a corresponding one of the writing electrodes 628 to produce a writing discharge so as to select a light emission unit (i.e., cell), as will be described later; and the other electrode 652 of the each pair functions as a sustaining electrode only.

The dielectric cover layer 648 has, on the sustaining electrodes 652, a thickness falling in the range of, e.g., from about 10 (μm) to about 50 (μm), for example, a thickness of about 20 (μm), and is formed of a thick film which contains a glass having a low softening point, such as PbO—$B_2O_3$—$SiO_2$—$Al_2O_3$—ZnO—$TiO_2$ glasses or a combination of two or more of these glasses. The dielectric cover layer 648 is employed mainly for the purpose of storing electric charges on an outer surface thereof and thereby causing each pair of sustaining electrodes 652, 652 to produce an alternate-current discharge. In addition, since the cover layer 648 prevents exposure of the thick-film-based sustaining electrodes 652, and thereby restrains the generation of outgas from those electrodes 652 and the change of atmosphere in each discharge space 624.

The protection film 650 has a thickness of, e.g., about 0.5 (μm), and is formed of a thin or thick film which contains, e.g., MgO as a main component thereof. The protection film 650 is employed for the purpose of preventing discharge-gas ions from causing sputtering of the dielectric cover layer 648. Since, however, the protection film 650 is formed of a dielectric material having a high secondary electron emission factor, the protection film 650 substantially functions as the discharge electrodes.

Figure 40:
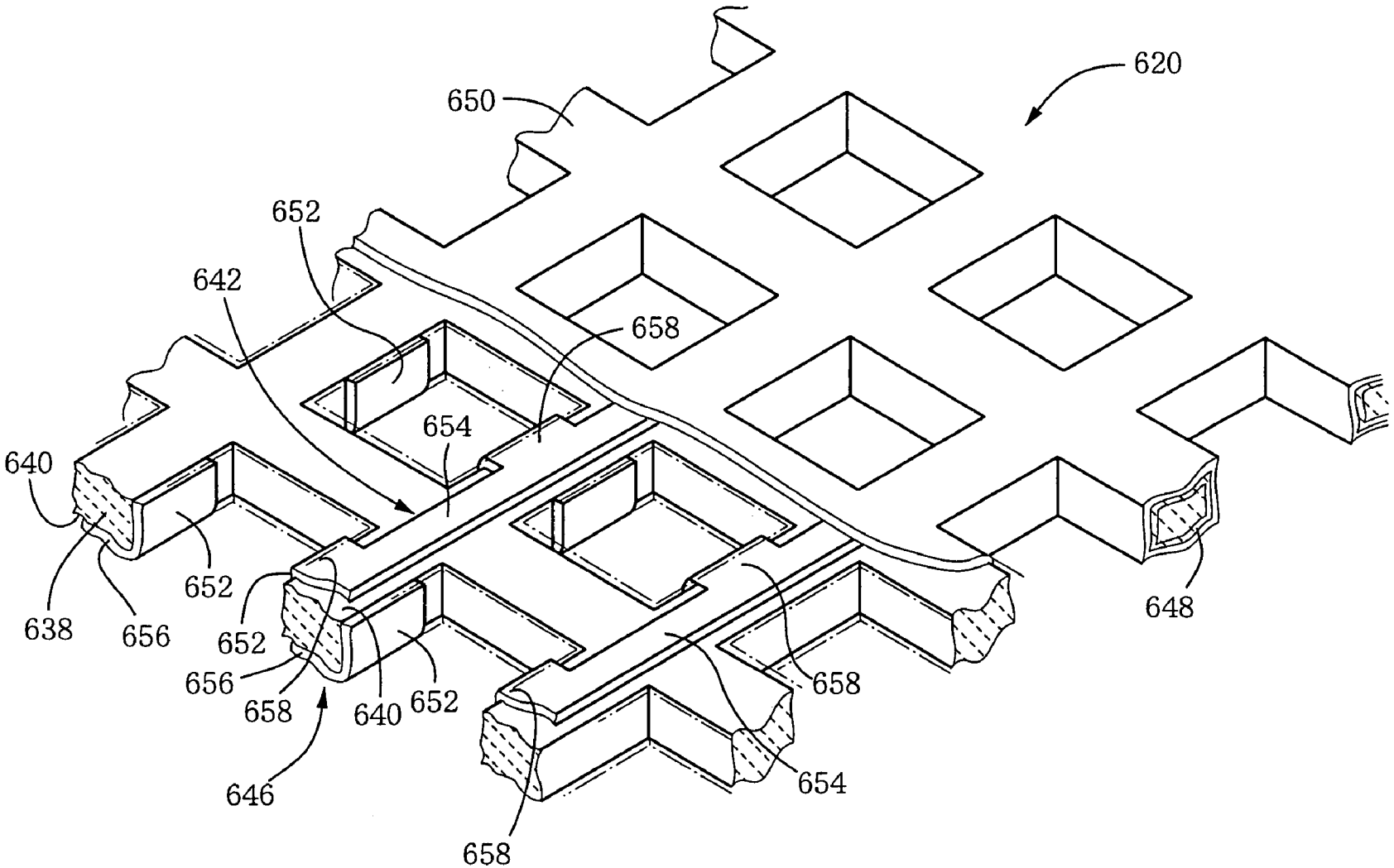
FIG. 40 is a view for explaining a construction of a sheet member of the PDP of FIG. 38.

FIG. 40 is a view for explaining in detail a construction of each of the sustaining wiring layers 642, 646, with a portion of the sheet member 620 being cut away. In the figure, the first sustaining wiring layer 642 includes a plurality of wiring portions 654 which extend in one direction of the grid pattern constituting the sheet member 620; and the second sustaining wiring layer 646 includes a plurality of wiring portions 656 which extend in the one direction of the grid pattern. A lengthwise direction of the wiring portions 654, 656 is perpendicular to the lengthwise direction of the partition walls 622, i.e., a lengthwise direction of the writing electrodes 628. Each of the wiring portions 654, 656 has a pre-determined width of from about 50 (μm) to about 130 (μm), and is located on a widthwise middle portion of a corresponding one of the grid bars of the dielectric core layer 638.

Each of the wiring portions 654, 656 includes a plurality of projecting portions 658 which laterally project from a plurality of locations, respectively, that are distant from each other in the lengthwise direction of the each wring portion 654, 656. Thus, each of the projecting portions 654, 656 projects in a direction substantially perpendicular to the lengthwise direction of the each wiring portion 654, 656. Each sustaining electrode 652 is continuous with an end of each projecting portion 654, 656, and extends from the end in a direction perpendicular to the same 654, 656. The projecting portions 658 of each of the wiring portions 654 project toward the wiring portion 656 adjacent the each wiring portion 654; and the projecting portions 658 of each of the wiring portions 656 project toward the wiring portion 654 adjacent the each wiring portion 656. That is, the sustaining electrodes 652 continuous with each of the wiring portions 654 oppose the sustaining electrodes 652 continuous with a corresponding one of the wiring portions 656. A width of each projecting portion 658 or each sustaining electrode 652 (i.e., a dimension of the same 658, 652 in the lengthwise direction of each wiring portion 654, 656) is, e.g., about 100 (μm); and a height of each sustaining electrode 652 is substantially equal to the thickness of the sheet member 620, i.e., falls in the range of from about 50 (μm) to about 100 (μm), e.g., about 70 (μm). That is, each sustaining electrode 652 covers a portion of a side surface of a corresponding one of the grid bars of the dielectric core layer 638.

Figure 41:
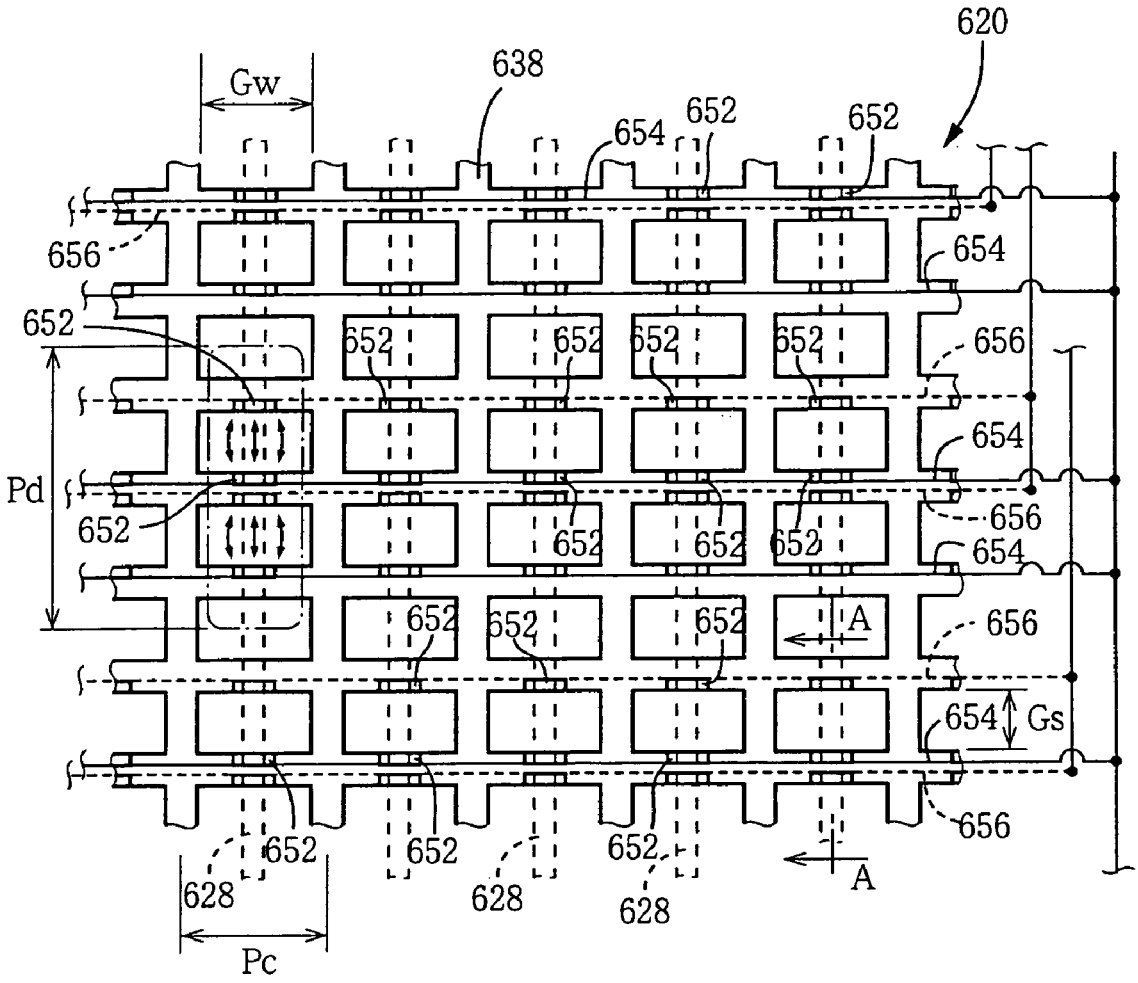
FIG. 41 is a view for explaining a manner in which a wiring layer is formed in the sheet member shown in FIG. 40.

FIG. 41 is a schematic view for explaining a manner in which the wiring portions 654, 656 of the sustaining wiring layers 642, 646 are connected, and a positional relationship between the wiring portions 654, 656 and the writing electrodes 628. Both or either one of a wiring portion 654 and a wiring portion 656 that extend in a horizontal direction in the figure correspond to each of the horizontal grid bars of the dielectric core layer 638 that extend in the horizontal direction in the figure. More specifically described, both of a wiring portion 654 and a wiring portion 656 correspond to every third horizontal grid bar of the core layer 638; and a wiring portion 654 and a wiring portion 656 alternately correspond to each one of the remaining horizontal grid bars of the core layer 638. In the figure, the wiring portions 654 provided on the one surface 640 are indicated at solid lines; and the wiring portions 656 provided on the other surface 644 are indicated at broken lines. The first group of wiring portions 654 or the second group of wiring portions 656, e.g., the first group of wiring portions 654 shown in the figure are all connected to a common line as indicated in a right-hand end area in the figure, and are simultaneously supplied with a drive voltage. Although all the wiring portions 654 shown in the figure are connected to the single common line, the wiring portions 654 may be grouped into a plurality of groups, e.g., two groups, depending upon a driving method such as 2-1 interlacing, and those groups of wiring portions 654 may be connected to a plurality of common lines, respectively. Meanwhile, the other group of wiring portions, e.g., the second group of wiring portions 656 include a plurality of pairs of wiring portions 656 each pair of which are connected to a common line and consist of two wiring portions 656 one of which corresponds, together with one wiring portion 654, to one grid bar of the dielectric core layer 638 and the other of which corresponds solely to another grid bar adjacent to the one grid bar. Thus, the plurality of pairs of wiring portions 656 are connected to a plurality of common lines, and each one of those common lines is independent of all the other lines. Thus, the plurality of pairs of wiring portions 656 provide a plurality of units, respectively, and an arbitrarily selected one of those units is supplied with a drive voltage.

The intervals of distance between the grid bars of the sheet member 620 are uniform in each of two directions of the grid pattern. More specifically described, the grid bars of the sheet member 620 that extend along the wiring portions 654, 656 are arranged at a regular interval, Gs, of, e.g., about 100 (μm), and the grid bars of the sheet member 620 that extend in a direction perpendicular to the wiring portions 654, 656 are arranged at a regular interval, Gw, of, e.g., about 200 (μm). As indicated in a left-hand middle area in FIG. 41, since, in the present embodiment, each pair of sustaining electrodes 652, 652 opposing each other cooperate with each other to produce a sustaining discharge, the discharge gap of each pair of electrodes 652 is substantially equal to the interval Gs, i.e., about 100 (μm). As is apparent from the comparison of FIG. 41 with FIG. 38, the grid bars of the sheet member 620 that extend in the direction perpendicular to the wiring portions 654, 656 are placed on the partition walls 622, respectively. FIG. 39 is a cross-section view taken along A—A in FIG. 41.

When an alternate-current pulse is applied to the pairs of wiring portions 656 each pair of which is independent of all the other wiring portions 654, 656 and to which a first group of sustaining electrodes 652 are connected, so as to scan sequentially the same 656, and concurrently an alternate-current pulse is applied to desired ones of the writing electrodes 628 that correspond to data (i.e., the writing electrodes 628 corresponding to the light emission units each selected to emit light), in synchronism with the timing of scanning of the pairs of wiring portions 656, so that the desired writing electrodes 628 and the corresponding sustaining electrodes 652 of the first group cooperate with each other to produce respective writing discharges. Thus, electric charges are accumulated on respective portions of the protection films 650 that are located above those sustaining electrodes 652. After the scanning of all the sustaining electrodes 652 functioning as the scanning electrodes is carried out in this way, an alternate-current pulse is applied to all pairs of sustaining electrodes 652 via the wiring portions 654, 656, so that the thus applied voltage is added to the electric potential caused by the electric charges accumulated in each of the light emission units corresponding to the above-indicated sustaining electrodes 652 of the first group, so as to exceed a discharge starting voltage. Thus, those sustaining electrodes 652 of the first group and the corresponding sustaining electrodes 652 of the other, second group cooperate with each other to produce respective discharges, and these discharges are sustained for a pre-determined time by the wall electric charges newly produced on the protection film 650. Consequently the fluorescent layers 632, 636 corresponding to the selected light emission units are excited by ultraviolet lights produced by the gas discharges, and accordingly generate visible lights, so that those lights are outputted through the front plate 616 and thus a desired image is displayed. Each time one full scanning of the scanning electrodes (i.e., the sustaining electrodes 652) is finished, desired ones of the data electrodes (i.e., the writing electrodes 628), to which an alternate-current pulse is to be applied, are re-selected, so that desired images are continuously displayed. As is apparent from the above explanation, the first group of sustaining electrodes 652 corresponding to the pairs of wiring portions 656 function as the scanning electrodes which cooperate with the writing electrodes 628, and additionally function as sustaining electrodes (i.e., image-display discharge electrodes) which cooperate with the second group of sustaining electrodes 652.

Since, as described previously, each pair of wiring portions 656 that consist of two wiring portions 656 adjacent each other are connected to a corresponding one of the common lines, respectively, two sustaining electrodes 652 that correspond to the each pair of wiring portions 656 and each of the writing electrodes 628 simultaneously produce respective writing discharges. Therefore, a light emission block that can be selected as a whole corresponds to the each pair of wiring portions 656, that is, a light emission unit is defined as an area including two discharge portions schematically indicated at one-dot chain line in FIG. 41. In addition, as shown in FIG. 41, each discharge is produced between each pair of electrodes 652, 652 that are distant from each other by the small distance Gs, e.g., about 100 (μm). However, each discharge space 624 is continuous in the vertical direction in the figure. Therefore, the ultraviolet light produced by the discharge is spread, as schematically indicated at one-dot chain line in FIG. 41, outward of the two outer electrodes 652 out of the two pairs of discharge electrodes 652, in a lengthwise direction of the each discharge space 624. Thus, respective portions of the fluorescent layers 632, 636 that are located, in the each discharge space 624, within the range bounded by the one-dot chain line are excited by the ultraviolet lights generated by the discharges produced by the two pairs of electrodes 652, indicated in the left-hand middle portion of the figure, and accordingly emit respective visible lights.

Therefore, the light emission units (i.e., cells) of the PDP 610 are defined by the partition walls 622 with respect to the direction perpendicular to the same 622, i.e., the horizontal direction in the figure, and are substantially defined by the area to which the ultraviolet lights are spread, with respect to the lengthwise direction of the partition walls 622, i.e., the vertical direction in the figure. Thus, an interval of distance between respective centerlines of the light emission cells in the horizontal direction in the figure is a color cell pitch, Pc, of about 0.5 (mm); and an interval of distance between respective centerlines of the light emission cells in the vertical direction in the figure is a dot pitch, Pd, of about 1.5 (mm). In the present color PDP 610 in which the three colors R, G, B are used, three light emission units that are adjacent each other in the horizontal direction in the figure cooperate with each other to define one pixel. Therefore, a pitch of the pixels of the PDP 610 is about 0.9 (mm) with respect to each of the horizontal and vertical directions in the figure.

Thus, in the present embodiment, the sheet member 620 having the grid pattern includes the first sustaining wiring layer 642 provided on the one surface 640 of the grid pattern, and the second sustaining wiring layer 646 provided on the other surface 644 of the grid pattern, and the wiring portions 654, 656 of the wiring layers 642, 646 are provided such that, in each of the light emission units, a plurality of pairs of sustaining electrodes 652 corresponding to a plurality of pairs of wiring portions 654, 656 each pair of which consist of a wiring portion 654 and a wiring portion 656 adjacent each other, produce respective discharges at respective locations along a lengthwise direction of the writing electrodes 628. Therefore, although, in the present embodiment, an interval of distance between respective centers of the light emission units in a lengthwise direction of the units is increased, an area where each light emission unit emits a light can be increased without increasing a drive voltage that has been used to drive conventional light emission units each including a single pair of discharge electrodes. In addition, the PDP 610 has the opposing discharge structure in which each pair of discharge surfaces oppose each other. Therefore, as compared with the conventional three-electrode structure in which sustaining electrodes are provided on one plane, the PDP 610 enjoys a higher efficiency. In addition, the PDP 610 is free of the problem that the dielectric cover layer 648 and the protection film 650 are locally deteriorated because of local strengthening of discharge, and accordingly enjoys a longer life expectancy. Moreover, since the PDP 610 has the opposing discharge structure, occurrence of a cross-talk resulting from a gap produced between the partition walls 622 and the front plate 616 can be prevented even if the top ends of the partition walls 622 and/or the front plate 616 may have unevenness.

In addition, the respective discharge surfaces of the sustaining electrodes 652 are located at an intermediate height position that is distant from each of the front and rear plates 616, 618, and the discharge direction in which the discharge electrodes 652 produce the discharges is parallel to each of the respective inner surfaces 612, 614 of the front and rear plates 616, 618. Therefore, the inner surfaces 612, 614 of the two plates 616, 618 are less influenced by the discharge-gas ions, and accordingly the fluorescent layers 632, 636 can be provided in respective wider areas on the inner surfaces 612, 614. Thus, as compared with a surface discharge structure in which fluorescent layers can be provided on only a substrate opposing a substrate to which sustaining electrodes are fixed, the PDP 610 can enjoy a highly increased degree of brightness.

In addition, since the sustaining electrodes 652 are not provided on the front plate 616, a phenomenon that the electrodes 652 each formed of a silver thick film may turn yellow is not observed. Therefore, it is not needed to use, as a component of the material of the sustaining electrodes 652, an expensive black-color conductive material such as ruthenium oxide.

Figure 42:
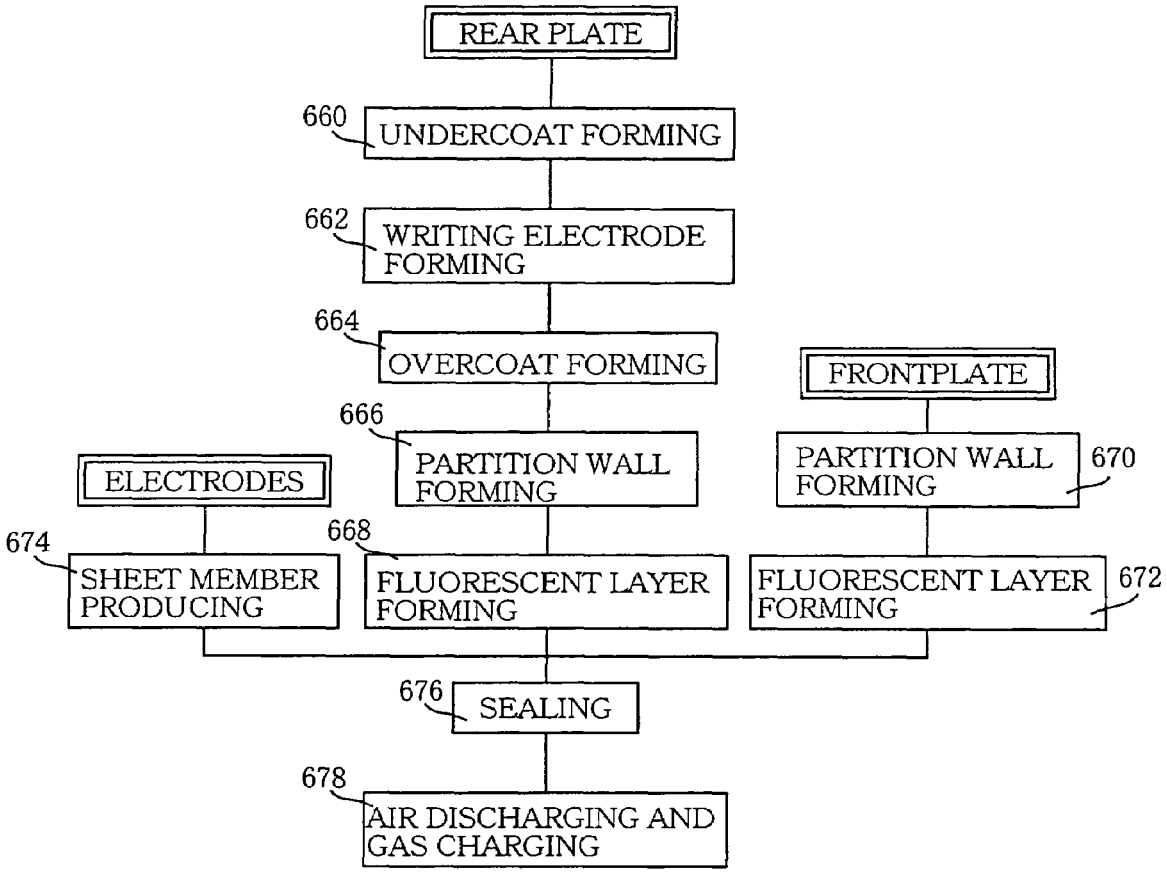
FIG. 42 is a flow chart for explaining a method of producing the PDP of FIG. 38.

Meanwhile, the PDP 610 constructed as described above can be produced, in the method according to the eighth invention, by assembling the sheet member 620, the front plate 616, and the rear plate 618 that are processed (or produced) independent of each other according to the flow chart shown in FIG. 42.

The rear plate 618 is processed as follows: First, in an undercoat forming step 660, a thick-film insulating paste is applied to the flat inner surface 614 of the rear plate 618 prepared, and then the applied paste is fired to form the previously-described undercoat 626. Subsequently, in a writing electrode forming step 662, the previously-described writing electrodes 628 are formed, using a thick-film conductive paste such as a thick-film silver paste and using, e.g., a thick-film screen printing method or a lithograph method, on the undercoat 626. Then, in an overcoat forming step 664, a thick-film insulating paste including a low softening point glass and an inorganic filler is repeatedly applied to cover a substantially entire surface of the undercoat 626 on which the writing electrodes 628 have been formed, and then the applied paste is fired to form the overcoat 630.

Next, in a partition wall forming step 666, a thick-film insulating paste containing, as main components thereof, a low softening point glass and an inorganic filler, is printed and dried, and then the paste is fired at a temperature of, e.g., from about 500 (° C.) to about 650 (° C.) so as to obtain the partition walls 622. In the case where a desired height of the partition walls 622 cannot be obtained by one-time printing of the paste, the printing and the drying are repeated, as needed. This is true with each of the above-described undercoat forming step 660 and the overcoat forming step 664. Subsequently, in a fluorescent layer forming step 668, a thick-film screen printing method or a pouring method is used to apply each of three kinds of fluorescent pastes corresponding to the three colors R, G, B, to a corresponding one of the respective spaces between the partition walls 622 and then fire the applied pastes at a temperature of, e.g., about 450 (° C.) so as to obtain the fluorescent layers 632.

The front plate 616 is processed as follows: First, in a partition wall forming step 670 like the above-described step 666, a thick-film forming technique such as a thick-film screen printing method is used to print repeatedly a thick-film insulating paste containing, as main components thereof, a low softening point glass and an inorganic filler, to the inner surface 612 of the front plate 616 and dry the printed paste. Subsequently, the printed paste is fired at a heat treatment temperature that falls in the range of, e.g., from about 500 (° C.) to about 650 (° C.), depending upon the kind of the paste used. Thus, the previously-described partition walls 634 are obtained. Subsequently, in a fluorescent layer forming step 672, a technique such as a thick-film screen printing method or a pouring printing is used to apply, from above the partition walls 634, each of three kinds of fluorescent pastes corresponding to the three colors R, G, B, to a corresponding one of the respective spaces between the partition walls 634 and then fire the applied pastes at a temperature of, e.g., about 450 (° C.) so as to obtain the fluorescent layers 636.

The sheet member 620 is produced in a sheet member producing step 674. The front and rear plates 616, 618 are superposed on each other via the sheet member 620, and are subjected, in a sealing step 676, to a heat treatment so that the two plates 616, 618 and the sheet member 620 are gas-tightly sealed with a sealing material, such as a sealing glass, that is applied in advance on respective interfaces of the same 616, 618, 620. Before this sealing step 676, the sheet member 620 may be fixed, as needed, to either one of the front and rear plates 616, 618, using a glass frit. Finally, in an air discharging and gas charging step 678, air is discharged from the thus obtained, gas-tight container, and an appropriate discharge gas is charged into the same so as to obtain the PDP 610.

Figure 43:
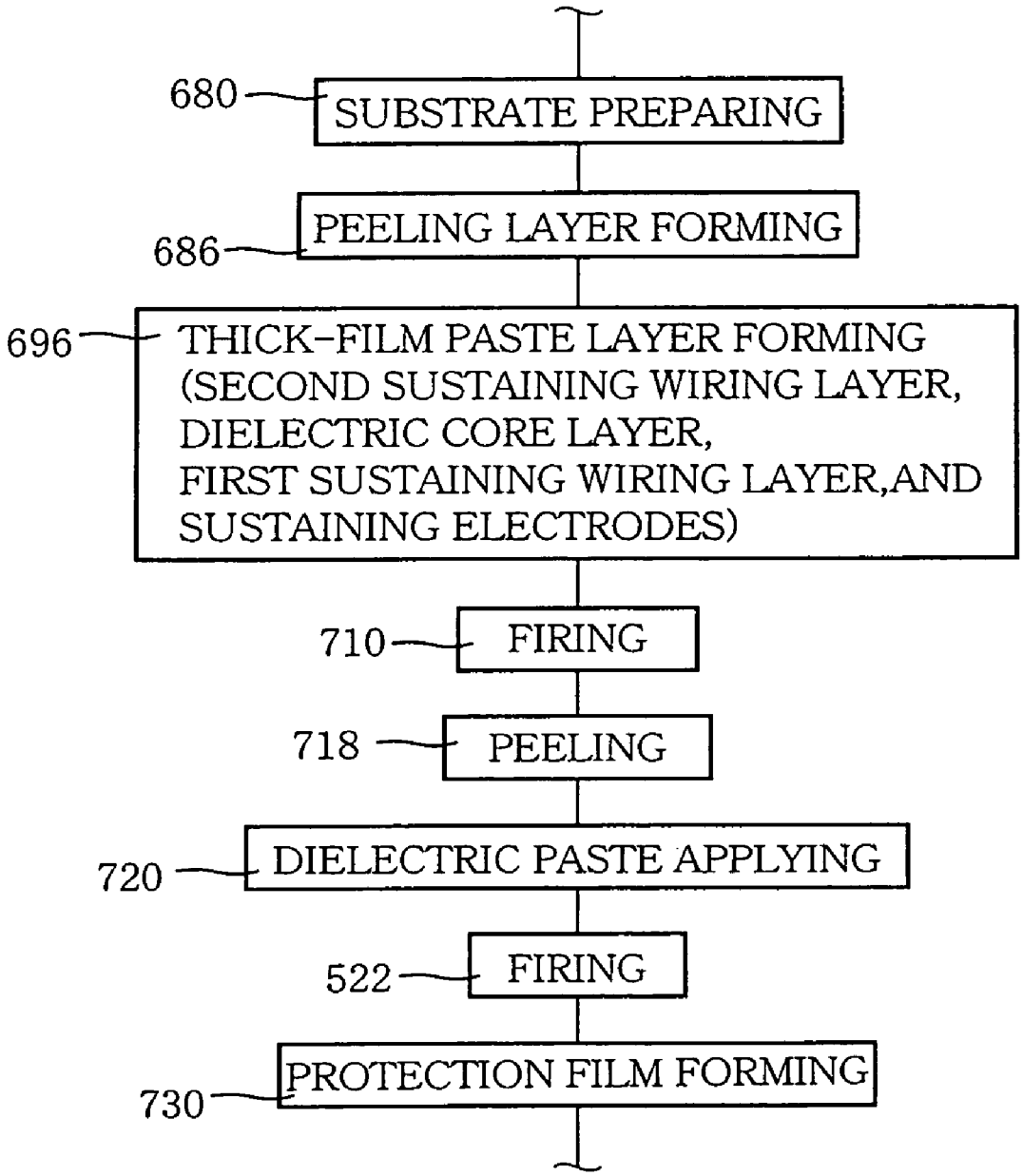
FIG. 43 is a flow chart for explaining a method of producing the sheet member.

In the above-described producing method, the sheet member producing step 674 is carried out according to the flow chart, shown in FIG. 43, in which a well known thick-film printing technique is used. Hereinafter, the method of producing the sheet member 620 will be explained by reference to FIGS. 44(*a*) through 44(*f*) and FIGS. 45(*g*) through 45(*i*) that show respective states in essential steps of the producing method.

First, in a substrate preparing step 680, a substrate 682 (see FIG. 44) on which a thick-film printing is to be carried out, is prepared, and a surface 684 of the substrate 682 is subjected to an appropriate cleaning treatment. This substrate 682 is preferably provided by a glass substrate formed of, e.g., a soda lime glass that exhibits substantially no deformation or deterioration in a heat treatment, described later, and has a thermal expansion coefficient of about $87\times10^{-7}$ (° C.), a softening point of about 740 (° C.), and a distorting point of about 510 (° C.). The substrate 682 has a thickness of from about 2 (mm) to about 3 (mm), e.g., about 2.8 (mm), and the surface 684 of the substrate 682 is sufficiently larger than that of the sheet member 620.

Figure 44:
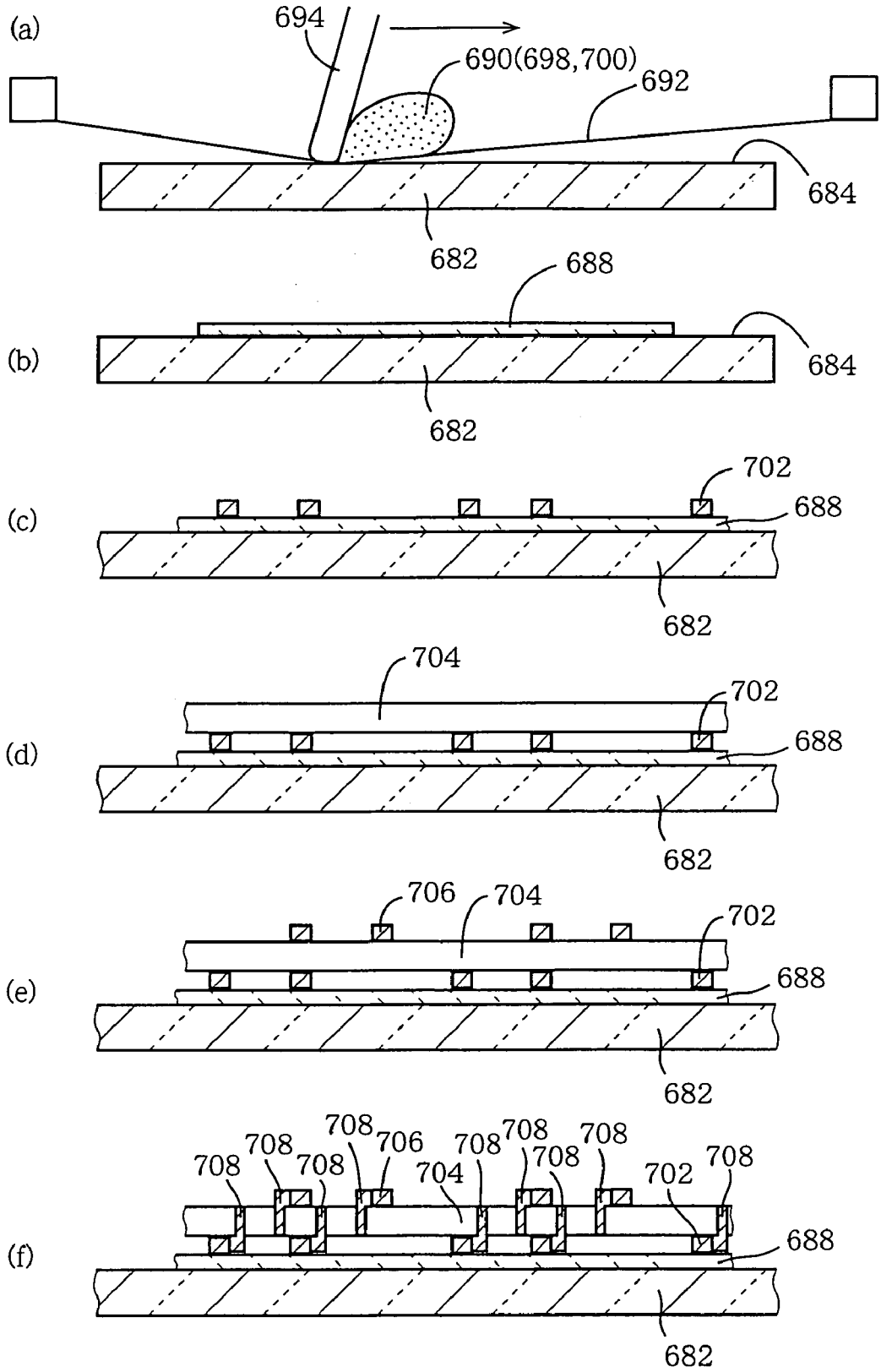
FIGS. 44(*a*) through 44(*f*) are views showing a substrate and one or more thick films, in respective essential steps out of the producing steps shown in FIG. 43.

Subsequently, in a peeling layer forming step 686, a peeling layer 688 that consists of particles having a high melting point and bound to each other with a resin, and has a thickness of, e.g., from about 5 (μm) to 50 (μm), is provided on the surface 684 of the substrate 682. The high melting point particles may be a mixture of a high softening point glass frit having an average particle size of from 0.5 (μm) to 3 (μm), and a ceramic filler, such as alumina or zirconia, having an average particle size of from 0.01 (μm) to 5 (μm), e.g., about 1 (μm) and a percentage of from about 30 (%) to 50 (%). The high softening point glass may be a glass having a high softening point not lower than, e.g., about 550 (° C.), and the high melting point particles as the mixture may have a softening point not lower than, e.g., about 550 (° C.). The resin may be an ethyl cellulose resin that is burned out at, e.g., 350 (° C.). The peeling layer 688 is formed, as shown in FIG. 44(*a*), on a substantially entire surface of the substrate 682 in such a manner that an inorganic material paste 690 in which the high melting point particles and the resin are dispersed in an organic solvent such as butyl carbitol acetate (BCA) or terpineol is applied to substantially the entire surface of the substrate 682, by a screen printing method, and subsequently the applied paste 690 is dried in a drying furnace, or at room temperature. However, the peeling layer 686 may be formed using a coater, or by adhesion of a film laminate. The drying furnace is preferably provided by a far infrared drying furnace that can be sufficiently ventilated so that the layer can enjoy an excellent surface roughness and the resin can be uniformly dispersed. FIG. 44(*b*) shows a step in which the peeling layer 686 is thus formed on the substrate 682. In FIG. 44(*a*), numeral 692 designates a screen; and numeral 694 designates a squeegee. In the present embodiment, the substrate 682 and the peeling layer 688 formed thereon cooperate with each other to provide a support member; the surface of the peeling layer 688 provides a film formation surface on which films are formed; and the substrate preparing step 680 and the peeling layer forming step 686 cooperate with each other to provide a support member preparing step.

Subsequently, in a thick-film paste layer forming step 696, a thick-film conductive paste 698 for forming the sustaining wiring layers 642, 646 and the sustaining electrodes 652, and a thick-film dielectric paste 700 (see FIG. 44(*a*)) for forming the dielectric core layer 638 are sequentially applied, each in a predetermined pattern, on the peeling layer 688, and then dried, by utilizing, e.g., the screen printing method, like in the step 686 in which the inorganic material paste 690 is applied. Thus, a conductive printed layer 702 constituting the wiring portions 656 and the projecting portions 658 of the second sustaining wiring layer 646, a dielectric thick layer 704 constituting the dielectric core layer 638, a conductive printed layer 706 constituting the wiring portions 654 and the projecting portions 658 of the second sustaining wiring layer 642, and a conductive printed layer 708 constituting the sustaining electrodes 652 are formed in the order of description. The thick-film conductive paste 698 may be obtained by dispersing, in an organic solvent, a mixture of powder of conductive material, such as powder of silver; a glass frit; and a resin. The thick-film dielectric paste 700 may be obtained by dispersing, in an organic solvent, a mixture of powder of dielectric material such as powder of alumina or zirconia; a glass frit; and a resin. Each glass frit is, e.g., a low softening point glass such as $PbO—B_2O_3—SiO_2—Al_2O_3—TiO_2$ glasses, and each resin and each organic solvent are, e.g., the same resin and organic solvent that are used to obtain the inorganic material paste 700.

For the purpose of forming the wiring portions 656 and the projecting portions 658 of the second sustaining wiring layer 646 and the wiring portions 654 and the projecting portions 658 of the first sustaining wiring layer 642, and the dielectric core layer 638, those screens 692 are used which have respective slot patterns corresponding to the respective shapes of the layers 646, 642, 638, shown in FIGS. 38 and 40. The thick-film conductive paste 698 and the thick-film dielectric paste 700 are so applied as to have respective predetermined thickness values which assure that the layers 642, 646, 638 have the above-described thickness values after being fired and shrunk. Meanwhile, for the purpose of forming the sustaining electrodes 652, such a screen 692 is used which has slots that are slightly offset inward of the inner wall surfaces of the grid pattern of the dielectric core layer 638, so that the thick-film conductive paste 698 applied flow down from the upper surface of the dielectric core layer 638 along the inner wall surfaces of the same 638. FIGS. 44(*c*) through 44(*f*) show respective steps in which the conductive printed layer 702, the dielectric printed layer 704, the conductive printed layer 706, and the conductive printed layer 708 are formed. Since the respective thickness values of the conductive printed layers 702, 706, 708 fall in the range of from about 5 (μm) to about 10 (μm), each of the layers 702, 706, 708 can be formed in a single printing operation. However, since the dielectric printed layer 704 has the thickness of about 30 (μm), the layer 704 is formed by repeating, e.g., three printing and drying operations and thereby stacking three layers on each other that have an appropriate thickness in total. Meanwhile, the thick-film conductive paste 698 used for forming the conductive printed layer 708 is prepared such that the paste 698 flows downward along the inner wall surfaces of the dielectric printed layer 704. For example, the prepared paste 698 has a considerably low viscosity of from 10 (Pa·s) to 50 (Pa·s). When the thick-film conductive paste 698 flows down onto the peeling layer 688, the solvent of the conductive paste 698 is absorbed by the peeling layer 688, so that the paste 698 is not spread on the surface of the layer 688.

Figure 45:
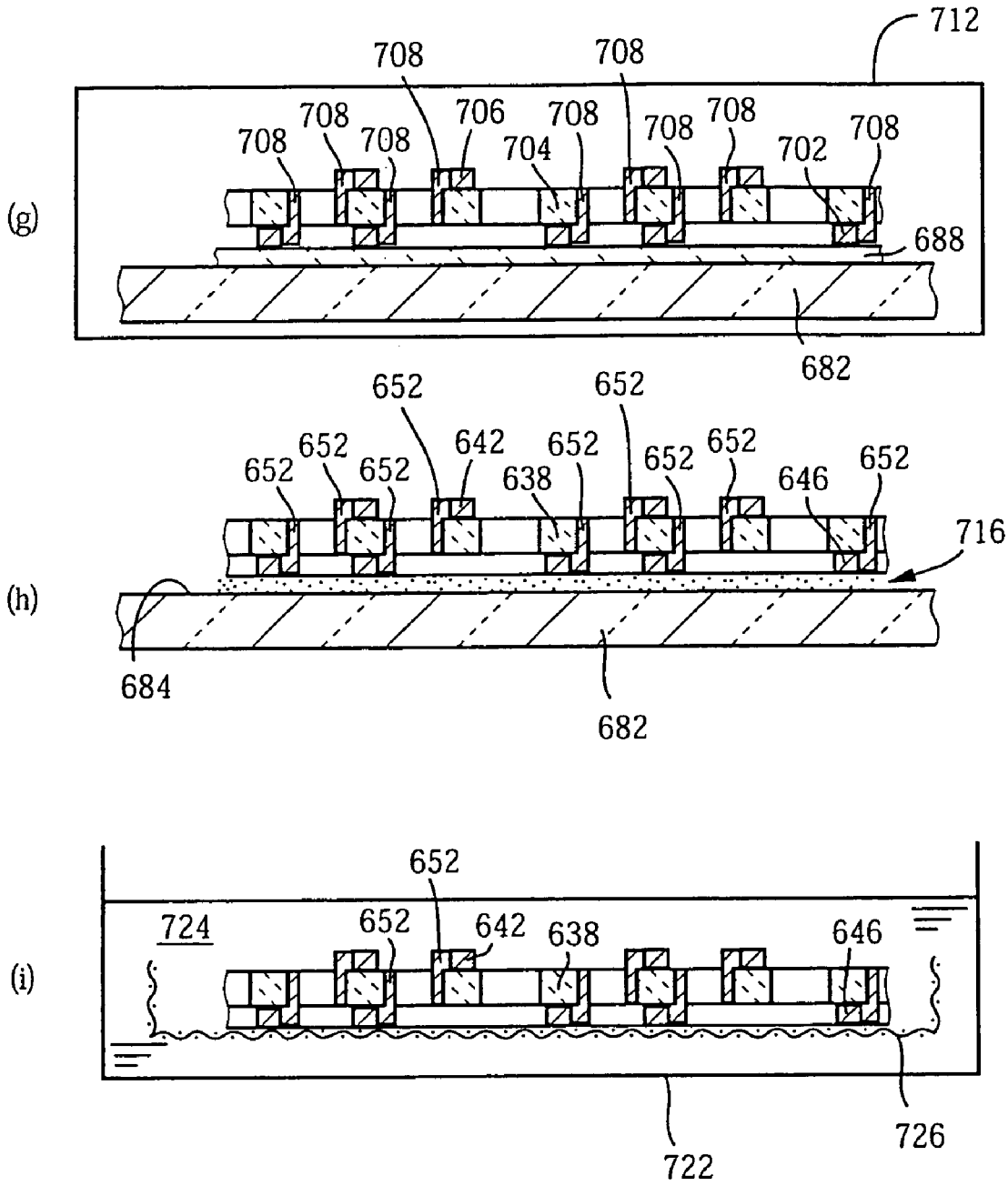
FIGS. 45(*g*) through 45(*i*) are views showing the substrate and the thick films in respective essential steps out of the producing steps shown in FIG. 43 that follow the step shown in FIG. 44(*f*).

After the thick-film printed layers 702 through 708 are formed in this way and then dried to remove the solvents, a firing step 710 is carried out. In the firing step 710, the substrate 682 is put in a furnace 712 of an appropriate firing device, and is subjected to a heat treatment at a firing temperature, e.g., 550 (° C.), corresponding to each of the thick-film conductive paste 698 and the thick-film dielectric paste 700. FIG. 45(*g*) shows a step in which the heat treatment is carried out.

A sintering temperature of each of the thick-film printed layers 702 through 708 is, e.g., about 550 (° C.). Therefore, during the heat treatment, the resins are burned, and the dielectric material, the conductive material, and the glass frit are sintered. Thus, the dielectric core layer 638 and the sustaining wiring layers 642, 646, that is, a basic portion of the sheet member 620 is produced. FIG. 45(*h*) shows this state. As described above, the peeling layer 688 includes the inorganic material particles whose softening point is not lower than 550 (° C.). Therefore, the resin is burned by firing, but the high melting point particles (i.e., the glass powder and the ceramic filler) are not sintered. Thus, as the heat treatment progresses, the resin is removed and accordingly the peeling layer 688 is processed into a particle layer 716 consisting of the high melting point particles 714 (see FIG. 46) only.

Figure 46:
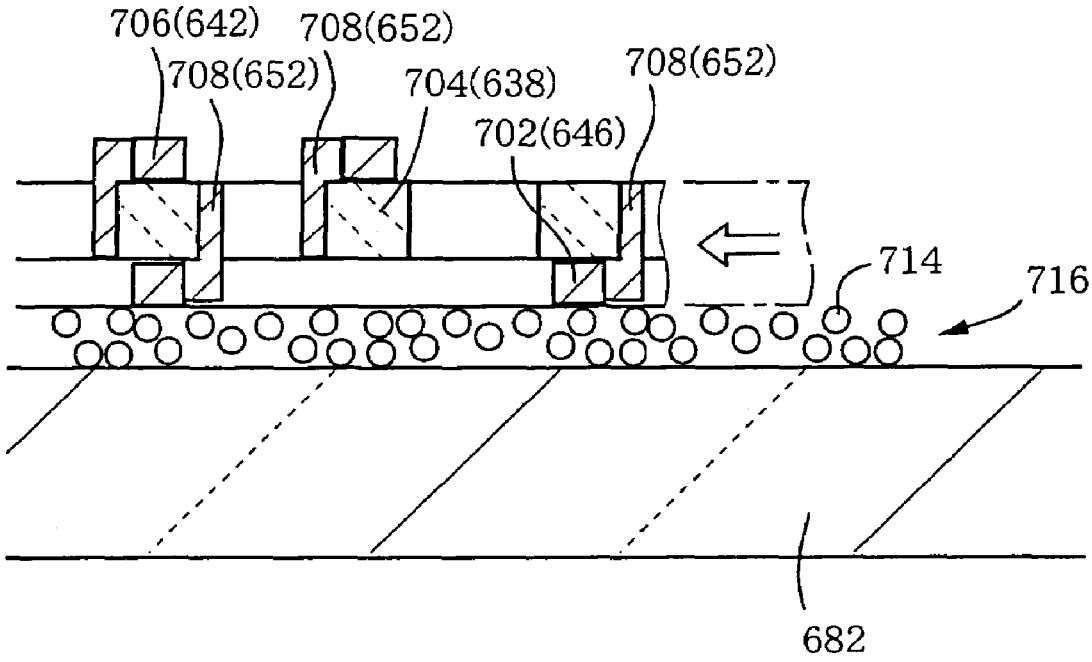
FIG. 46 is a view for explaining a manner in which the thick films are shrunk in a firing step shown in FIG. 43.

FIG. 46 is an enlarged, illustrative view corresponding to right-hand end portions of the thick-film printed layers 702 through 708, shown in FIG. 45(*h*), and showing how the sintering process progresses in the heat treatment. The particle layer 716, produced by removing, by firing, the resin from the peeling layer 688, is a layer consisting of the high melting point particles 714 that just are gathered and are not bound to each other. Therefore, when the respective end portions of the thick-film printed layers 702 to 708 are shrunk from a position before firing, indicated at one-dot chain line in the figure, the high melting point particles 714 function as rollers. Thus, there are produced no forces that resist the shrinking of the printed layers 702 to 708, at an interface between a lower surface of the layers 702 to 708 and an upper surface of the substrate 682. Therefore, a lower portion of the layers 702 to 708 shrinks similarly to an upper portion of the same. Thus, the layers 702 to 708 are free of the difference of density and/or warpage resulting from the difference of amounts of shrinkage.

In the present embodiment, when the sintering of the thick-film printed layers 702 to 708 is started, the substrate 682 does not resist, owing to the presence of the particle layer 716, the sintering and shrinking of the layers 702 to 708. Thus, the thermal expansion of the substrate 682 does not substantially influence the quality of the thick films thus produced. However, in the case where the substrate 682 is repeatedly used or the heat treatment is carried out at a higher temperature, it is possible to use a heat-resisting glass having a still higher distorting point (e.g., a borosilicate glass having a thermal expansion coefficient of about $32\times10^{-7}$ (/° C.) and a softening point of about 820 (° C.), or a quartz glass having a thermal expansion coefficient of about $5\times10^{-7}$ (/° C.) and a softening point of about 1580 (° C.)). In this case, too, the amount of thermal expansion of the substrate 682 is small in a temperature range in which the binding force of the dielectric material powder is small, and accordingly the thermal expansion does not influence the quality of the thick films produced.

Back to FIG. 43, in a peeling step 718, the thus produced thick films, i.e., the dielectric core layer 638 and the wiring layers 642, 646 that are stacked on each other, are peeled from the substrate 682. Since the particle layer 716 interposed between the layers 638, 642, 646 and the substrate 482 consists of the high melting point particles 714 just being gathered, the peeling operation can be easily carried out without using any agents or tools. Although the high melting point particles 714 may adhere, with a thickness corresponding to one layer of particles 714, to the layers 638, 642, 646, those particles 714 can be removed, as needed, using an adhesive tape or an air blower. The substrate 682 from which the thick films have been peeled can be used again and again for similar purposes, because the substrate 682 is not deformed or deteriorated at the above-described firing temperature.

Subsequently, in a dielectric paste applying step 720, the thus peeled layers 638, 642, 646 are dipped in a dielectric paste 724 accommodated in a dipping tank 722, so that the dielectric paste 724 is applied to the entire outer surfaces of those layers. The dielectric paste 724 may be obtained by dispersing, in a solvent such as water, a mixture of powder of a glass such as $PbO—B_2O_3—SiO_2—Al_2O_3—TiO_2$ glasses or a combination of two or more of those glasses, and a resin such as PVA. The dielectric paste 724 is so prepared as to have a viscosity lower than that of the thick-film dielectric paste 700. It is possible to use, as the above-indicated glass powder, one which does not contain lead and whose softening point is not lower than 630 (° C.). This softening point is equal to, or higher than, that of the glass powder contained in the thick-film dielectric paste 700. The reason why the paste 724 prepared to have the low viscosity is used is to prevent air bubbles from being mixed with the paste 724 when the paste 724 is applied, and thereby prevent the fired product from suffering defects. The layers 638, 642, 646 are slowly dipped in the dielectric paste 724, and then taken out from the same 724, while being supported on a wire net 726 such that those layers take a horizontal posture.

Subsequently, in a firing step 728, the layers 638, 642, 646 that have been taken out from the dipping tank 722 and then dried sufficiently, is put in a firing furnace, so that those layers are subjected to a heat treatment (i.e., a firing process) in which the layers are fired at a pre-determined temperature of, e.g., about 650 (° C.) that corresponds to the kind of the glass powder contained in the dielectric paste 724. This firing temperature is so pre-determined as to be sufficiently higher than the softening point of the glass powder, so that the glass powder may sufficiently soften and provide a compact dielectric layer (i.e., the dielectric cover layer 648). Therefore, the thus obtained dielectric cover layer 648 is free of porosity that would otherwise result from grain boundaries of the glass powder, and enjoys a high withstand voltage. In the present embodiment, the electric paste applying step 720 and the firing step 728 cooperate with each other to provide a covering step.

Figure 47:
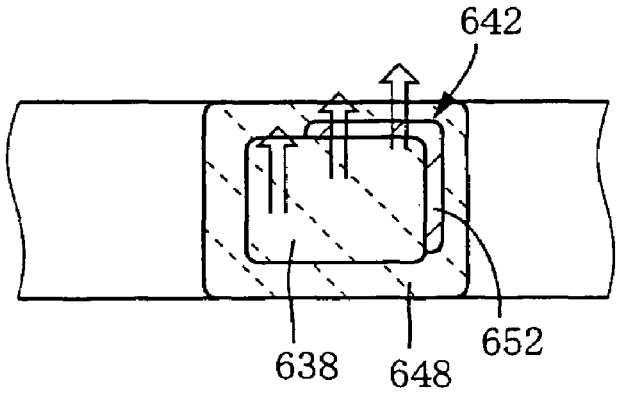
FIG. 47 is a view for explaining a direction in which gas moves out of a dielectric cover layer in the firing step.

In the case where the firing step 728 is carried out at a considerably high temperature, gas is produced from the dielectric core layer 638 and the sustaining wiring layers 642, 646 that are located inside, because the organic components remaining in those layers 638, 642, 646 are burned. This gas produces bubbles in the dielectric cover layer 648, and those bubbles move upward as indicated at arrows in FIG. 47. Therefore, the bubbles produced in the cover layer 648 gather in an upper portion thereof as seen in the figure, and do not gather in the respective portions thereof that function as the discharge surfaces, i.e., cover the side surfaces of the dielectric core layer 638. Thus, even if the treatment temperature used in the firing step 728 may be considerably high, the high temperature does not cause any bubbles to be produced in the portions of the dielectric cover layer 648 that cover the sustaining electrodes 652. That is, a high firing temperature can be used to increase the degree of compactness of the layer 648 and thereby improve the properties of the same 648 such as a withstand voltage.

Then, in a protection film forming step 730, the protection film 650 is formed with a desired thickness on a substantially entire surface of the dielectric cover layer 648, e.g., by dipping and firing, or by a thick-film forming process such as electronic-beam method or sputtering. Thus, the sheet member 620 is obtained. Since the protection film 650 is thin as described above, it is considerably difficult to form the protection film 650 with a uniform thickness, by a thick-film forming process such as dipping. However, in the present embodiment, the respective distances between the pairs of sustaining electrodes 652, 652 are uniform, because each pair of electrodes 652 produce an electric discharge while opposing each other. Therefore, irrespective of what shape the surface of the protection film 648 may have, local discharge hardly occurs. Thus, the protection film 650 is not required to be so highly uniform as a layer is required which is employed in the above-described surface discharge structure. In addition, the protection film 650 is not present on a path of emission of light, the film 650 is not required to be transparent.

Thus, in the present embodiment, when the front and rear plates 616, 618 are superposed on, and fixed to, each other to obtain the PDP 610, the sheet member 620 including the sustaining wiring layers 642, 646 provided on the opposite surfaces 640, 644 of the grid pattern of the dielectric core layer 638, such that, in each of the light emission units, the plurality of pairs of sustaining electrodes 652 corresponding to the plurality of pairs of wiring portions 654, 656 each pair of which consist of one wiring portion 654 and one wiring portion 656 adjacent each other, produce the respective discharges at the respective locations along the lengthwise direction of the writing electrodes 628, is fixed to the front or rear plate 616, 618, so that the sustaining electrodes 652 are provided in the discharge spaces 624. Since the sheet member 620 includes the sustaining wiring layers 642, 646 as the thick-film conductive layers constituting the sustaining electrodes 652, two or more sustaining electrodes 652 can be provided in each light emission unit, by just placing the sheet member 620 between the front and rear plates 616, 618. Thus, the PDP 610 is advantageously freed of the problem with the case where sustaining electrodes are formed, by using a heat treatment, on the front plate 616, i.e., the problem that the front plate 616 and the sustaining electrodes are distorted because of the heat treatment. In addition, in each of the light emission units, the plurality of pairs of sustaining electrodes 652 corresponding to the plurality of pairs of wiring portions 654, 656 produce the respective discharges at the respective locations along the lengthwise direction of the writing electrodes 628. Therefore, even in the case where the interval of distance between the respective centers of the light emission units in the lengthwise direction of the units is increased, the area where each light emission unit emits the light can be increased without increasing the drive voltage that has been used to drive the conventional light emission units each including the single pair of discharge electrodes. Therefore, the three-electrode-structure AC-type PDP 610 which is free of the distortions caused by the heat treatment that would otherwise be carried out to form the electrodes, and which enjoys the increased light-emission area can be produced by the simple method. That is, the present method does not need any complicated processes in which a $SiO_2$ coat, an ITO film, and/or bus electrodes are provided.

In addition, in the present embodiment, on the film formation surface defined by the peeling layer 688 having the higher melting point than the respective sintering temperatures of the thick-film conductive paste 698 and the thick-film dielectric paste 700, the thick-film printed layers 702 through 708 are formed in the respective predetermined patterns and, subsequently, are subjected to the heat treatment at the sintering temperature, so as to obtain the sheet member 620 including the dielectric core layer 638 and the thick-film conductive layers that are formed on the opposite surfaces 640, 644 of the core layer 638 and constitute the sustaining wiring layers 642, 646. Although the peeling layer 688 is not sintered at the heat treatment temperature, the resin of the layer 688 is burned out, and accordingly the particle layer 716 consisting of only the high melting point particles 714 is obtained. Since, therefore, the thus produced thick films are not fixed to the substrate 682, those thick films can be easily peeled from the surface 684 of the substrate 682. Thus, the sheet member 620 constituting the sustaining electrodes 652 can be easily produced and can be easily used to produce the PDP 610.

In addition, in the present embodiment, the support member to which the thick-film pastes 698, 700 are applied is constituted by the substrate 682 and the peeling film 688 formed on the surface 684 of the substrate 682. Therefore, even after the heat treatment, the support member can maintain its shape. Thus, the sheet member 620 can be more easily dealt with after being produced, than in the case where the support member would be constituted by the peeling layer 688 only. Since the peeling layer 688 is located between the thick-film printed layers 702 to 708 and the substrate 682, the substrate 682 does not bind those layers 702 to 708 when those layers are subjected to the heat treatment. Therefore, the substrate 682 does not have any limitations with respect to its degree of flatness and/or its degree of surface roughness. For example, in the case where the surface 684 of the substrate 682 is warped, the thick-film printed layers 702 to 708 are also warped following the warped surface 684. Since, however, the sheet member 620 has a sufficiently high degree of flexibility even after being fired, the sheet member 620 can follow, when being placed on a flat surface, that flat surface and become flat.

In addition, in the present embodiment, the thick-film layers 702 to 708 are formed by the thick-film printing method. Therefore, the PDP 610 can be produced using the simple equipment and without wasting the materials. Thus, the PDP 610 can be produced at low cost.

In addition, in the present embodiment, the thick-film screen printing method is used to form the thick films and accordingly no so-called wet processes are used. Thus, it is not needed to treat the waste water. The wet processes have the problem that if a solution permeates the films and remains in the same, it may cause the generation of outgas from the vacuum container obtained by adhering the front and rear plates 616, 618 to each other. To avoid this problem, materials having a higher heat-resisting temperature are used and, after the container is gas-tightly sealed, air is discharged at a higher temperature or in a longer time period. Those measures, however, lead to increasing the load of the processes.

ELEVENTH EMBODIMENT

Figure 48:
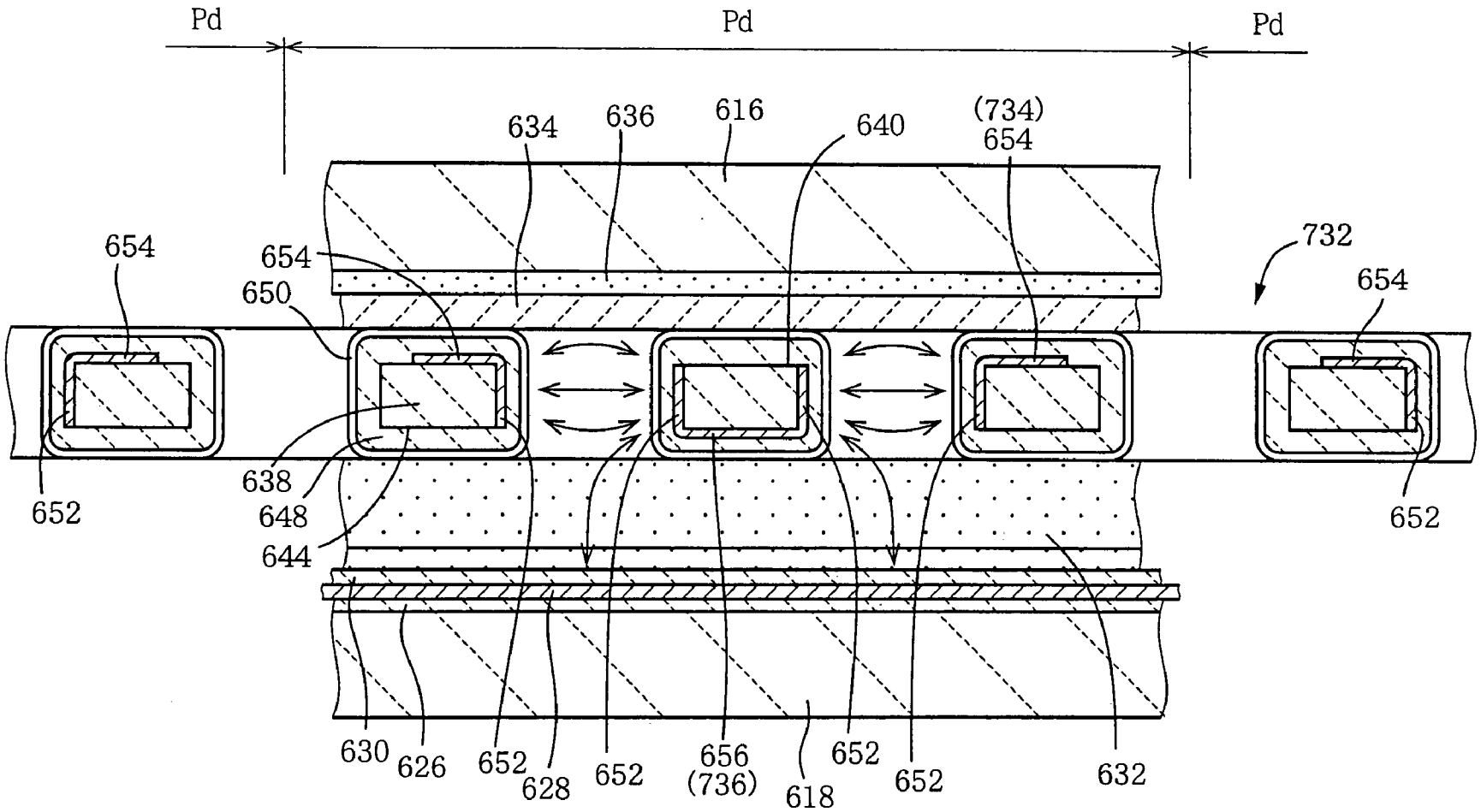
FIG. 48 is a cross-section view corresponding to FIG. 39, for explaining a portion of another PDP according to the present invention.

FIG. 48 is a view corresponding to FIG. 39, for explaining a construction of a sheet member 732 which can be employed by another PDP as another embodiment according to the seventh invention. In the present embodiment, in place of the above-described first sustaining wiring layer 642, a first sustaining wiring layer 734 is provided on one surface 640 of a dielectric core layer 638, and a second sustaining wiring layer 736 is provided on the opposite surface 644 of the core layer 638. All of the sustaining wiring layers 734, 736 extend in a direction perpendicular to a lengthwise direction of writing electrodes 628 and partition walls 734, 736, like in the previously-described embodiment. In the present embodiment, however, a plurality of wiring portions 656 of the second sustaining wiring layer 736 provided on the opposite surface 644 correspond, one to one, to every third grid bar of the dielectric core layer 638, and a plurality of wiring portions 654 of the first sustaining wiring layer 734 provided on the one surface 640 correspond, one to one, to the remaining grid bars of the core layer 638 that are free of the wiring portions 656. Therefore, on either side of each of the wiring portions 656 of the second sustaining wiring layer 736, there are provided two wiring portions 654 of the first sustaining wiring layer 734, respectively; and one either side of each of the wiring portions 654 of the first sustaining wiring layer 734, there are provided one wiring portion 656 of the second sustaining wiring layer 736 and one wiring portion 654 of the first sustaining wiring layer 734, respectively.

Like each of the wiring portions 654, 656 of the sustaining wiring layers 642, 646, each of the wiring portions 654, 656 of the above-indicated sustaining wiring layers 734, 736 includes a plurality of sustaining electrodes 652 at respective locations that are distant from each other in a lengthwise direction of the each wiring portion 654, 656. In each of light emission units (i.e., cells), each of the wiring portions 656 of the second sustaining wiring layer 736 provides two sustaining electrodes 652, such that the two sustaining electrodes 652 extend from the each wiring portion 656 along opposite side surfaces of one grid bar of the dielectric core layer 638; and each of the wiring portions 654 of the first sustaining wiring layer 734 provides one sustaining electrode 652, such that the one sustaining electrode 652 extends from the each wiring portion 654 along one of opposite side surfaces of one grid bar of the core layer 638 that is located on the side of one wiring portion 656 adjacent to the each wiring portion 654. Therefore, in an area, indicated at Pd shown in FIG. 48, that corresponds to one cell, a wiring portion 656 including one pair of sustaining electrodes 652 is located in a middle portion of the area, and two wiring portions 654, 654 including respective sustaining electrodes 652 opposing the two sustaining electrodes 652 of the one pair, respectively, are located, symmetrically with each other, outside the two sustaining electrodes 652, respectively. Thus, in the area, the two pairs of opposing sustaining electrodes 652, 652 produce respective discharges. Therefore, in the present embodiment, too, each of the light emission units includes two discharge spots, which leads to producing discharges in an increased area. Thus, the present embodiment can enjoy the same advantages as those with the above-described embodiment, e.g., the advantage that the area where lights are emitted can be increased without increasing the drive voltage used to drive the each light emission unit.

The present embodiment employs the same drive method as that employed by the above-described embodiment. More specifically described, the plurality of wiring portions 656 of the second sustaining wiring layer 736 are electrically independent of each other, and cooperate with a plurality of writing electrodes 628 to produce one or more writing discharges to select one or more light emission units. The plurality of wiring portions 654 of the first sustaining wiring layer 734 are all connected to a common line, and are simultaneously supplied with an electric voltage. After the light emission units are selected, the firs sustaining wiring layer 734 cooperates with the second sustaining wiring layer 736 to produce discharges, so as to emit lights from the selected light emission units. In the present embodiment, too, a discharge is produced between each pair of grid bars of the dielectric core layer 638, although the sustaining electrodes 652 of the present embodiment have a three-electrode structure, unlike the sustaining electrodes 652 of the above-described embodiment that have a four-electrode structure.

TWELFTH EMBODIMENT

Figure 49:
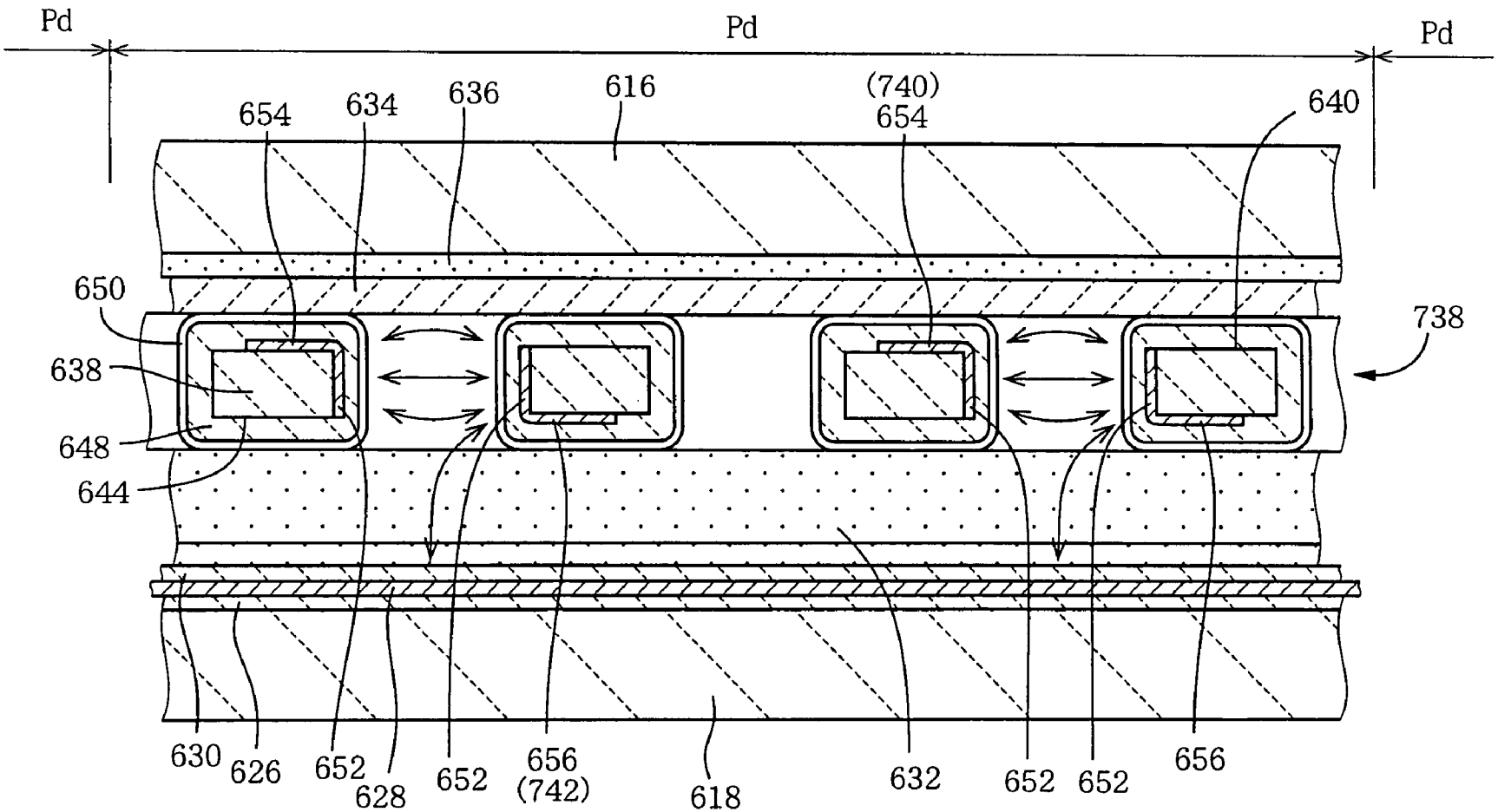
FIG. 49 is a cross-section view corresponding to FIG. 39, for explaining a portion of yet another PDP according to the present invention.

FIG. 49 is a cross-section view corresponding to FIG. 39, for explaining yet another embodiment according to the seventh invention. In the present embodiment, a PDP employs, in place of the sheet member 620, a sheet member 738. The sheet member 738 includes a first sustaining wiring layer 740 provided on one surface 640 of a dielectric core layer 638, and a second sustaining wiring layer 742 provided on an opposite surface 644 of the core layer 638. A plurality of wiring portions 654 of the first sustaining wiring layer 740 correspond, one to one, to every second grid bar of the dielectric core layer 638 as counted in a lengthwise direction of writing electrodes 628, and a plurality of wiring portions 656 of the second sustaining wiring layer 736 correspond, one to one, to the remaining grid bars of the core layer 638 that are free of the wiring portions 654. That is, the wiring portions 656 correspond, one to one, to every second grid bar of the core layer 638, such that the wiring portions 654 and the wiring portions 656 are alternate with each other in the lengthwise direction of the writing electrodes 628.

Each one of the wiring portions 654, or 656 includes a plurality of sustaining electrodes 652 which cooperate with a plurality of sustaining electrodes 652, respectively, of one of two wiring portions 656, or 654 adjacent to the each one wiring portion, so as to produce respective discharges. The sustaining electrodes 652 of the each one wiring portion 654, or 656 are provided on one side surface of a corresponding one of the grid bars of the dielectric core layer 638, and the sustaining electrodes 652 of the one wiring portion 656, or 654 are provided on an opposite side surface of a corresponding one of the grid bars of the core layer 638, such that the former sustaining electrodes 652 oppose the latter sustaining electrodes 652, respectively. In the present embodiment, the four wiring portions 654, 656 in total, shown in the figure, are provided in each light emission unit whose area is indicated at Pd, and two sustaining discharges are produced between the left-hand pair of wiring portion and the right-hand pair of wiring portion, respectively. Therefore, in the present embodiment, too, each of the light emission units produces two sustaining discharges at two locations, respectively. Thus, the present embodiment can enjoy the same advantages as those with the above-described embodiment, e.g., the advantage that the area where lights are emitted can be increased without increasing the drive voltage used to drive the each light emission unit.

Figure 50:
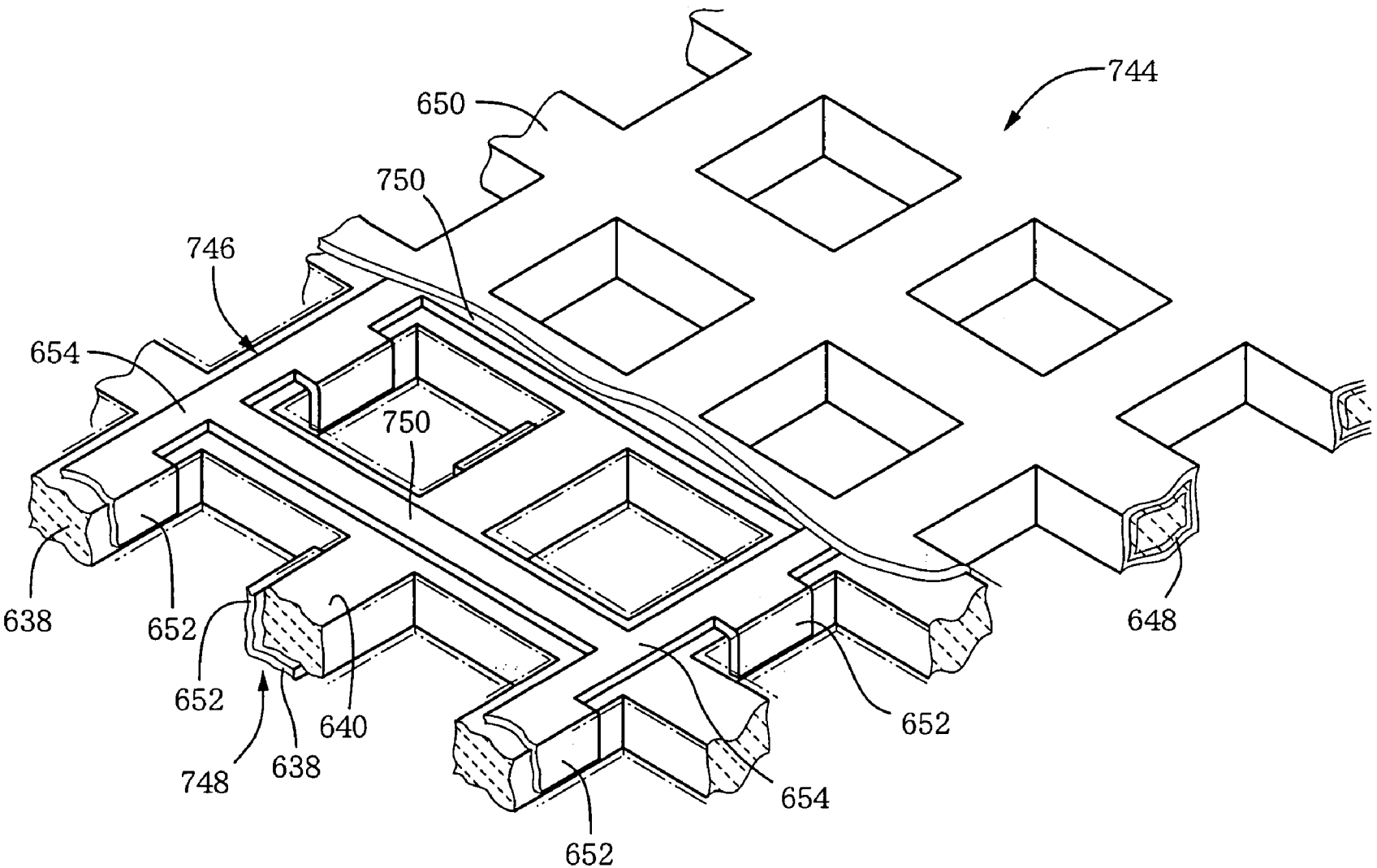
FIG. 50 is a view corresponding to FIG. 40, for explaining a construction of a sheet member which is employed by yet another PDP according to the present invention.

FIG. 50 is a view for explaining a manner in which a first sustaining wiring layer 746 is provided on one surface 640 of a dielectric core layer 638, in the sheet member shown in FIG. 49. In the present embodiment, each pair of wiring portions 654 of the first sustaining wiring layer 746 that are adjacent to each other are connected to each other via a plurality of connecting wiring portions 750 that extend in a direction perpendicular to a lengthwise direction of the wiring portions 654. Since the wiring portions 654 are simultaneously supplied with a drive voltage, the wiring portions 654 may be connected to each other at an arbitrary position in the PDP 10 or a drive circuit associated with the same 10, and, outside or inside the gas-tight space. However, the first sustaining wiring layer 746 does not need any external lines to connect the wiring portions 654 to each other, which leads to decreasing the production cost of the sheet member. In the present embodiment, since the two sustaining wiring layers 746, 748 are provided, separately from each other, on the one surface 640 and the opposite surface 644 of the dielectric core layer 638, respectively, the one surface 640 can be freely used irrespective of the shape of the second sustaining wiring layer 748.

In the above-described embodiment, each pair of wiring portions 654 adjacent to each other are connected to each other via the connecting conductors 750. Those pairs of wiring portions 654 may be employed in the case where a drive voltage is sequentially applied to the pairs of wiring portions 654 functioning as a plurality of pairs of scanning electrodes. Meanwhile, in the case where a plurality of wiring portions function as a plurality of sustaining electrodes which are simultaneously supplied with a drive voltage, all those wiring portions may be connected to each other via similar connecting portions.

THIRTEENTH EMBODIMENT

Figure 51:
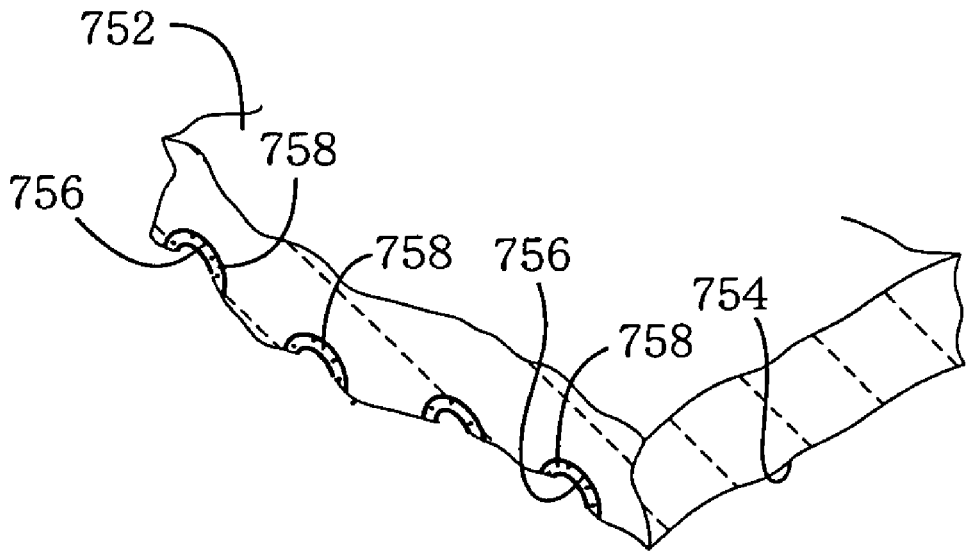
FIG. 51 is a view for explaining a construction of another front plate which may be employed by the PDP of FIG. 38.

FIG. 51 is a view for explaining a construction of a front plate 752 which can be used in place of the front plate 616. In the figure, the front plate 752 has the same dimensions and shape as those of the front plate 616, and is formed of the same material as that used to form the plate 416. However, an inner surface 754 of the front plate 752 that is located in a gas-tight space has, in place of the partition walls 634, a plurality of grooves 756 which extend parallel to each other in one direction, such that a plurality of ridges present between the grooves 756 are located at the respective same positions as the positions where the partition walls 634 are located on the front plate 616, and such that a plurality of fluorescent layers 758 are provided in the grooves 756, respectively. Since this front plate 752 allows the sheet member 620 to be placed on the inner surface 754 thereof without contacting the fluorescent layers 758, the PDP can enjoy a high degree of brightness like the PDP 610 having the front plate 616 on which the partition walls 634 are provided. In addition, since the grooves 756 can be easily formed by, e.g., grinding, the front plate 752 can be produced in a simpler method than the method in which the partition walls 634 are formed by the thick-film forming process.

The above-described tenth through thirteenth embodiments relate to the cases where the seventh and eighth inventions are applied to the full-color AC-type PDP 610 and the method of producing the same 610, respectively.

However, likewise, those inventions may be applied to a monochrome AC-type PDP and a method of producing the same, respectively.

The PDP 610 as each of the tenth through thirteenth embodiments employs the fluorescent layers 632, 636 that correspond to the three colors, and display a full-color image. However, likewise, the seventh and eighth inventions may be applied to such PDPs that employ fluorescent layers corresponding to one or two colors.

The thickness value of the sheet member 620, 732 and the respective thickness values of the dielectric core layer 638 and the wiring layers 642, 646 that cooperate with each other to constitute the sheet member 620, 732 are selected depending upon respective mechanical strengths needed to deal with the same 620, 732, and the thickness value of the wiring layer is selected depending upon an electrical conductivity needed to function as an electrical conductor. Therefore, those thickness values are not limited to the values exemplified in the description of the embodiments, and may be appropriately determined depending upon the size and structure of the gas-discharge display apparatus.

In addition, in the tenth through thirteenth embodiments, the wiring layers 642, 646 of the sheet member 620 is completely covered with the dielectric cover layer 648. However, the wiring layer may be partly exposed so long as the exposure does not influence the discharges of the electrodes or the atmosphere in the gas-tight container.

In addition, in the tenth through thirteenth embodiments, the sheet member 620 includes the dielectric core layer 638 and the wiring layers 642, 646 that are formed by using the thick-film screen printing method. However, a coater or a film laminate may be used to form uniformly each of thick-film paste layers on the film formation surface, and a photo process may be used to process the each layer to have a predetermined pattern.

In addition, in the tenth through thirteenth embodiments, the support member used to produce the sheet member 620 is constituted by the substrate 682 and the peeling layer 688 formed on the surface 684 of the substrate 682. However, a ceramic green sheet (i.e., an unfired ceramic sheet) may be used as the support member. In the latter case, the composition of the green sheet is determined such that at the heat treatment temperature employed in the firing step 710, the ceramic green sheet cannot be sintered but the resin contained therein can be fully burned off.

In addition, in the tenth through thirteenth embodiments, the PDP employs the opposing discharge structure in which the discharges are produced between the sustaining electrodes 652 partly covering the inner wall surfaces of the sheet member 620. However, it is possible to employ the surface discharge structure in which no electrodes cover the inner wall surfaces of the sheet member. In the latter case, it is preferred that the projecting portions 658 be provided to cause the discharges to be produced at desired positions.

In addition, in the embodiments, the partition walls 622 are provided in the stripe pattern. However, a grid-like partition wall may be used to separate the discharge spaces from each other, so long as there are no problems with the air discharging and gas charging operation after the sealing operation. In addition, in the illustrated embodiments, both the front and rear plates 616, 618 have the respective partition walls 622, 634. However, it is possible that only one of the two plates 616, 618 have the partition walls. In the latter case, it is preferred that the other plate free of the partition walls be free of the fluorescent layers, for the purpose of preventing the sheet member 620 from contacting the fluorescent body.

In addition, in the embodiments, the fluorescent layers 632, 636 are provided on the inner surfaces 612, 614, respectively. However, it is possible to provide the fluorescent layers on only one of the two surfaces 612, 614.

In addition, boundary portions between the discharge spaces 624, more specifically described, the respective top and/or base portions of the partition walls 622, 634, or the ridges between the grooves 756 of the front plate 752 may be provided with a black stripe (i.e., a black mask) formed using, e.g., a glass paste (i.e., an insulating thick film) containing a black pigment.

FOURTEENTH EMBODIMENT

Figure 52:
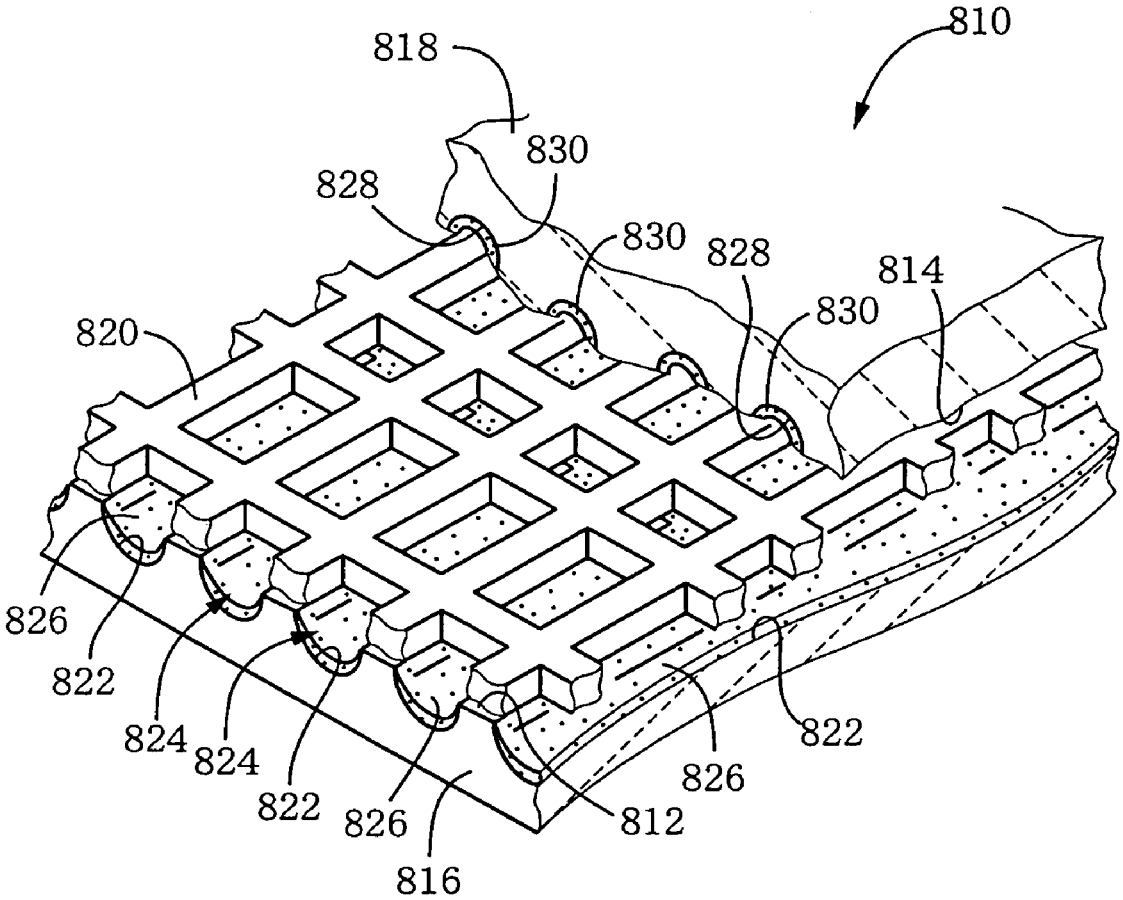
FIG. 52 is a perspective view of another color PDP as another gas-discharge display apparatus according to the present invention, with a portion of the PDP being cut away.

FIG. 52 is a perspective view for explaining a construction of an AC-type color PDP (hereafter, simply referred to as the PDP) 810 as an example of a gas-discharge display apparatus according to the ninth invention, such that a portion of the PDP 810 is cut away. In the figure, the PDP 810 includes a front plate 816 and a rear plate 818 which are provided such that the front and rear plates 816, 818 extend parallel to each other and are distant from each other by a pre-determined distance, so that respective one inner surfaces 812, 814 of the front and rear plates 816, 818 which surfaces are generally flat, oppose each other. A sheet member 820 having a grid pattern is provided between the front and rear plates 816, 818, and peripheral portions of the front and rear plates 816, 818 are gas-tightly sealed. Thus, a gas-tight space is defined in the PDP 810. Each of the front and rear plates 816, 818 has a size of about 900 (mm)× about 500 (mm) and a uniform thickness of from about 1.1 (mm) to about 3 (mm), and those plates 216, 218 are formed of, e.g., respective soda lime glasses which are similar to each other and each of which is transparent and has a softening point of about 700 (° C.). In the present embodiment, the front plate 816 provides a first substrate; and the rear plate 818 provides a second substrate.

On the inner surface 812 of the front plate 816, there are provided a plurality of elongate grooves 822 which extend parallel to each other in one direction and whose centerlines are distant from each other at a regular interval of from about 200 (μm) to about 500 (μm). Thus, the gas-tight space defined between the front and rear plates 816, 818 is divided into a plurality of discharge spaces 824 by ridge-like portions (or ridges) present between the grooves 822. The grooves 822 are formed by, e.g., grinding the inner surface 812, such that each of the grooves 822 has a depth of not greater than about 100 (μm) and an opening width of from about 150 (μm) to about 400 (μm). Thus, a top end of each of the ridge-like portions present between the grooves 822 has a width of from about 50 (μm) to about 100 (μm). The sheet member 820 includes a plurality of elongate grid bars which extend in one direction and are placed on respective top ends of the ridge-like portions present between the grooves 822.

In the plurality of grooves 822, there are provided a plurality of fluorescent layers 826, respectively, which are distinguished from each other so as to correspond to the plurality of discharge spaces 824, respectively. A thickness of each of the fluorescent layers 826 is pre-determined to fall in the range of, e.g., from about 10 (μm) to about 20 (μm), depending upon its fluorescent color. The fluorescent layers 826 are grouped into three groups of layers 826 that emit, by ultraviolet-light excitation, three fluorescent colors, e.g., red color (R), green color (G), and blue color (B), respectively. The fluorescent layers 826 are arranged such that each one of the layers 826, and two layers 826 located on either side of the each layer 826 emit the three, different fluorescent colors, respectively, in the corresponding three discharge spaces 824, respectively.

Meanwhile, on the inner surface 814 of the rear plate 818, there are provided a plurality of elongate grooves 828 which extend parallel to each other in one direction and whose centerlines are distant from each other at a regular interval of from about 200 (μm) to about 500 (μm). Thus, the grooves 828 oppose the grooves 822, respectively. Each of the grooves 828 has the same depth and opening width as those of each grove 822. In the plurality of grooves 828, there are provided a plurality of fluorescent layers 830, respectively, each of which has a thickness falling in the range of, e.g., from about 10 (μm) to about 20 (μm). The fluorescent layers 830 are arranged such that each of the layers 830 emits, in a corresponding one of the discharge spaces 824, the same fluorescent color as the fluorescent color emitted in the one discharge space 824 by a corresponding one of the fluorescent layers 826 provided on the front plate 816. Thus, in the present embodiment, the front plate 816 and the rear plate 818 have a substantially identical construction.

Figure 53:
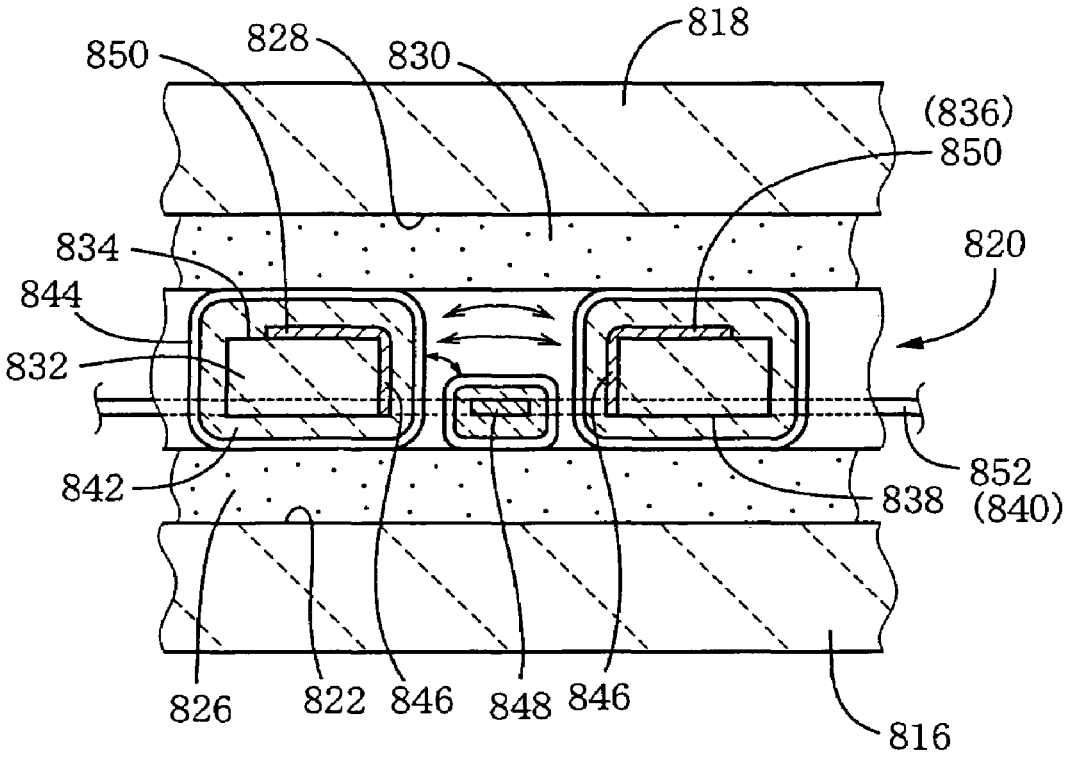
FIG. 53 is a cross-section view for explaining a construction of the PDP of FIG. 52, taken in a lengthwise direction of grooves thereof.

FIG. 53 is a cross-section view, taken in a lengthwise direction of the grooves 822 and along a centerline of one of the grooves 828, for explaining a construction of the PDP 810. The sheet member 820 includes a dielectric core layer 832 which has a grid pattern (see FIG. 52) constituting a skeleton of the grid pattern of the sheet member 820; a sustaining wiring layer 836 which is stacked on, and fixed to, an area continuing from one surface 834 (i.e., an upper surface, shown in the figure) of the core layer 832 to respective one side surfaces of grid bars of the core layer 832 (i.e., respective one inner wall surfaces of the grid pattern thereof); a writing wiring layer 840 which is stacked on, and fixed to, an area continuing from an opposite surface 838 (i.e., a lower surface, shown in the figure) of the core layer 832 to respective one side surfaces of grid bars of the core layer 832 (i.e., respective one inner wall surfaces of the grid pattern thereof); a dielectric cover layer 842 which covers the dielectric core layer 832, the sustaining wiring layer 836, and the writing wiring layer 840; and a protection film 844 which covers the dielectric cover layer 842 and provides a surface layer of the sheet member 820. In the present embodiment, the sustaining wiring layer 836 provides a first conductive thick-film layer; and the writing wiring layer 840 provides a second conductive thick-film layer.

The dielectric core layer 832 has a thickness of from about 50 (μm) to about 150 (μm), for example, a thickness of 100 (μm), and respective grid bars of the core layer 832 that extend in lengthwise and width directions thereof and cooperate with each other to constitute the grid pattern thereof, have a width which is substantially equal to the width of the top ends of the ridge-like portions between the grooves 822, or somewhat greater than that width in consideration of alignment margins, for example, a width of from about 80 (μm) to about 200 (μm). The dielectric core layer 832 is formed of a dielectric thick-film material which contains a low softening point glass, such as $PbO—B_2O_3—SiO_2—Al_2O_3—ZnO—TiO_2$ glasses or a combination of two or more of these glasses, and additionally contains a ceramic filler such as alumina.

The sustaining wiring layer 836 and the writing wiring layer 840 are each formed of an electrically conductive thick film which contains, as an electrically conductive component thereof, silver (Ag), chromium (Cr), or copper (Cu), and each have a thickness of from about 5 (μm) to about 10 (μm). The sustaining wiring layer 836 includes a plurality of portions 846 which cover respective side surfaces of the grid bars of the dielectric core layer 832. Those portions 846 function as a plurality of pairs of sustaining electrodes which produce respective gas discharges in the respective discharge spaces 824. As shown in the figure, each pair of sustaining electrodes 846 are located, on the inner wall surfaces of the grid pattern of the sheet member 820, at respective positions where the two sustaining electrodes 846 extend parallel to each other and oppose each other. Thus, the PDP 810 has an opposing discharge structure in which a discharge is produced between two sustaining electrodes 846 opposing each other in each discharge space 824.

Meanwhile, the writing wiring layer 840 includes a plurality of portions 848 (i.e., portions located in a middle area in the figure) each of which is located between the two sustaining electrodes (i.e., opposing portions) 846, 846 of a corresponding one pair out of the pairs of sustaining electrodes 846. The each portion 848 cooperates with one of the two sustaining electrodes 846, 846, for example, a left-hand electrode 846 shown in the figure, to produce a writing discharge so as to select a light emission unit (i.e., cell).

The dielectric cover layer 842 has a thickness falling in the range of, e.g., from about 10 (μm) to about 30 (μm), for example, a thickness of about 20 (μm), and is formed of a thick film which contains a glass having a low softening point, such as $PbO—B_2O_3—SiO_2—Al_2O_3—ZnO—TiO_2$ glasses or a combination of two or more of these glasses. The dielectric cover layer 842 is employed mainly for the purpose of storing electric charges on an outer surface thereof and thereby causing each pair of sustaining electrodes 846, 846 to produce an alternate-current discharge. In addition, since the cover layer 842 prevents exposure of the thick-film-based sustaining electrodes 846 and writing electrodes 848, and thereby restrains the generation of outgas from those electrodes 846, 848 and the change of atmosphere in each discharge space 824.

The protection film 844 has a thickness of, e.g., about 0.5 (μm), and is formed of a thin or thick film which contains, e.g., MgO as a main component thereof. The protection film 844 is employed for the purpose of preventing discharge-gas ions from causing sputtering of the dielectric cover layer 842. Since, however, the protection film 844 is formed of a dielectric material having a high secondary electron emission factor, the protection film 844 substantially functions as the discharge electrodes.

Figure 54:
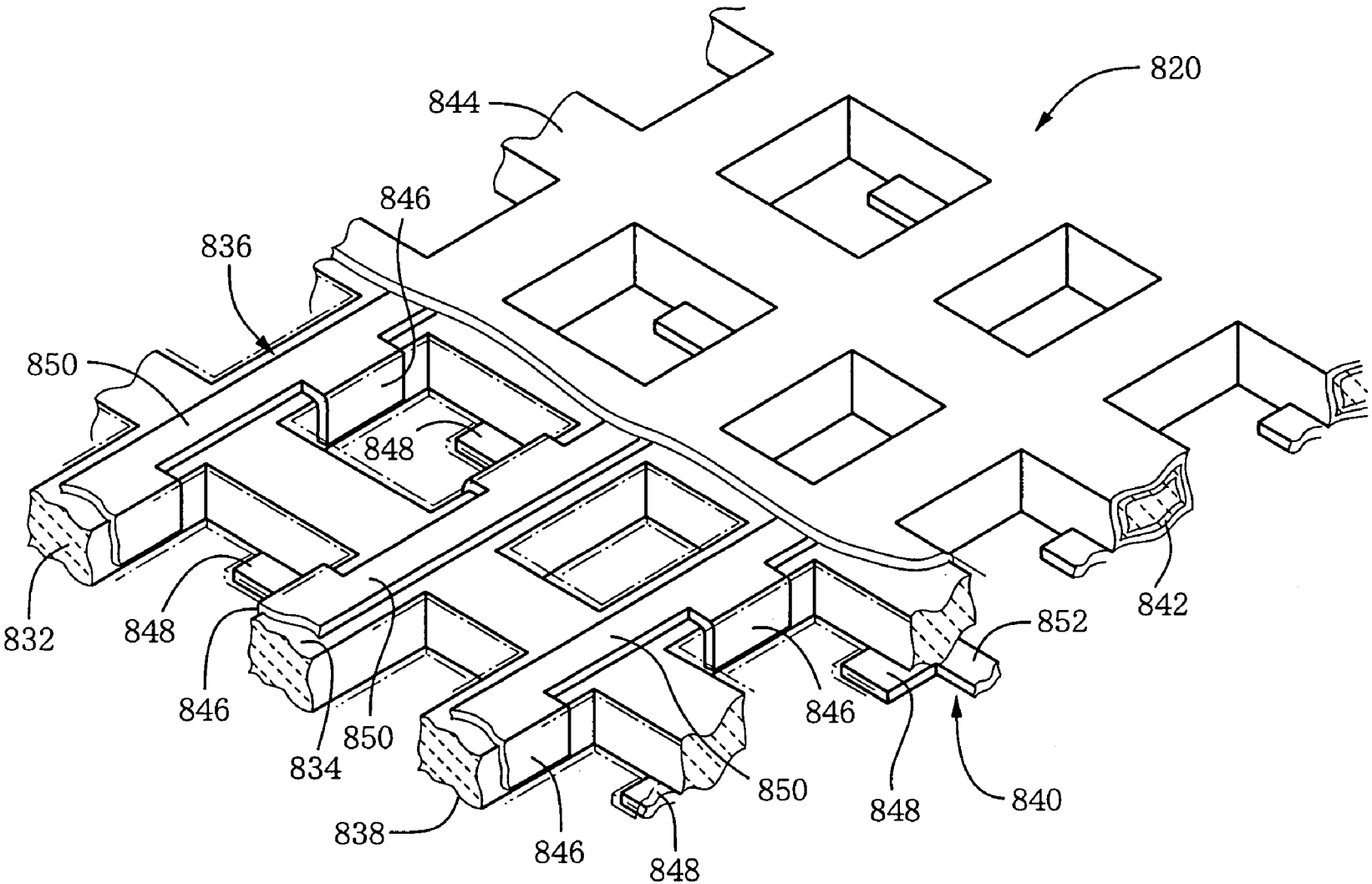
FIG. 54 is a view for explaining a construction of a sheet member of the PDP of FIG. 52.

FIG. 54 is a view for explaining in detail respective constructions of the sustaining wiring layer 836 and the writing wiring layer 840, with a portion of the sheet member 820 being cut away. In the figure, the sustaining wiring layer 836 includes a plurality of wiring portions 850 which extend in one direction of the grid pattern constituting the sheet member 820; and the writing wiring layer 840 includes a plurality of wiring portions 852 which extend in another direction perpendicular to the above-indicated one direction and which are electrically insulated from each other. Thus, the wiring portions 850 and the wiring portions 852 extend in the respective directions perpendicular to each other. Each of the wiring portions 850, 852 has a pre-determined width of from about 50 (μm) to about 80 (μm), and is located on a widthwise middle portion of a corresponding one of the grid bars of the dielectric core layer 832.

Each of the wiring portions 850 of the sustaining wiring portion 836 includes a plurality of projecting portions 854 which laterally project from a plurality of locations, respectively, that are distant from each other in a lengthwise direction of the each wring portion 850. Thus, each of the projecting portions 854 projects in a direction substantially parallel to the wiring portions 852 of the writing wiring portion 840. Each of the sustaining electrodes 846 is continuous with an end of the projecting portion 854, and extends from the end in a direction perpendicular to the same 854. A width of each projecting portion 854 and each sustaining electrode 846 is, e.g., about 100 (μm); and a height of each sustaining electrode 846 is substantially equal to the thickness of the sheet member 820, i.e., falls in the range of from about 50 (μm) to about 150 (μm), e.g., about 100 (μm). Thus, the sustaining electrodes 846 cover respective portions of respective side surfaces of the grid bars of the dielectric core layer 832.

Each of the wiring portions 852 of the writing wiring portion 840 includes a plurality of projecting portions, i.e., a plurality of writing electrodes 848 which laterally project from a plurality of locations, respectively, that are distant from each other in a lengthwise direction of the each wring portion 852. A width of each projecting portion or writing electrode 848 falls in the range of from about 50 (μm) to about 150 (μm), e.g., about 100 (μm); and a length of projection of each writing electrode 848 from the corresponding wiring portion 852 falls in the range of from about 30 (μm) to about 100 (μm), e.g., about 50 (μm).

Figure 55:
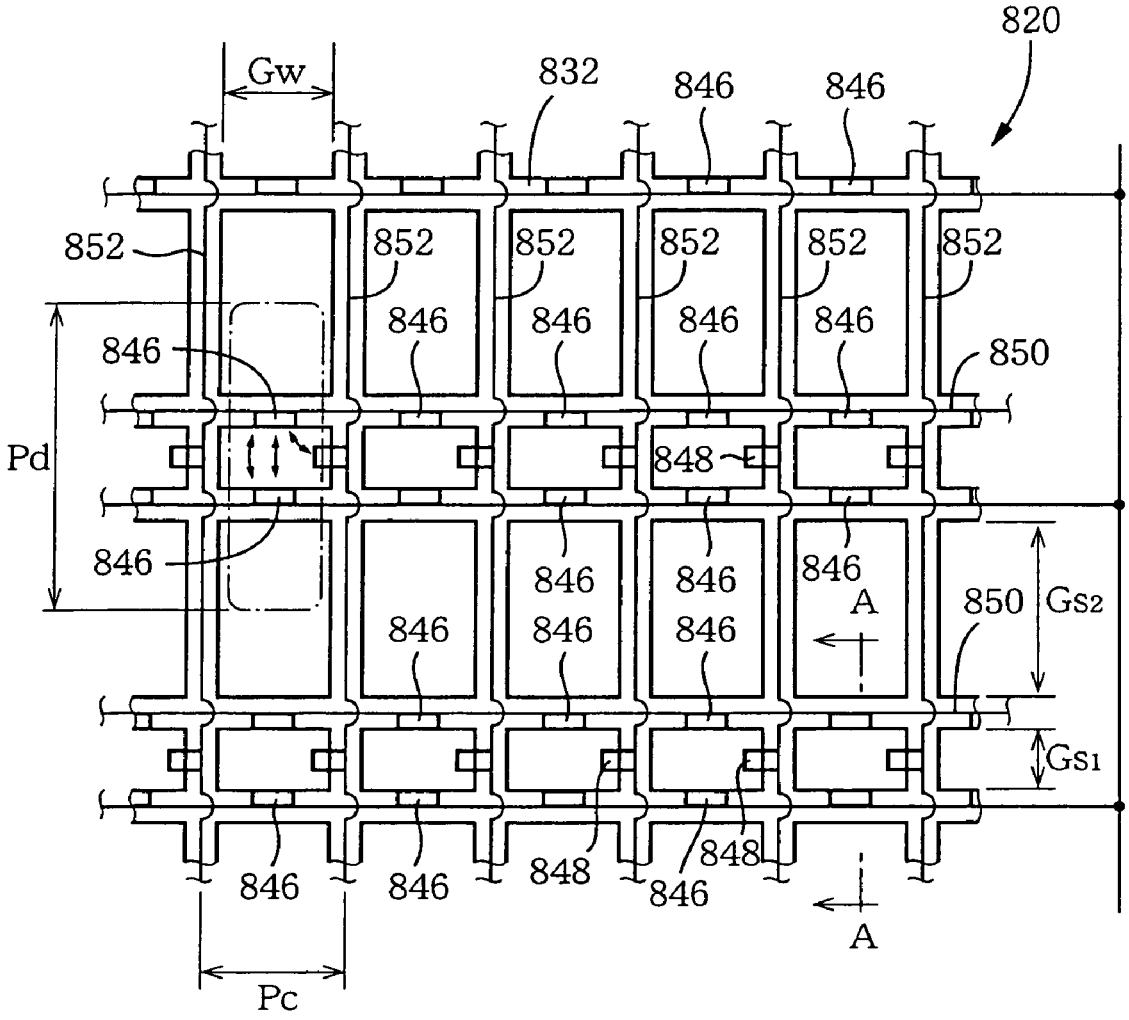
FIG. 55 is a view for explaining a manner in which wiring layers are formed in the sheet member shown in FIG. 54.

FIG. 55 is a schematic view for explaining a manner in which the wiring portions 850 of the sustaining wiring layer 836 and the wiring portions 852 of the writing wiring layer 840 are connected to the sustaining electrode 846 and the writing electrodes 848, respectively. The plurality of wiring portions 850 that extend in a horizontal direction in the figure correspond, one to one, to a plurality of horizontal grid bars of the dielectric core layer 832 that extend in the horizontal direction in the figure. Thus, a plurality of sustaining electrodes 846 that are arranged in each array in the horizontal direction in the figure are connected to a common wiring portion 850. The wiring portions 850 include a first group of wiring portions 850 each of which is independent of all the other wiring portions 850, and a second group of wiring portions 850 all of which are connected to a common line, and the wiring portions 850 of the first group and the wiring portions 850 of the second group are alternately arranged in a vertical direction in the figure.

The plurality of wiring portions 852 that extend in the vertical direction in the figure correspond, one to one, to a plurality of vertical grid bars of the dielectric core layer 832 that extend in the vertical direction in the figure. As shown in the figure, all the writing electrodes 848 project in a same direction, i.e., in a leftward direction in the figure, such that each of the writing electrodes 848 is provided in a corresponding one of the grid spaces in which the pairs of sustaining electrodes 846, 846 are provided.

As shown in the figure, the intervals of distance between the grid bars of the sheet member 820 are not uniform. More specifically described, the grid bars of the sheet member 820 that extend along the wiring portions 852 of the writing wiring layer 840 are arranged at a regular interval, Gw, of, e.g., about 200 (μm), but the grid bars of the sheet member 820 that extend along the wiring portions 850 of the sustaining wiring layer 836 are arranged such that a relatively small interval, Gs1, of, e.g., about 100 (μm) and a relatively large interval, Gs2, of, e.g., about 600 (μm) are alternate with each other. The sustaining electrodes 846, 846 of each pair oppose each other at the relatively small interval Gs1. As indicated in a left-hand middle area shown in FIG. 55, each pair of sustaining electrodes 846, 846 cooperate with each other to produce a sustaining discharge to display an image, and according the discharge gap is substantially equal to the small interval Gs1, i.e., about 100 (μm). As is apparent from the comparison of FIG. 55 with FIG. 52, the grid bars of the sheet member 820 that extend along the wiring portions 852 are placed on the ridge-like portions present between the grooves 822, respectively. FIG. 53 is a cross-section view taken along A—A in FIG. 55.

When an alternate-current pulse is applied to the first group of wiring portions 850 each of which is independent of the other wiring portions 850 and to which a first group of sustaining electrodes 846 are connected, so as to scan sequentially the same 850, and concurrently an alternate-current pulse is applied via the wiring portions 852 to desired ones of the writing electrodes 848 that correspond to data (i.e., the writing electrodes corresponding to the light emission units each selected to emit light), in synchronism with the timing of scanning of the first group of wiring portions 850, so that, as indicated in the cell located in the left-end, middle area shown in FIG. 55, the desired writing electrodes 848 and the corresponding sustaining electrodes 846 of the first group cooperate with each other to produce respective writing discharges. Thus, electric charges are accumulated on respective portions of the protection films 844 that are located above those sustaining electrodes 846. After all the sustaining electrodes 846 are scanned in this way, an alternate-current pulse is applied to all pairs of sustaining electrodes 846, 846 via the wiring portions 850, so that the thus applied voltage is added to the electric potential caused by the electric charges accumulated in each of the light emission units corresponding to the above-indicated sustaining electrodes 846 of the first group, so as to exceed a discharge starting voltage. Thus, those sustaining electrodes 846 of the first group and the corresponding sustaining electrodes of the second group cooperate with each other to produce respective discharges, and these discharges are sustained for a pre-determined time by the wall electric charges newly produced on the protection film 844. Consequently the fluorescent layers 826, 830 corresponding to the selected light emission units are excited by ultraviolet lights produced by the gas discharges, and accordingly generate visible lights, so that those lights are outputted through the front plate 816 or the rear plate 818 and thus a desired image is displayed. Each time one-time scanning of the scanning electrodes (i.e., the sustaining electrodes 846) is completed, desired ones of the data electrodes (i.e., the writing electrodes 848), to which the pulse is to be applied, are re-selected, so that desired images are continuously displayed. As is apparent from the above explanation, the first group of sustaining electrodes 846 corresponding to the independent wiring portions 850 function as the scanning electrodes which cooperate with the writing electrodes 848, and additionally function as sustaining electrodes (i.e., image-display discharge electrodes) which cooperate with the second group of sustaining electrodes 846. In the case where an image is observed through only one of the front plate 816 and the rear plate 818, a reflecting film such as an aluminum film is provided on a rear surface of the other plate.

As shown in FIG. 55, each discharge is produced between each pair of electrodes 846, 846 that are distant from each other by the small distance Gs1, e.g., about 100 (μm). However, each discharge space 824 is continuous in the vertical direction in the figure. Therefore, the ultraviolet light produced by the discharge is spread, as schematically indicated at one-dot chain line in FIG. 55, outward of the discharge electrodes 846, 846, in a lengthwise direction of the each discharge space 824. Thus, respective portions of the fluorescent layers 826, 830 that are located, in the each discharge space 824, within the range bounded by the one-dot chain line are excited by the ultraviolet light generated by the discharge produced by the electrodes 846, 846, indicated in the left-hand middle portion of the figure, and accordingly emit light.

Therefore, the light emission units (i.e., cells) of the PDP 810 are defined by the ridge-like portions present between the grooves 822, with respect to the direction perpendicular to the same 822, i.e., the horizontal direction in the figure, and are substantially defined by the range to which the ultraviolet light is spread, with respect to the lengthwise direction of the grooves 822, i.e., the vertical direction in the figure. Thus, an interval of distance between respective centerlines of the light emission cells in the horizontal direction in the figure is a color cell pitch, Pc, of about 0.3 (mm); and an interval of distance between respective centerlines of the light emission cells in the vertical direction in the figure is a dot pitch, Pd, of about 0.9 (mm). In the present color PDP 810 in which the three colors R, G, B are used, three light emission units that are adjacent each other in the horizontal direction in the figure cooperate with each other to define one pixel. Therefore, a pitch of the pixels of the PDP 810 is about 0.9 (mm) with respect to each of the horizontal and vertical directions in the figure.

Thus, in the present embodiment, the sheet member 820 having the grid pattern includes the sustaining wiring layer 836 and the writing.wiring layer 840, and the respective portions of the sustaining wiring layer 836 that are fixed to the mutually opposing, side surfaces of the grid bars of the sheet member 820 provide the pairs of sustaining electrodes 846, 846 while the respective portions of the writing wiring layer 840 that project into the grid spaces in which the pairs of sustaining electrodes 846 are located provide the writing electrodes 848. That is, the PDP 810 has the opposing discharge structure in which each pair of discharge surfaces oppose each other. Therefore, the variation of respective discharge voltages (e.g., respective starting voltages or respective sustaining voltages) of the light emission units is reduced and the operation margin of the PDP 810 is improved.

In addition, the respective discharge surfaces of the sustaining electrodes 846, 846 are located at an intermediate height position that is distant from each of the front and rear plates 816, 818, and the discharge direction in which the discharge electrodes produce the discharges is parallel to each of the respective inner surfaces 812, 814 of the front and rear plates 816, 818. Therefore, the inner surfaces 812, 814 of the two plates 816, 818 are less influenced by the discharge-gas ions, and accordingly the fluorescent layers 826, 830 can be provided in respective wider areas on the inner surfaces 812, 814. Thus, as compared with a surface discharge structure in which fluorescent layers can be provided on only a substrate opposing a substrate to which sustaining electrodes are fixed, the PDP 810 can enjoy a highly increased degree of brightness.

Moreover, since the sheet member 820 includes both the sustaining electrodes 846 and the writing electrodes 848, the writing electrodes 848 are freed of limitations with respect to their position and size and accordingly can enjoy desirable position and size. Thus, the efficiency of discharge, speed of response, and degree of brightness, of the PDP 810 can be largely improved.

Figure 56:
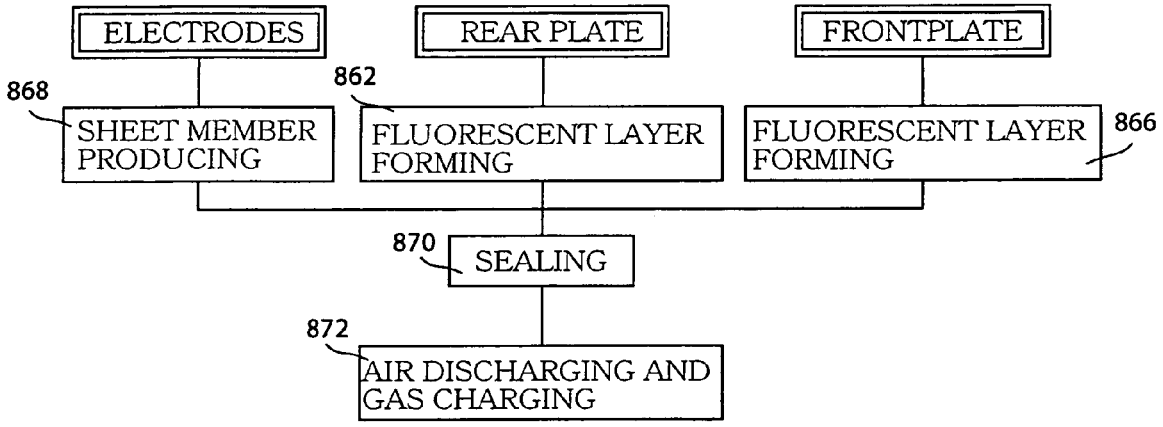
FIG. 56 is a flow chart for explaining a method of producing the PDP of FIG. 52.

Meanwhile, the PDP 810 constructed as described above can be produced, in the method according to the tenth invention, by assembling the sheet member 820, the front plate 816, and the rear plate 818 that are processed (or produced) independent of each other according to the flow chart shown in FIG. 56.

The rear plate 818 is processed as follows: First, a flat rear plate 818 is prepared and then grooves 828 are formed by grinding an inner surface 814 of the rear plate 818. Alternatively, a rear plate 818 having grooves 828 formed in advance is prepared. Subsequently, in a fluorescent layer forming step 862, a thick-film screen printing method or a pouring method is used to apply each of three kinds of fluorescent slurries or pastes corresponding to the three colors R, G, B, to a corresponding one of respective inner spaces of the grooves 822 and then fire the applied slurries or pastes at a temperature of, e.g., about 450 (° C.) so as to obtain the fluorescent layers 830.

Meanwhile, the front plate 816 is processed as follows: Similarly, a glass plate having grooves 822 formed in advance is prepared. Subsequently, in a fluorescent layer forming step 866, a technique such as a thick-film screen printing method or a pouring method is used to apply each of three kinds of fluorescent slurries or pastes corresponding to the three colors R, G, B, to a corresponding one of respective inner spaces of the grooves 822 and then fire the applied slurries or pastes at a temperature of, e.g., about 450 (° C.) so as to obtain the fluorescent layers 826.

The sheet member 820 is produced in a sheet member producing step 868. The front and rear plates 816, 818 are superposed on each other via the sheet member 820, and are subjected, in a sealing step 870, to a heat treatment so that the two plates 816, 818 and the sheet member 820 are gas-tightly sealed with a sealing material, such as a sealing glass, that is applied in advance on respective interfaces of the same 816, 818, 820. Before this sealing step, the sheet member 820 may be fixed, as needed, to either one of the front and rear plates 816, 818, using a glass frit. Finally, in an air discharging and gas charging step 872, air is discharged from the thus obtained, gas-tight container, and an appropriate discharge gas is charged into the same so as to obtain the PDP 810.

Figure 57:
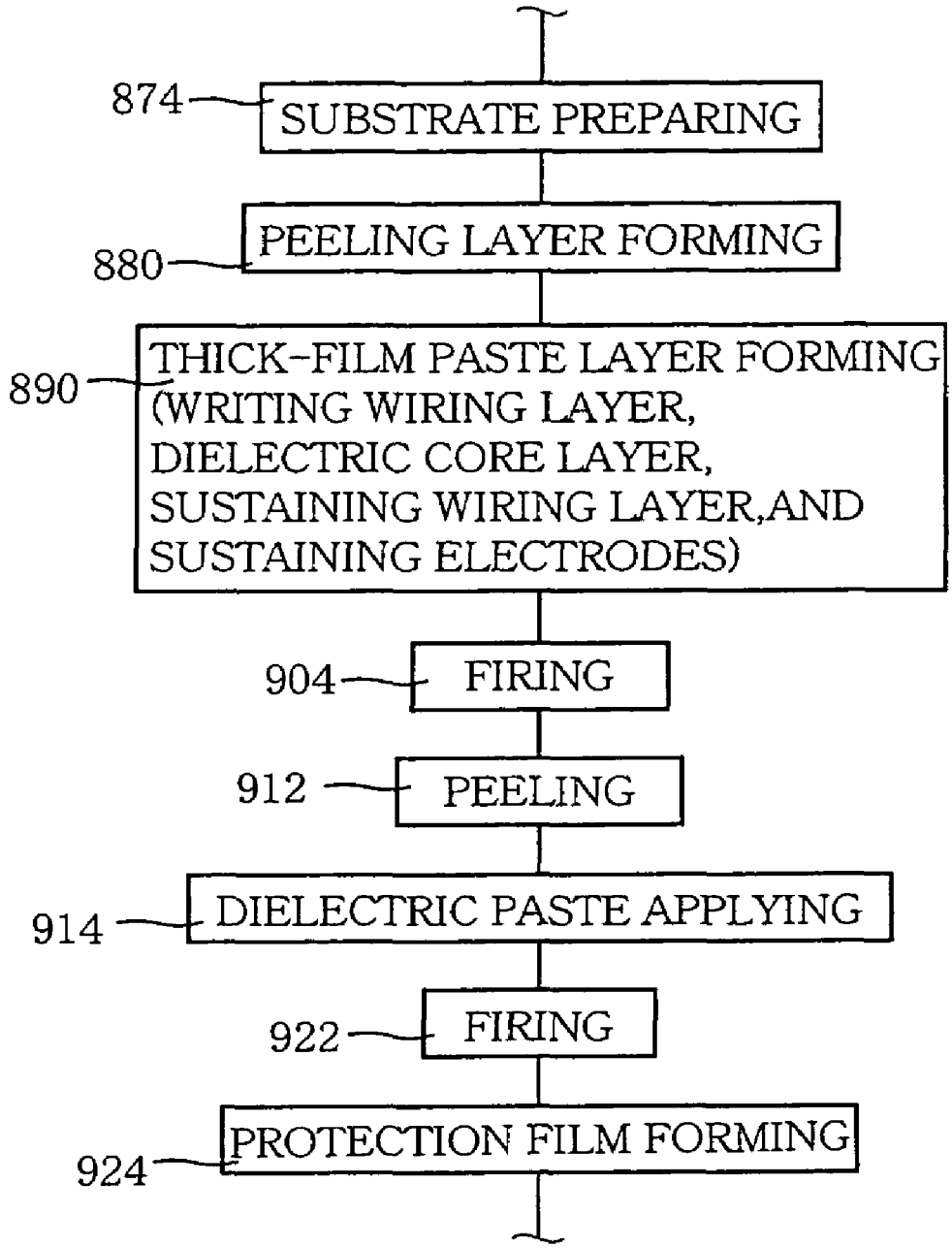
FIG. 57 is a flow chart for explaining a method of producing the sheet member.

In the above-described producing method, the sheet member producing step 868 is carried out according to the flow chart, shown in FIG. 57, in which a well known thick-film printing technique is used. Hereinafter, the method of producing the sheet member 820 will be explained by reference to FIGS. 58(*a*) through 58(*f*) and FIGS. 59(*g*) through 59(*i*) that show respective states in essential steps of the producing method.

First, in a substrate preparing step 874, a substrate 876 (see FIG. 58) on which a thick-film printing is to be carried out, is prepared, and a surface 878 of the substrate 876 is subjected to an appropriate cleaning treatment. This substrate 876 is preferably provided by a glass substrate formed of, e.g., a soda lime glass that exhibits substantially no deformation or deterioration in a heat treatment, described later, and has a thermal expansion coefficient of about $87\times10^{-7}$ (/° C.), a softening point of about 740 (° C.), and a distorting point of about 510 (° C.). The substrate 876 has a thickness of, e.g., about 2.8 (mm), and the surface 878 of the substrate 876 is sufficiently larger than that of the sheet member 820.

Subsequently, in a peeling layer forming step 880, a peeling layer 882 that consists of particles having a high melting point and bound to each other with a resin, and has a thickness of, e.g., from about 5 (μm) to 50 (μm), is provided on the surface 878 of the substrate 876. The high melting point particles may be a mixture of a high softening point glass frit having an average particle size of from 0.5 (μm) to 3 (μm), and a ceramic filler, such as alumina or zirconia, having an average particle size of from 0.01 (μm) to 5 (μm) and a percentage of from about 30 (%) to 50 (%).

Figure 58:
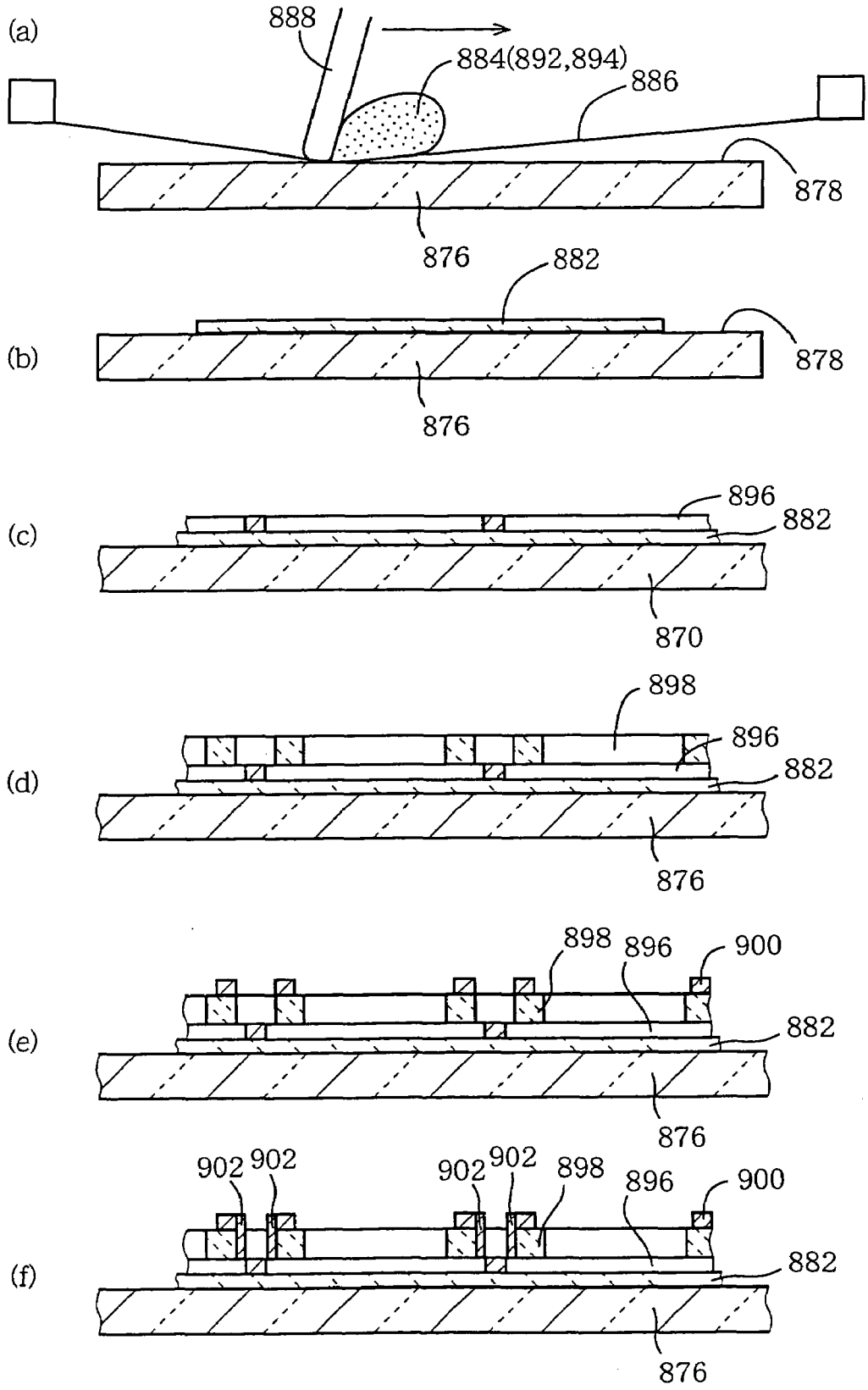
FIGS. 58(*a*) through 58(*f*) are views showing a substrate and one or more thick films, in respective essential steps out of the producing steps shown in FIG. 57.

The high softening point glass may be a glass having a high softening point not lower than, e.g., about 550 (° C.), and the high melting point particles as the mixture may have a softening point not lower than, e.g., about 550 (° C.). The resin may be an ethyl cellulose resin that is burned out at, e.g., 350 (° C.). The peeling layer 882 is formed, as shown in FIG. 58(*a*), on a substantially entire surface of the substrate 876 in such a manner that an inorganic material paste 884 in which the high melting point particles and the resin are dispersed in an organic solvent such as butyl carbitol acetate (BCA) is applied to substantially the entire surface of the substrate 876, by a screen printing method, and subsequently the applied paste 884 is dried at room temperature. However, the peeling layer 882 may be formed using a coater, or by adhesion of a film laminate. FIG. 58(*b*) shows a step in which the peeling layer 882 is thus formed on the substrate 876. In FIG. 58(*a*), numeral 886 designates a screen; and numeral 888 designates a squeegee. In the present embodiment, the substrate 876 and the peeling layer 882 formed thereon cooperate with each other to provide a support member; the surface of the peeling layer 882 provides a film formation surface on which films are formed; and the substrate preparing step 874 and the peeling layer forming step 880 cooperate with each other to provide a support member preparing step.

Subsequently, in a thick-film paste layer forming step 890, a thick-film conductive paste 892 for forming the writing wiring layer 840, the sustaining wiring layer 836, and the sustaining electrodes 846, and a thick-film dielectric paste 894 (see FIG. 58(*a*)) for forming the dielectric core layer 832 are sequentially applied, each in a predetermined pattern, on the peeling layer 882, and then dried, by utilizing, e.g., the screen printing method, like in the step 880 in which the inorganic material paste 884 is applied. Thus, a conductive printed layer 896 constituting the writing wiring layer 840, a dielectric thick-film layer 898 constituting the dielectric core layer 832, a conductive printed layer 900 constituting the sustaining wiring layer 836, and a conductive printed layer 902 constituting the sustaining electrodes 846 are formed in the order of description. The thick-film conductive paste 892 may be obtained by dispersing, in an organic solvent, a mixture of powder of conductive material, such as powder of silver; a glass frit; and a resin. The thick-film dielectric paste 894 may be obtained by dispersing, in an organic solvent, a mixture of powder of dielectric material such as powder of alumina or zirconia; a glass frit; and a resin. Each glass frit is, e.g., a low softening point glass such as $PbO—B_2O_3—SiO_2—Al_2O_3—TiO_2$ glasses, and each resin and each organic solvent are, e.g., the same resin and organic solvent that are used to obtain the inorganic material paste 884.

For the purpose of forming the wiring layers 836, 840 and the dielectric core layer 832, those screens 886 are used which have respective slot patterns corresponding to the respective shapes of the layers 836, 840, 832, shown in FIGS. 52 and 54. The thick-film conductive paste 892 and the thick-film dielectric paste 894 are so applied as to have respective predetermined thickness values which assure that the layers 836, 840, 832 have the above-described thickness values after being fired and shrunk. Meanwhile, for the purpose of forming the sustaining electrodes 846, such a screen 886 is used which has slots that are slightly offset inward of the inner wall surfaces of the dielectric core layer 832, so that the thick-film conductive paste 892 flows downward from the upper surface of the dielectric core layer 832 along the inner wall surfaces of the same 832. FIGS. 58(*c*) through 58(*f*) show respective steps in which the conductive printed layer 896, the dielectric printed layer 898, the conductive printed layer 900, and the conductive printed layer 902 are formed. Since the respective thickness values of the conductive printed layers 896, 900, 902 fall in the range of from about 5 (□m) to about 10 (□m), each of the layers 896, 900, 902 can be formed in a single printing operation. However, since the dielectric printed layer 898 has the thickness of about 30 (□m), the layer 898 is formed by repeating, e.g., three printing and drying operations and thereby stacking three layers on each other that have an appropriate thickness in total.

Figure 59:
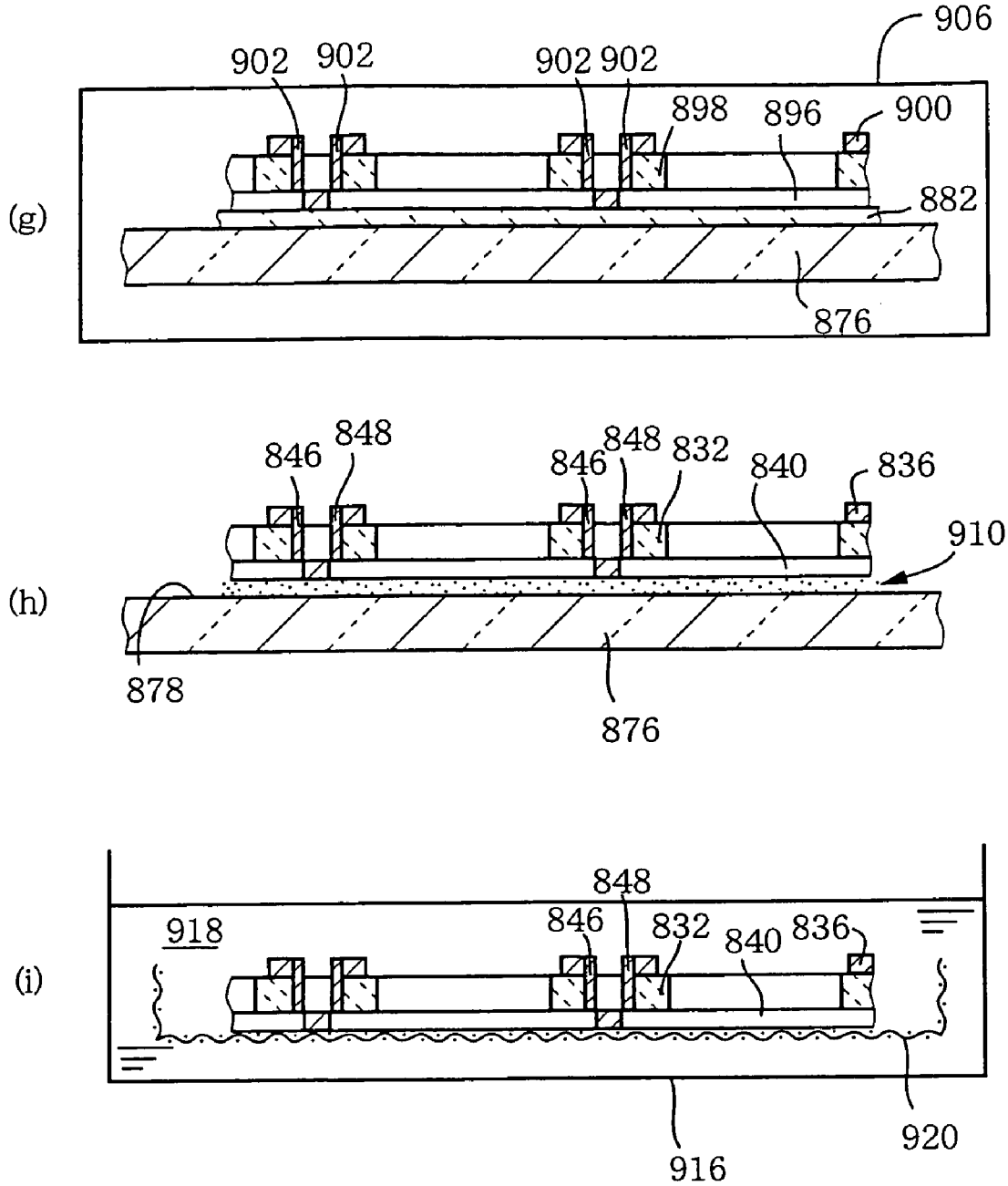

After the thick-film printed layers 896 through 902 are formed in this way and then dried to remove the solvents, a firing step 904 is carried out. In the firing step 904, the substrate 876 is put in a furnace 906 of an appropriate firing device, and is subjected to a heat treatment at a firing temperature, e.g., 550 (° C.), corresponding to each of the thick-film conductive paste 892 and the thick-film dielectric paste 894. FIG. 59(*g*) shows a state in which the heat treatment is carried out.

A sintering temperature of each of the thick-film printed layers 896 through 902 is, e.g., about 550 (° C.). Therefore, during the heat treatment, the resins are removed, and the dielectric materials, the conductive materials, and the glass frit are sintered. Thus, the dielectric core layer 832 and the thick-film conductive layers (i.e., the sustaining wiring layer 836 and the writing wiring layer 840), that is, a basic portion of the sheet member 820 is produced. FIG. 59(*h*) shows this state. As described above, the peeling layer 882 includes the inorganic material particles whose softening point is not lower than 550 (° C.). Therefore, the resin is removed by firing, but the high melting point particles (i.e., the glass powder and the ceramic filler) are not sintered. Thus, as the heat treatment processes, the resin is removed and accordingly the peeling layer 882 is processed into a particle layer 910 consisting of the high melting point particles 908 (see FIG. 60).

Figure 60:
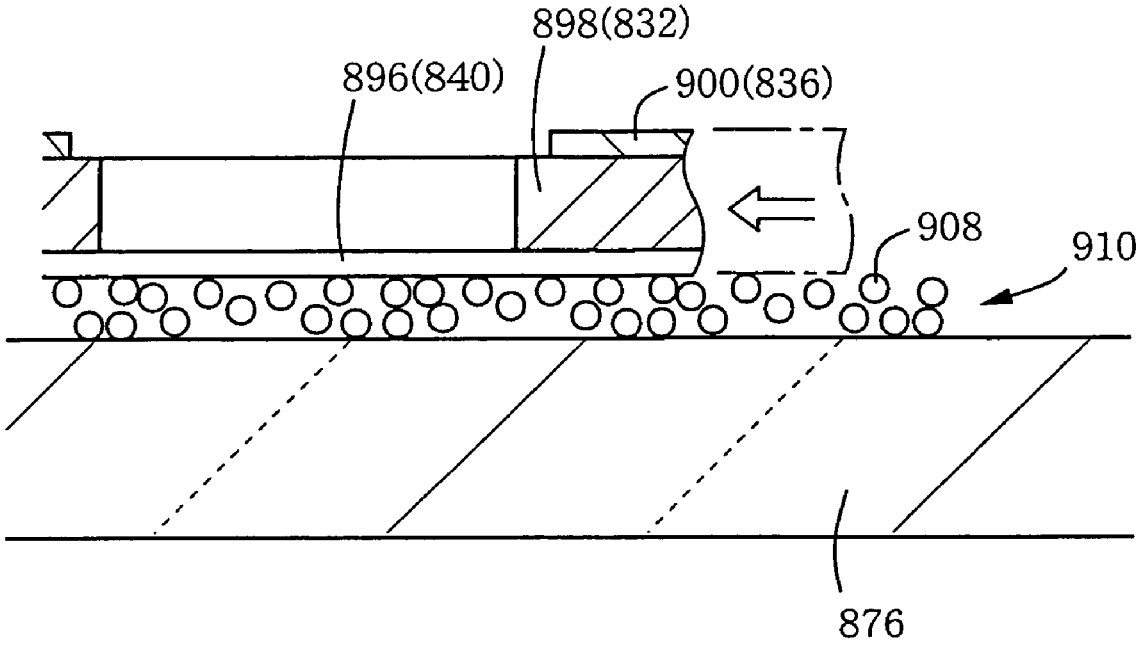
FIG. 60 is a view for explaining a manner in which the thick films are shrunk in a firing step shown in FIG. 57.

FIG. 60 is an enlarged, illustrative view corresponding to right-hand end portions of the thick-film printed layers 896 through 902, shown in FIG. 59(*h*), and showing how the sintering process advances in the heat treatment. The particle layer 910, produced by removing, by firing, the resin from the peeling layer 882, is a layer consisting of the high melting point particles 908 that just are gathered and are not bound to each other. Therefore, when the respective end portions of the thick-film printed layers 896 to 902 are shrunk from a position before firing, indicated at one-dot chain line in the figure, the high melting point particles 908 function as rollers. Thus, there are produced no forces that resist the shrinking of the printed layers 896 to 902, at an interface between a lower surface of the layers 896 to 902 and the substrate 876. Therefore, a lower portion of the layers 896 to 902 shrinks similarly to an upper portion of the same. Thus, the layers 896 to 902 are free of the difference of density and/or warpage resulting from the difference of amounts of shrinkage.

In the present embodiment, when the sintering of the thick-film printed layers 896 to 902 is started, the substrate 876 does not resist, owing to the presence of the particle layer 910, the sintering and shrinking of the layers 896 to 902. Thus, the thermal expansion of the substrate 876 does not substantially influence the quality of the thick films thus produced. However, in the case where the substrate 876 is repeatedly used or the heat treatment is carried out at a higher temperature, it is possible to use a heat-resisting glass having a still higher point (e.g., a borosilicate glass having a thermal expansion coefficient of about $32\times10^{-7}$ (/° C.) and a softening point of about 820 (° C.), or a quartz glass having a thermal expansion coefficient of about $5\times10^{-7}$ (/° C.) and a softening point of about 1580 (° C.)). In this case, too, the amount of thermal expansion of the substrate 876 is small in a temperature range in which the binding force of the dielectric material powder is small, and accordingly the thermal expansion does not influence the quality of the thick films produced.

Back to FIG. 57, in a peeling step 912, the thus produced thick films, i.e., the dielectric core layer 832 and the wiring layers 836, 840 that are stacked on each other, are peeled from the substrate 876. Since the particle layer 910 interposed between the layers 832, 836, 840 and the substrate 876 consists of the high melting point particles 908 just being gathered, the peeling operation can be easily carried out without using any agents or tools. Although the high melting point particles 908 may be adhered, with a thickness corresponding to one layer of particles 908, to the layers 832, 836, 840, those particles 908 can be removed, as needed, using an adhesive tape or an air blower. The substrate 876 from which the thick films have been peeled can be used again and again for similar purposes, because the substrate 876 is not deformed or deteriorated at the above-described firing temperature.

Subsequently, in a dielectric paste applying step 914, the thus peeled layers 832, 836, 840 are dipped in a dielectric paste 918 accommodated in a dipping tank 916, so that the dielectric paste 918 is applied to the entire outer surfaces of the layers. The dielectric paste 918 may be obtained by dispersing, in a solvent such as water, a mixture of powder of a glass such as $PbO—B_2O_3—SiO_2—Al_2O_3—TiO_2$ glasses or a combination of two or more of those glasses, and a resin such as PVA. The dielectric paste 918 is so prepared as to have a viscosity lower than that of the thick-film dielectric paste 894. It is possible to use, as the above-indicated glass powder, one which does not contain lead and whose softening point is not lower than 630 (° C.). This softening point is equal to, or higher than, that of the glass powder contained in the thick-film dielectric paste 894. The reason why the paste 918 prepared to have a low viscosity is used is to prevent air bubbles from being mixed with the paste 918 when the paste 918 is applied, and thereby prevent the fired product from suffering defects. The layers 832, 836, 840 are slowly dipped in the dielectric paste 918, and then taken out from the same 918, while being supported on a wire net 920 such that the layers take a horizontal posture.

Subsequently, in a firing step 922, the layers 832, 836, 840 that have been taken out from the dipping tank 918 and then dried sufficiently, is put in a firing furnace, so that the layers are subjected to a heat treatment (i.e., a firing treatment) in which the layers are fired at a pre-determined temperature of, e.g., about 650 (° C.) that corresponds to the kind of the glass powder contained in the dielectric paste 918. This firing temperature is so pre-determined as to be sufficiently higher than the softening point of the glass powder, so that the glass powder may sufficiently soften and provide a compact dielectric layer (i.e., the dielectric cover layer 842). Therefore, the thus obtained dielectric cover layer 842 is free of porosity that would otherwise result from grain boundaries of the glass powder, and enjoys a high withstand voltage. In the present embodiment, the electric paste applying step 914 and the firing step 922 cooperate with each other to provide a covering step.

Figure 61:
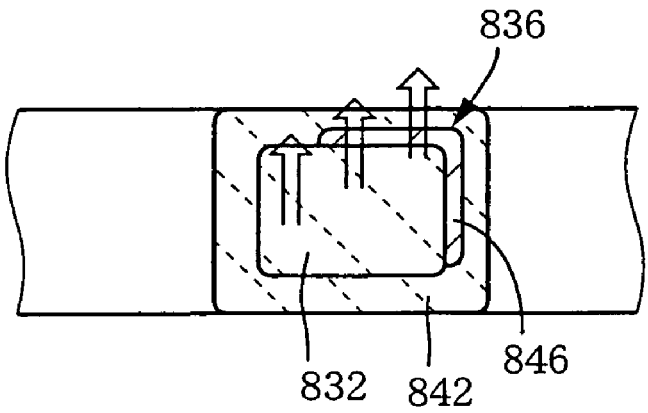
FIG. 61 is a view for explaining a direction in which gas moves out of a dielectric cover layer in the firing step.
Figure 62:
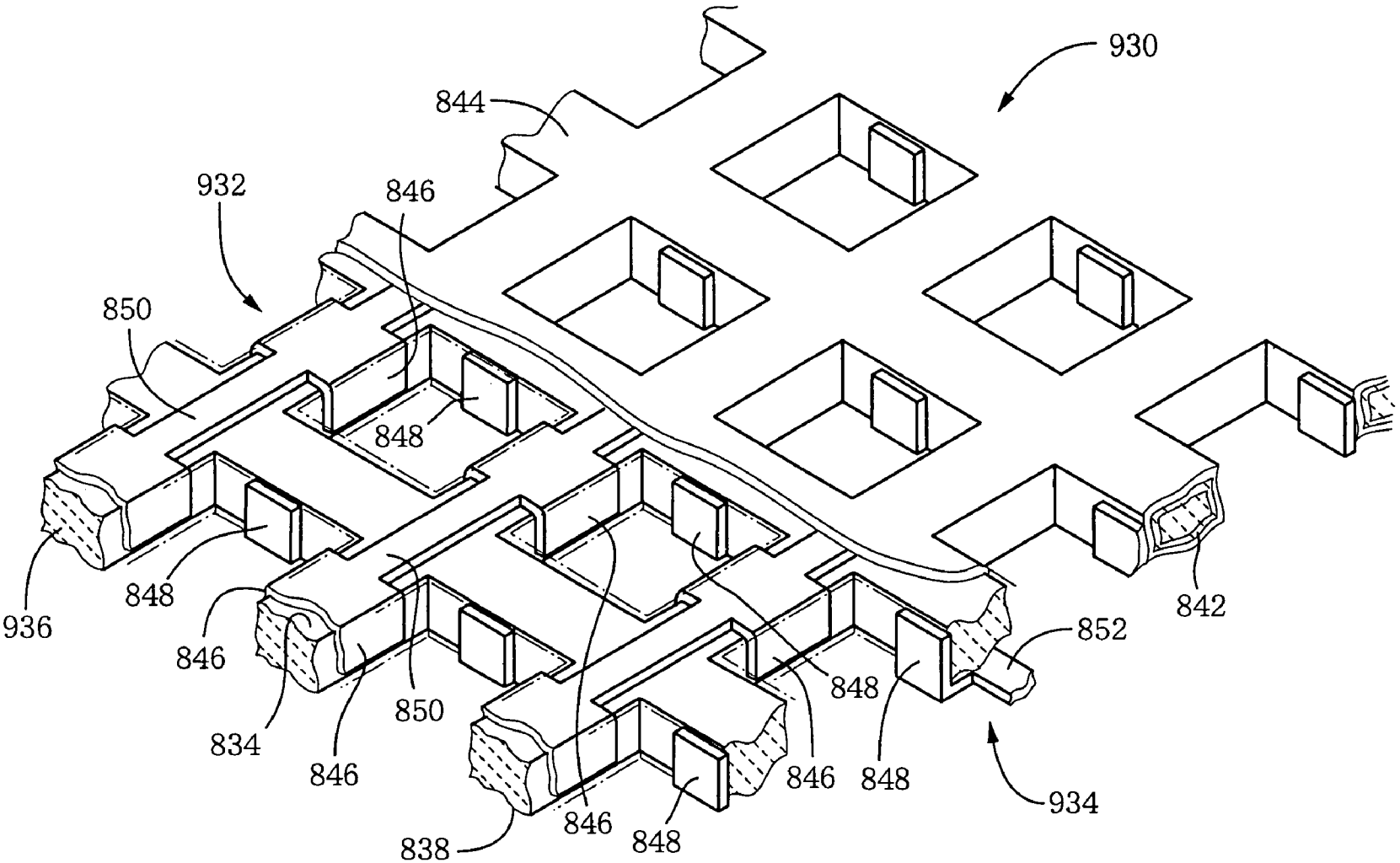
FIG. 62 is a cross-section view for explaining another sheet member employed by another PDP according to the present invention.

In the case where the firing step 922 is carried out at a considerably high temperature, gas is produced from the dielectric core layer 832 and the sustaining wiring layer 836 that are located inside, because the organic components remaining in those layers 832, 836 are burned. This gas produces bubbles in the dielectric cover layer 842, and those bubbles move upward as indicated at arrows in FIG. 61. Therefore, the bubbles produced in the cover layer 842 gather in an upper portion thereof as seen in the figure, and do not gather in the respective portions thereof that function as the discharge surfaces, i.e., cover the side surfaces of the dielectric core layer 832. Thus, even if the treatment temperature used in the firing step 922 may be considerably high, the high temperature does not cause any bubbles to be produced in the portions of the dielectric cover layer 842 that cover the sustaining electrodes 846. That is, a high firing temperature can be used to increase the degree of compactness of the layer 842 and thereby improve the properties of the same 842 such as a withstand voltage.

Then, in a protection film forming step 924, the protection film 844 is formed with a desired thickness on a substantially entire surface of the dielectric cover layer 842, e.g., by dipping and firing, or by a thick-film forming process such as sputtering. Thus, the sheet member 820 is obtained. Since the protection film 844 is thin as described above, it is considerably difficult to form the protection film 844 with a uniform thickness, by a thick-film forming process such as dipping. However, in the present embodiment, the respective distances between the pairs of electrodes 846, 846 are uniform, because each pair of electrodes produce an electric discharge while opposing each other. Therefore, irrespective of what shape the surface of the protection film 844 may have, local discharge hardly occurs. Thus, the protection film 844 is not required to be so uniform as a layer that is employed in the above-described surface discharge structure. In addition, the protection film 844 is not present on a path of emission of light, the film 844 is not required to be transparent.

Thus, in the present embodiment, when the front and rear plates 816, 818 are superposed on, and fixed to, each other to obtain the PDP 810, the sheet member 820 including the sustaining wiring layer 836 and the writing wiring layer 840 produced as described above, is fixed to the front or rear plate 816, 818, so that the sustaining electrodes 846 and the writing electrodes 848 are provided in the discharge spaces 824. Since the sheet member 820 includes the sustaining wiring layer 836 and the writing wiring layer 840 as the thick-film conductive layers constituting the sustaining electrodes 846 and the writing electrodes 848, the sustaining electrodes 846 and the writing electrodes 848 can be provided by just placing the sheet member 820 between the front and rear plates 816, 818. Thus, the PDP 810 is advantageously freed of the problem with the case where discharge electrodes are formed, by using a heat treatment, on the front and rear plates 816, 818, i.e., the problem that the front and rear plates 816, 818 and the electrodes 846, 848 are distorted because of the heat treatment.

In addition, in the present embodiment, on the film formation surface defined by the peeling layer 882 having the higher melting point than the respective sintering temperatures of the thick-film conductive paste 892 and the thick-film dielectric paste 894, the dielectric printed layer 898 and the conductive printed layers 896, 900 are formed in the respective predetermined patterns and, subsequently, are subjected to the heat treatment at the sintering temperature, so as to obtain the sheet member 820 including the dielectric core layer 832 and the conductive thick-film layers that are formed on the opposite surfaces 833, 844 of the core layer 832 and constitute the sustaining wiring layer 836 and the writing wiring layer 840. Although the peeling layer 882 is not sintered at the heat treatment temperature, the resin of the layer 882 is burned out, and accordingly the particle layer 910 consisting of only the high melting point particles 908 is obtained. Since, therefore, the thus produced thick films are not fixed to the substrate 876, those thick films can be easily peeled from the surface 878 of the substrate 876. Thus, the sheet member 820 constituting the sustaining electrodes 846 can be easily produced and can be easily used to produce the PDP 810.

In addition, in the present embodiment, the support member to which the thick-film pastes 892, 894 are applied is constituted by the substrate 876 and the peeling film 882 formed on the surface 878 of the substrate 876. Therefore, even after the heat treatment, the support member can maintain its shape. Thus, the sheet member 820 can be more easily dealt with after being produced, than in the case where the support member would be constituted by the peeling layer 882 only. Since the peeling layer 882 is located between the thick-film printed layers 896 to 902 and the substrate 876, the substrate 876 does not bind those layers 968 to 902 when the layers are subjected to the heat treatment. Therefore, the substrate 876 does not have any limitations with respect to its degree of flatness and/or its degree of surface roughness. For example, in the case where the surface 878 of the substrate 876 is warped, the thick-film printed layers 896 to 902 are also warped following the warped surface 878. Since, however, the sheet member 820 has a sufficiently high degree of flexibility even after being fired, the sheet member 820 can follow, when being placed on a flat surface, that flat surface and become flat.

In addition, in the present embodiment, the thick-film printed layers 896 to 902 are formed by the thick-film printing method. Therefore, the PDP 810 can be produced using the simple equipment and without wasting the materials. Thus, the PDP 810 can be produced at low cost.

In addition, in the present embodiment, the thick-film screen printing method is used to form the thick films and accordingly no so-called wet processes are used. Thus, it is not needed to treat the waste water. The wet processes have the problem that if a solution permeates the films and remains in the same, it may cause the generation of outgas from the vacuum container obtained by adhering the front and rear plates 816, 818 to each other. To avoid this problem, materials having a higher heat resisting temperature are used and, after the container is gas-tightly sealed, air is discharged at a higher temperature or in a longer time period. Those measures, however, lead to increasing the load of the processes.

FIFTEENTH EMBODIMENT

FIG. 48 is a view corresponding to FIG. 54, for explaining a construction of a sheet member 930 which can be employed by another PDP as another embodiment according to the ninth invention. In the present embodiment, in place of the above-described sustaining wiring layer 836, a sustaining wiring layer 932 is provided. Though the sustaining wiring layer 932 has a construction substantially identical with that of the sustaining wiring layer 836, the former wiring layer 932 differs from the latter wiring layer 836, in that a plurality of sustaining electrodes 846 are provided on either side of each of a plurality of wiring portions 850 of the former wiring layer 932. More specifically described, a pair of sustaining electrodes 846 are provided in each of a plurality of grid spaces of the sheet member 930. Dimensions and a shape of each of the sustaining electrodes 846 provided on one side of each wiring portion 850 are substantially identical with those of each of the sustaining electrodes 846 provided on the opposite side of the each wiring portion 850. In addition, in the present embodiment, in place of the above-described writing wiring layer 840, a writing wiring layer 934 is provided. The writing wiring layer 934 has a construction substantially identical with that of the writing wiring layer 834, but the former wiring layer 934 differs from the latter wiring layer 840, only in that a writing electrode 848 is provided in each of the grid spaces of the sheet member 930, such that the writing electrode 848 cooperates with the pair of sustaining electrodes 846 provided in the each grid space.

In the fourteenth embodiment, the writing electrodes 848 project into the respective grid spaces of the dielectric core layer 832. In contrast, in the present embodiment, like the sustaining electrodes 846, the writing electrodes 848 are provided along, more specifically described, fixed to, the respective side surfaces of the grid bars of the dielectric core layer 936. Therefore, in a PDP that is constructed such that light emitted through the sheet member 930 is also observed, an amount of the light interrupted by the writing electrodes 848 can be minimized (or substantially zeroed) and accordingly a degree of brightness can be increased. In addition, even if the variation of respective sizes of the writing electrodes 848 may be increased, the variation of respective distances between the pairs of sustaining electrodes 846 each pair of which includes one scanning sustaining electrode 846 can be minimized. The writing electrodes 848 may be formed by using, when the thick-film conductive paste 892 is applied to form the sustaining electrodes 846, a screen 886 that additionally has slots at respective positions where the writing electrodes 848 are to be located.

A dielectric core layer 936 has a construction substantially identical with that of the dielectric core layer 832. However, respective centerlines of a plurality of grid bars of the dielectric core layer 936 that extend in a lengthwise direction of the wiring portions 850 of the sustaining wiring layer 932 are arranged at a regular interval of, e.g., about 0.3 (mm); and respective centerlines of a plurality of grid bars of the core layer 936 that extend in a lengthwise direction of the wiring portions 852 of the writing wiring layer 934 are arranged at a regular interval of, e.g., about 0. 7 (mm). That is, unlike the grid bars of the sheet member 820, the grid bars of the sheet member 930 are arranged at the respective regular intervals in each of the above-indicated two directions.

Respective dimensions of the other portions of the sheet member 930 may be the same as those of the counterparts of the sheet member 820. For example, the dielectric core layer 936 has a height of about 100 (μm) and a width of about 100 (μm); each of the wiring portions 850, 852 has a width of about 60 (μm); each of the sustaining electrodes 846 has a width of about 150 (μm) and a height of about 100 (μm); and each of the writing electrodes 848 has a width of about 100 (μm) and a height of about 100 (μm).

In the PDP in which the sheet member 930 constructed as described above is employed in place of the sheet member 820, a discharge voltage is sequentially applied to all the wiring portions 850 of the sustaining wiring layer 932, so as to scan the same 850, and the discharge voltage is applied, in synchronism with the timings of the scanning, to desired ones of the wiring portions 852 of the writing wiring layer 934 that correspond to image data, so that respective gas discharges are produced between the desired wiring portions 852 and the corresponding wiring portions 850 and accordingly wall charges are accumulated on the protection film 844. After desired light emission units are thus selected, the wiring portions 850 of the sustaining wiring layer 932 are scanned, by interlacing, during an image-display period, so that the wiring portions 850 being scanned cooperate with the corresponding wiring portions 850 (located on the front or rear side thereof) to produce respective sustaining discharges. Thus, the present invention can be advantageously applied to the PDP in which 2:1 interlacing drive is employed, i.e., respective discharges are produced, in the image-display period consisting of two cycles, in all light emission units (i.e., the grid spaces) corresponding to the image data.

The above-described fourteenth and fifteenth embodiments relate to the case where the present inventions are applied to the full-color AC-type PDP 810 and the method of producing the same 810, respectively. However, the present inventions may be applied to a monochrome AC-type PDP and a method of producing the same, respectively.

The full-color AC-type PDP 810 as the embodiments employs the fluorescent layers 826, 830 that correspond to the three colors, and displays a full-color image. However, the present inventions may be applied to such PDPs that employ fluorescent layers corresponding one color or two colors.

The thickness value of the sheet member 820, 930 and the respective thickness values of the dielectric core layer 832, 936 and the wiring layers 836, 840, 932, 934 that cooperate with each other to constitute the same 820, 930 are selected depending upon respective mechanical strengths needed to deal with the same 820, 930, and the respective thickness values of the wiring layers 836, 840, 932, 934 are selected depending upon respective electrical conductivities needed to function as electrical conductors. Therefore, those thickness values are not limited to the values exemplified in the description of the embodiment, and may be appropriately determined depending upon the size and structure of the gas-discharge display apparatus.

In addition, in the embodiments, the wiring layers 836, 840, 932, 934 of the sheet member 820, 930 are completely covered with the dielectric cover layer 842. However, the wiring layers 836, 840, 932, 934 may be partly exposed so long as the exposure does not influence the discharges of the electrodes or the atmosphere in the gas-tight container.

In addition, in the embodiments, the sheet member 820, 930 includes the dielectric core layer 832, 936 and the wiring layers 836, 840, 932, 934 that are formed by using the thick-film screen printing method. However, a coater or a film laminate may be used to form uniformly thick-film paste layers on the film formation surface, and a photo process may be used to process those layers to have respective predetermined patterns.

In addition, in the embodiments, the support member used to produce the sheet member 820, 930 is constituted by the substrate 876 and the peeling layer 882 formed on the surface 868 of the substrate 876. However, a ceramic green sheet (i.e., an unsintered sheet of ceramic) may be used as the support member. In the latter case, the composition of the green sheet is determined such that at the firing temperature in the firing step 904, the ceramic green sheet cannot be sintered but the resin contained therein can be fully removed by firing.

In addition, in the embodiments, the opposing discharge structure is employed in which the discharges are produced between the sustaining electrodes 846, 846 partly covering the inner wall surfaces of the sheet member 820. However, it is possible to employ the surface discharge structure in which no electrodes cover the inner wall surfaces of the sheet member.

In addition, in the embodiments, the writing electrodes 848 are constituted by the projecting portions of the wiring portions 852 of the writing wiring layer 840, or the portions of the wiring portions 852 of the writing wiring layer 934 that extend along the inner wall surfaces of the dielectric core layer 936. However, it is possible to omit the projecting portions or the like, if each pair of sustaining electrodes 846 including a scanning electrode can write with reliability.

In addition, in the embodiments, the grooves 822 are provided in the stripe pattern. However, a grid-like groove may be used to separate the discharge spaces from each other, so long as there are no problems with the discharging of air and the charging of gas after the sealing. In addition, in the embodiments, the grooves 822 and the grooves 828 are formed in the front plate 816 and the rear plate 818, respectively. However, it is possible to form grooves in only one of the two plates 816, 818. In the latter case, it is desired not to provide fluorescent layers on the plate free of the grooves, for the purse of preventing the sheet member 820 from contacting the fluorescent layers.

In addition, in the embodiments, the front and rear plates 816, 818 are each formed of the transparent glass plate, so that the light emissions can be observed through each of the two plates 816, 818. However, one of the two plates 816, 818 may be formed of a translucent material, so that only the light transmitted through the other plate can be observed.

In addition, in the embodiments, the fluorescent layers 826, 830 are provided on the inner surfaces 812, 814, respectively. However, it is possible to provide fluorescent layers on only one of the two surfaces 812, 814.

In addition, the front and rear plates 816, 818 have the grooves 822, 828 for defining the discharge spaces 824. However, the grooves 822, 828 may be replaced with partition walls that are each formed of, e.g., an insulating thick film and are located at respective positions where the ridge-like portions present between the grooves 822, 828 are located.

In addition, the boundary portions between the discharge spaces 824, more specifically described, the ridge-like portions present between the grooves 822, 828, or the back surface of the front plate 816, or the respective top or base portions of the partition walls, if employed, may be provided with a black stripe (i.e., a black mask) formed using, e.g., a glass paste (i.e., an insulating thick film) containing a black pigment.

In addition, in the embodiments, when the sheet member 820 is produced, the thick-film conductive paste 892 for forming the writing wiring layer 840 is directly printed on the peeling layer 882. However, in the case where the writing electrodes 848 might be curved upward, upon firing, because of the difference of respective thermal capacities of the writing electrodes 848 and the peeling layer 882, it is possible to apply, before the printing of the thick-film conductive paste 892, a dielectric paste in an identical pattern and thereby provide a dielectric thick-film layer on which the writing wiring layer 840 is to be formed. However, this step is not needed when the sheet member 930 is produced, because the writing electrodes 848 of the sheet member 848 are provided on the inner wall surfaces of the dielectric core layer 936.

While the present invention has been described in its embodiments, it is to be understood that the present invention may be embodied with various changes without departing from the spirit of the invention.

The invention claimed is:

1. A gas-discharge display apparatus comprising a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, and a plurality of pairs of first and second discharge electrodes each pair of which cooperate with each other to produce a gas discharge in a corresponding one of the discharge spaces, so that a light produced by the gas discharge is observed through the first substrate, the apparatus being characterized by comprising a sheet member including a dielectric core layer comprising a dielectric thick-film having a grid pattern and a pre-determined thickness, a first conductive thick-film layer comprising a plurality of first conductive thick films which are provided on one of opposite surfaces of the grid pattern of the dielectric core layer and extend parallel to each other in one direction of the grid pattern and which function as the first discharge electrodes, respectively, and a second conductive thick-film layer comprising a plurality of second conductive thick-films which are provided on the other surface of the grid pattern of the dielectric core layer and extend parallel to each other in an other direction of the grid pattern and which function as the second discharge electrodes, respectively, the sheet member being provided between the first and second substrates, such that the sheet member extends parallel to each of the first and second substrates.

2. The gas-discharge display apparatus according to claim 1, wherein the first conductive thick-film layer comprises a plurality of first opposing portions which are fixed to respective side surfaces of grid bars of the dielectric core layer, and wherein the second conductive thick-film layer comprises a plurality of second opposing portions which are fixed to respective side surfaces of grid bars of the dielectric core layer, such that the second opposing portions oppose the first opposing portions, respectively.

3. The gas-discharge display apparatus according to claim 1, wherein the plurality of discharge spaces are separated from each other by a plurality of rib-like walls which extend in one direction and are arranged at a pre-determined interval of distance, so that the discharge spaces have a stripe pattern, and wherein the sheet member includes a plurality of portions which extend in one direction of the grid pattern and are located on respective top ends of the rib-like walls.

4. A method of producing a gas-discharge display apparatus including a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, and a plurality of pairs of first and second discharge electrodes each pair of which cooperate with each other to produce a gas discharge in a corresponding one of the discharge spaces, so that a light produced by the gas discharge is observed through the first substrate, the method comprising superposing the first and second substrates on each other and gas-tightly sealing the superposed first and second substrates, the method being characterized by comprising a sheet-member fixing step of fixing, to an inner surface of one of the first and second substrates, a sheet member including a dielectric core layer comprising a dielectric thick film having a grid pattern and a pre-determined thickness, a first conductive thick-film layer comprising a plurality of first conductive thick films which are provided on one of opposite surfaces of the grid pattern of the dielectric core layer and extend parallel to each other in one direction of the grid pattern and which function as the first discharge electrodes, respectively, and a second conductive thick-film layer comprising a plurality of second conductive thick films which are provided on the other surface of the grid pattern of the dielectric core layer and extend parallel to each other in an other direction of the grid pattern and which function as the second discharge electrodes, respectively.

5. The gas-discharge display apparatus producing method according to claim 4, further comprising a support-member preparing step of preparing a support member having a film formation surface which is defined by a high melting point particle layer in which particles having a melting point higher than a first pre-selected temperature are bound together by a resin, a first conductive paste film forming step of forming, on the film formation surface, and in a pre-determined pattern corresponding to the first conductive thick-film layer, a plurality of first conductive paste films which are separate from each other and in each of which particles as a conductive thick films which are sintered at the first temperature are bound together by a resin, a dielectric paste film forming step of forming, on respective surfaces of the first conductive paste films, and in a grid pattern corresponding to the grid pattern of the dielectric core layer, a dielectric paste film in which particles as a dielectric thick-film material which are sintered at the first temperature are bound together by a resin, a second conductive paste film forming step of forming, on a surface of the dielectric paste film, and in a pre-determined pattern corresponding to the second conductive thick-film layer, a plurality of second conductive paste films which are separate from each other and in each of which particles as a conductive thick-film material which are sintered at the first temperature are bound together by a resin, and a firing step of subjecting the support member to a heat treatment at the first temperature, so that the first conductive paste films, the second conductive paste films, and the dielectric paste film are sintered while the high melting point particle layer is not sintered, whereby the first conductive paste films, the second conductive paste films, and the dielectric paste film are processed into the first conductive thick-film layer, the second conductive thick-film layer, and the dielectric core layer, respectively, and thus the sheet member is produced.

6. The gas-discharge display apparatus producing method according to claim 5, wherein the first conductive thick-film layer comprises a plurality of first opposing portions which are fixed to respective side surfaces of grid bars of the dielectric core layer, wherein the second conductive thick-film layer comprises a plurality of second opposing portions which are fixed to respective side surfaces of grid bars of the dielectric core layer, such that the second opposing portions oppose the first opposing portions, respectively, and wherein the method further comprises a third conductive paste film forming step of forming, on respective side surfaces of grid bars of the dielectric paste film, and in a pattern corresponding to the first and second opposing portions, a plurality of third conductive paste films in each of which particles a conductive thick-film material which are sintered at the first temperature are bound together by a resin.

7. A gas-discharge display apparatus comprising a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, and a plurality of pairs of discharge electrodes each pair of which cooperate with each other to produce a gas discharge in a corresponding one of the discharge spaces, so that a light produced by the gas discharge is observed through the first substrate, the apparatus being characterized by comprising a sheet member including a dielectric core layer comprising a dielectric thick film having a grid pattern and a pre-determined thickness, the dielectric thick film including a plurality of grid bars, a plurality of grid spaces, and a plurality of pairs of recesses which are formed in respective side surfaces of the grid bars, such that each pair of recesses oppose each other in a corresponding one of the grid spaces, a plurality of pairs of electrode-constituting conductive thick films which are provided in the plurality of pairs of recesses, respectively, and which constitute the plurality of pairs of discharge electrodes, respectively, and a plurality of wiring-constituting conductive thick films which are provided on at least one of opposite surfaces of the dielectric core layer and are connected to the electrode-constituting conductive thick films, the sheet member being provided between the first and second substrates, such that the sheet member extends parallel to each of the first and second substrates.

8. The gas-discharge display apparatus according to claim 7, wherein the plurality of wiring-constituting conductive thick films are provided on one of the opposite surfaces of the dielectric core layer, such that the wiring-constituting conductive thick films extend parallel to each other along one side of the grid pattern of the dielectric core layer and are connected to the electrode-constituting conductive thick films.

9. A method of producing a gas-discharge display apparatus including a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, and a plurality of pairs of discharge electrodes each pair of which cooperate with each other to produce a gas discharge in a corresponding one of the discharge spaces, so that a light produced by the gas discharge is observed through the first substrate, the method comprising superposing the first and second substrates on each other and gas-tightly sealing the superposed first and second substrates, the method being characterized by comprising a sheet-member fixing step of fixing a sheet member to an inner surface of one of the first and second substrates, such that the sheet member extends parallel to each of the first and second substrates, the sheet member including a dielectric core layer comprising a dielectric thick film having a grid pattern and a pre-determined thickness, the dielectric thick film including a plurality of grid bars and a plurality of grid spaces; a plurality of pairs of electrode-constituting conductive thick films which are provided on respective side surfaces of the grid bars, such that each pair of electrode-constituting conductive thick films oppose each other in a corresponding one of the grid spaces; and a plurality of wiring-constituting conductive thick films which are provided on at least one of opposite surfaces of the dielectric core layer and are connected to the electrode-constituting conductive thick films, the sheet member being produced by a plurality of steps comprising the following steps a support-member preparing step of preparing a support member having a film formation surface which is defined by a high melting point particle layer in which particles having a melting point higher than a first pre-selected temperature are bound together by a resin, a dielectric paste film forming step of forming, in a grid pattern corresponding to the grid pattern of the dielectric core layer, a dielectric paste film in which particles as a dielectric thick-film material which are sintered at the first temperature are bound together by a resin, a wiring-constituting conductive paste film forming step of forming, in a pattern corresponding to the wiring-constituting conductive thick films, a plurality of wiring-constituting conductive paste films in each of which particles as a conductive thick-film material which are sintered at the first temperature are bound together by a resin, an electrode-constituting conductive paste film forming step of applying, to the dielectric paste film having the grid pattern, an electrode-constituting conductive paste in which a conductive thick-film material which are sintered at the first temperature and a resin are dispersed in a solvent, in an island-like pattern, and allowing the electrode-constituting conductive paste to flow down along respective side surfaces of grid bars of the dielectric paste film, thereby forming, on the respective side surfaces of the grid bars, a plurality of electrode-constituting conductive paste films having respective shapes corresponding to respective shapes of the electrode-constituting conductive thick films, such that the electrode-constituting conductive paste films are connected to the wiring-constituting conductive paste films, and a firing step of subjecting the support member to a heat treatment at the first temperature, so that the dielectric paste film, the wiring-constituting conductive paste films, and the electrodes-providing conductive paste films are sintered while the high melting point particle layer is not sintered, whereby the dielectric paste film, the wiring-constituting conductive paste films, and the electrode-constituting conductive paste films are processed into the dielectric core layer, the wiring-constituting conductive thick films, and the electrode-constituting conductive thick films, respectively, and thus the sheet member is produced.

10. The gas-discharge display apparatus producing method according to claim 9, wherein the plurality of wiring-constituting conductive thick films are provided on one of the opposite surfaces of the dielectric core layer, such that the wiring-constituting conductive thick films extend parallel to each other along one side of the grid pattern of the dielectric core layer and are connected to the electrode-constituting conductive thick films, and wherein the wiring-constituting conductive paste film forming step comprises forming the wiring-constituting conductive paste films in a stripe pattern corresponding to the wiring-constituting conductive thick films.

11. The gas-discharge display apparatus producing method according to claim 9, wherein the electrode-constituting conductive paste has a higher degree of fluidity than a degree of fluidity of a conductive paste which is used to form the wiring-constituting conductive paste films.

12. The gas-discharge display apparatus producing method according to claim 9, further comprising a flow stopper forming step of forming, before the electrode-constituting conductive paste film forming step, a plurality of flow stoppers on the film formation surface, so that each of the flow stoppers prevents the electrode-constituting conductive paste flowing down along a corresponding one of the respective side surfaces of the grid bars of the dielectric paste film, from spreading, on the film formation surface, toward the side surface opposing said one side surface.

13. The gas-discharge display apparatus producing method according to claim 12, wherein each of the flow stoppers is formed of the high melting point particles that are bound together by the resin.

14. The gas-discharge display apparatus producing method according to claim 12, wherein each of the flow stoppers is formed, integrally with the dielectric paste film, of the particles of the dielectric thick-film material that are bound together by the resin.

15. The gas-discharge display apparatus producing method according to claim 14, wherein the wiring-constituting conductive paste film forming step comprises forming, before the dielectric paste film forming step, the wiring-constituting conductive paste films including respective projecting portions which are to project, at respective positions where the electrode-constituting conductive paste films are to be formed, from the dielectric paste film to be formed, wherein each of the flow stoppers is so formed as to have a shape which assures that said each flow stopper covers an end portion of a corresponding one of the projecting portions of the wiring-constituting conductive paste films and allows a portion of said one projecting portion to be exposed.

16. The gas-discharge display apparatus producing method according to claim 9, wherein the dielectric paste film forming step comprises forming the dielectric paste film which has, in the respective side surfaces of the grid bars thereof where the electrode-constituting conductive paste films are to be formed, a plurality of recesses each of which has a pre-determined depth as measured from an upper surface of the grid pattern of the dielectric paste film.

17. The gas-discharge display apparatus producing method according to claim 16, wherein each of the recesses extends from the upper surface of the grid pattern of the dielectric paste film to a lower surface of the grid pattern.

18. An AC-type gas-discharge display apparatus comprising a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, a plurality of pairs of sustaining electrodes which are covered with a dielectric element and each pair of which cooperate with each other to produce a gas discharge in a corresponding one of the discharge spaces, so that a light produced by the gas discharge is observed through the first substrate, and a plurality of writing electrodes which cooperate with the sustaining electrodes to produce respective gas discharges and thereby select respective light emission units and which are provided on the second substrate such that the writing electrodes extend parallel to each other in one direction, the apparatus being characterized by comprising a sheet member including a dielectric core layer comprising a dielectric thick-film having a grid pattern and a pre-determined thickness, a conductive thick-film layer comprising a plurality of conductive thick films which are provided on at least one of opposite surfaces of the dielectric core layer, such that the conductive thick films extend parallel to each other in an other direction perpendicular to said one direction, and which include respective portions that are located between respective intersection points of the grid pattern of the dielectric core layer and function as the sustaining electrodes, and a dielectric cover layer comprising a dielectric thick film which covers the conductive thick-film layer, the sheet member being provided between the first and second substrates, such that the sheet member extends parallel to each of the first and second substrates.

19. The gas-discharge display apparatus according to claim 18, wherein each pair of conductive thick films of the conductive thick-film layer that are adjacent each other include, as the respective portions thereof located between the respective intersection points of the grid pattern of the dielectric core layer, a plurality of pairs of opposing portions which are fixed to respective side surfaces of grid bars of the dielectric core layer, such that each pair of opposing portions oppose each other.

20. A method of producing an AC-type gas-discharge display apparatus including a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, a plurality of pairs of sustaining electrodes which are covered with a dielectric element and each pair of which cooperate with each other to produce a gas discharge in a corresponding one of the discharge spaces, so that a light produced by the gas discharge is observed through the first substrate, and a plurality of writing electrodes which cooperate with the sustaining electrodes to produce respective gas discharges and thereby select respective light emission units and which are provided on the second substrate such that the writing electrodes extend parallel to each other in one direction, the method comprising superposing the first and second substrates on each other and gas-tightly sealing the superposed first and second substrates, the method being characterized by comprising a sheet-member fixing step of fixing a sheet member to an inner surface of one of the first and second substrates, the sheet member including a dielectric core layer comprising a dielectric thick film having a grid pattern and a pre-determined thickness, a conductive thick-film layer comprising a plurality of conductive thick films which are provided on at least one of opposite surfaces of the dielectric core layer, such that the conductive thick films extend parallel to each other in an other direction perpendicular to said one direction, and which includes respective portions that are located between respective intersection points of the grid pattern of the dielectric core layer and function as the sustaining electrodes, and a dielectric cover layer comprising a dielectric thick film which covers the conductive thick-film layer.

21. The gas-discharge display apparatus producing method according to claim 20, further comprising a support-member preparing step of preparing a support member having a film formation surface which is defined by a high melting point particle layer in which particles having a melting point higher than a first pre-selected temperature are bound together by a resin, a dielectric paste film forming step of forming, in a grid pattern corresponding to the grid pattern of the dielectric core layer, a dielectric paste film in which particles as a dielectric thick-film material which are sintered at the first temperature are bound together by a resin, a conductive paste film forming step of forming, in a pre-determined pattern corresponding to the conductive thick-film layer, a plurality of conductive paste films which are separate from each other and in each of which particles as a conductive thick-film material which are sintered at the first temperature are bound together by a resin, and a firing step of subjecting the support member to a heat treatment at the first temperature, so that the conductive paste films and the dielectric paste film are sintered while the high melting point particle layer is not sintered, whereby the conductive paste films and the dielectric paste film are processed into the conductive thick-film layer and the dielectric core layer, respectively.

22. An AC-type gas-discharge display apparatus comprising a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, a plurality of pairs of sustaining electrodes which are covered with a dielectric element and each pair of which cooperate with each other to produce a gas discharge in a corresponding one of the discharge spaces, so that a light produced by the gas discharge is observed through the first substrate, and a plurality of writing electrodes which cooperate with the sustaining electrodes to produce respective gas discharges and thereby select respective light emission units and which are provided on the second substrate such that the writing electrodes extend parallel to each other in one direction, the apparatus being characterized by comprising a sheet member including a dielectric core layer comprising a dielectric thick film having a grid pattern and a pre-determined thickness, a conductive thick-film layer comprising a plurality of conductive thick films which are provided on at least one of opposite surfaces of the dielectric core layer, such that the conductive thick films extend parallel to each other in an other direction perpendicular to said one direction, and which include respective portions that are located between respective intersection points of the grid pattern of the dielectric core layer and that comprise a plurality of pairs of portions each pair of which are adjacent each other and cooperate with each other to produce a discharge, the pairs of portions functioning as the pairs of sustaining electrodes, such that, in each of the light emission units, at least two pairs of the sustaining electrodes produce respective discharges at respective locations different from each other in said one direction, and a dielectric cover layer comprising a dielectric thick film which covers the conductive thick-film layer, the sheet member being provided between the first and second substrates, such that the sheet member extends parallel to each of the first and second substrates.

23. The gas-discharge display apparatus according to claim 22, wherein each pair of conductive thick films of the conductive thick-film layer that are adjacent each other include, as the respective portions thereof located between the respective intersection points of the grid pattern of the dielectric core layer, a plurality of pairs of opposing portions which are fixed to respective side surfaces of grid bars of the dielectric core layer, such that each pair of opposing portions oppose each other.

24. The gas-discharge display apparatus according to claim 18, wherein the conductive thick films comprise a first group of thick films which are provided on one of the opposite surfaces of the dielectric core layer, and a second group of thick films which are provided on the other surface of the dielectric core layer, such that the thick films of the first group and the thick films of the second group are arranged alternately with each other in said one direction.

25. The gas-discharge display apparatus according to claim 22, wherein, in said each light emission unit, the conductive thick films of said at least two pairs comprise two inner conductive thick films and two outer conductive thick films which are located outside, and adjacent, the two inner conductive thick films, respectively, and cooperate with the two inner conductive thick films to produce the respective discharges.

26. A method of producing an AC-type gas-discharge display apparatus including a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, a plurality of pairs of sustaining electrodes which are covered with a dielectric element and each pair of which cooperate with each other to produce a gas discharge in a corresponding one of the discharge spaces, so that a light produced by the gas discharge is observed through the first substrate, and a plurality of writing electrodes which cooperate with the sustaining electrodes to produce respective gas discharges and thereby select respective light emission units and which are provided on the second substrate such that the writing electrodes extend parallel to each other in one direction, the method comprising superposing the first and second substrates on each other and gas-tightly sealing the superposed first and second substrates, the method being characterized by comprising a sheet-member fixing step of fixing a sheet member to an inner surface of one of the first and second substrates, the sheet member including a dielectric core layer comprising a dielectric thick film having a grid pattern and a pre-determined thickness, a conductive thick-film layer comprising a plurality of conductive thick films which are provided on at least one of opposite surfaces of the dielectric core layer, such that the conductive thick films extend parallel to each other in an other direction perpendicular to said one direction, and which include respective portions that are located between respective intersection points of the grid pattern of the dielectric core layer and that comprise a plurality of pairs of portions each pair of which are adjacent each other and cooperate with each other to produce a discharge, the pairs of portions functioning as the pairs of sustaining electrodes, such that, in each of the light emission units, at least two pairs of the sustaining electrodes produce respective discharges at respective locations different from each other in said one direction, and a dielectric cover layer comprising a dielectric thick film which covers the conductive thick-film layer.

27. The gas-discharge display apparatus producing method according to claim 26, further comprising a support-member preparing step of preparing a support member having a film formation surface which is defined by a high melting point particle layer in which particles having a melting point higher than a first pre-selected temperature are bound together by a resin, a dielectric paste film forming step of forming, in a grid pattern corresponding to the grid pattern of the dielectric core layer, a dielectric paste film in which particles as a dielectric thick-film material which are sintered at the first temperature are bound together by a resin, a conductive paste film forming step of forming, in a pre-determined pattern corresponding to the conductive thick-film layer, a plurality of conductive paste films which are separate from each other and in each of which particles as a conductive thick-film material which are sintered at the first temperature are bound together by a resin, and a firing step of subjecting the support member to a heat treatment at the first temperature, so that the conductive paste films and the dielectric paste film are sintered while the high melting point particle layer is not sintered, whereby the conductive paste films and the dielectric paste film are processed into the conductive thick-film layer and the dielectric core layer, respectively.

28. The gas-discharge display apparatus producing method according to claim 21, wherein each pair of conductive thick films of the conductive thick-film layer that are adjacent each other include, as the respective portions thereof located between the respective intersection points of the grid pattern of the dielectric core layer, a plurality of pairs of opposing portions which are fixed to respective side surfaces of grid bars of the dielectric core layer, such that each pair of opposing portions oppose each other, and wherein the method further comprises a wall-surface conductive paste film forming step of forming, on respective side surfaces of grid bars of the dielectric paste film, and in a pattern corresponding to the opposing portions, a plurality of wall-surface conductive paste films in each of which particles as a conductive thick-film material which are sintered at the first temperature are bound together by a resin.

29. An AC-type gas-discharge display apparatus comprising a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, a plurality of pairs of sustaining electrodes which are covered with a dielectric element and each pair of which cooperate with each other to produce a gas discharge in a corresponding one of the discharge spaces, so that a light produced by the gas discharge is observed through the first substrate, and a plurality of writing electrodes which cooperate with the sustaining electrodes to produce respective gas discharges and thereby select respective light emission units, the apparatus being characterized by comprising a sheet member including a dielectric core layer comprising a dielectric thick film having a grid pattern and a pre-determined thickness, a first conductive thick-film layer comprising a plurality of first conductive thick films which are provided on one of opposite surfaces of the grid pattern of the dielectric core layer and extend parallel to each other in one direction of the grid pattern, and which include respective portions that are located between respective intersection points of the grid pattern and that function as the pairs of sustaining electrodes, a second conductive thick-film layer comprising a plurality of second conductive thick films which are provided on the other surface of the grid pattern of the dielectric core layer and extend parallel to each other in an other direction perpendicular to said one direction, and which include respective portions that are located between the respective intersection points of the grid pattern of the dielectric core layer and that function as the writing electrodes, and a dielectric cover layer comprising a dielectric thick film which covers the first conductive thick-film layer, the sheet member being provided between the first and second substrates, such that the sheet member extends parallel to each of the first and second substrates.

30. The gas-discharge display apparatus according to claim 29, wherein each pair of first conductive thick films of the first conductive thick-film layer that are adjacent each other include, as the respective portions thereof located between the respective intersection points of the grid pattern of the dielectric core layer, a plurality of pairs of opposing portions which are fixed to respective side surfaces of grid bars of the dielectric core layer, such that each pair of opposing portions oppose each other.

31. The gas-discharge display apparatus according to claim 30, wherein each of the first conductive thick films includes the opposing portions located on each of opposite sides of said each conductive thick film in a widthwise direction thereof.

32. The gas-discharge display apparatus according to claim 30, wherein the second conductive thick-film layer includes a plurality of projecting portions which project toward a plurality of grid spaces, respectively, of the dielectric core layer in which the pairs of opposing portions are provided, respectively.

33. The gas-discharge display apparatus according to claim 18, wherein at least one of respective opposing surfaces of the first and second substrates that oppose each other has a plurality of grooves which extend in said one direction of the grid pattern of the dielectric core layer.

34. A method of producing an AC-type gas-discharge display apparatus including a transparent first substrate, a second substrate which is distant from the first substrate by a pre-determined distance and extends parallel to the first substrate, a plurality of discharge spaces which are provided in a gas-tight space which is located between the first and second substrates and is filled with a pre-selected gas, a plurality of pairs of sustaining electrodes which are covered with a dielectric element and each pair of which cooperate with each other to produce a gas discharge in a corresponding one of the discharge spaces, so that a light produced by the gas discharge is observed through the first substrate, and a plurality of writing electrodes which cooperate with the sustaining electrodes to produce respective gas discharges and thereby select respective light emission units, the method comprising superposing the first and second substrates on each other and gas-tightly sealing the superposed first and second substrates, the method being characterized by comprising a sheet-member fixing step of fixing a sheet member to an inner surface of one of the first and second substrates, the sheet member including a dielectric core layer comprising a dielectric thick film having a grid pattern and a pre-determined thickness, a first conductive thick-film layer comprising a plurality of first conductive thick films which are provided on one of opposite surfaces of the grid pattern of the dielectric core layer and extend parallel to each other in one direction of the grid pattern, and which include respective portions that are located between respective intersection points of the grid pattern of the dielectric core layer and that function as the pairs of sustaining electrodes, a second conductive thick-film layer comprising a plurality of second conductive thick films which are provided on the other surface of the grid pattern of the dielectric core layer and extend parallel to each other in an other direction perpendicular to said one direction, and which include respective portions that are located between the respective intersection points of the grid pattern of the dielectric core layer and that function as the writing electrodes, and a dielectric cover layer comprising a dielectric thick film which covers the first conductive thick-film layer.

35. The gas-discharge display apparatus producing method according to claim 34, further comprising a support-member preparing step of preparing a support member having a film formation surface which is defined by a high melting point particle layer in which particles having a melting point higher than a first pre-selected temperature are bound together by a resin, a lower conductive paste film forming step of forming, on the film formation surface, and in a pre-determined pattern corresponding to one of the first and second conductive thick-film layers, a plurality of lower conductive paste films which are separate from each other and in each of which particles as a conductive thick-film material which are sintered at the first temperature are bound together by a resin, and a dielectric paste film forming step of forming, on respective surfaces of the lower conductive paste films, and in a grid pattern corresponding to the grid pattern of the dielectric core layer, a dielectric paste film in which particles as a dielectric thick-film material which are sintered at the first temperature are bound together by a resin, an upper conductive paste film forming step of forming, on a surface of the dielectric paste film, and in a pre-determined pattern corresponding to the other of the first and second conductive thick-film layers, a plurality of upper conductive paste films which are separate from each other and in each of which particles as a conductive thick-film material which are sintered at the first temperature are bound together by a resin, and a firing step of subjecting the support member to a heat treatment at the first temperature, so that the lower conductive paste films, the upper conductive paste films, and the dielectric paste film are sintered while the high melting point particle layer is not sintered, whereby the lower conductive paste films, the upper conductive paste films, and the dielectric paste film are processed into the first conductive thick-film layer, the second conductive thick-film layer, and the dielectric core layer.

36. The gas-discharge display apparatus producing method according to claim 35, wherein each pair of first conductive thick films of the first conductive thick-film layer that are adjacent each other include, as the respective portions thereof located between the respective intersection points of the grid pattern of the dielectric core layer, a plurality of pairs of opposing portions which are fixed to respective side surfaces of grid bars of the dielectric core layer, such that each pair of opposing portions oppose each other, and wherein the method further comprises a wall-surface conductive paste film forming step of forming, on the side surfaces of the grid bars of the dielectric paste film, and in a pattern corresponding to the opposing portions, a plurality of wall-surface conductive paste films in each of which particles as a conductive thick-film material which are sintered at the first temperature are bound together by a resin.

37. The gas-discharge display apparatus producing method according to claim 21, wherein the support-member preparing step comprises forming the high melting point particle layer on a surface of a pre-selected substrate.

38. The gas-discharge display apparatus producing method according to claim 37, wherein the substrate is not deformed at the firing temperature.

39. The gas-discharge display apparatus producing method according to claim 20, further comprising a covering step of applying a dielectric thick-film paste in which particles as a dielectric thick-film material which are sintered at a pre-selected temperature are bound together by a resin, to an outer surface of the dielectric core layer, subjecting, to a heat treatment, the dielectric core layer and the dielectric thick-film paste applied thereto, and thereby providing the dielectric cover layer which covers the outer surface of the dielectric core layer.

40. The gas-discharge display apparatus producing method according to claim 21, wherein each of the paste films is formed by a thick-film screen printing method.

* * * * *